US009726190B2

(12) United States Patent
Kumon et al.

(10) Patent No.: US 9,726,190 B2
(45) Date of Patent: Aug. 8, 2017

(54) PROPELLER FAN, FLUID FEEDER, ELECTRIC FAN, AND MOLDING DIE

(71) Applicant: Sharp Kabushiki Kaisha, Osaka-shi, Osaka (JP)

(72) Inventors: Yui Kumon, Osaka (JP); Masaki Ohtsuka, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 352 days.

(21) Appl. No.: 14/391,412

(22) PCT Filed: Apr. 9, 2013

(86) PCT No.: PCT/JP2013/060708
§ 371 (c)(1),
(2) Date: Oct. 9, 2014

(87) PCT Pub. No.: WO2013/154100
PCT Pub. Date: Oct. 17, 2013

(65) Prior Publication Data

US 2015/0125307 A1 May 7, 2015

(30) Foreign Application Priority Data

Apr. 10, 2012 (JP) ..... 2012-089281
Apr. 10, 2012 (JP) ..... 2012-089283
(Continued)

(51) Int. Cl.
*F04D 19/00* (2006.01)
*F04D 29/32* (2006.01)
(Continued)

(52) U.S. Cl.
CPC ..... *F04D 29/325* (2013.01); *F04D 19/002* (2013.01); *F04D 25/08* (2013.01); *F04D 29/384* (2013.01); *F05D 2240/307* (2013.01)

(58) Field of Classification Search
CPC ..... F04D 29/325; F04D 19/002; F04D 25/08; F04D 29/384; F05D 2240/307
(Continued)

(56) References Cited

U.S. PATENT DOCUMENTS 2,269,287 A * 1/1942 Roberts ..... F04D 29/384 416/238
5,513,951 A 5/1996 Komoda et al.
(Continued)

FOREIGN PATENT DOCUMENTS

CN 1388869 A 1/2003
CN 104145118 B 8/2016
(Continued)

OTHER PUBLICATIONS

Official Communication issued in International Patent Application No. PCT/JP2013/060708, mailed on Jul. 23, 2013.
(Continued)

*Primary Examiner* — Ninh H Nguyen
*Assistant Examiner* — Aaron R Eastman
(74) *Attorney, Agent, or Firm* — Keating & Bennett, LLP

(57) ABSTRACT

A propeller fan includes a boss hub portion and a blade including a front edge portion, a rear edge portion, and an outer edge portion. The outer edge portion has a front outer edge portion, a rear outer edge portion, and a connection portion connecting the front outer edge portion and the rear outer edge portion to each other. In a plan view of the blade along a central axis, a maximum radius $R1_{max}$ of the outer edge portion in a portion corresponding to the front outer edge portion and a maximum radius $R2_{max}$ of the outer edge portion in a portion corresponding to the rear outer edge portion satisfy a condition of $R1_{max}>R2_{max}$. With such a construction, a propeller fan which generates wind less in
(Continued)

pressure fluctuation and is capable of sending comfortable wind and achieving lowering in noise is provided.

19 Claims, 119 Drawing Sheets

(30) Foreign Application Priority Data

Apr. 10, 2012 (JP) ..... 2012-089284
Apr. 10, 2012 (JP) ..... 2012-089286

(51) Int. Cl.
*F04D 29/38* (2006.01)
*F04D 25/08* (2006.01)

(58) Field of Classification Search
USPC ..... 416/223 R
See application file for complete search history.

(56) References Cited

U.S. PATENT DOCUMENTS

| | | | | |
|---|---|---|---|---|
| 6,254,342 | B1 | 7/2001 | Fujinaka et al. | |
| 6,341,940 | B1 * | 1/2002 | Giribaldi | F04D 29/384 416/169 A |
| 2003/0103846 | A1 * | 6/2003 | Ohsuka | F04D 29/384 416/223 R |
| 2006/0042894 | A1 | 3/2006 | Lee et al. | |
| 2007/0243064 | A1 | 10/2007 | Nakano et al. | |
| 2008/0019826 | A1 * | 1/2008 | Arinaga | F04D 29/384 415/206 |
| 2008/0050240 | A1 * | 2/2008 | Tanigawa | F04D 29/329 416/223 R |
| 2008/0069700 | A1 * | 3/2008 | Laisathit | F04D 25/088 416/242 |
| 2009/0010763 | A1 * | 1/2009 | Watts | F04D 29/181 416/223 R |
| 2011/0223029 | A1 | 9/2011 | Allen et al. | |
| 2012/0107127 | A1 * | 5/2012 | Chang | F04D 29/668 416/223 R |
| 2012/0171042 | A1 | 7/2012 | Takeda | |
| 2015/0071786 | A1 | 3/2015 | Kumon et al. | |

FOREIGN PATENT DOCUMENTS

| | | | |
|---|---|---|---|
| JP | 61-104194 | A | 5/1986 |
| JP | 1-247797 | A | 10/1989 |
| JP | 04-171299 | A | 6/1992 |
| JP | 5-202893 | A | 8/1993 |
| JP | 05-296195 | A | 11/1993 |
| JP | 06-307397 | A | 11/1994 |
| JP | 6-336999 | A | 12/1994 |
| JP | 08-121391 | A | 5/1996 |
| JP | 11-201084 | A | 7/1999 |
| JP | 2000-054992 | A | 2/2000 |
| JP | 2001-082389 | A | 3/2001 |
| JP | 2002-54597 | A | 2/2002 |
| JP | 2003-206894 | A | 7/2003 |
| JP | 2004-293528 | A | 10/2004 |
| JP | 2006-037800 | A | 2/2006 |
| JP | 2006-063978 | A | 3/2006 |
| JP | 2008-157117 | A | 7/2008 |
| JP | 2010-255560 | A | 11/2010 |
| JP | 2011-058449 | A | 3/2011 |
| JP | 2012-057587 | A | 3/2012 |

OTHER PUBLICATIONS

Kumon et al., "Propeller Fan, Fluid Feeder, and Molding Die," U.S. Appl. No. 14/391,414, filed Oct. 9, 2014.

* cited by examiner

E-E

F-F

G-G

H-H

PROPELLER FAN, FLUID FEEDER, ELECTRIC FAN, AND MOLDING DIE

TECHNICAL FIELD

This invention generally relates to a propeller fan, a fluid feeder, an electric fan, and a molding die, and more particularly to a propeller fan for sending a fluid, a fluid feeder such as an electric fan, a circulator, an air-conditioner, an air cleaner, a humidifier, a dehumidifier, a fan heater, a cooling apparatus, or a ventilator including such a propeller fan, and a molding die used for molding such a propeller fan with a resin.

BACKGROUND ART

As a conventional propeller fan, a propeller fan provided with a plurality of small notches in an outer edge portion of a blade as disclosed, for example, in Japanese Patent Laying-Open No. 2008-157117 (PTD 1) and a propeller fan provided with a notch in a rear edge portion of a blade as disclosed, for example, in Japanese Patent Laying-Open No. 2003-206894 (PTD 2) have been known.

These propeller fans were designed with focus being mainly placed on lowering in noise or improvement in blowing efficiency by suppressing a vortex which is generated in an outer edge portion or a rear edge portion of a blade and flows from a side of a positive pressure surface toward a negative pressure surface (generally referred to as a horseshoe vortex).

As a conventional propeller fan, Japanese Patent Laying-Open No. 2003-206894 (PTD 2) discloses a propeller fan aiming to suppress fluctuation and development of a vortex generated from a blade tip end portion and a blade end portion of the propeller fan, prevent separation over a blade surface, and increase a quantity of wind. The propeller fan disclosed in PTD 2 is constituted of a cylindrical boss and a plurality of blades. A recess is formed at a prescribed position at a rear end of a blade.

Japanese Patent Laying-Open No. 2011-58449 (PTD 3) discloses a propeller fan aiming to greatly contribute to energy saving and design for resource saving. The propeller fan disclosed in PTD 3 has two or three blades and a coupling portion connecting the blades to each other. A consecutive disposition portion has a surface like a blade surface, and exhibits a function to send wind in a forward direction around a center of rotation of the blade.

Japanese Patent Laying-Open No. 2004-293528 (PTD 4) discloses a propeller fan aiming to improve aerodynamic performance and lower noise and power consumption. When a vane is cut along a prescribed plane in a direction of an axis of rotation thereof in the propeller fan disclosed in PTD 4, a smooth convex curve which is convex toward upstream is obtained.

Japanese Patent Laying-Open No. 2000-54992 (PTD 5) discloses a propeller fan aiming to lessen separation of a flow of an air current and to achieve both of improvement in blowing performance and lowering in noise during blowing. In the propeller fan disclosed in PTD 5, a plurality of blades are disposed around a boss portion. Each blade is formed such that its cross-sectional shape is in a streamline shape in both of a circumferential direction and a direction of radius.

CITATION LIST

Patent Document

PTD 1: Japanese Patent Laying-Open No. 2008-157117
PTD 2: Japanese Patent Laying-Open No. 2003-206894

PTD 3: Japanese Patent Laying-Open No. 2011-58449
PTD 4: Japanese Patent Laying-Open No. 2004-293528
PTD 5: Japanese Patent Laying-Open No. 2000-54992

SUMMARY OF INVENTION

Technical Problem

The propeller fans as disclosed in PTDs 1 and 2 above do not aim to generate comfortably impinging wind (which can also be reworded as soft wind, natural wind, refreshing wind, pleasing wind, smooth wind, gentle wind, delicate wind, or comfortable wind, although expressions vary from person to person). Therefore, when the propeller fan is applied, for example, to an electric fan, a user may feel uncomfortable about sent wind.

A main factor is that the number of blades generally provided in a propeller fan is relatively small, and hence air passes through a relatively large space between blades and consequently pressure fluctuation in wind sent from the propeller fan is great. Therefore, in order to have the propeller fan generate comfortably impinging wind, the number of blades of the propeller fan should be increased in order to lessen pressure fluctuation in sent wind. When the number of blades is increased, however, efficiency in blowing by the propeller fan is disadvantageously lower.

With higher consciousness about power saving in recent years, in many cases, an electric fan has been used as a circulator (an apparatus for enhancing an air-conditioning function of an air-conditioning apparatus represented by an air-conditioner, by generating a great flow of wind which is convected in an indoor space). With a conventional propeller fan mounted on an electric fan, however, wind converges during rotation at a low speed (that is, straightness of wind is high) and wind diffuses during rotation at a high speed (that is, straightness of wind is low), and the propeller fan may not be suitable for use as a circulator. Furthermore, the conventional propeller fan mounted on an electric fan is also disadvantageous in that noise is particularly noticeable during rotation at a high speed.

In addition, in a case that an electric fan is desirably operated without wind substantially being felt during bedtime at night as well, the conventional propeller fan mounted on an electric fan generates considerable noise even during rotation at a low speed, sent wind strongly impinges, and use throughout the night may be discouraged.

Therefore, the present invention was made to solve the above-described problems, and an object of this invention is to provide a propeller fan which generates wind less in pressure fluctuation and is capable of sending comfortably impinging wind and achieving lowering in noise, and a fluid feeder including the same, as well as a molding die for a propeller fan.

Then, as disclosed in PTDs 2 to 5 described above, various propeller fans mainly aiming to improve capability to send wind have been known. In such propeller fans, depending on difference in a peripheral velocity of blades, capability to send wind is higher on an outer circumferential side of a fan and lower on an inner circumferential side thereof. Therefore, on the outer circumferential side of the fan, wind is sent with a height of a blade being increased or a cord length of a blade being increased. In a boss hub portion arranged at a center of rotation of the fan or a portion around the same, a height tends to be decreased or eliminated in a central portion for reducing costs for materials or lowering weight.

With start of a power saving boom, an electric fan or a circulator has again gained popularity in recent years. These electric appliances have been demanded to have high agitation capability and to send comfortable (uniform) wind in agitating air in a room or in cooling by direct impingement of wind to human skin. With the propeller fans in the conventional examples, comfortable impingement of wind, that is, uniformity of a wind velocity or temperature distribution (soft wind, natural wind, refreshing wind, pleasing wind, smooth wind), has not been studied in detail. Because of an extreme peak of a wind velocity on an outer circumferential side of the fan or diffusion of a flow of air sent from the fan outward in a direction of radius, wind sent from the fan may be felt uncomfortable in many cases in a method of use, in particular, as an electric fan or a circulator, which aims at cooling by direct impingement of wind on human or at agitation of air in a room.

Essentially, around a center of rotation of a fan, a member called a spinner is attached for fixation of the fan or a motor shaft is passed therethrough. Therefore, there may be substantially no contribution to blowing or a back flow may occur. Then, in order to prevent a back flow, an approach to provide a large boss hub portion in a center of rotation of the fan is adopted. With such an approach, however, a problem that a portion around the center of rotation of the fan does not contribute to blowing cannot be solved.

On the outer circumferential side of the fan, a wind velocity increases based on relation of $V \propto A$ ($\pi r^2$), and the wind velocity is highest and has an extreme peak in a portion around an outer edge portion of a blade. With the peak of this wind velocity and no contribution to blowing by the portion around the center of rotation of the fan described above as combined, a difference in wind velocity is great between the inner and outer circumferential sides of the fan. Such variation in wind velocity is the cause of uncomfortableness of wind sent from the fan.

Furthermore, in the propeller fan in the conventional examples, during a process of various studies about resource saving of the fan itself, a height of a blade surface is lower around the central portion than on the outer circumferential side of the fan. With such a structure, however, efficiency in blowing with respect to a volume of a region which can be occupied by the fan is very low. Therefore, when capability to send wind is insufficient, the fan is increased in size, which leads to various problems such as increase in size of a blower as a whole or higher cost due to costs for materials for a useless space. When a volume of a region which can be occupied by a fan is predetermined, how efficient wind is sent within that range is important.

Another object of this invention is to solve the problems above, and to provide a propeller fan capable of enhancing efficiency in sending a fluid with respect to a volume of a region which can be occupied by a fan and achieving less uncomfortableness of a fluid sent from the fan, a fluid feeder including the propeller fan, and a molding die used for manufacturing of the propeller fan.

Yet another object of this invention is to solve the problems above, and to provide a propeller fan achieving less uncomfortableness of a fluid sent from a fan, a fluid feeder including the propeller fan, and a molding die used for manufacturing of the propeller fan.

In the conventional examples, for improvement in capability to send wind, a blade has generally been constructed such that a passage region through which a propeller fan passes when the propeller fan is rotated is substantially the same in shape as a space substantially in a shape of a column or a truncated cone encompassing the propeller fan. With such a construction, however, a volume occupied by the propeller fan has disadvantageously been large.

When a volume occupied by the propeller fan is large, a physical size of various fluid feeders including the propeller fan is also naturally large, which has interfered reduction in size. For example, in a fluid feeder represented by an electric fan, a lattice-shaped or web-shaped guard is provided to surround the propeller fan, however, it may become a cause for jamming of a finger if a distance between the guard and the propeller fan is not sufficiently ensured.

Therefore, the present invention was made to solve the above-described problems, and yet another object of this invention is to provide a propeller fan capable of achieving reduction in size and contributing to improvement in safety and a fluid feeder including the same, an electric fan, as well as a molding die for the propeller fan.

Solution to Problem

A propeller fan according to one aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, and an outer edge portion extending along the direction of rotation, and the outer edge portion has a front outer edge portion located on a side of the front edge portion, a rear outer edge portion located on a side of the rear edge portion, and a connection portion connecting the front outer edge portion and the rear outer edge portion to each other. In a plan view of the blade along the central axis, a maximum radius $R1_{max}$ from the center of rotation of the front outer edge portion and a maximum radius $R2_{max}$ from the center of rotation of the rear outer edge portion satisfy a condition of $R1_{max}>R2_{max}$.

The connection portion is a site where the front outer edge portion and the rear outer edge portion different in maximum radius are connected to each other, and it desirably smoothly connects the front outer edge portion and the rear outer edge portion to each other. Alternatively, desirably, the connection portion connects the front outer edge portion and the rear outer edge portion to each other substantially at an acute angle, for example, in a state having a cut. Alternatively, desirably, the connection portion connects the front outer edge portion and the rear outer edge portion to each other substantially at an obtuse angle, for example, in a state having a height difference. Alternatively, desirably, the connection portion is in a shape recessed toward the central axis.

In the propeller fan thus constructed, preferably, the outer edge portion has a front end where the front outer edge portion is connected to an outer end of the front edge portion and a rear end where the rear outer edge portion is connected to an outer end of the rear edge portion, and in the plan view of the blade along the central axis, a distance W between the front end and the rear end along a direction orthogonal to a bisector of an angle formed by a line segment connecting the front end and the center of rotation to each other and a line segment connecting the rear end and the center of rotation to each other and a distance w between a point located on a radially innermost side of the connection portion and the rear end along the direction orthogonal to the bisector satisfy a condition of $0<w/W\leq 0.7$.

In the propeller fan above, preferably, in the plan view of the blade along the central axis, maximum radius $R1_{max}$, a radius R from the center of rotation, of a point located on a radially innermost side of the connection portion, and a radius r of the rotation shaft portion satisfy a condition of $0<(R1_{max}-R)/(R1_{max}-r)\leq 0.6$.

In the propeller fan above, preferably, the outer edge portion has a front end where the front outer edge portion is connected to an outer end of the front edge portion and a rear end where the rear outer edge portion is connected to an outer end of the rear edge portion, and in the plan view of the blade along the central axis, a distance W between the front end and the rear end along a direction orthogonal to a bisector of an angle formed by a line segment connecting the front end and the center of rotation to each other and a line segment connecting the rear end and the center of rotation to each other and a distance w between a point located on a radially innermost side of the connection portion and the rear end along the direction orthogonal to the bisector satisfy a condition of $0.2\leq w/W\leq 0.6$, and maximum radius $R1_{max}$, a radius R from the center of rotation, of the point located on the radially innermost side of the connection portion, and a radius r of the rotation shaft portion satisfy a condition of $0<(R1_{max}-R)/(R1_{max}-r)\leq 0.2$.

In the propeller fan above, preferably, in the plan view of the blade along the central axis, a radius R from the center of rotation, of a point located on a radially innermost side of the connection portion and maximum radius $R2_{max}$ satisfy a condition of $R<R2_{max}$.

In the propeller fan above, in the plan view of the blade along the central axis, a radius R from the center of rotation, of a point located on a radially innermost side of the connection portion and maximum radius $R2_{max}$ may satisfy a condition of $R=R2_{max}$.

In the propeller fan above, in the plan view of the blade along the central axis, a radius R from the center of rotation, of a point located on a radially innermost side of the connection portion and maximum radius $R2_{max}$ may satisfy a condition of $R>R2_{max}$.

A propeller fan according to another aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, and an outer edge portion extending along the direction of rotation, and the outer edge portion has a front outer edge portion located on a side of the front edge portion, a rear outer edge portion located on a side of the rear edge portion, a connection portion connecting the front outer edge portion and the rear outer edge portion to each other, a front end where the front outer edge portion is connected to an outer end of the front edge portion, and a rear end where the rear outer edge portion is connected to an outer end of the rear edge portion. In a plan view of the blade along the central axis, a maximum radius $R1_{max}$ from the center of rotation of the front outer edge portion and a maximum radius $R2_{max}$ from the center of rotation of the rear outer edge portion satisfy a condition of $R1_{max}=R2_{max}$, and a distance W between the front end and the rear end along a direction orthogonal to a bisector of an angle formed by a line segment connecting the front end and the center of rotation to each other and a line segment connecting the rear end and the center of rotation to each other and a distance w between a point located on a radially innermost side of the connection portion and the rear end along the direction orthogonal to the bisector satisfy a condition of $0<w/W<0.5$.

In the propeller fan above, preferably, the connection portion has a smooth shape without a corner portion.

In the propeller fan above, the connection portion may have a shape at a substantially obtuse angle.

In the propeller fan above, the connection portion may have a shape substantially at an acute angle.

In the propeller fan above, the rear outer edge portion may further include a site recessed toward the central axis.

In the propeller fan above, preferably, a plurality of blades are provided as being spaced apart from one another along a direction of rotation, and in that case, preferably, the outer edge portions provided in the plurality of blades are all identical in shape.

In the propeller fan above, preferably, a plurality of blades are provided as being spaced apart from one another along a direction of rotation, and in that case, the outer edge portions provided in the plurality of blades may include an outer edge portion different in shape.

In the propeller fan above, preferably, when a plane orthogonal to the central axis is assumed on a burst side of the blade and a length in an axial direction of the central axis from that plane is defined as a height, the front edge portion has a constant height between an inner end and a position distant radially outward from the inner end.

In the propeller fan above, preferably, when a plane orthogonal to the central axis is assumed on a burst side of the blade and a length in an axial direction of the central axis from that plane is defined as a height, a radially outer portion including an outer end of the rear edge portion is constructed to increase in height from a radially inner side toward a radially outer side.

In the propeller fan above, preferably, when an end surface on the suction side in such a two-dimensional shape as including a site of the blade outermost on the suction side along a direction of extension of the central axis and being orthogonal to the central axis is assumed, the entire outer edge portion is located as being distant from the end surface on the suction side along the direction of extension of the central axis.

In the propeller fan above, preferably, when an end surface on the burst side in such a two-dimensional shape as including a site of the blade outermost on the burst side along a direction of extension of the central axis and being orthogonal to the central axis is assumed, the entire outer edge portion is located as being distant from the end surface on the burst side along the direction of extension of the central axis.

In the propeller fan above, preferably, the blade has a blade inner region located on a side of the rotation shaft portion, a blade outer region located on a side of the outer edge portion, and a coupling portion coupling the blade inner region and the blade outer region to each other in a curved or bent manner at a boundary between the blade inner region and the blade outer region such that a side of the negative pressure surface is recessed and a side of the positive pressure surface is projecting.

The propeller fan above is preferably formed from a resin molded product.

A fluid feeder according to one aspect of this invention includes the propeller fan described above and a drive motor rotationally driving the propeller fan.

A molding die for a propeller fan according to one aspect of this invention is used for molding the propeller fan described above when it is formed from a resin molded product.

A propeller fan according to yet another aspect of this invention includes a rotation shaft portion rotating around a virtual central axis and a blade extending from the rotation shaft portion outward in a direction of radius of the central axis. The blade has a front edge portion arranged on a side in a direction of rotation, a rear edge portion arranged on an opposite side in the direction of rotation, and an outer edge portion extending in a circumferential direction around the central axis and connecting the front edge portion and the rear edge portion to each other. The front edge portion has a constant height in an axial direction of the central axis between the rotation shaft portion and a position distant from the rotation shaft portion outward in a direction of radius of the central axis.

With the propeller fan thus constructed, on the inner circumferential side around the central axis, a height of the blade (a length between the front edge portion and the rear edge portion in the axial direction of the central axis) is more positively increased. Thus, on the inner circumferential side, fluid feeding capability is enhanced, so that fluid feeding efficiency with respect to a volume of the region which can be occupied by the fan can be improved. In addition, a difference in fluid feeding capability between the inner circumferential side and the outer circumferential side around the central axis is lessened and a fluid can more uniformly be sent. Thus, uncomfortableness of the fluid sent from the fan can be lessened.

Further preferably, the rear edge portion has a constant height in the axial direction of the central axis on an outer circumferential side around the central axis.

Further preferably, the blade further has a blade root portion arranged between the blade and an outer surface of the rotation shaft portion, a blade tip end portion arranged on an outer side in the direction of radius of the central axis, in the front edge portion, a blade rear end portion arranged on the outer side in the direction of radius of the central axis, in the rear edge portion, and a blade surface formed in a region surrounded by the blade root portion, the front edge portion, the blade tip end portion, the outer edge portion, the blade rear end portion, and the rear edge portion. The outer edge portion connects the blade tip end portion and the blade rear end portion to each other. The blade surface includes an inner region including the blade root portion and located on an inner side in the direction of radius of the central axis, an outer region including the blade rear end portion and located on an outer side in the direction of radius of the central axis, and a coupling portion extending from a front end portion located close to the front edge portion, the blade tip end portion, or the outer edge portion to a rear end portion located close to the rear edge portion and coupling the inner region and the outer region to each other such that a side of a positive pressure surface of the blade surface is projecting and a side of a negative pressure surface of the blade surface is recessed. The blade surface is formed such that a stagger angle in a portion on the inner side in the direction of radius relative to the coupling portion in the blade surface is smaller than a stagger angle in a portion on the outer side in the direction of radius of the central axis relative to the coupling portion in the blade surface.

Further preferably, the coupling portion is formed along a flow of a blade tip end vortex generated over the blade surface with rotation of the blade.

Further preferably, the coupling portion is formed such that an interior angle formed on the side of the negative pressure surface of the coupling portion is smallest around a center of the coupling portion in a direction of rotation of the blade. The blade surface located around each of the front end portion and the rear end portion is formed at 180° in a cross-sectional view along the direction of radius, which passes through each of the front end portion and the rear end portion.

Further preferably, when a virtual concentric circle passing through a central position in the coupling portion in a direction of rotation of the blade and centered around the central axis is drawn, the front end portion of the coupling portion is located on an outer side in a direction of radius of the concentric circle and the rear end portion of the coupling portion is located on an inner side in the direction of radius of the concentric circle.

Further preferably, the blade surface is formed such that a stagger angle in a portion on an inner side in the direction of radius relative to the coupling portion in the blade surface is smaller toward the rotation shaft portion.

Further preferably, the blade surface is formed such that an area of the blade in a portion on the inner side in the direction of radius relative to the coupling portion in the blade surface is equal to or greater than an area of the blade in a portion on the outer side in the direction of radius relative to the coupling portion in the blade surface.

Further preferably, a stagger angle in the blade root portion is smaller than a stagger angle in the outer edge portion. The blade root portion of the blade surface has a warped shape such that the side of the positive pressure surface of the blade surface is projecting and the side of the negative pressure surface of the blade surface is recessed. The blade is formed such that a direction of warpage of the blade root portion and a direction of warpage of the outer edge portion are opposite to each other.

Further preferably, the coupling portion is provided as being curved from the inner region toward the outer region.

Further preferably, the coupling portion is provided as being bent from the inner region toward the outer region.

Further preferably, the outer edge portion includes a front outer edge portion located on a side of the front edge portion, a rear outer edge portion located on a side of the rear edge portion, and a connection portion connecting the front outer edge portion and the rear outer edge portion to each other.

The connection portion is a site where the front outer edge portion and the rear outer edge portion different in maximum radius are connected to each other, and it desirably smoothly connects the front outer edge portion and the rear outer edge portion to each other. Alternatively, desirably, the connection portion connects the front outer edge portion and the rear outer edge portion to each other substantially at an acute angle, for example, in a state having a cut. Alternatively, desirably, the connection portion connects the front outer edge portion and the rear outer edge portion to each other substantially at an obtuse angle, for example, in a state having a height difference. Alternatively, desirably, the connection portion is in a shape recessed toward the central axis.

Further preferably, the propeller fan described in any portion described above is formed from a resin molded product.

A fluid feeder according to another aspect of this invention includes the propeller fan described in any portion described above and a drive motor rotationally driving the propeller fan.

A molding die according to another aspect of this invention is used for molding the propeller fan made of a resin described above.

A propeller fan according to yet another aspect of this invention includes a rotation shaft portion rotating around a virtual central axis and a blade extending from the rotation shaft portion outward in a direction of radius of the central axis. The blade has a front edge portion arranged on a side in a direction of rotation, a rear edge portion arranged on an opposite side in the direction of rotation, and an outer edge portion extending in a circumferential direction around the central axis and connecting the front edge portion and the rear edge portion to each other. When a plane orthogonal to the central axis is assumed on a burst side of the blade and a length in an axial direction of the central axis from that plane is defined as a height, the rear edge portion has a height increasing toward the outer edge portion on an outer circumferential side around the central axis.

With the propeller fan thus constructed, on the outer circumferential side around the central axis, a height of the blade (a distance between the front edge portion and the rear edge portion in the axial direction of the central axis) is decreased, to thereby suppress capability to feed a fluid by the blade. Thus, a difference in fluid feeding capability between the inner circumferential side and the outer circumferential side around the central axis is lessened, so that a fluid can more uniformly be sent. Thus, uncomfortableness of the fluid sent from the fan can be lessened.

Further preferably, when the blade is viewed in an axial direction of the central axis, the rear edge portion includes an inner circumferential portion extending in a prescribed direction from the rotation shaft portion outward in the direction of radius of the central axis and an outer circumferential portion extending from the inner circumferential portion toward the outer edge portion with inclination being varied from the prescribed direction to the direction of rotation.

Further preferably, the prescribed direction is a direction of radius around the central axis.

Further preferably, the outer circumferential portion extends linearly or in an arc shape.

Further preferably, the front edge portion has a constant height between the rotation shaft portion and the outer edge portion.

Further preferably, the front edge portion has a height constant on an inner circumferential side around the central axis and decreasing toward the outer edge portion on an outer circumferential side around the central axis.

Further preferably, the blade further has a blade root portion arranged between the blade and an outer surface of the rotation shaft portion, a blade tip end portion arranged on the outer side in the direction of radius of the central axis, in the front edge portion, a blade rear end portion arranged on the outer side in the direction of radius of the central axis, in the rear edge portion, and a blade surface formed in a region surrounded by the blade root portion, the front edge portion, the blade tip end portion, the outer edge portion, the blade rear end portion, and the rear edge portion. The outer edge portion connects the blade tip end portion and the blade rear end portion to each other. The blade surface includes an inner region including the blade root portion and located on an inner side in the direction of radius of the central axis, an outer region including the blade rear end portion and located on an outer side in the direction of radius of the central axis, and a coupling portion extending from a front end portion located close to the front edge portion, the blade tip end portion, or the outer edge portion to a rear end portion located close to the rear edge portion and coupling the inner region and the outer region to each other such that a side of a positive pressure surface of the blade surface is projecting and a side of a negative pressure surface of the blade surface is recessed. The blade surface is formed such that a stagger angle in a portion on an inner side in the direction of radius relative to the coupling portion in the blade surface is smaller than a stagger angle in a portion on an outer side in the direction of radius of the central axis relative to the coupling portion in the blade surface.

Further preferably, the coupling portion is formed along a flow of a blade tip end vortex generated over the blade surface with rotation of the blade.

Further preferably, the coupling portion is formed such that an interior angle formed on the side of the negative pressure surface of the coupling portion is smallest around a center of the coupling portion in a direction of rotation of the blade. The blade surface located around each of the front end portion and the rear end portion is formed at 180° in a cross-sectional view along the direction of radius, which passes through each of the front end portion and the rear end portion.

Further preferably, when a virtual concentric circle passing through a central position in the coupling portion in a direction of rotation of the blade and centered around the central axis is drawn, the front end portion of the coupling portion is located on an outer side in a direction of radius of the concentric circle and the rear end portion of the coupling portion is located on an inner side in the direction of radius of the concentric circle.

Further preferably, the blade surface is formed such that a stagger angle in a portion on the inner side in the direction of radius relative to the coupling portion in the blade surface is smaller toward the rotation shaft portion.

Further preferably, the blade surface is formed such that an area of the blade in a portion on the inner side in the direction of radius relative to the coupling portion in the blade surface is equal to or greater than an area of the blade in a portion on the outer side in the direction of radius relative to the coupling portion in the blade surface.

Further preferably, the coupling portion is provided as being curved from the inner region toward the outer region.

Further preferably, the coupling portion is provided as being bent from the inner region toward the outer region.

Further preferably, the outer edge portion includes a front outer edge portion located on a side of the front edge portion, a rear outer edge portion located on a side of the rear edge portion, and a connection portion connecting the front outer edge portion and the rear outer edge portion to each other.

The connection portion is a site where the front outer edge portion and the rear outer edge portion different in maximum radius are connected to each other, and it desirably smoothly connects the front outer edge portion and the rear outer edge portion to each other. Alternatively, desirably, the connection portion connects the front outer edge portion and the rear outer edge portion to each other substantially at an acute angle, for example, in a state having a cut. Alternatively, desirably, the connection portion connects the front outer edge portion and the rear outer edge portion to each other substantially at an obtuse angle, for example, in a state having a height difference. Alternatively, desirably, the connection portion is in a shape recessed toward the central axis.

Further preferably, the propeller fan described in any portion described above is formed from a resin molded product.

A fluid feeder according to yet another aspect of this invention includes the propeller fan described in any portion described above and a drive motor rotationally driving the propeller fan.

A molding die according to yet another aspect of this invention is used for molding the propeller fan made of a resin described above.

A propeller fan according to yet another aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, an outer edge portion extending along the direction of rotation, a blade tip end projection portion connecting the front edge portion and the outer edge portion to each other, and a blade rear end projection portion connecting the rear edge portion and the outer edge portion to each other. When a plane orthogonal to the central axis is assumed on the burst side of the blade and a length in an axial direction of the central axis from that plane is defined as a height, a height $h_{A1}$ at a position which is a connection portion between the front edge portion and the blade tip end projection portion and where a curvature is varied and a height $h_B$ at a front end position in the direction of rotation of the blade tip end projection portion satisfy a condition of $h_{A1}>h_B$.

A propeller fan according to yet another aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, an outer edge portion extending along the direction of rotation, a blade tip end projection portion connecting the front edge portion and the outer edge portion to each other, and a blade rear end projection portion connecting the rear edge portion and the outer edge portion to each other. When a plane orthogonal to the central axis is assumed on the burst side of the blade and a length in an axial direction of the central axis from that plane is defined as a height, a height $h_{A2}$ at a central position in the front edge portion and a height $h_B$ at a front end position in a direction of rotation of the blade tip end projection portion satisfy a condition of $h_{A2}>h_B$.

A propeller fan according to yet another aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, an outer edge portion extending along the direction of rotation, a blade tip end projection portion connecting the front edge portion and the outer edge portion to each other, and a blade rear end projection portion connecting the rear edge portion and the outer edge portion to each other. When a plane orthogonal to the central axis is assumed on the burst side of the blade and a length in an axial direction of the central axis from that plane is defined as a height, a height $h_{A3}$ at a position lowest in height in the front edge portion and a height $h_B$ at a front end position in the direction of rotation of the blade tip end projection portion satisfy a condition of $h_{A3}>h_B$.

A propeller fan according to yet another aspect of this invention includes a rotation shaft portion rotating with a central axis being defined as a center of rotation and a blade projecting radially outward from the rotation shaft portion and including a negative pressure surface located on a suction side and a positive pressure surface located on a burst side. The blade includes a front edge portion located on a front side in a direction of rotation, a rear edge portion located on a rear side in the direction of rotation, an outer edge portion extending along the direction of rotation, a blade tip end projection portion connecting the front edge portion and the outer edge portion to each other, and a blade rear end projection portion connecting the rear edge portion and the outer edge portion to each other. When a plane orthogonal to the central axis is assumed on the burst side of the blade, a length in an axial direction of the central axis from that plane is defined as a height, and a distance from the center of rotation is defined as a radius, a height $h_{A1}$ at a position which is a connection portion between the front edge portion and the blade tip end projection portion and where a curvature is varied, a height $h_B$ and a radius $R_B$ at a front end position in the direction of rotation of the blade tip end projection portion, and a height $h_C$ and a radius $R_C$ at a position which is a connection portion between the outer edge portion and the blade tip end projection portion and where a curvature is varied satisfy a condition of $h_{A1}\geq h_B>h_C$ and a condition of $0.8\times R_C\leq R_B\leq 0.93\times R_C$.

In the propeller fan above, preferably, a height $h_{D1}$ at a position which is a connection portion between the rear edge portion and the blade rear end projection portion and where a curvature is varied and a height $h_E$ at a central position in the blade rear end projection portion satisfy a condition of $h_E>h_{D1}$.

In the propeller fan above, preferably, a height $h_{D1}$ at a position which is a connection portion between the rear edge portion and the blade rear end projection portion and where a curvature is varied, a height $h_E$ and a radius $R_E$, at a central position in the blade rear end projection portion, and a height $h_F$ and a radius $R_F$ at a position which is a connection portion between the outer edge portion and the blade rear end projection portion and where a curvature is varied satisfy a condition of $h_F>h_E\geq h_{D1}$ and a condition of $R_F<R_F$.

In the propeller fan above, preferably, the outer edge portion has a front outer edge portion located on a side of the front edge portion, a rear outer edge portion located on a side of the rear edge portion, and a connection portion connecting the front outer edge portion and the rear outer edge portion to each other.

The connection portion is a site where the front outer edge portion and the rear outer edge portion different in maximum radius are connected to each other, and it desirably smoothly connects the front outer edge portion and the rear outer edge portion to each other. Alternatively, desirably, the connection portion connects the front outer edge portion and the rear outer edge portion to each other substantially at an acute angle, for example, in a state having a cut. Alternatively, desirably, the connection portion connects the front outer edge portion and the rear outer edge portion to each other substantially at an obtuse angle, for example, in a state having a height difference. Alternatively, desirably, the connection portion is in a shape recessed toward the central axis.

In the propeller fan above, preferably, the front edge portion has a constant height between an inner end and a position distant radially outward from the inner end.

In the propeller fan above, preferably, a radially outer portion including an outer end of the rear edge portion is constructed to decrease in height from a radially inner side toward a radially outer side.

In the propeller fan above, preferably, when an end surface on the suction side in such a two-dimensional shape as including a site of the blade outermost on the suction side along a direction of extension of the central axis and being orthogonal to the central axis is assumed, the entire outer edge portion is located as being distant from the end surface on the suction side along the direction of extension of the central axis.

In the propeller fan above, preferably, when an end surface on the burst side in such a two-dimensional shape as including a site of the blade outermost on the burst side along a direction of extension of the central axis and being orthogonal to the central axis is assumed, the entire outer edge portion is located as being distant from the end surface on the burst side along the direction of extension of the central axis.

In the propeller fan above, preferably, the blade has a blade inner region located on a side of the rotation shaft portion, a blade outer region located on a side of the outer edge portion, and a coupling portion coupling the blade inner region and the blade outer region to each other in a curved or bent manner at a boundary between the blade inner region and the blade outer region such that a side of the negative pressure surface is recessed and a side of the positive pressure surface is projecting.

A propeller fan according to yet another aspect of this invention includes a rotation shaft portion rotating with a central axis being defined as a center of rotation and a blade projecting radially outward from the rotation shaft portion. The blade is constructed such that a passage region through which the propeller fan passes with rotation of the propeller fan is in a shape obtained by cutting a circumferential angle portion of an end surface located on a suction side from a space in a substantially columnar shape encompassing the propeller fan.

In the propeller fan above, preferably, in a case that the blade has a front edge portion located on a front side in a direction of rotation, a rear edge portion located on a rear side in the direction of rotation, an outer edge portion extending along the direction of rotation, a blade tip end projection portion connecting the front edge portion and the outer edge portion to each other, and a blade rear end projection portion connecting the rear edge portion and the outer edge portion to each other, when a plane orthogonal to the central axis is assumed on a burst side of the blade, a length in an axial direction of the central axis from that plane is defined as a height, and a distance from the center of rotation is defined as a radius, a height $h_{A1}$ at a position which is a connection portion between the front edge portion and the blade tip end projection portion and where a curvature is varied, a height $h_B$ and a radius $R_B$ at a front end position in a direction of rotation of the blade tip end projection portion, and a height $h_C$ and a radius $R_C$ at a position which is a connection portion between the outer edge portion and the blade tip end projection portion and where a curvature is varied satisfy a condition of $h_{A1} \geq h_B > h_C$ and a condition of $0.8 \times R_C \leq R_B \leq 0.93 \times R_C$.

In the propeller fan above, preferably, the blade is constructed such that the passage region is in a shape obtained by further cutting a circumferential angle portion of an end surface located on a burst side from the space in the substantially columnar shape encompassing the propeller fan.

A fluid feeder according to yet another aspect of this invention includes the propeller fan described above and a drive motor rotationally driving the propeller fan.

An electric fan according to this invention includes the fluid feeder described above and a guard surrounding the propeller fan.

A molding die for a propeller fan according to yet another aspect of this invention is used for molding the propeller fan based on the first to fifth aspects of the present invention described above when they are formed from a resin molded product.

Advantageous Effects of Invention

According to the present invention, a propeller fan which generates wind less in pressure fluctuation and is capable of sending comfortably impinging wind and achieving lowering in noise, and a fluid feeder including the same, as well as a molding die for a propeller fan can be provided.

According to this invention, a propeller fan enhancing fluid feeding efficiency with respect to a volume of a region which can be occupied by a fan and achieving less uncomfortableness of a fluid sent from the fan, a fluid feeder including the propeller fan, and a molding die used for manufacturing of the propeller fan can be provided.

According to this invention, a propeller fan achieving less uncomfortableness of a fluid sent from a fan, a fluid feeder including the propeller fan, and a molding die used for manufacturing of the propeller fan can be provided.

According to the present invention, a propeller fan capable of achieving reduction in size and contributing to improvement in safety and a fluid feeder including the same, an electric fan, and a molding die for a propeller fan can be provided.

BRIEF DESCRIPTION OF DRAWINGS

FIG. 120 is a side view showing a propeller fan in a Comparative Example 1.

FIG. 121 is a side view showing a propeller fan in a Comparative Example 2.

FIG. 122 is a graph showing relation between the number of rotations and a quantity of wind in the propeller fan in Variation 2 in FIG. 118 and the propeller fan in Comparative Example 1 in FIG. 120.

FIG. 123 is a graph showing relation between a quantity of wind and power consumption in the propeller fan in Variation 2 in FIG. 118 and the propeller fan in Comparative Example 1 in FIG. 120.

FIG. 124 is a graph showing relation between a quantity of wind and noise in the propeller fan in Variation 2 in FIG. 118 and the propeller fan in Comparative Example 1 in FIG. 120.

FIG. 125 is a graph showing relation between a distance from a center of rotation and a wind velocity in the propeller fan in Variation 2 in FIG. 118 and the propeller fan in Comparative Example 1 in FIG. 120.

FIG. 126 is a graph showing relation between the number of rotations and a quantity of wind in the propeller fan in Embodiment C1 in FIG. 116, the propeller fan in Variation 1 in FIG. 117, and the propeller fan in Comparative Example 2 in FIG. 121.

FIG. 127 is a graph showing relation between a quantity of wind and power consumption in the propeller fan in Embodiment C1 in FIG. 116, the propeller fan in Variation 1 in FIG. 117, and the propeller fan in Comparative Example 2 in FIG. 121.

FIG. 128 is a graph showing relation between a quantity of wind and noise in the propeller fan in Embodiment C1 in FIG. 116, the propeller fan in Variation 1 in FIG. 117, and the propeller fan in Comparative Example 2 in FIG. 121.

FIG. 129 is a graph showing relation between a distance from a center of rotation and a wind velocity in the propeller fan in Embodiment C1 in FIG. 116, the propeller fan in Variation 1 in FIG. 117, and the propeller fan in Comparative Example 2 in FIG. 121.

FIG. 130 is a perspective view showing a circulator including a propeller fan in an Embodiment C2 of this invention.

FIG. 131 is a plan view of the propeller fan in Embodiment C2 of this invention viewed from a suction side.

Figure 131:
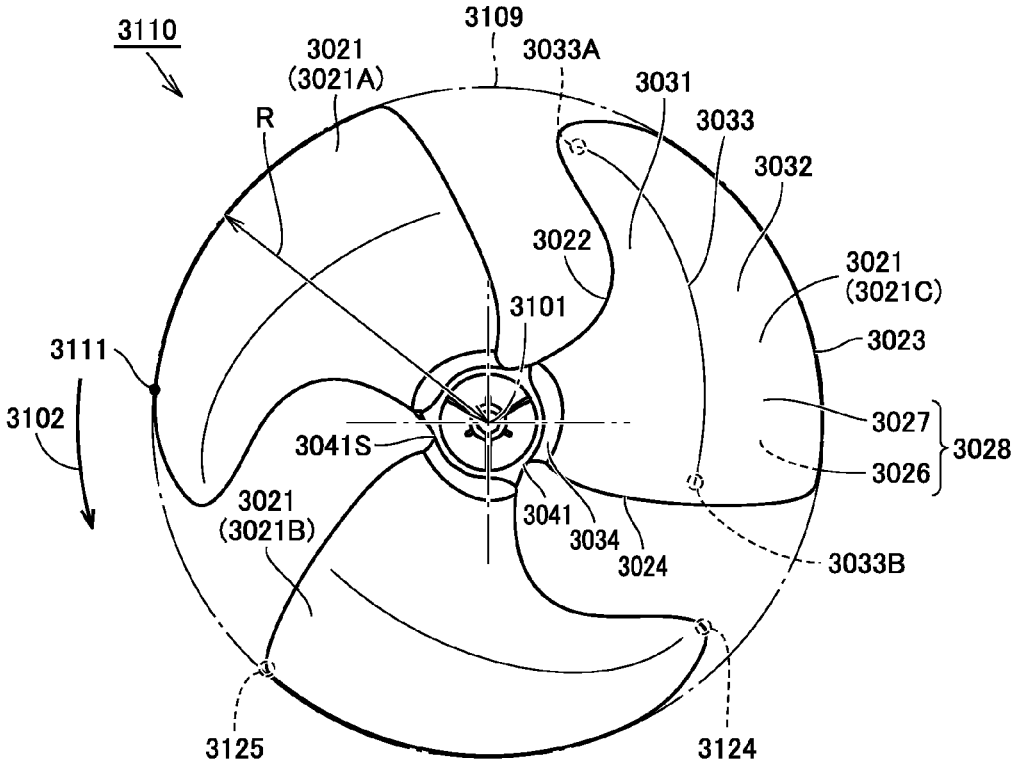
Figure 132:
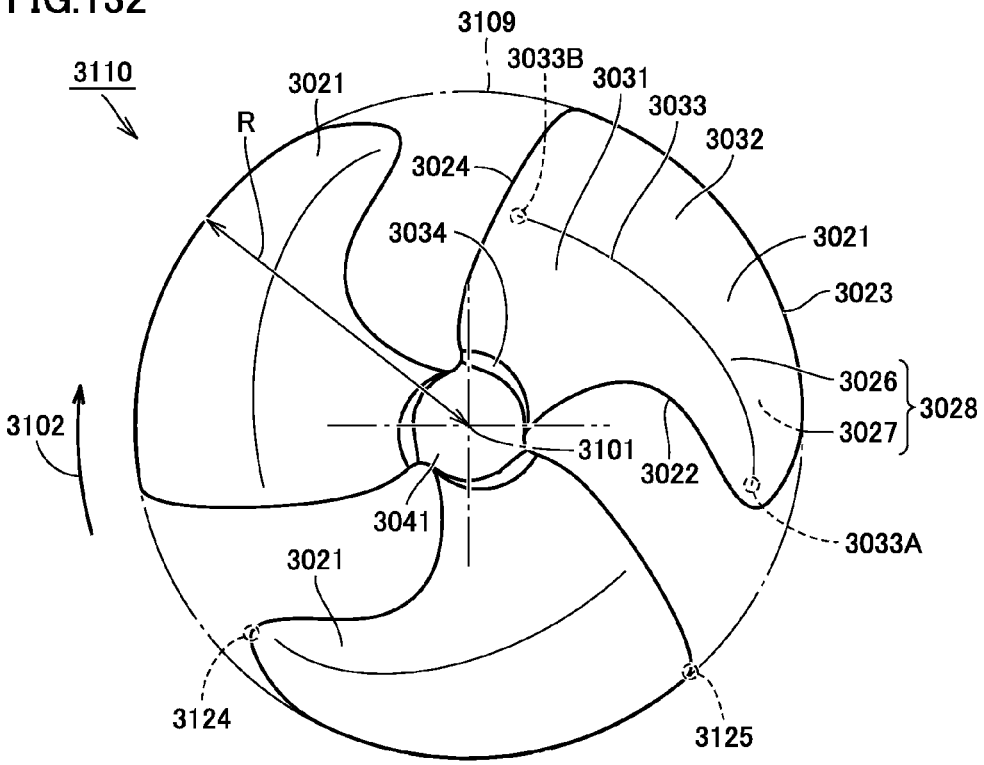

FIG. 132 is a plan view of the propeller fan in FIG. 131 viewed from a burst side.

Figure 133:
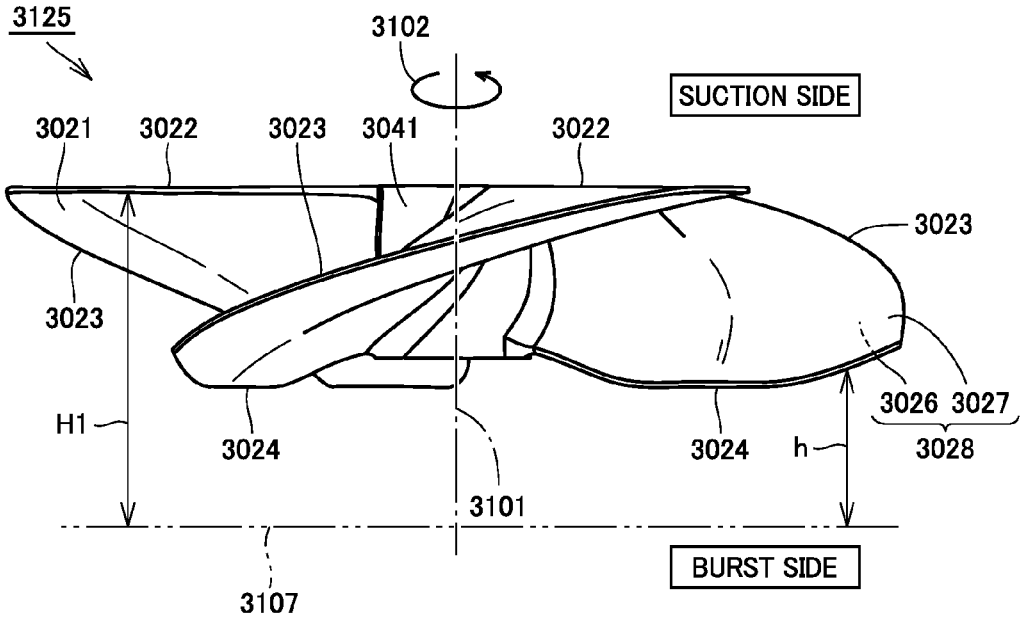

FIG. 133 is a side view showing the propeller fan in FIG. 131.

Figure 134:
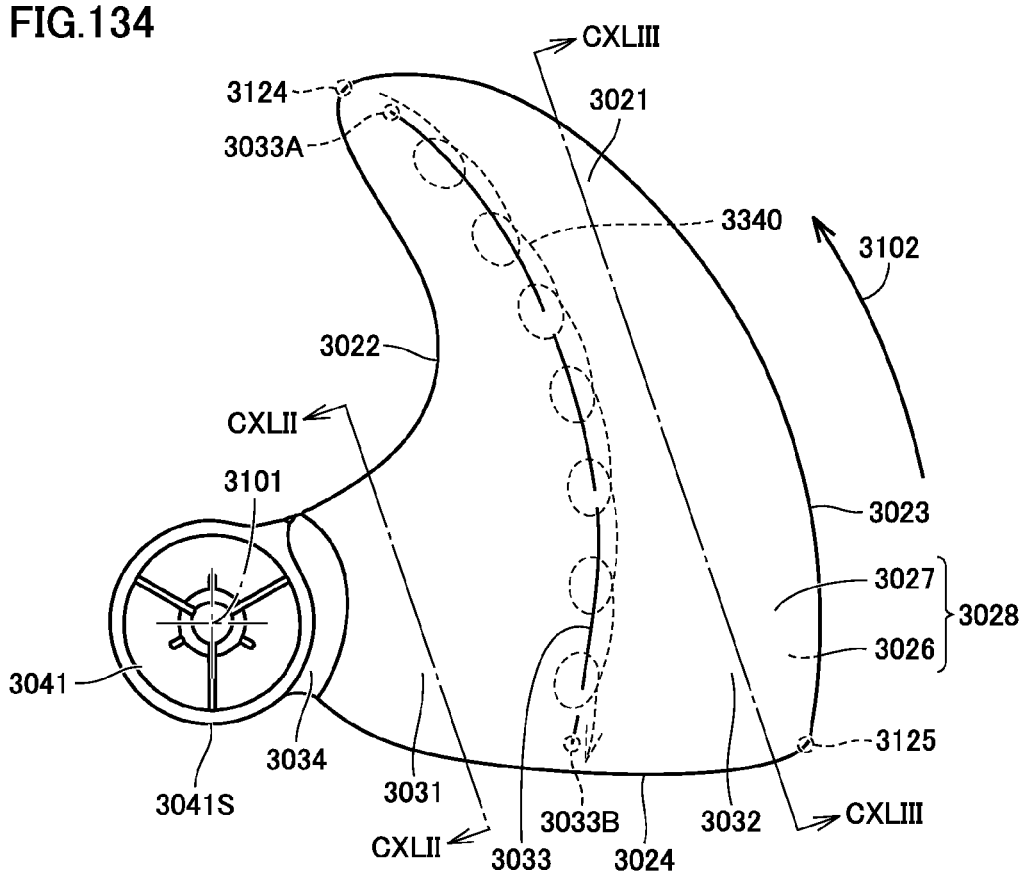

FIG. 134 is a plan view partially showing the propeller fan in FIG. 131.

Figure 135:
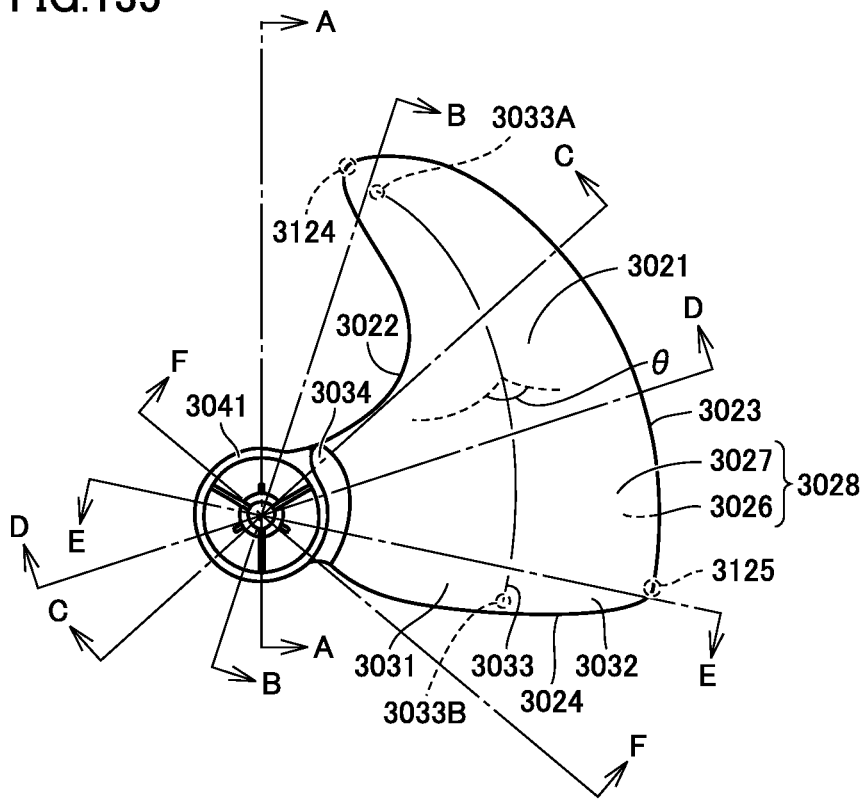

FIG. 135 is another plan view partially showing the propeller fan in FIG. 131.

Figure 136:
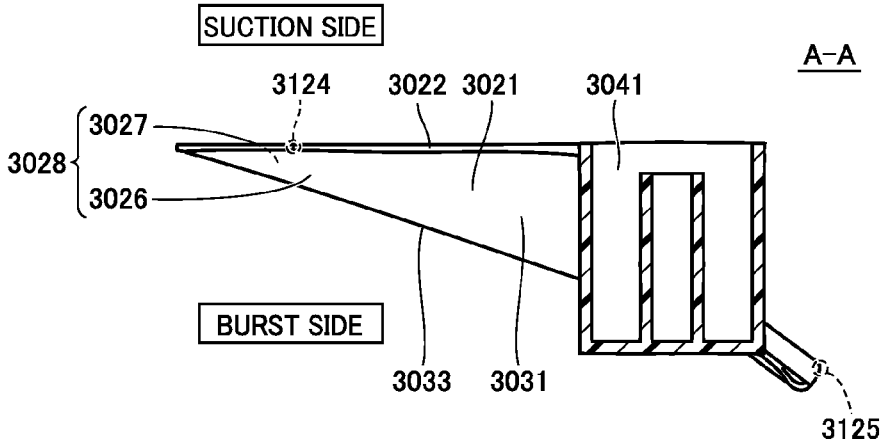

FIG. 136 is a cross-sectional view showing the propeller fan along the line A-A in FIG. 135.

Figure 137:
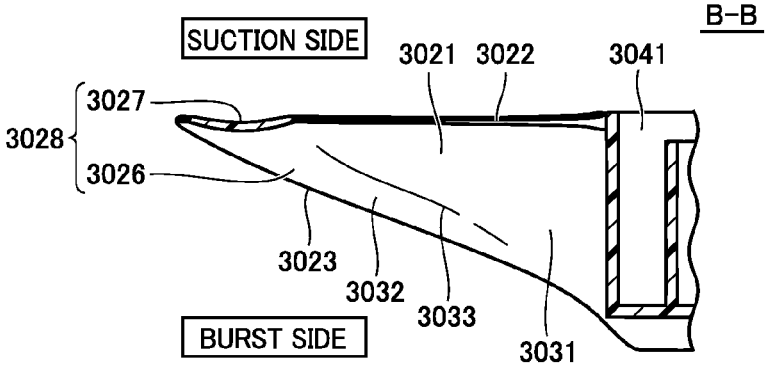

FIG. 137 is a cross-sectional view showing the propeller fan along the line B-B in FIG. 135.

Figure 138:
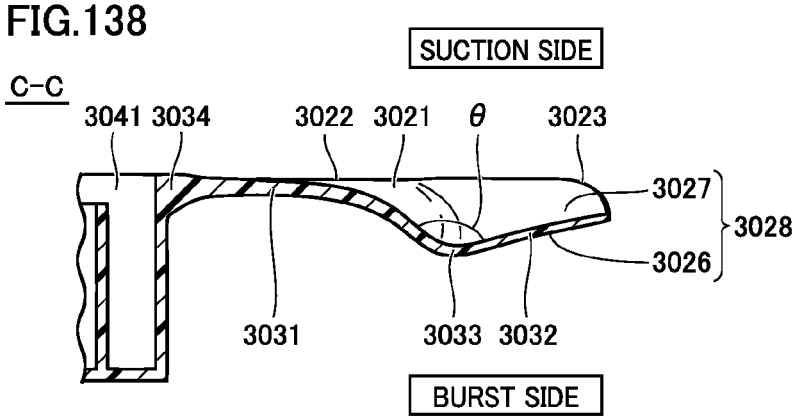

FIG. 138 is a cross-sectional view showing the propeller fan along the line C-C in FIG. 135.

Figure 139:
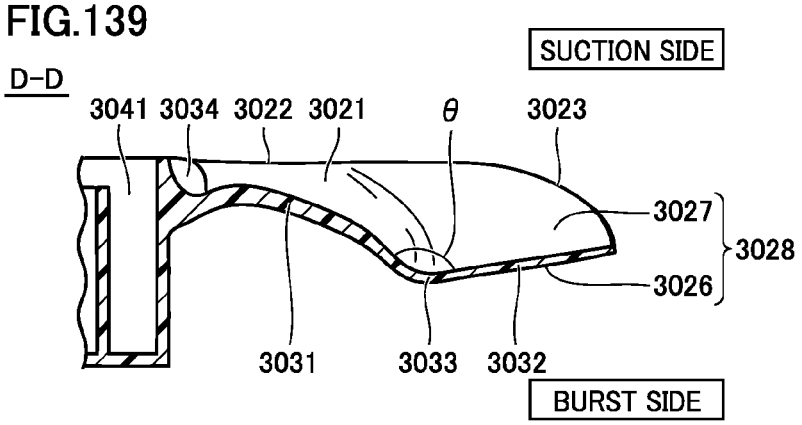

FIG. 139 is a cross-sectional view showing the propeller fan along the line D-D in FIG. 135.

Figure 140:
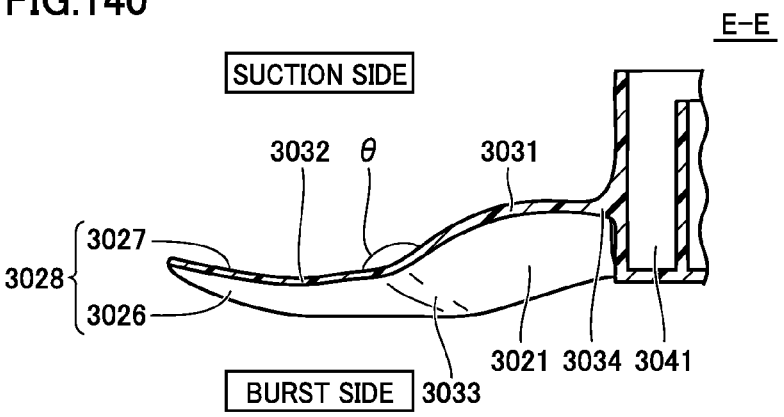

FIG. 140 is a cross-sectional view showing the propeller fan along the line E-E in FIG. 135.

Figure 141:
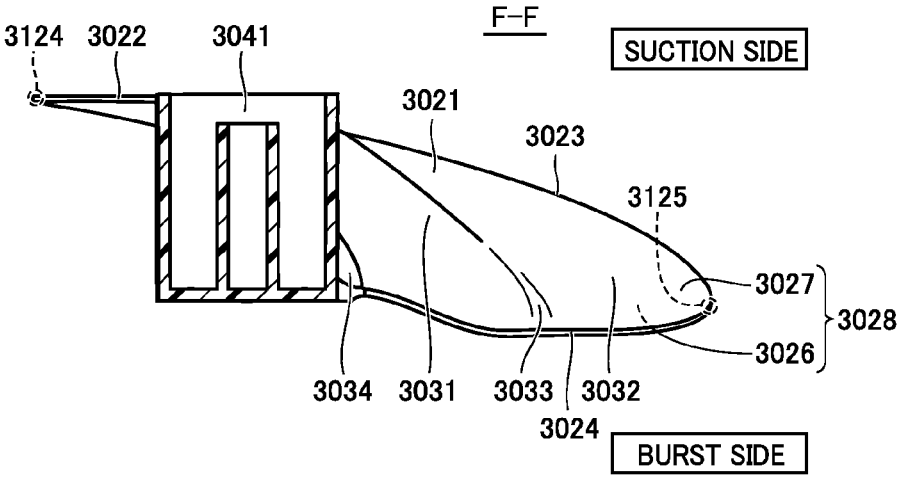

FIG. 141 is a cross-sectional view showing the propeller fan along the line F-F in FIG. 135.

Figure 142:
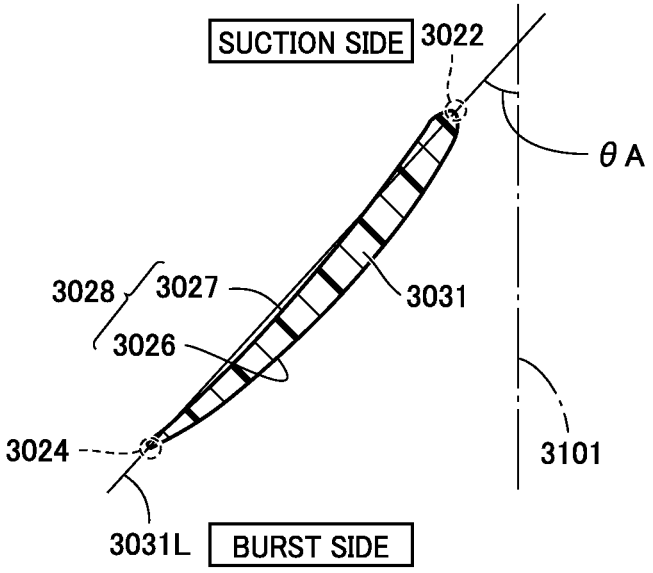

FIG. 142 is a cross-sectional view along the line CXLII-CXLII in FIG. 134.

Figure 143:
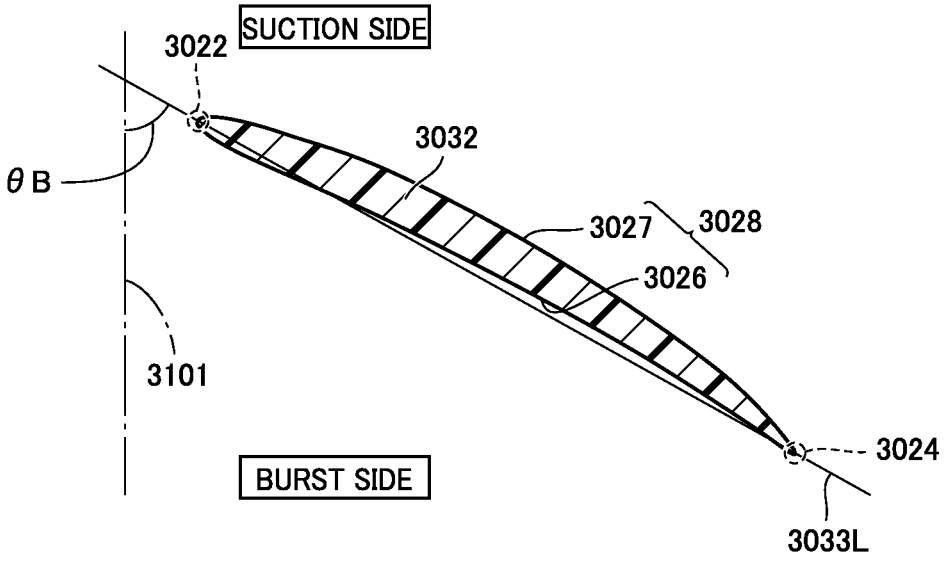

FIG. 143 is a cross-sectional view along the line CXLIII-CXLIII in FIG. 134.

Figure 144:
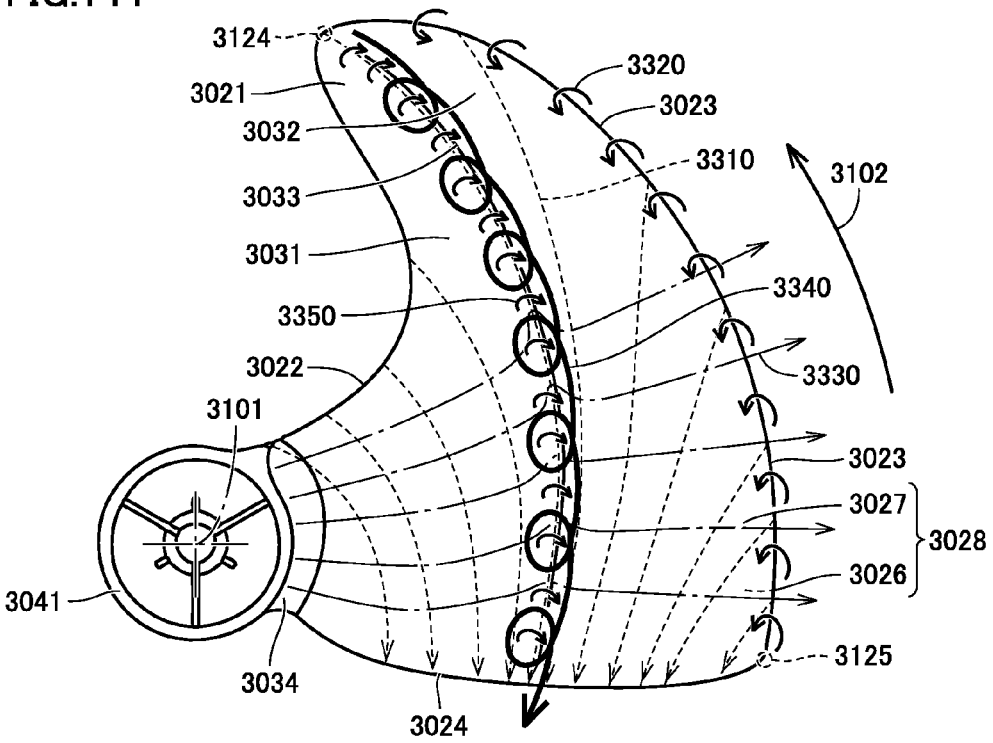

FIG. 144 is a plan view of a manner during rotation of a blade of a propeller fan viewed from a suction side.

Figure 145:
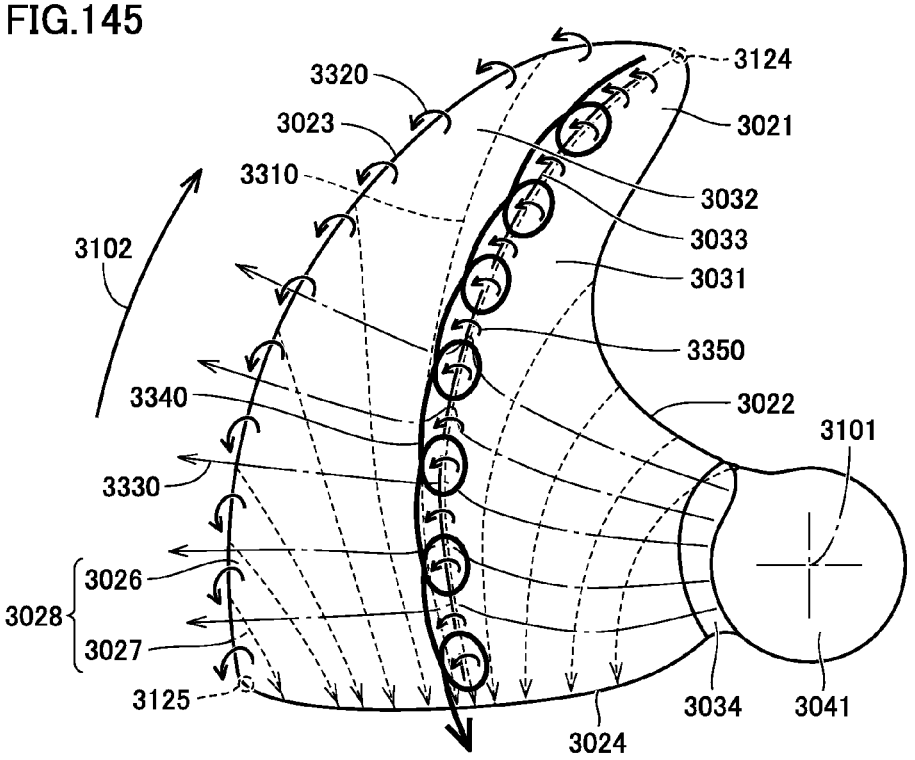

FIG. 145 is a plan view of a manner during rotation of a blade of a propeller fan viewed from a burst side.

Figure 146:
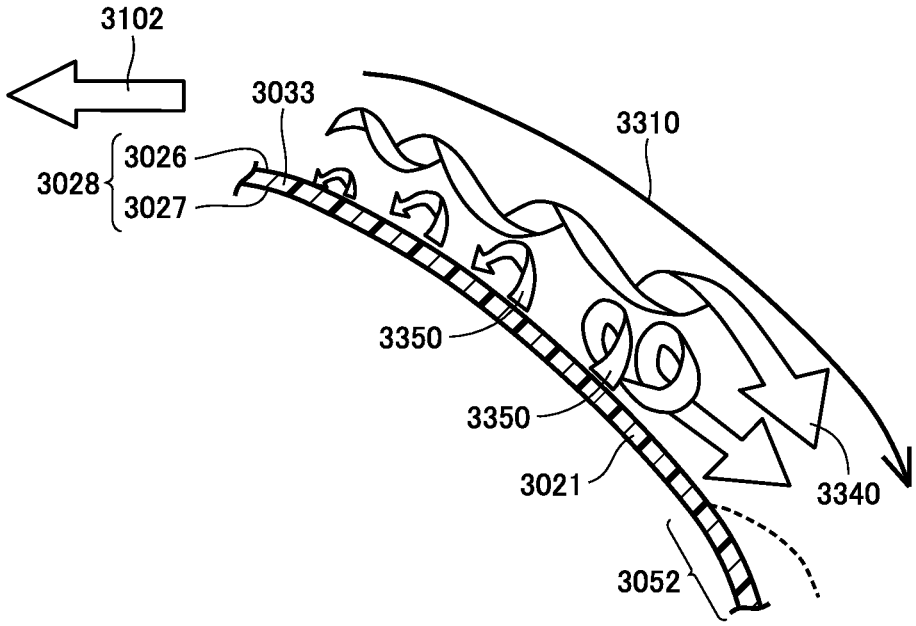

FIG. 146 is a cross-sectional view of a propeller fan virtually cut along a coupling portion, which is a diagram showing a manner during rotation of a blade of the propeller fan.

Figure 147:
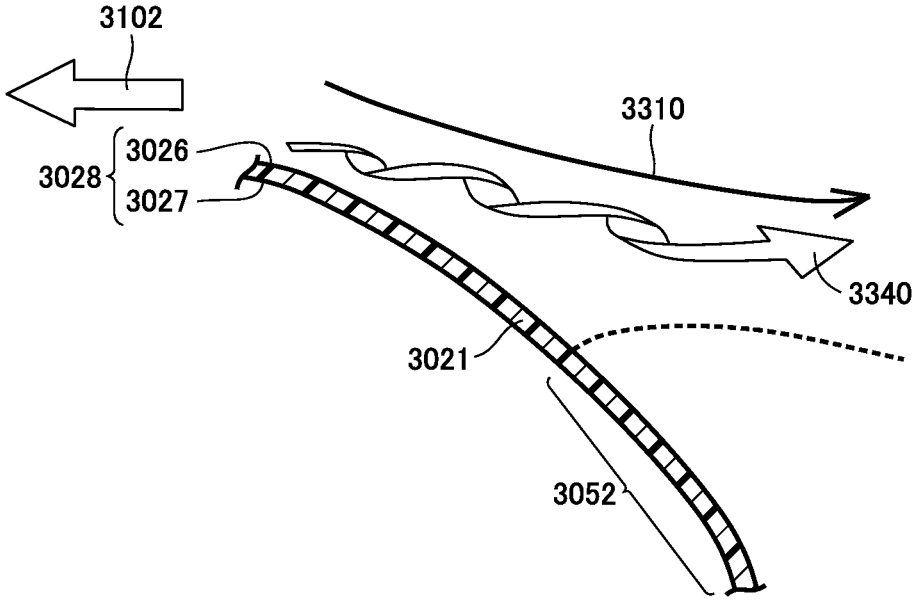

FIG. 147 is a cross-sectional view of a propeller fan for comparison virtually cut along a portion corresponding to a coupling portion in the present embodiment, which is a diagram showing a manner during rotation of a blade of this propeller fan.

Figure 148:
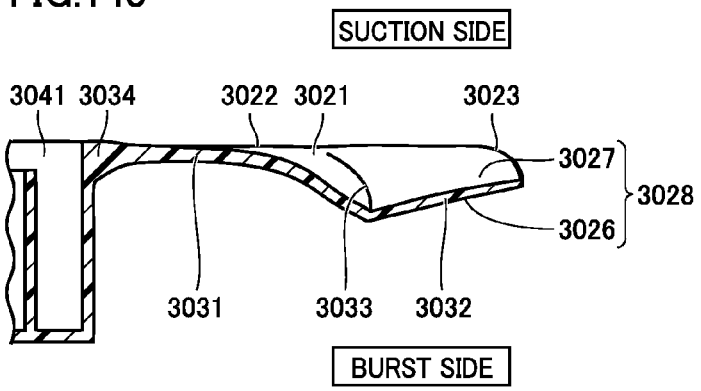

FIG. 148 is a cross-sectional view showing a Variation 1 of the propeller fan in FIG. 134.

Figure 149:
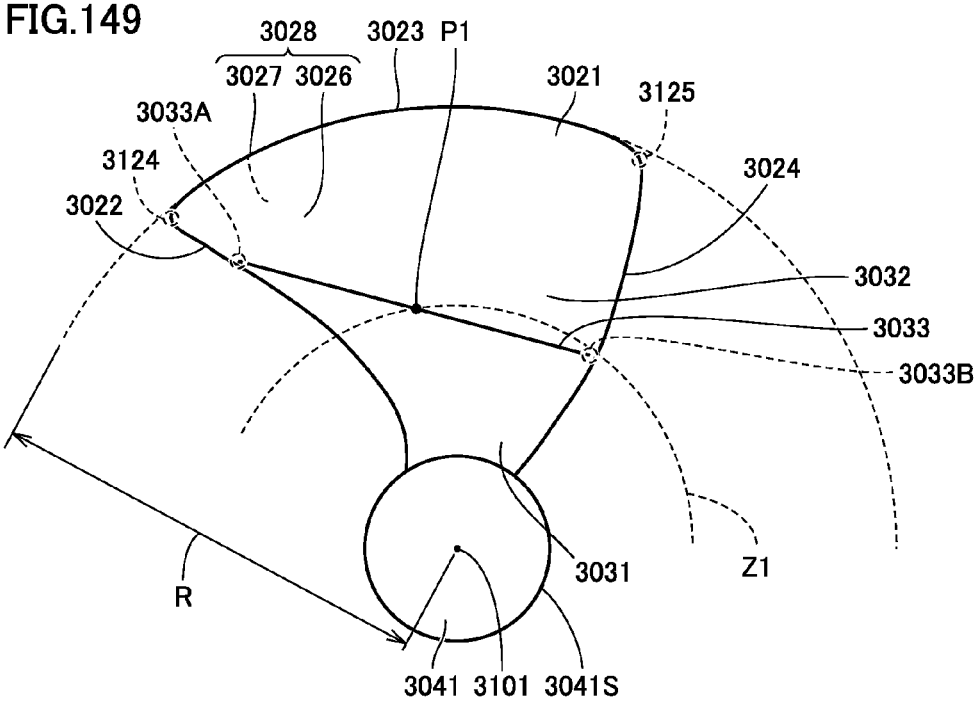

FIG. 149 is a cross-sectional view showing a Variation 2 of the propeller fan in FIG. 134.

Figure 150:
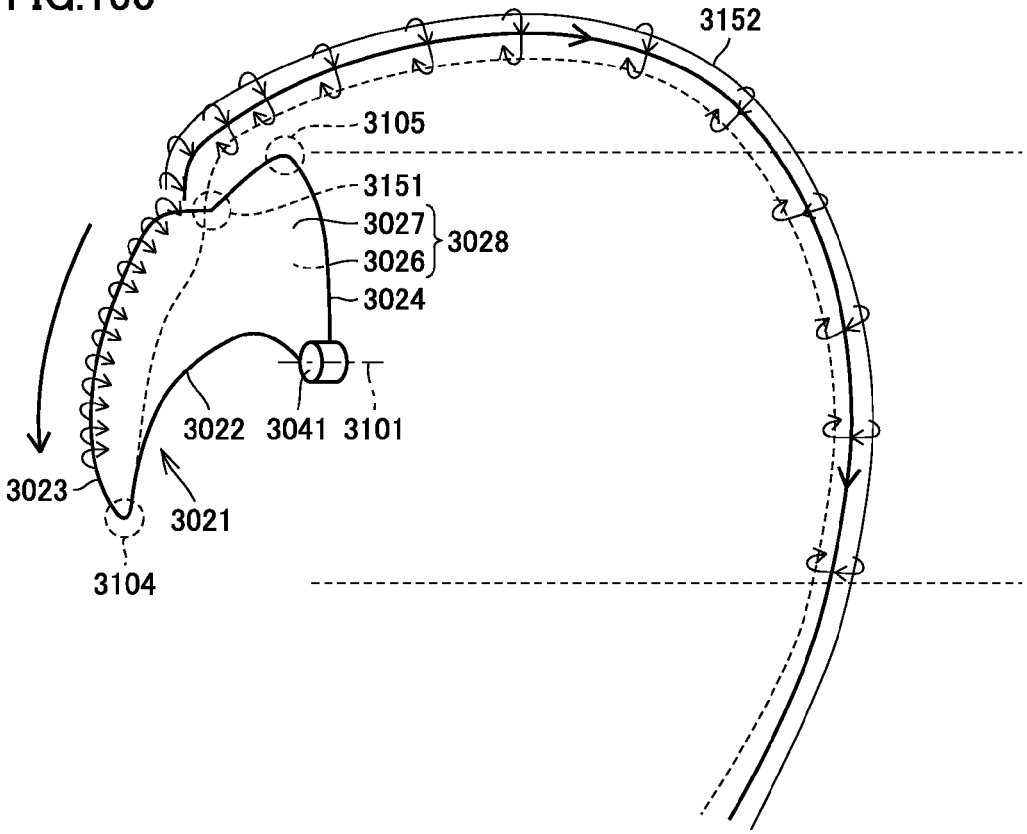

FIG. 150 is a conceptual diagram showing a flow of wind obtained at the time when a propeller fan is rotated at a low speed.

Figure 151:
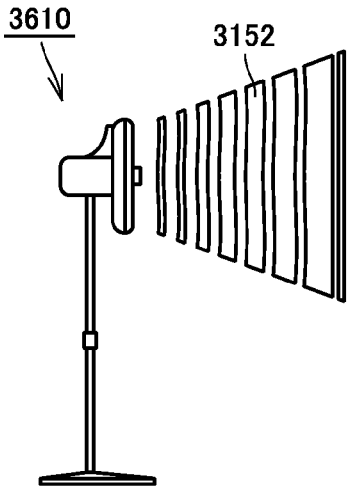

FIG. 151 is a diagram schematically showing a state of wind obtained at the time when a propeller fan is rotated at a low speed.

Figure 152:
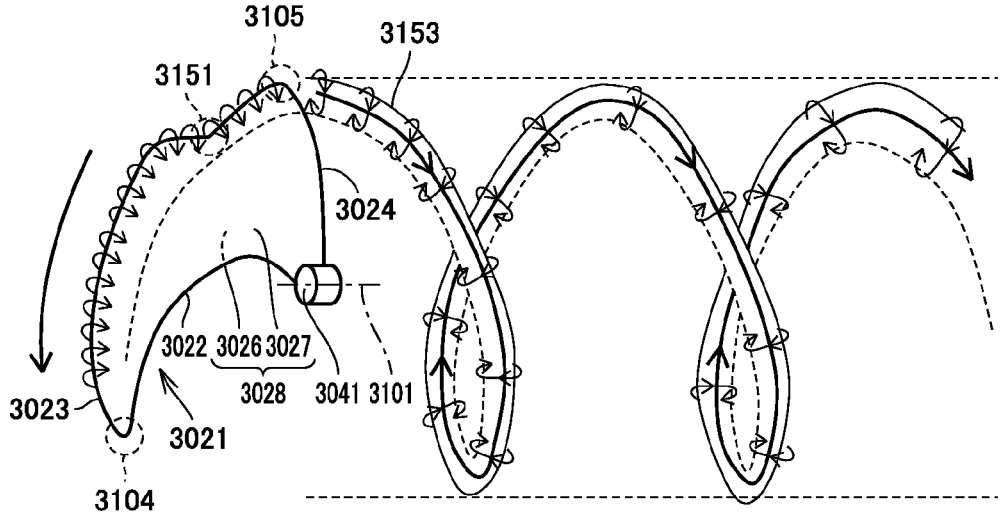

FIG. 152 is a conceptual diagram showing a flow of wind obtained at the time when a propeller fan is rotated at a high speed.

Figure 153:
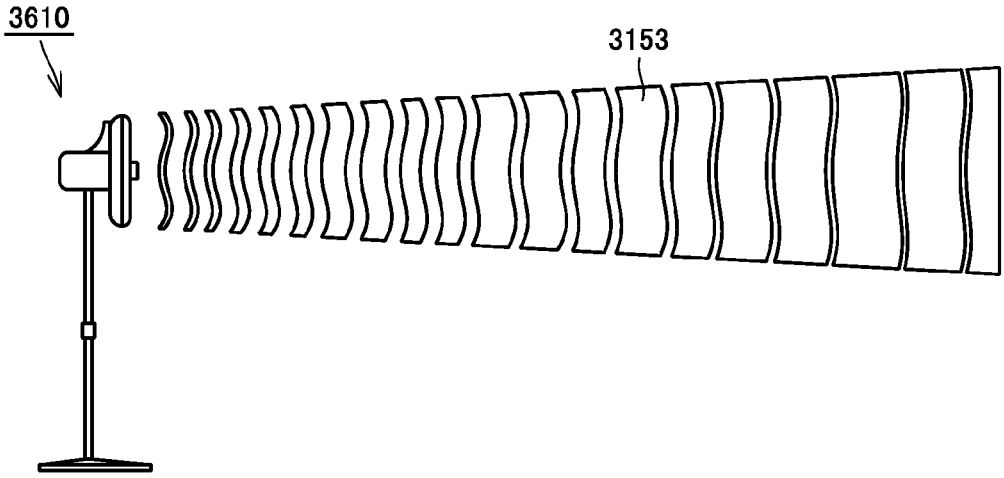

FIG. 153 is a diagram schematically showing a state of wind obtained at the time when a propeller fan is rotated at a high speed.

Figure 154:
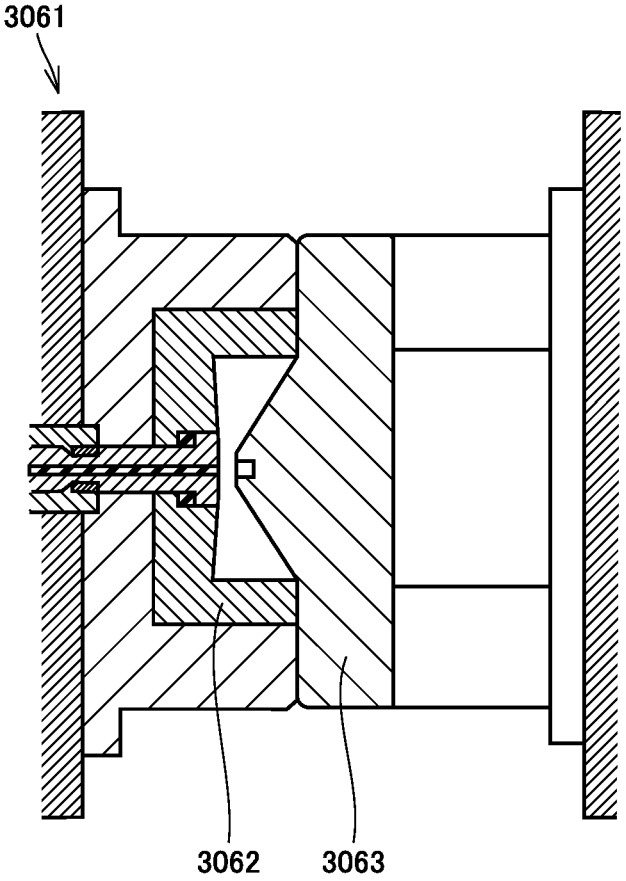

FIG. 154 is a cross-sectional view showing a molding die used for manufacturing of a propeller fan.

Figure 155:
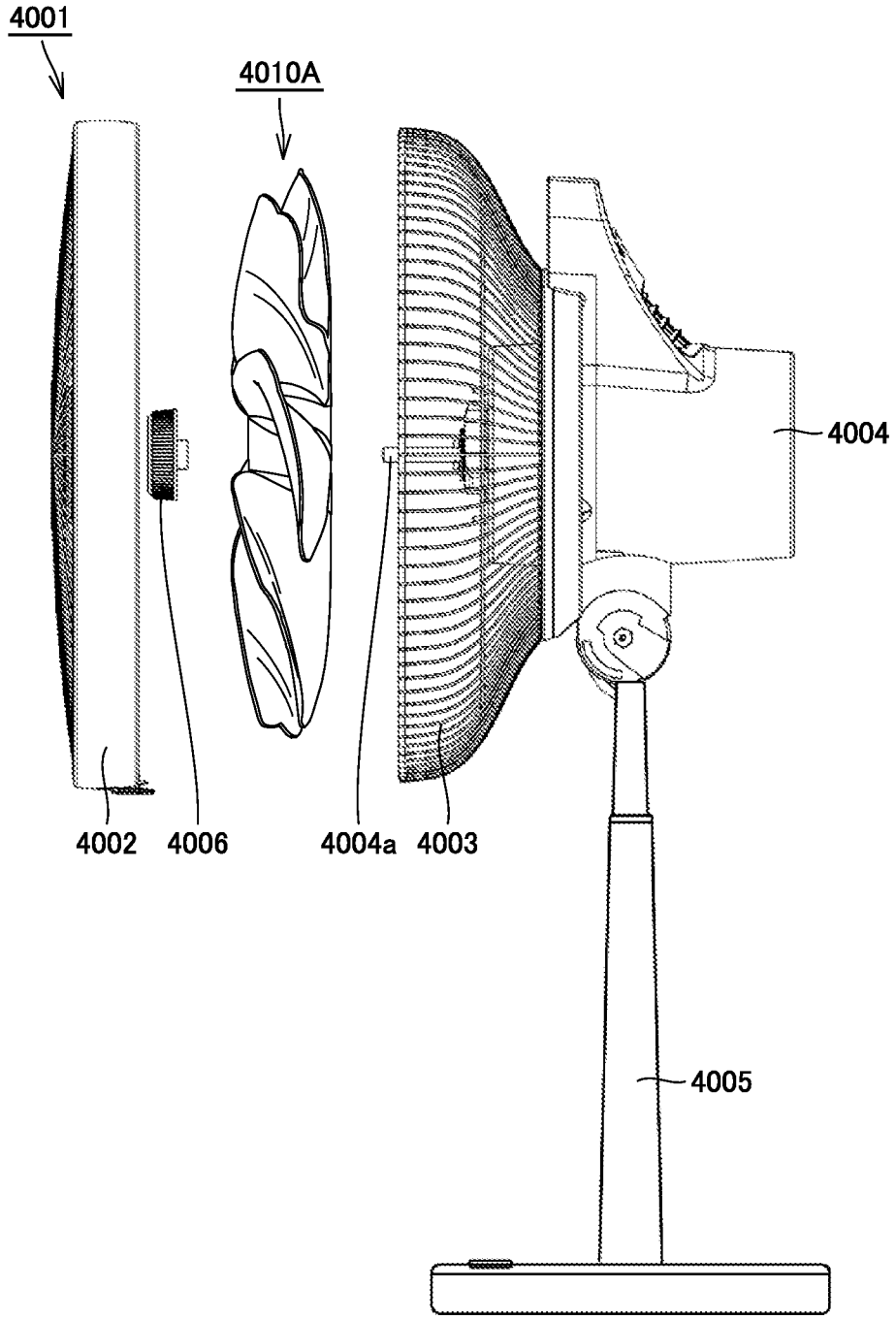

FIG. 155 is a partially exploded side view of an electric fan in an Embodiment D1 of the present invention.

Figure 156:
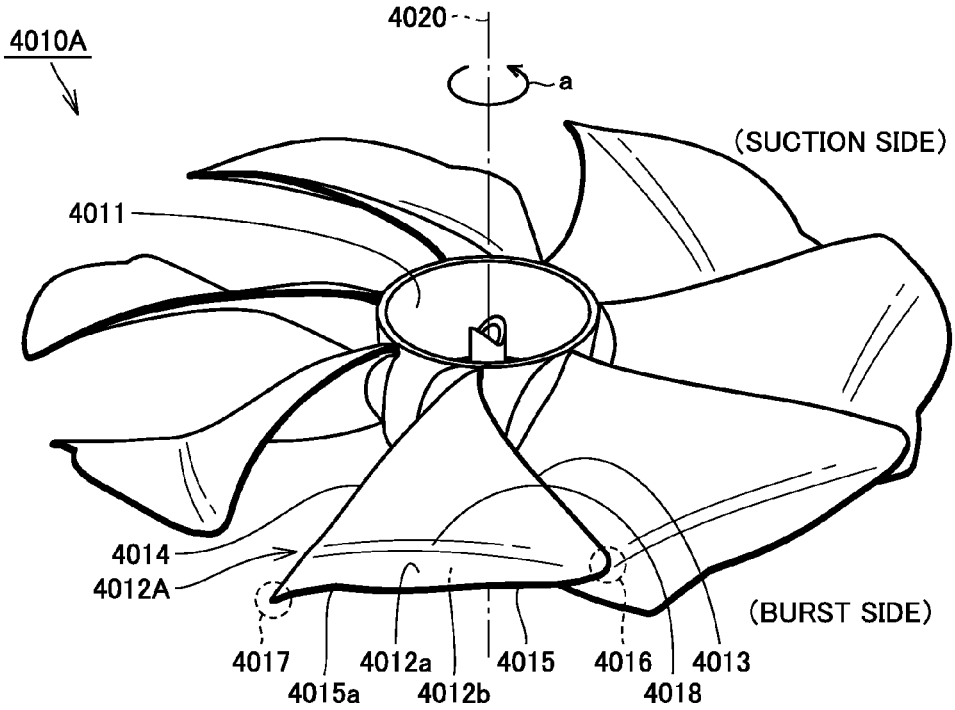

FIG. 156 is a perspective view of a propeller fan in Embodiment D1 of the present invention viewed from a rear surface side.

Figure 157:
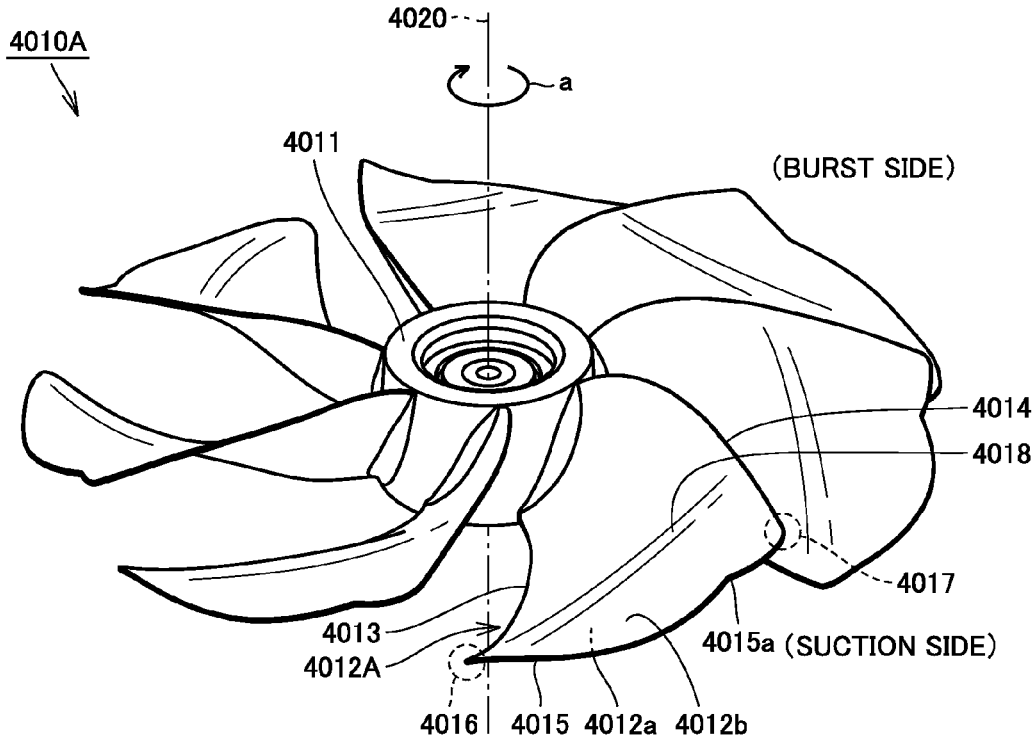

FIG. 157 is a perspective view of a propeller fan in Embodiment D1 of the present invention viewed from a front surface side.

Figure 158:
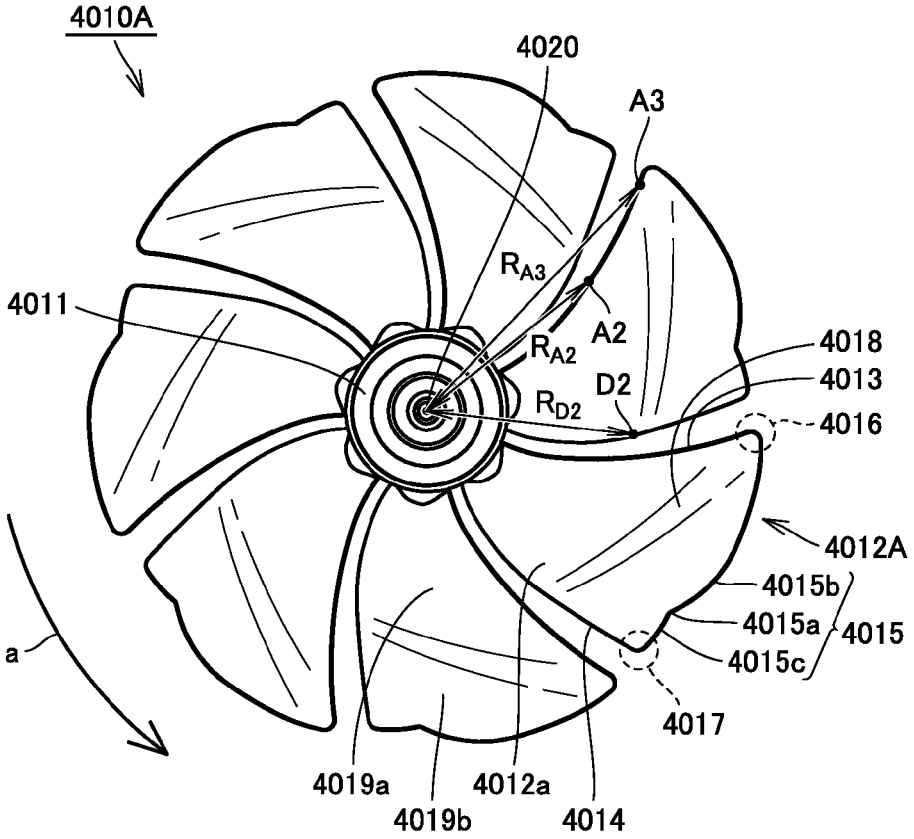

FIG. 158 is a rear view of the propeller fan in Embodiment D1 of the present invention.

Figure 159:
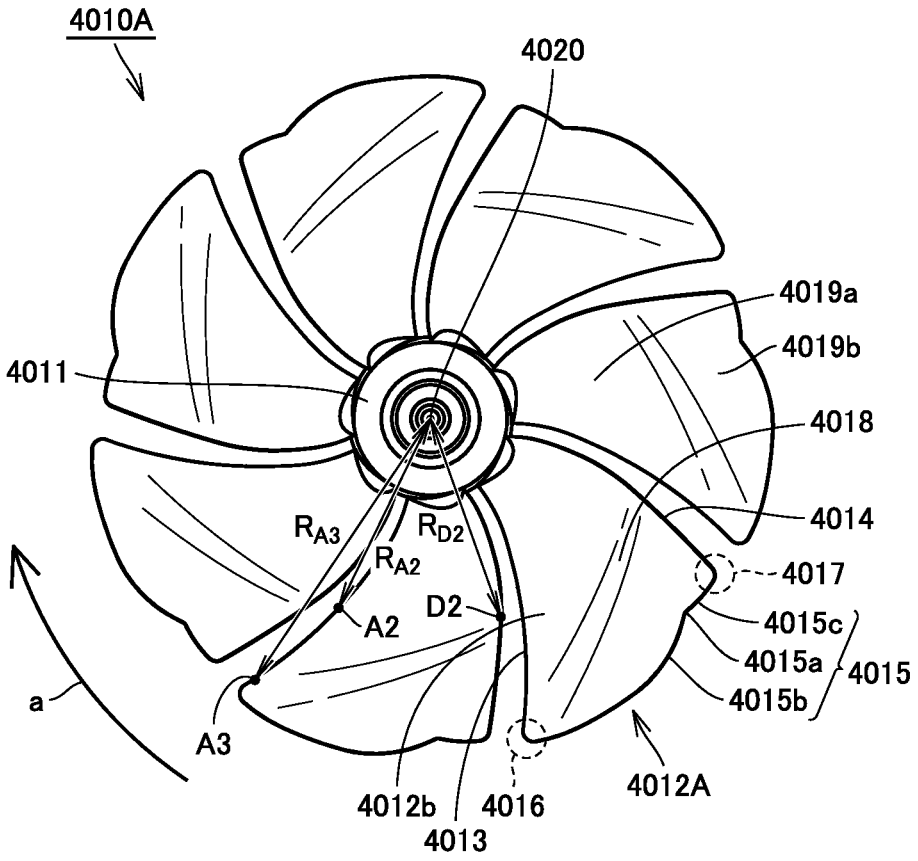

FIG. 159 is a front view of the propeller fan in Embodiment D1 of the present invention.

Figure 160:
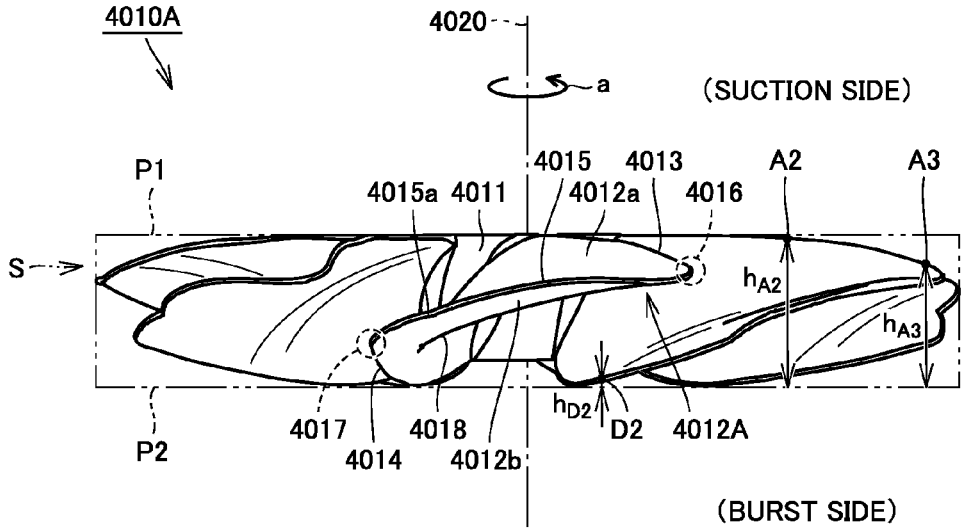

FIG. 160 is a side view of the propeller fan in Embodiment D1 of the present invention.

Figure 161:
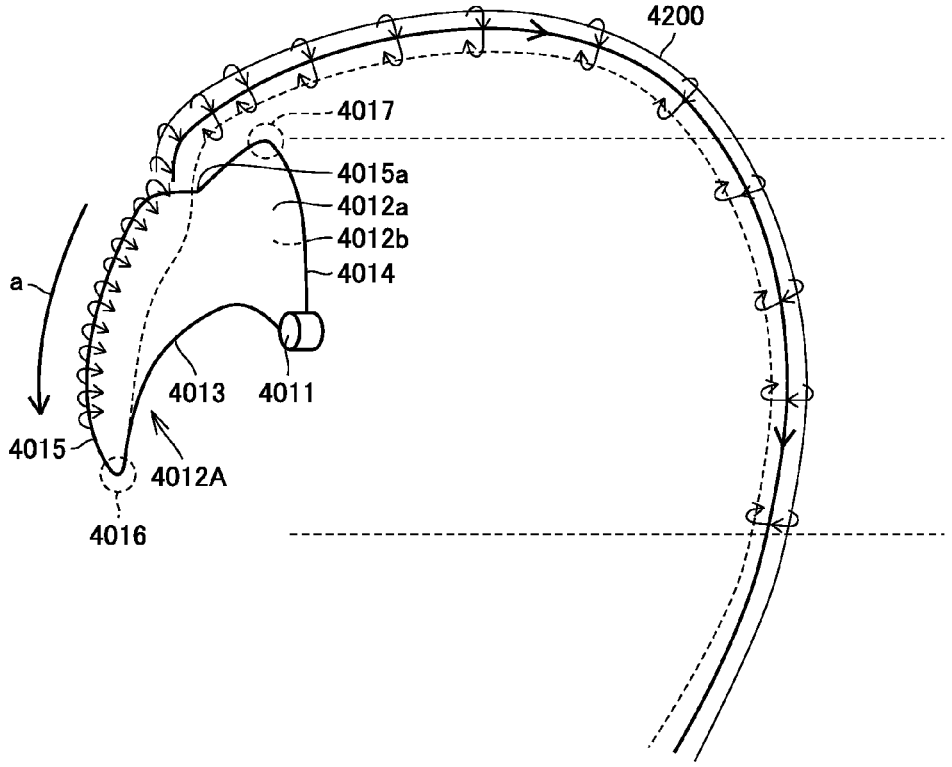

FIG. 161 is a conceptual view showing a flow of wind obtained at the time when the propeller fan is rotated at a low speed in the electric fan in Embodiment D1 of the present invention.

Figure 162:
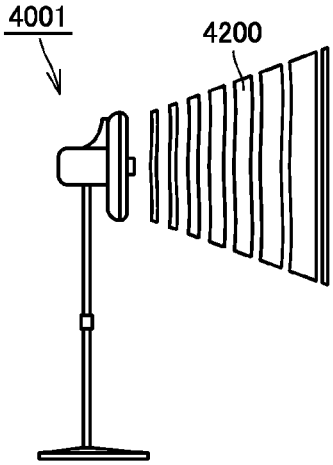

FIG. 162 is a diagram schematically showing a state of wind obtained at the time when the propeller fan is rotated at a low speed in the electric fan in Embodiment D1 of the present invention.

Figure 163:
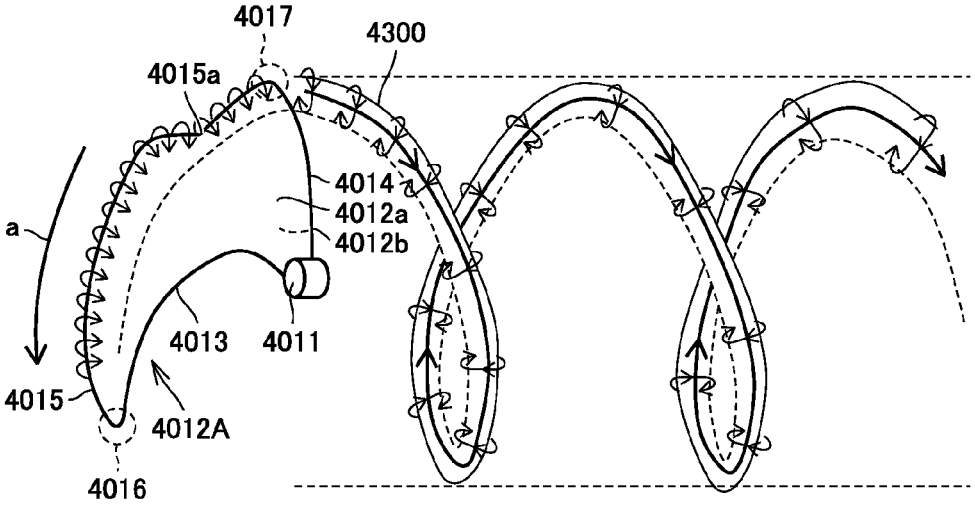

FIG. 163 is a conceptual view showing a flow of wind obtained at the time when the propeller fan is rotated at a high speed in the electric fan in Embodiment D1 of the present invention.

Figure 164:
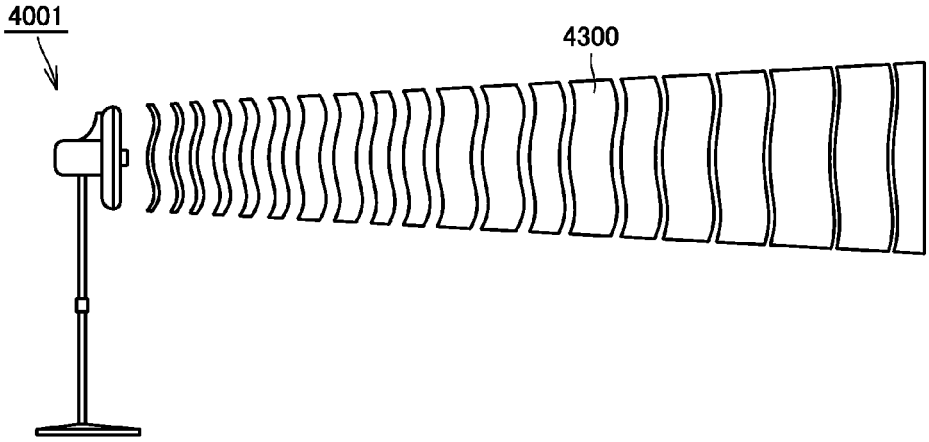

FIG. 164 is a diagram schematically showing a state of wind obtained at the time when the propeller fan is rotated at a high speed in the electric fan in Embodiment D1 of the present invention.

Figure 165:
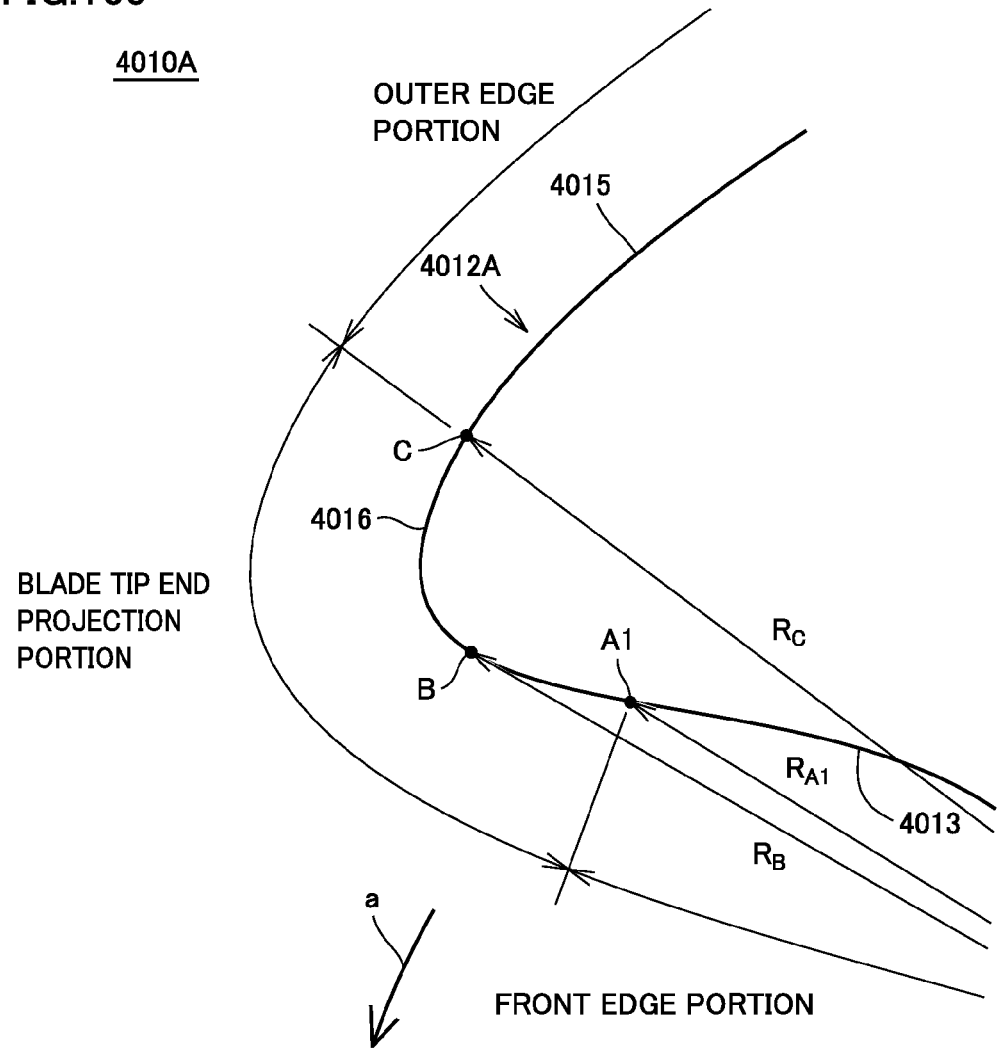

FIG. 165 is an enlarged rear view of a portion in the vicinity of a blade tip end projection portion of the propeller fan in Embodiment D1 of the present invention.

Figure 166:
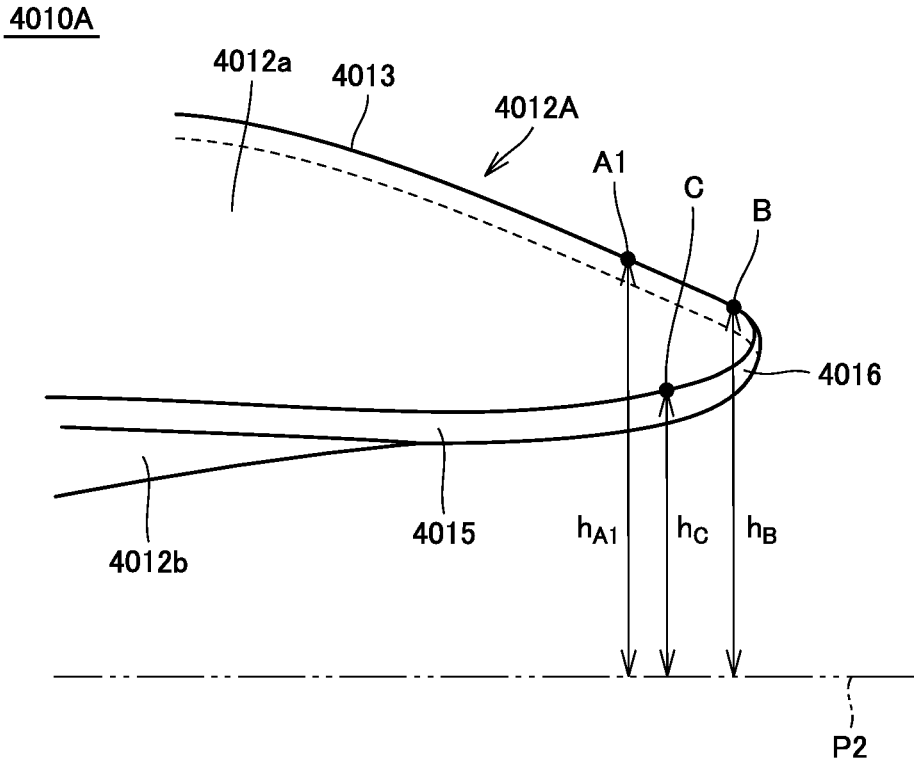

FIG. 166 is an enlarged side view of the portion in the vicinity of the blade tip end projection portion of the propeller fan in Embodiment D1 of the present invention.

Figure 167:
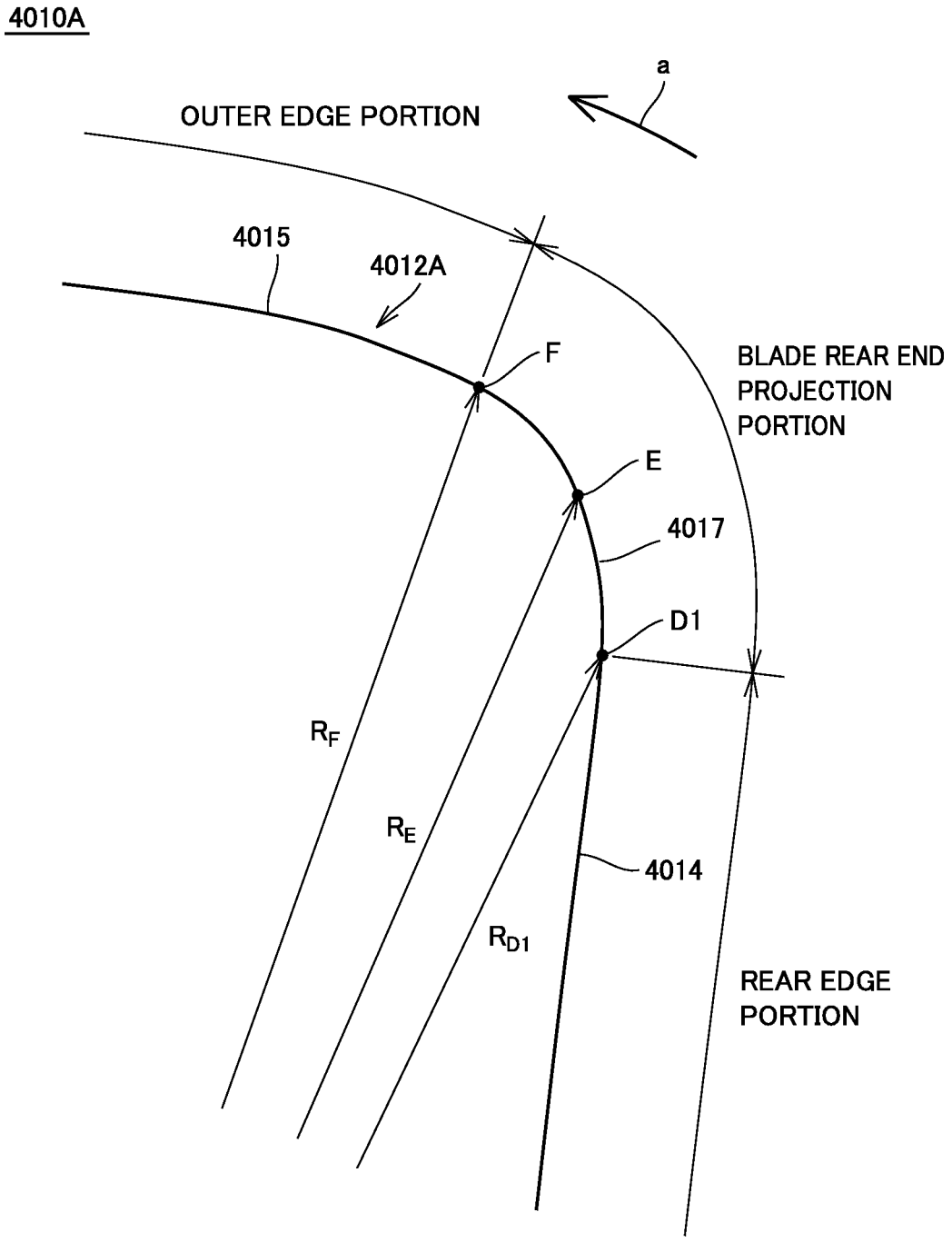

FIG. 167 is an enlarged rear view of a portion in the vicinity of a blade rear end projection portion of the propeller fan in Embodiment D1 of the present invention.

Figure 168:
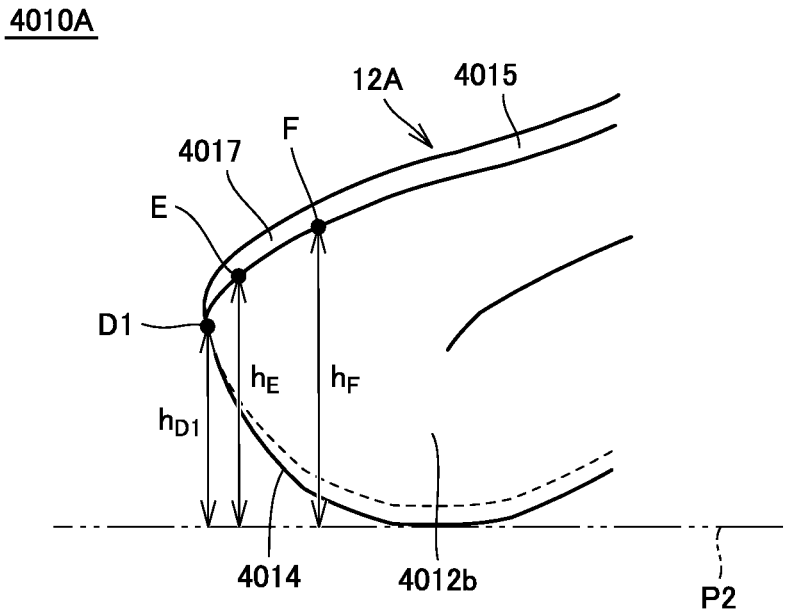

FIG. 168 is an enlarged side view of the portion in the vicinity of the blade rear end projection portion of the propeller fan in Embodiment D1 of the present invention.

Figure 169:
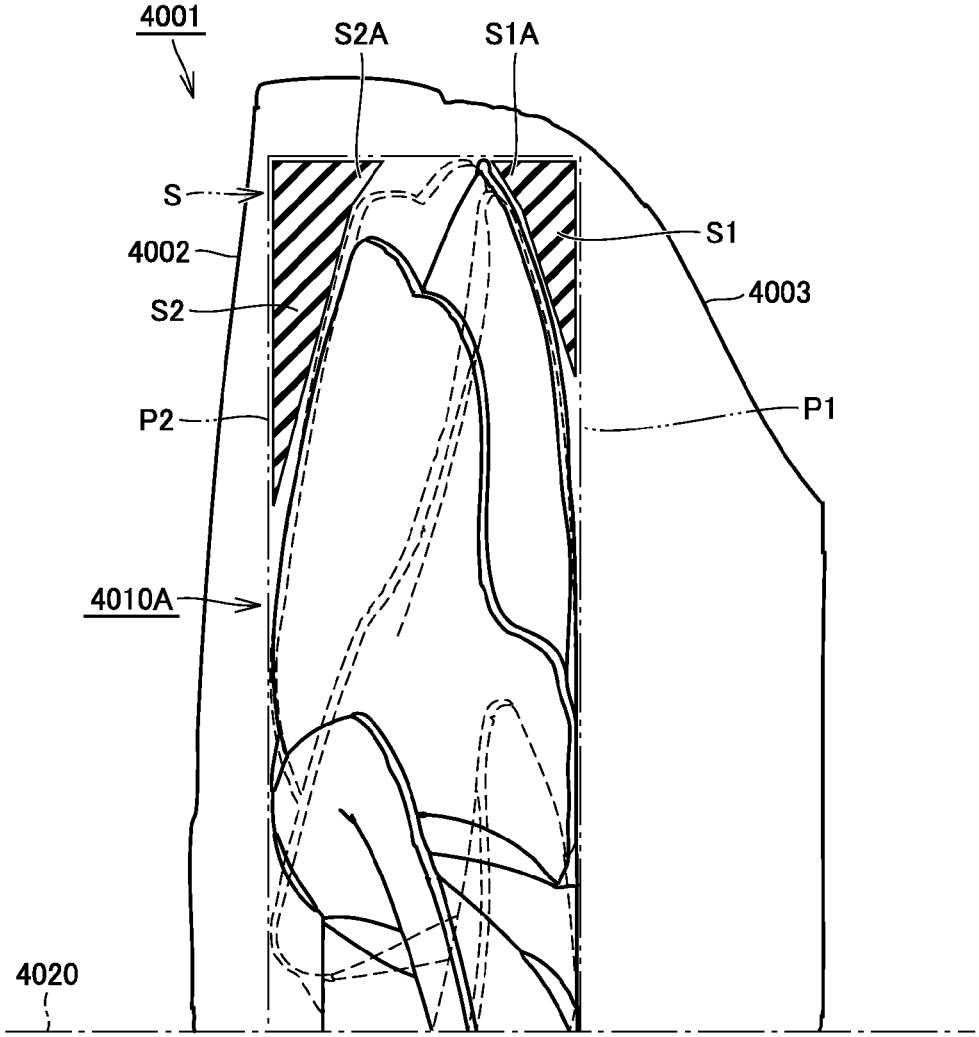

FIG. 169 is a diagram showing a trace of a blade when the propeller fan in Embodiment D1 of the present invention is rotated.

Figure 170:
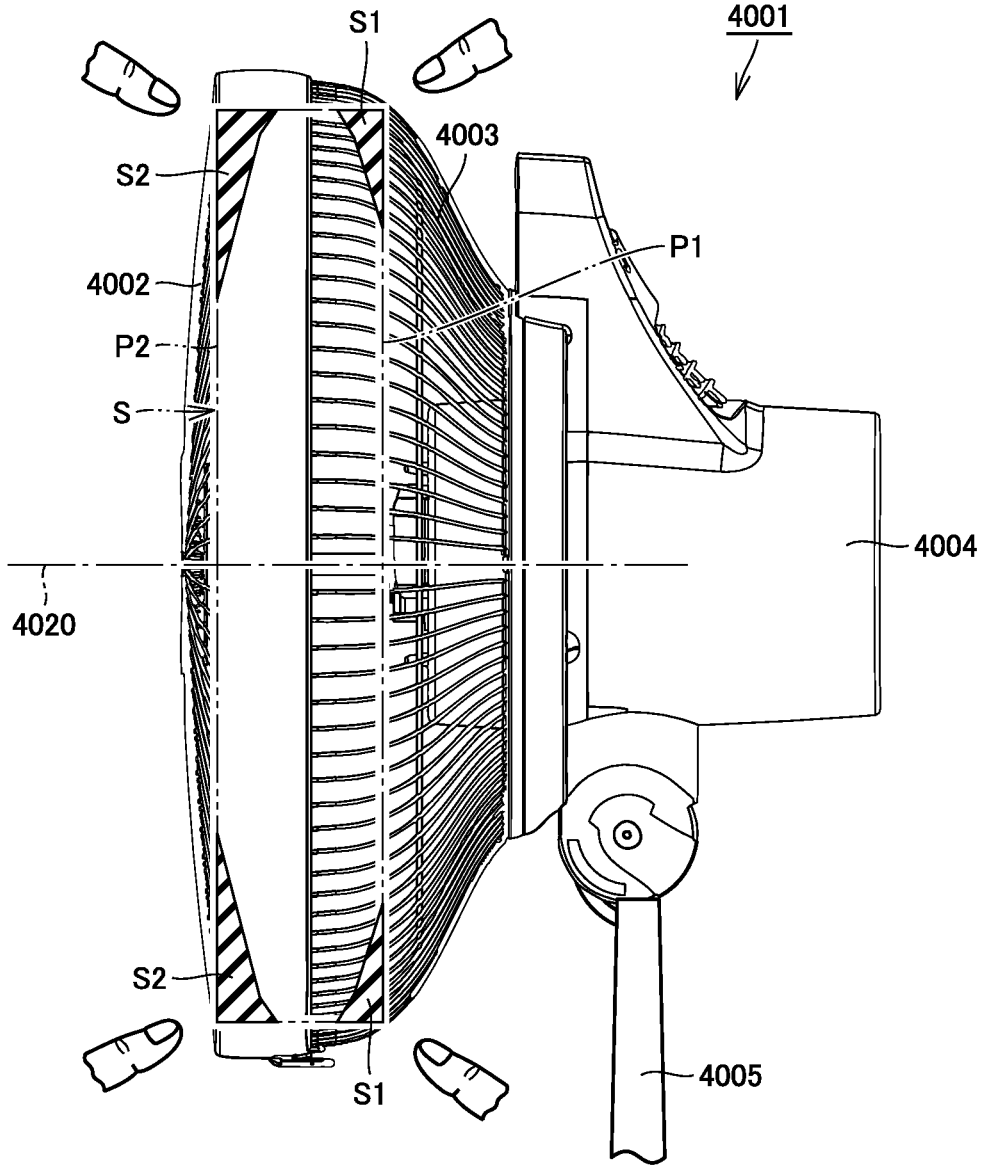

FIG. 170 is a diagram showing positional relation between a non-passage region and a guard of the propeller fan at the time when the propeller fan is rotated in the electric fan in Embodiment D1 of the present invention.

Figure 171:
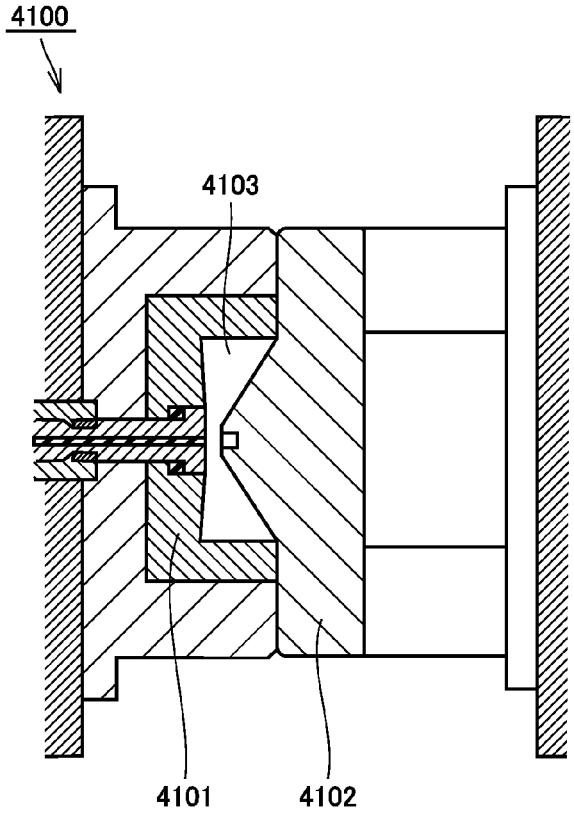

FIG. 171 is a schematic cross-sectional view showing a molding die for the propeller fan in Embodiment D1 of the present invention.

Figure 172:
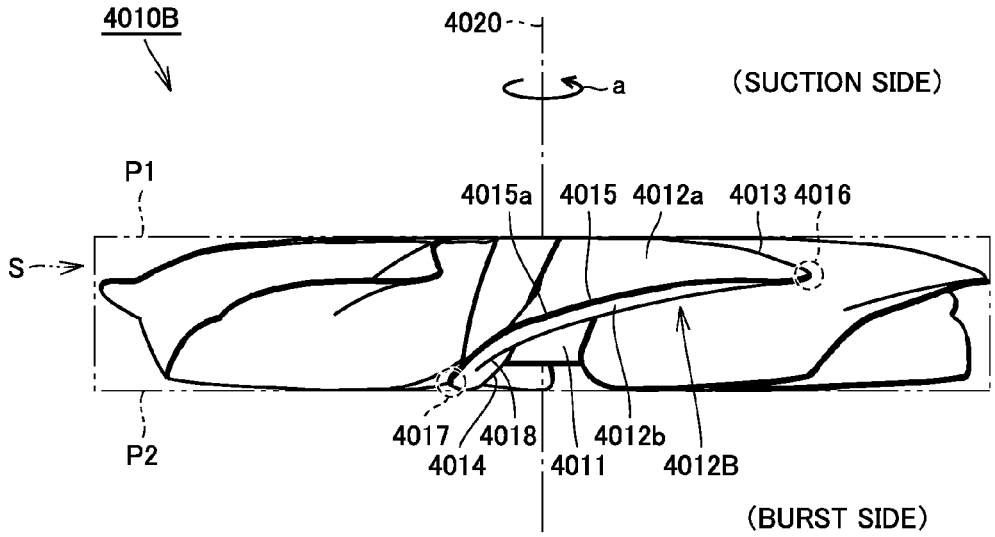

FIG. 172 is a side view of a propeller fan in an Embodiment D2 of the present invention.

Figure 173:
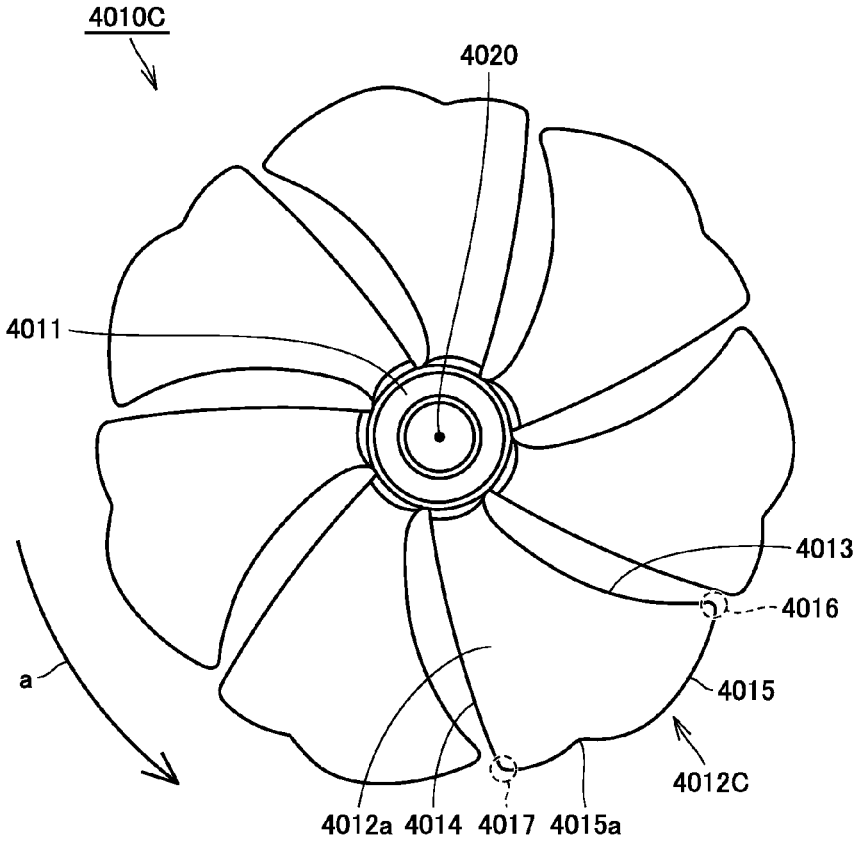

FIG. 173 is a rear view of a propeller fan in an Embodiment D3 of the present invention.

Figure 174:
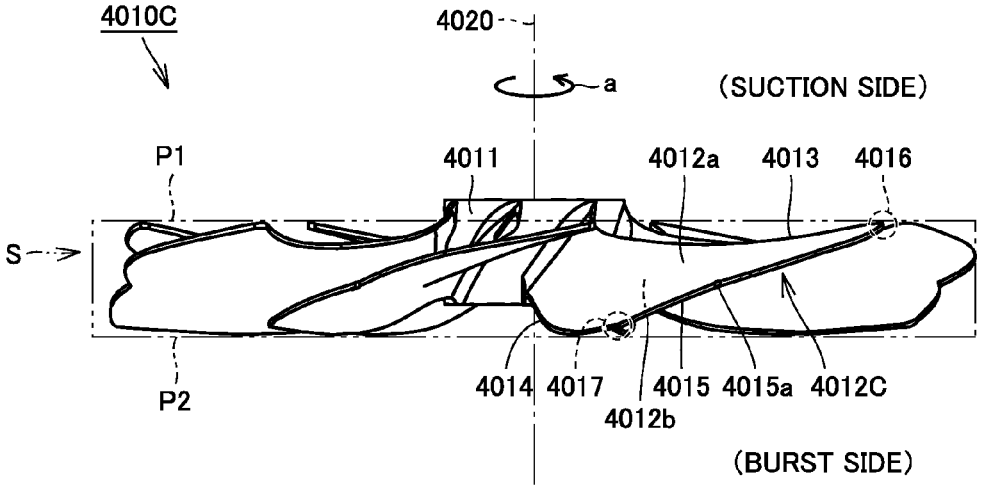

FIG. 174 is a side view of the propeller fan in Embodiment D3 of the present invention.

Figure 175:
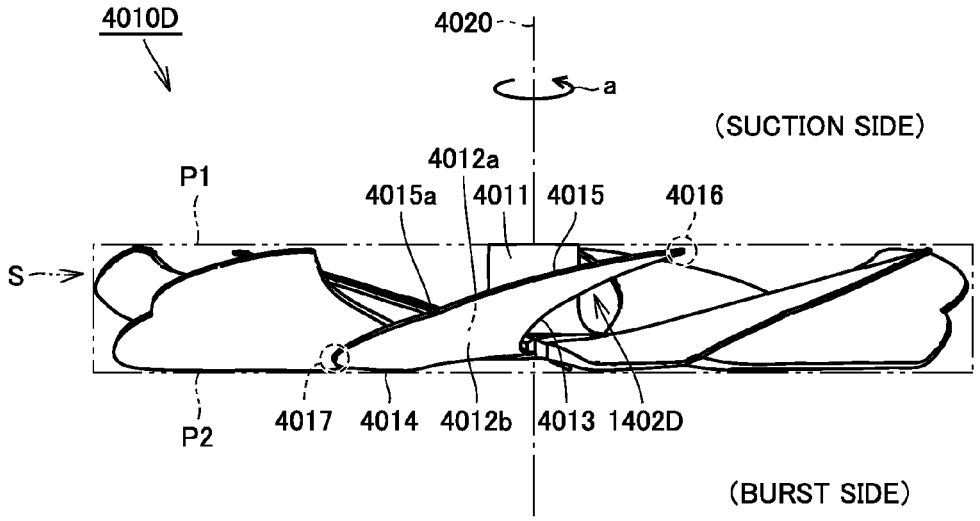

FIG. 175 is a side view of a propeller fan in an Embodiment D4 of the present invention.

Figure 176:
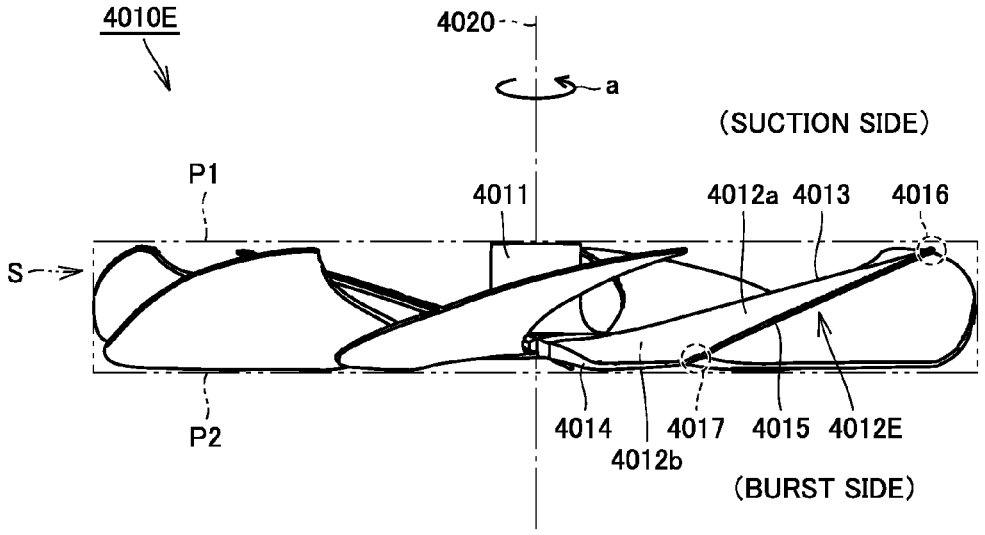

FIG. 176 is a side view of a propeller fan in an Embodiment D5 of the present invention.

Figure 177:
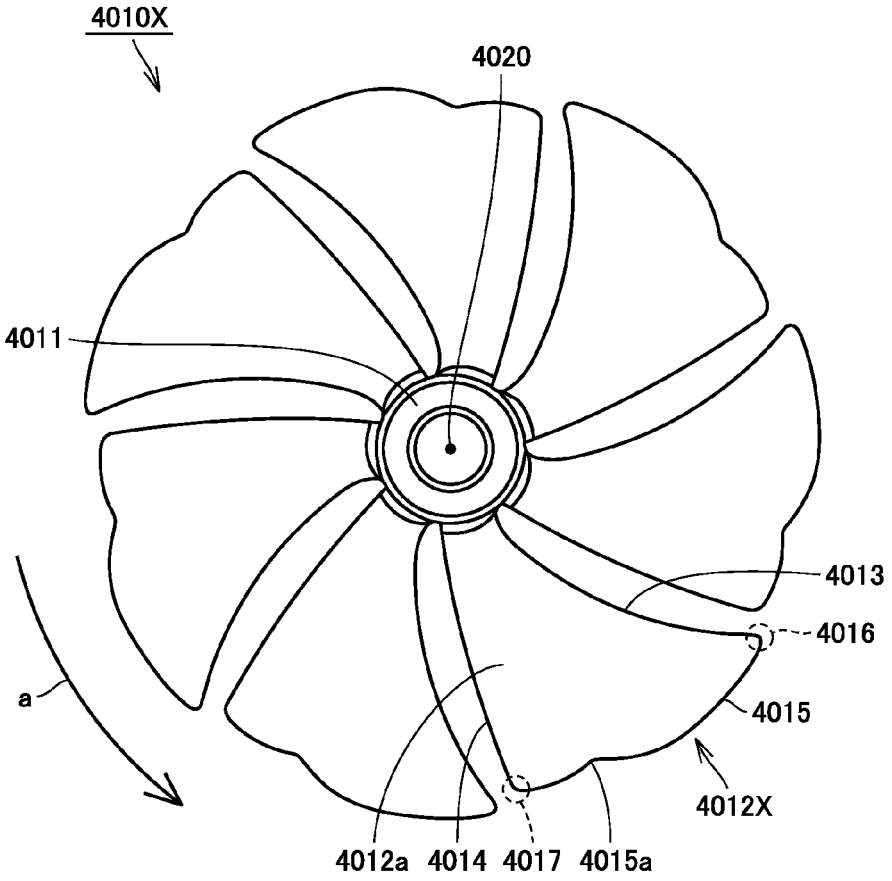

FIG. 177 is a rear view of a propeller fan according to a Comparative Example.

Figure 178:
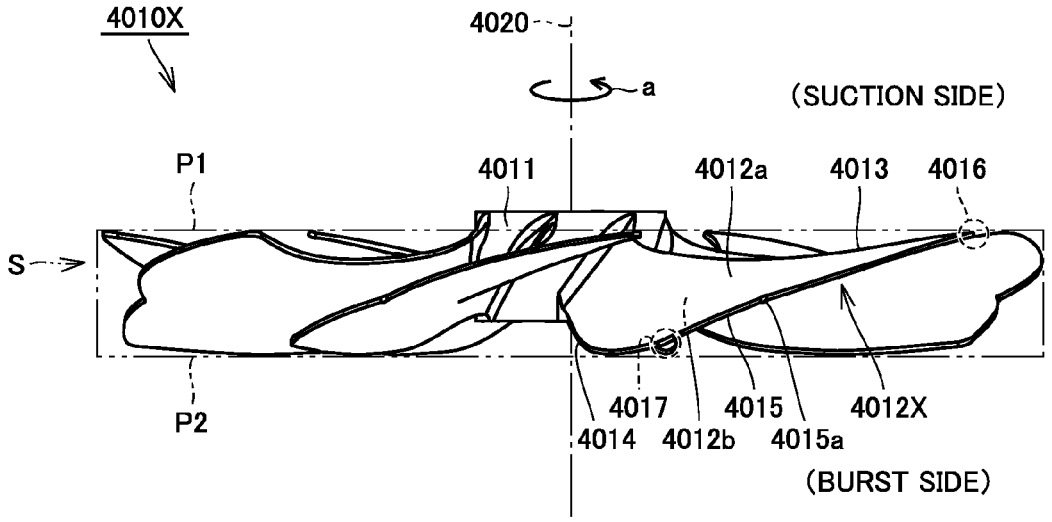

FIG. 178 is a side view of the propeller fan according to Comparative Example.

Figure 179:
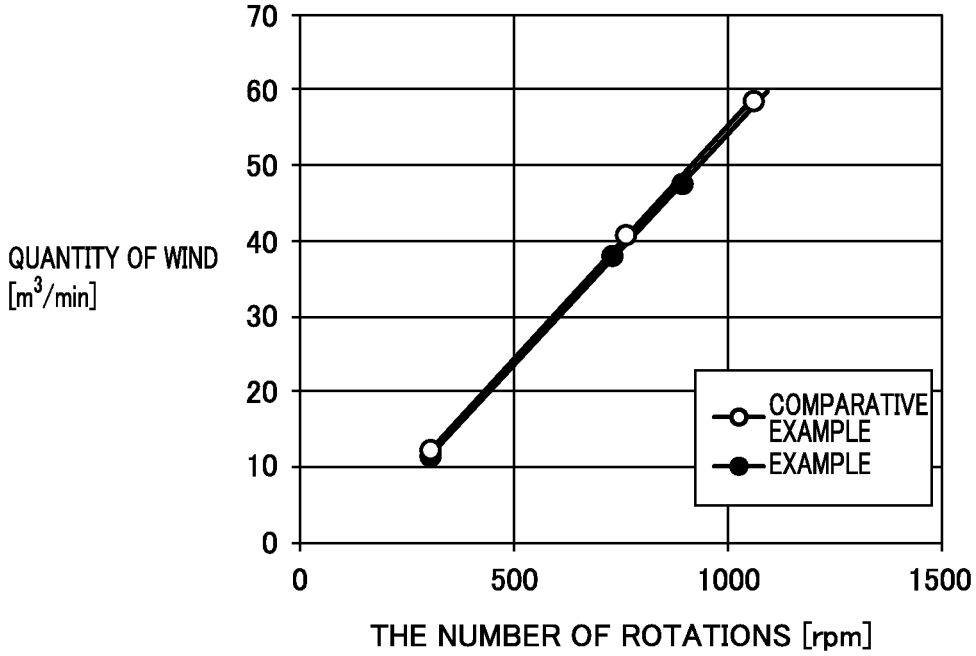

FIG. 179 is a graph showing relation between the number of rotations and a quantity of wind of the propeller fans according to an Example and Comparative Example.

Figure 180:
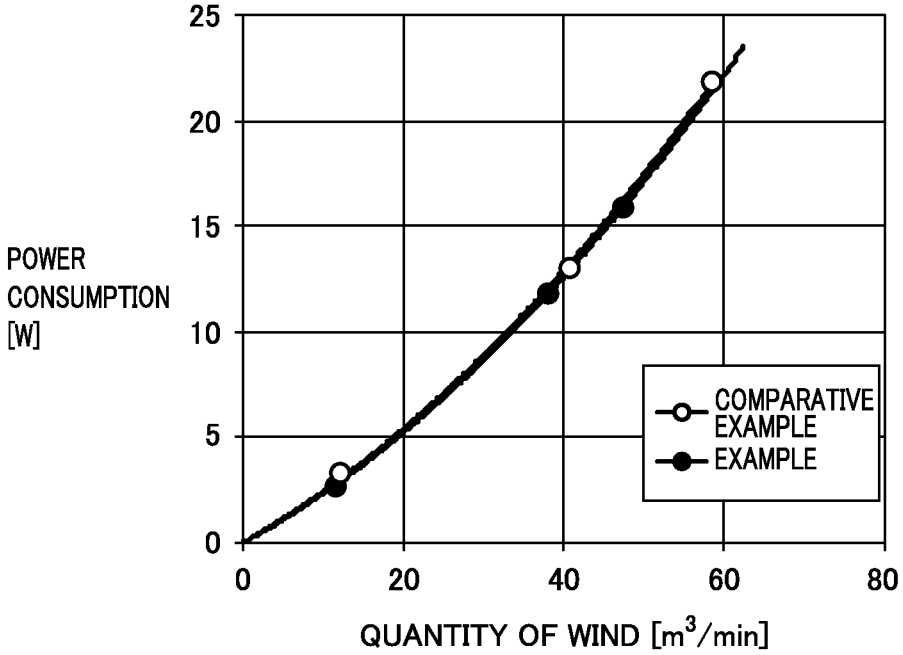

FIG. 180 is a graph showing relation between a quantity of wind and power consumption of the propeller fans according to Example and Comparative Example.

Figure 181:
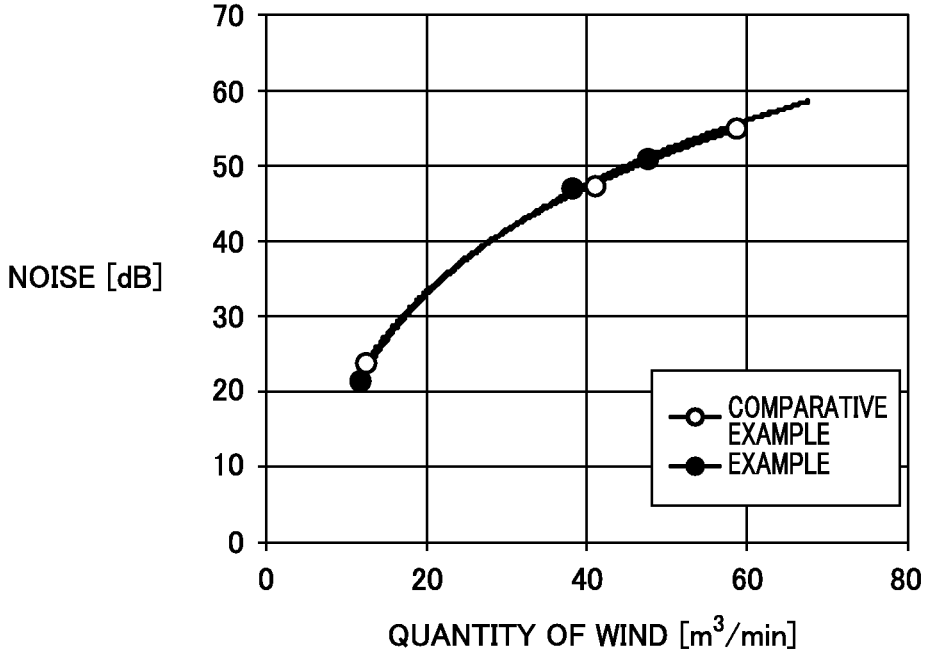

FIG. 181 is a graph showing relation between a quantity of wind and noise of the propeller fans according to Example and Comparative Example.

Figure 182:
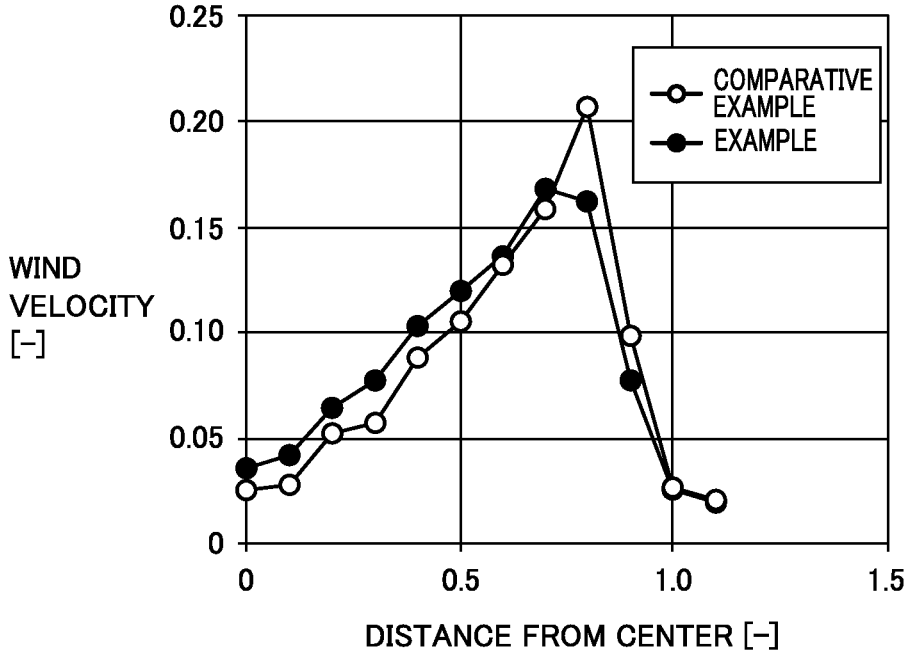

FIG. 182 is a graph showing relation between a distance from a center of rotation and a wind velocity of the propeller fans according to Example and Comparative Example.

DESCRIPTION OF EMBODIMENTS

An embodiment of the present invention will be described hereinafter in detail with reference to the drawings. In the embodiment shown below, the same or common elements have the same reference characters allotted in the drawings and description thereof will not be repeated.

Embodiment A1

Figure 1:
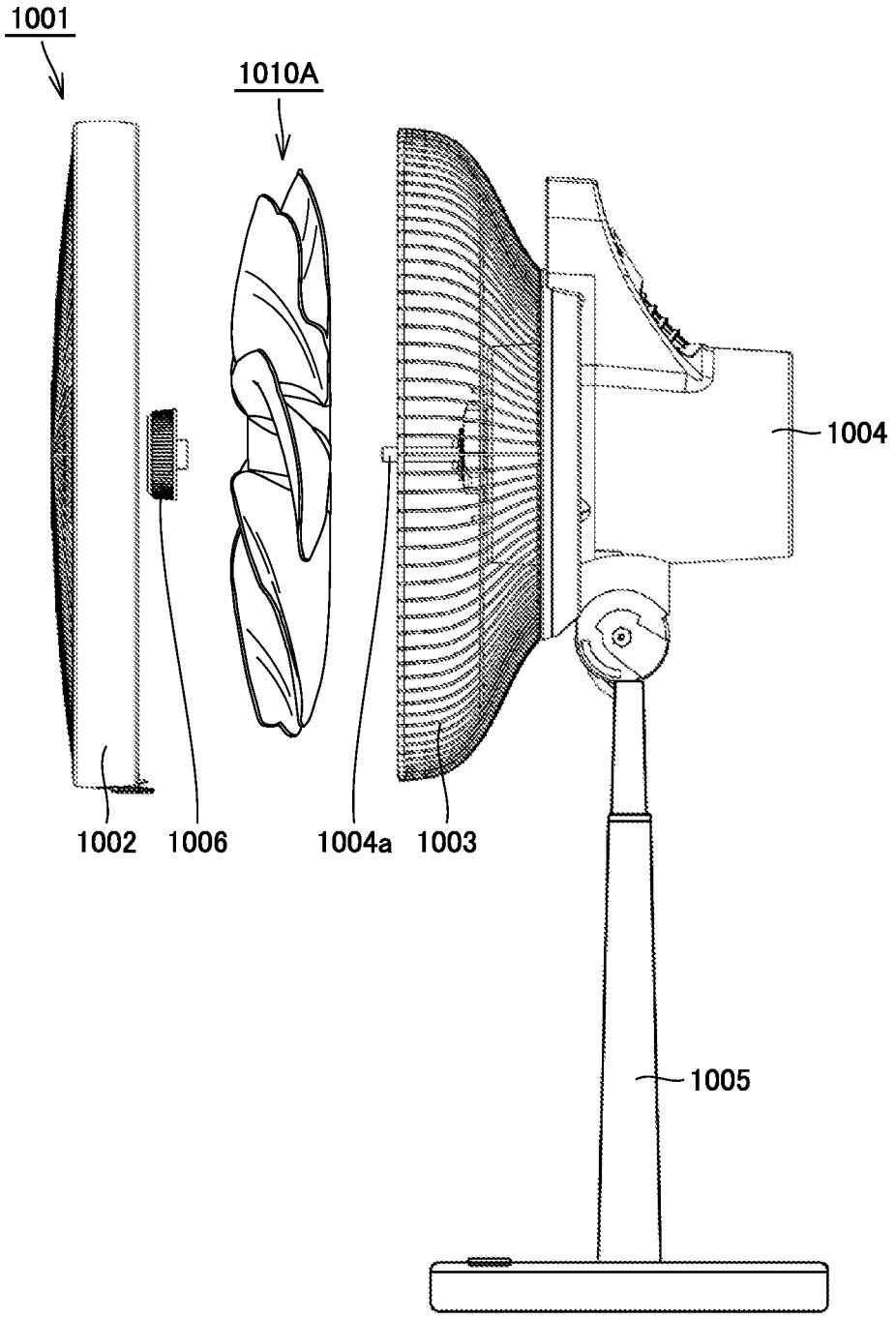
FIG. 1 is a partially exploded side view of an electric fan in an Embodiment A1 of the present invention.

FIG. 1 is a partially exploded side view of an electric fan in an Embodiment A1 of the present invention. Initially, referring to FIG. 1, an electric fan 1001 as a fluid feeder in the present embodiment will be described.

As shown in FIG. 1, electric fan 1001 mainly includes a front guard 1002, a rear guard 1003, a main body portion 1004, a stand 1005, and a propeller fan 1010A.

Main body portion 1004 is supported by stand 1005 and accommodates a not-shown drive motor. On a front surface of main body portion 1004, a rotation shaft 1004*a* of the drive motor is located as being exposed, and a boss hub portion 1011 (see FIG. 2 or the like) serving as a rotation shaft portion of propeller fan 1010A which will be described later is fixed to this rotation shaft 1004*a* with a screw cap 1006.

Front guard 1002 and rear guard 1003 are provided to surround propeller fan 1010A fixed to main body portion 1004. More specifically, rear guard 1003 is fixed to main body portion 1004 so as to cover a rear surface side of propeller fan 1010A, and front guard 1002 is fixed to rear guard 1003 so as to cover a front surface side of propeller fan 1010A.

Stand 1005 is provided to place electric fan 1001 on a floor surface and supports main body portion 1004. At a prescribed position of stand 1005, a not-shown operation portion for turning on/off electric fan 1001 or switching between operation states thereof is provided.

Main body portion 1004 and stand 1005 are preferably coupled such that main body portion 1004 can swing in a horizontal plane and a vertical plane for an oscillation function of electric fan 1001.

Stand 1005 is preferably constructed telescopically in a vertical direction such that electric fan 1001 has a height adjustment function.

Figure 2:
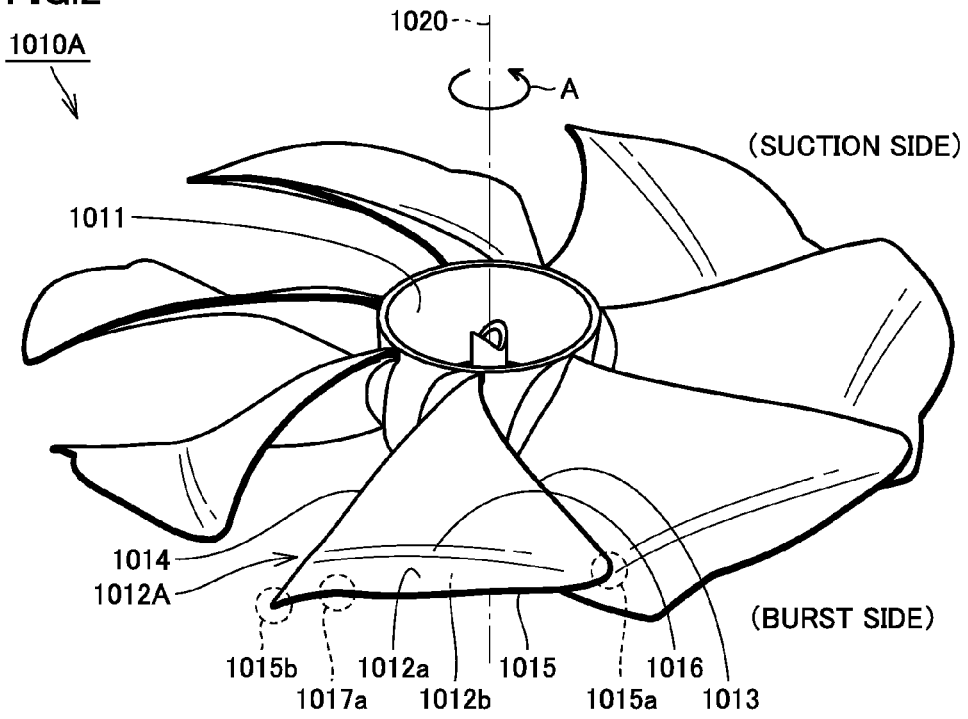
FIG. 2 is a perspective view of a propeller fan in Embodiment A1 of the present invention viewed from a rear surface side.
Figure 3:
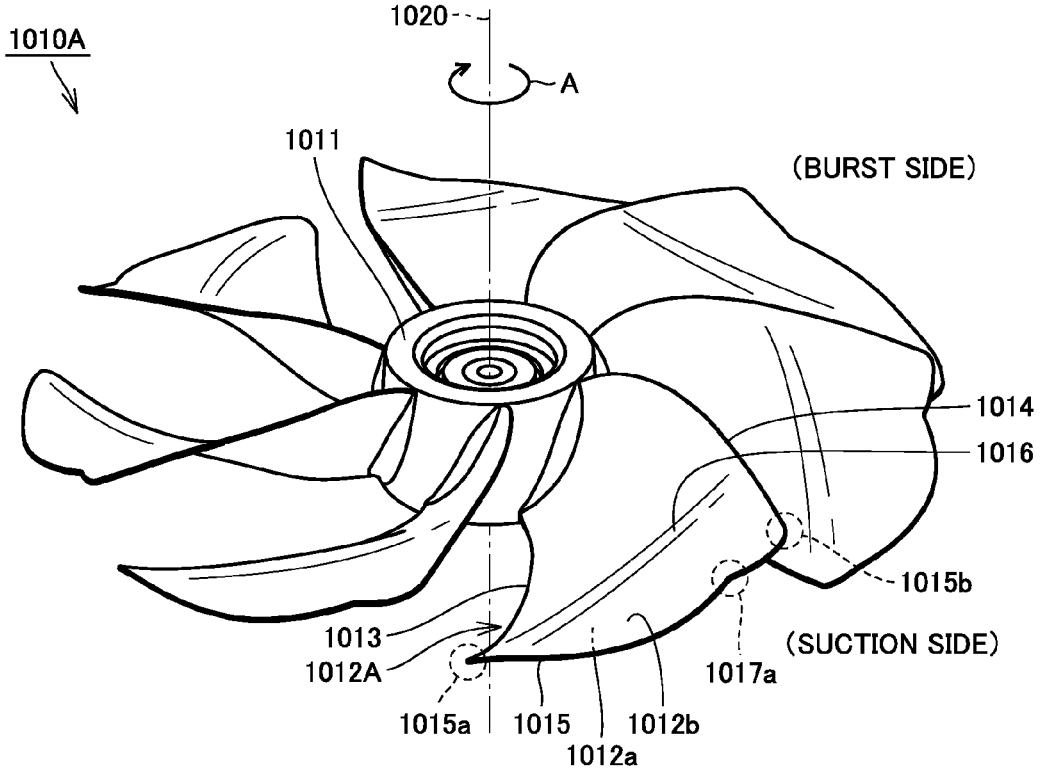
FIG. 3 is a perspective view of the propeller fan in Embodiment A1 of the present invention viewed from a front surface side.
Figure 4:
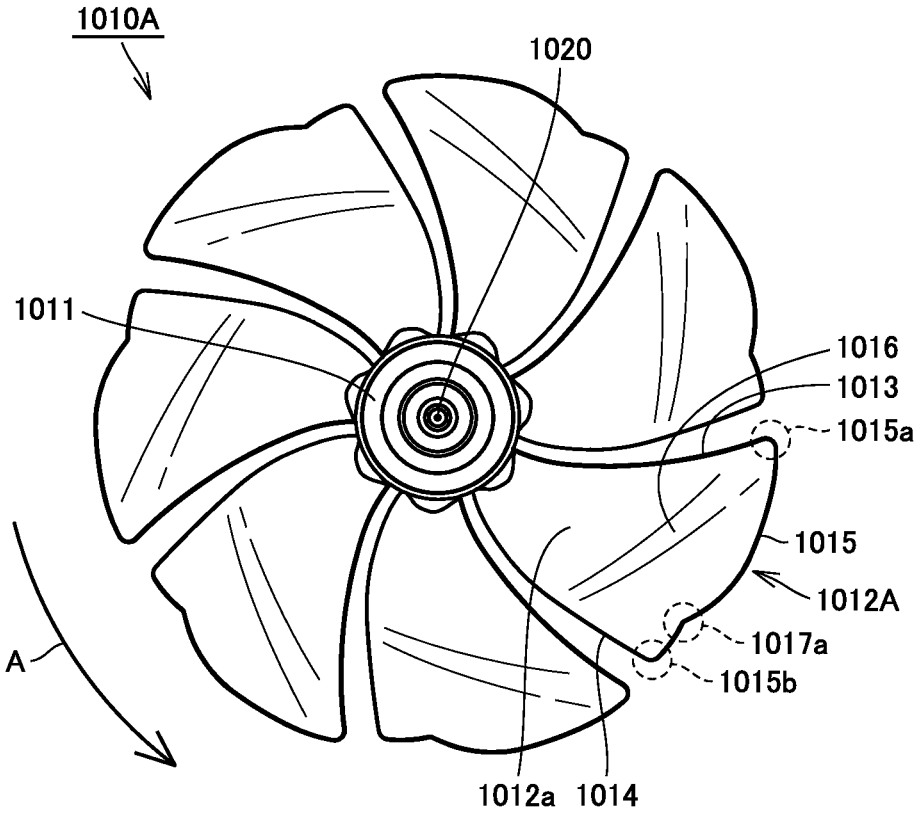
FIG. 4 is a rear view of the propeller fan in Embodiment A1 of the present invention.
Figure 5:
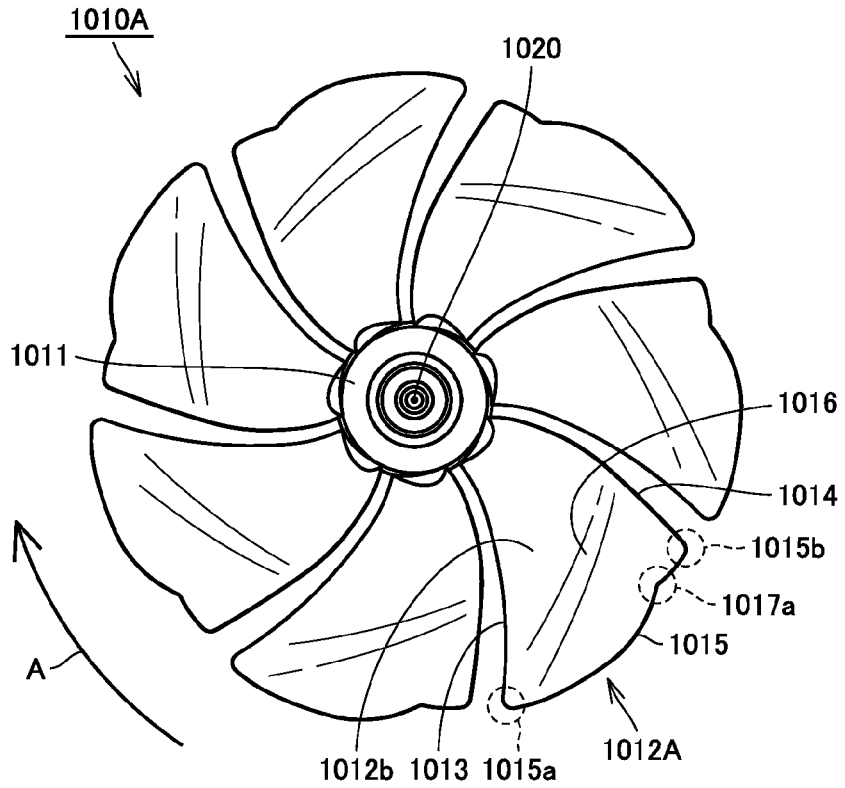
FIG. 5 is a front view of the propeller fan in Embodiment A1 of the present invention.
Figure 6:
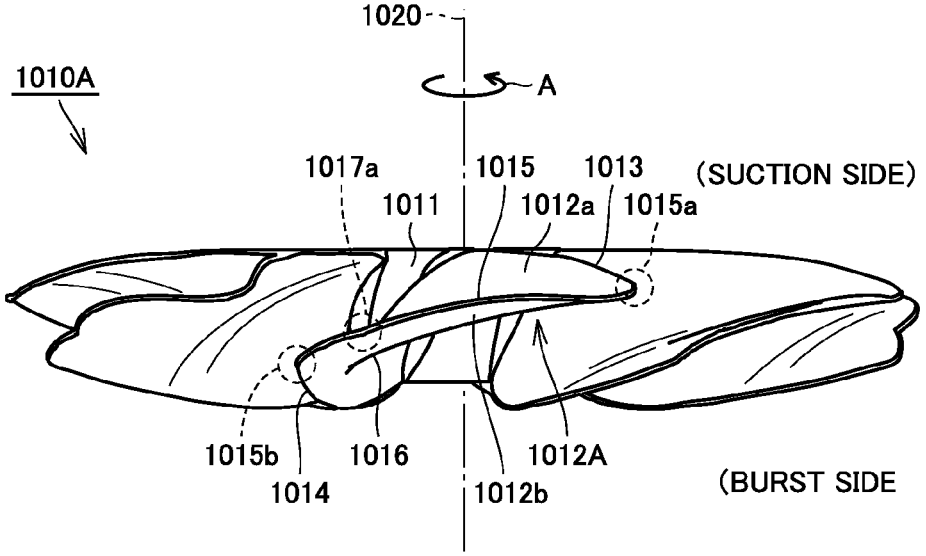
FIG. 6 is a side view of the propeller fan in Embodiment A1 of the present invention.

FIGS. 2 and 3 are perspective views when the propeller fan in the present embodiment is viewed from the rear surface side and the front surface side, respectively, and FIGS. 4 to 6 are a rear view, a front view, and a side view of the propeller fan in the present embodiment, respectively. A basic structure of propeller fan 1010A in the present embodiment will now be described with reference to these FIGS. 2 to 6.

As shown in FIGS. 2 to 6, propeller fan 1010A includes boss hub portion 1011 described above as the rotation shaft portion and a plurality of plate-shaped blades 1012A formed as being smoothly curved. Boss hub portion 1011 has a substantially cylindrical shape having a bottom, and each of the plurality of blades 1012A projects radially outward from an outer circumferential surface of boss hub portion 1011 for alignment along a circumferential direction of boss hub portion 1011.

Propeller fan 1010A in the present embodiment has seven blades, and is formed from a resin molded product in which boss hub portion 1011 and seven blades 1012A are integrally molded with a synthetic resin such as an AS (acrylonitrile-styrene) resin.

With drive by the drive motor described above, boss hub portion 1011 rotates in a direction shown with an arrow A in the figure, with a virtual central axis 1020 being defined as a center of rotation. Thus, entire propeller fan 1010A rotates in the direction shown with arrow A in the figure with central axis 1020 described above being defined as the center of rotation, and the plurality of blades 1012A provided as being aligned in the circumferential direction of boss hub portion 1011 also rotate around central axis 1020 described above.

With rotation of the plurality of blades 1012A, air flows from a suction side which is the rear surface side of propeller fan 1010A toward a burst side which is the front surface side of propeller fan 1010A, and wind is sent forward of electric fan 1001.

Here, in the present embodiment, the plurality of blades 1012A are arranged at regular intervals as being spaced apart from one another in the direction of rotation, and the plurality of blades 1012A are identical in shape. Therefore, when any blade 1012A is rotated with central axis 1020 being defined as the center of rotation, that blade 1012A and another blade 1012A will match in shape.

Blade 1012A includes a front edge portion 1013 located on a front side in the direction of rotation of propeller fan

1010A, a rear edge portion 1014 located on a rear side in the direction of rotation of propeller fan 1010A, and an outer edge portion 1015 extending along the direction of rotation of propeller fan 1010A. Namely, in a plan view of propeller fan 1010A along central axis 1020, an outer shape of blade 1012A is defined by front edge portion 1013, rear edge portion 1014, and outer edge portion 1015 except for a portion connected to boss hub portion 1011.

Front edge portion 1013 and rear edge portion 1014 extend radially outward from boss hub portion 1011. In a plan view of propeller fan 1010A along central axis 1020, front edge portion 1013 and rear edge portion 1014 have a generally arc shape as a whole such that they are located gradually toward the front in the direction of rotation, generally from a radially inner side toward an outer side.

Here, when a plane orthogonal to central axis 1020 is assumed on the burst side of blade 1012A and a length in the axial direction of central axis 1020 from that plane is defined as a height, front edge portion 1013 includes a site having a constant height between an inner end thereof and a position distant radially outward from the inner end.

More specifically, when an end surface on the suction side in such a two-dimensional shape as including a site of blade 1012A outermost on the suction side along a direction of extension of central axis 1020 and is orthogonal to central axis 1020 is assumed, a portion closer to the radially inner side which continues to boss hub portion 1011 of front edge portion 1013 extends as overlapping with the end surface on the suction side. In other words, a portion closer to a radially outer side of front edge portion 1013 does not overlap with the end surface on the suction side, but it is provided closer to the burst side relative to the end surface on the suction side as a whole.

When a plane orthogonal to central axis 1020 is assumed on the burst side of blade 1012A and a length in the axial direction of central axis 1020 from that plane is defined as a height, a radially outer portion including an outer end of rear edge portion 1014 is constructed to increase in height from the radially inner side toward the radially outer side.

In other words, when an end surface on the burst side in such a two-dimensional shape as including a site of blade 1012A outermost on the burst side in the direction of extension of central axis 1020 and is orthogonal to central axis 1020 is assumed, rear edge portion 1014 is constructed to be distant from the end surface on the burst side toward the radially outer side. Namely, the portion closer to the radially outer side of rear edge portion 1014 does not overlap with the end surface on the burst side but is provided closer to the suction side relative to the end surface on the burst side as a whole.

In a radially inner portion of front edge portion 1013 and rear edge portion 1014, blade 1012A is constructed to be smaller in width along the direction of rotation, and in a radially outer portion of front edge portion 1013 and rear edge portion 1014, blade 1012A is constructed to be greater in width along the direction of rotation.

An outer end located on the radially outer side of front edge portion 1013 is connected to a front end 1015*a* in the direction of rotation of outer edge portion 1015, and an outer end located on the radially outer side of rear edge portion 1014 is connected to a rear end 1015*b* in the direction of rotation of outer edge portion 1015. Namely, outer edge portion 1015 is constructed to connect the outer end of front edge portion 1013 and the outer end of rear edge portion 1014 to each other along the direction of rotation and it has a generally arc shape as a whole.

Outer edge portion 1015 is located such that its entirety is distant from the end surface on the suction side along the direction of extension of central axis 1020 and such that its entirety is distant from the end surface on the burst side along the direction of extension of central axis 1020. Namely, outer edge portion 1015 does not overlap with the end surface on the suction side and the end surface on the burst side at any position, but it is provided inward relative to the end surface on the suction side and the end surface on the burst side as a whole.

As described above, front edge portion 1013 and rear edge portion 1014 are in a smooth shape as they are both formed to have a generally arc shape. As described above, outer edge portion 1015 is also in a smooth shape as it is formed to have a substantially arc shape. Therefore, front end 1015*a* and rear end 1015*b* of outer edge portion 1015 described above have a relative maximum curvature at least around the same.

Front end 1015*a* of outer edge portion 1015 described above has a shape pointed like a sickle in a plan view of propeller fan 1010A along central axis 1020. This front end 1015 pointed like a sickle is arranged at a position foremost in blade 1012A in the direction of rotation. Since front edge portion 1013 and outer edge portion 1015 located in the vicinity of front end 1015*a* are portions located forward in the direction of rotation, they correspond to a blade tip end portion where a blade tip end vortex is generated.

In blade 1012A, a blade surface for sending wind (that is, sending air from the suction side to the burst side) with rotation of propeller fan 1010A is formed. The blade surface is constituted of a negative pressure surface 1012*a* corresponding to a rear surface of blade 1012A located on the suction side and a positive pressure surface 1012*b* corresponding to a front surface of blade 1012A located on the burst side, and these are both formed from a region surrounded by front edge portion 1013, rear edge portion 1014, and outer edge portion 1015 described above.

Negative pressure surface 1012*a* and positive pressure surface 1012*b* which are blade surfaces are both formed from a curved surface inclined from the burst side toward the suction side of propeller fan 1010A, from rear edge portion 1014 toward front edge portion 1013 along the direction of rotation of propeller fan 1010A. Thus, during rotation of propeller fan 1010A, as a flow of air is generated over the blade surface, such pressure distribution that a pressure is relatively high over positive pressure surface 1012*b* and a pressure is relatively low over negative pressure surface 1012*a* is generated.

Figure 7:
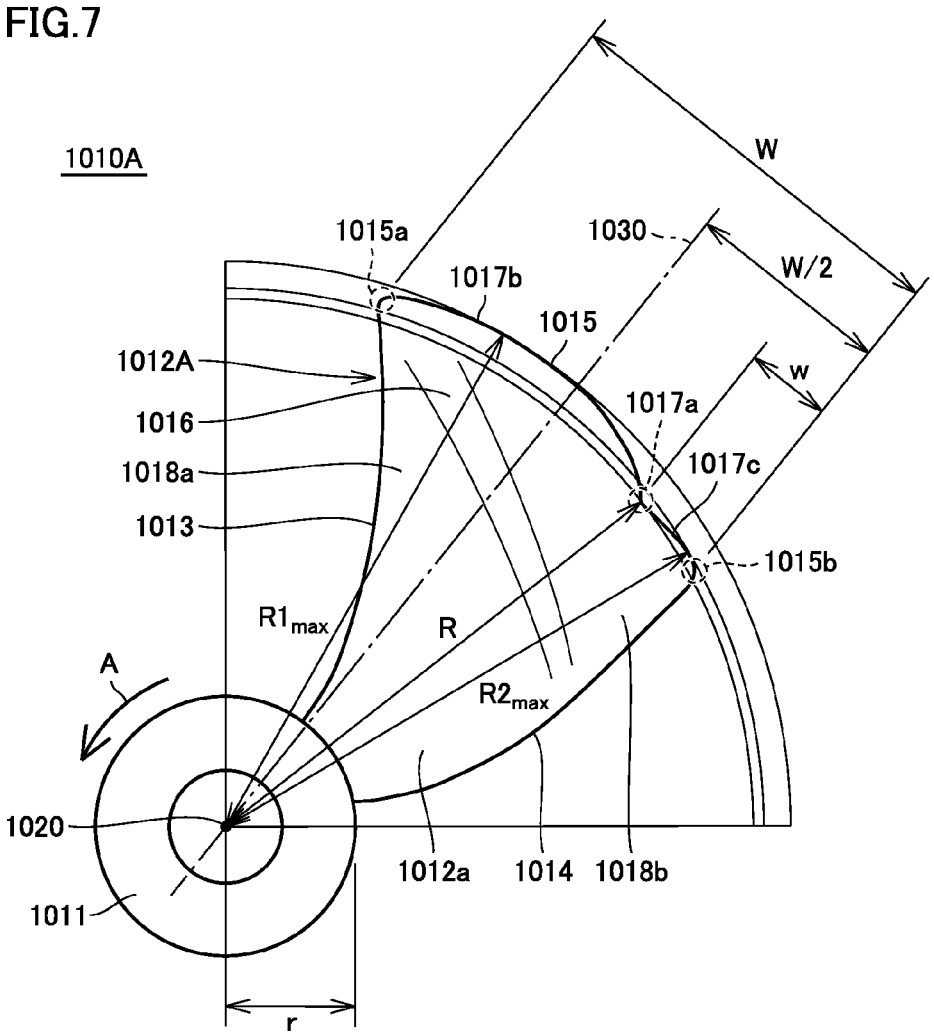
FIG. 7 is an enlarged rear view showing a shape of a blade of the propeller fan in Embodiment A1 of the present invention.

Blade 1012A has a blade inner region 1018*a* and a blade outer region 1018*b* different in blade surface shape from each other (see FIG. 7). Blade inner region 1018*a* corresponds to a region of blade 1012A located on a side of boss hub portion 1011 and blade outer region 1018*b* corresponds to a region of blade 1012A located on a side of outer edge portion 1015. Blade inner region 1018*a* and blade outer region 1018*b* different in a blade surface shape from each other are provided in blade 1012A, so that blade 1012A is provided with a coupling portion 1016 coupling in a curved manner, blade inner region 1018*a* and blade outer region 1018*b* to each other at a boundary therebetween, as illustrated.

Namely, blade 1012A has blade inner region 1018*a* located on the side of boss hub portion 1011, blade outer region 1018*b* located on the side of outer edge portion 1015, and coupling portion 1016 coupling in a curved or bent manner, blade inner region 1018*a* and blade outer region 1018*b* to each other at a boundary therebetween such that the side of negative pressure surface 1012*a* is recessed and the side of positive pressure surface 1012*b* is projecting.

Coupling portion 1016 has a curvature of a surface which attains to a relative maximum around the same, appears as a curved recessed groove portion in negative pressure surface 1012*a*, and appears as a curved protruding projection portion in positive pressure surface 1012*b*. Coupling portion 1016 is provided generally along the direction of rotation, and extends from a position in the vicinity of front end 1015*a* of outer edge portion 1015 toward a portion in the vicinity of a position intermediate in a radial direction of rear edge portion 1014.

Blade 1012A is formed in a shape of a blade having a thickness increasing from front edge portion 1013 and rear edge portion 1014 toward a portion around a center of the blade and having a largest thickness at a position close to front edge portion 1013 relative to the center of the blade, when viewed along the direction of rotation of propeller fan 1010A.

Here, in propeller fan 1010A in the present embodiment, outer edge portion 1015 of blade 1012A includes a front outer edge portion 1017*b* located on a side of front edge portion 1013 (see FIG. 7), a rear outer edge portion 1017*c* located on the side of rear edge portion 1014 (see FIG. 7), and a connection portion 1017*a* in a prescribed shape connecting front outer edge portion 1017*b* and rear outer edge portion 1017*c* to each other. With outer edge portion 1015 in such a shape, various effects which will be described later will be exhibited. A specific shape of outer edge portion 1015 will be described below in detail with reference to FIG. 7 along with FIGS. 2 to 6 described above.

FIG. 7 is an enlarged rear view showing a shape of a blade of the propeller fan in the present embodiment. As shown in FIGS. 2 to 7, in outer edge portion 1015 of blade 1012A, connection portion 1017*a* having a shape recessed toward central axis 1020 is formed. Connection portion 1017*a* is formed at a position in midway between front end 1015*a* of outer edge portion 1015 and rear end 1015*b* thereof.

As connection portion 1017 described above is formed in outer edge portion 1015, in outer edge portion 1015 of blade 1012A, front outer edge portion 1017*b* located on the side of front end 1015*a* of outer edge portion 1015 and rear outer edge portion 1017*c* located on the side of rear end 1015*b* of outer edge portion 1015 are provided.

Here, connection portion 1017*a* is preferably formed in a smoothly curved shape as illustrated, however, it does not necessarily have to be in a curved shape but may be in a bent shape. In the present embodiment, since connection portion 1017*a* is formed as being relatively shallowly recessed, connection portion 1017*a* has a shape substantially at an obtuse angle.

A position where connection portion 1017*a* is formed is not particularly limited so long as it is a position on outer edge portion 1015. In the present embodiment, however, connection portion 1017*a* is formed at a position closer to rear end 1015*b* of outer edge portion 1015. Therefore, in the present embodiment, a width of front outer edge portion 1017*b* along the direction of rotation is formed to be greater than a width of rear outer edge portion 1017*c* along the direction of rotation.

More specifically, as shown in FIG. 7, in the present embodiment, in a plan view of blade 1012A along central axis 1020, when a bisector 1030 of an angle formed by a line segment connecting front end 1015*a* of outer edge portion 1015 and central axis 1020 to each other and a line segment connecting rear end 1015*b* of outer edge portion 1015 and central axis 1020 to each other is drawn, a distance W and a distance w satisfy a condition of W/2>w, where W represents a distance between front end 1015*a* and rear end 1015*b* along a direction orthogonal to bisector 1030 and w represents a distance between rear end 1015*b* and a point located on a radially innermost side in connection portion 1017*a*, along a direction orthogonal to bisector 1030.

As shown in FIG. 7, in the present embodiment, in the plan view of blade 1012A along central axis 1020, a maximum radius $R1_{max}$ from central axis 1020 of front outer edge portion 1017*b* and a maximum radius $R2_{max}$ from central axis 1020 of rear outer edge portion 1017*c* satisfy a condition of $R1_{max}>R2_{max}$.

Furthermore, as shown in FIG. 7, in the present embodiment, in the plan view of blade 1012A along central axis 1020, a radius R and maximum radius $R2_{max}$ satisfy a condition of $R<R2_{max}$, where R represents a radius from central axis 1020, of a point located on the radially innermost side in connection portion 1017*a*.

With blade 1012A in a shape satisfying such a condition as illustrated, an effect as below is obtained.

Firstly, with blade 1012A constructed as above, wind velocity distribution in a radial direction can be more uniform and variation in wind velocity can be suppressed. Thus, comfortably impinging wind can be obtained.

Namely, in a case of a blade shape not having a recessed connection portion formed in the outer edge portion, a wind velocity is greater radially outward substantially in proportion, and there is a great difference in velocity between wind generated in a portion close to the radially inner side and wind generated in a portion close to the radially outer side. Thus, significant variation is caused in generated wind.

In contrast, in the present embodiment, recessed connection portion 1017*a* is formed on outer edge portion 1015. Therefore, as compared with a case that no recessed connection portion 1017*a* is formed on outer edge portion 1015, an area of a blade is decreased in the vicinity of outer edge portion 1015 (that is, a portion close to the radially outer side). Therefore, a wind velocity increasing radially outward substantially in proportion is lowered in a portion close to outer edge portion 1015. A velocity of wind generated in a portion close to the radially inner side and a velocity of wind generated in a portion close to outer edge portion 1015 are thus close to each other and wind velocity distribution in the radial direction is more uniform. Therefore, variation in wind velocity can be suppressed and comfortably impinging wind can be obtained.

Secondly, with blade 1012A constructed as above, pressure fluctuation included in wind generated in a portion close to the radially outer side is less and comfortably impinging wind can be generated.

Namely, in a case of a blade shape not having a recessed connection portion formed in the outer edge portion, air passes through a relatively large space between blades and great pressure fluctuation is caused in generated wind. This is particularly noticeable in a portion on the side of the outer edge portion where wind higher in velocity is generated, and wind greater in pressure difference is generated as the number of blades is smaller.

In contrast, in the present embodiment, the blade shape is such that recessed connection portion 1017*a* is formed in outer edge portion 1015. Therefore, a relatively small space (that is, a space where recessed connection portion 1017*a* is located) is formed between front outer edge portion 1017*b* and rear outer edge portion 1017*c* in one blade 1012A, and the space is present as a space in blade 1012A where no wind is generated. Consequently, in a portion on the side of outer edge portion 1015 where wind high in velocity is generated, a pressure difference caused in generated wind is lessened as a result of decrease in area of the blade, and in addition, a pressure fluctuates in a more finely stepwise manner. Therefore, front outer edge portion 1017*b* and rear outer edge portion 1017*c* provided in one blade 1012A function as if two blades sent wind, and comfortably impinging wind less in pressure fluctuation as a whole can be generated. Details of the effect will be mentioned more specifically in an Embodiment A2 of the present invention which will be described later.

Thirdly, with blade 1012A constructed as above, during rotation at a low speed, comfortably impinging wind diffusing over a wide range can be obtained, and during rotation at a high speed, wind high in straightness and reaching farther can be obtained, which will be described in further detail with reference to FIGS. 8 to 11.

Figure 8:
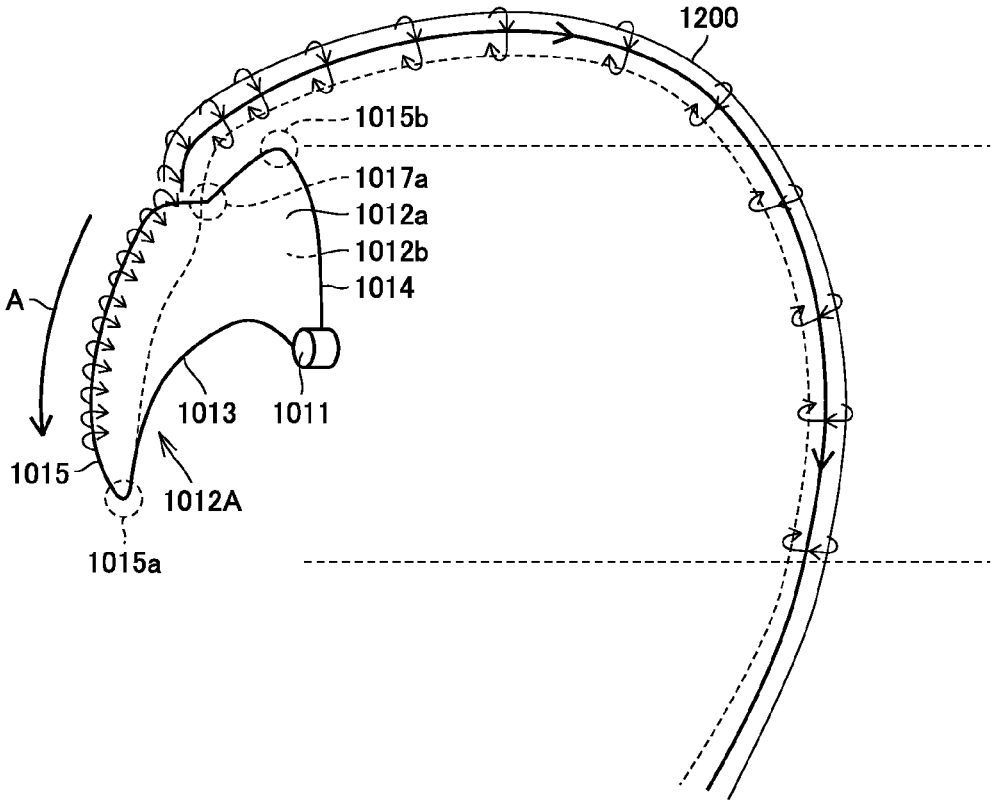
FIG. 8 is a conceptual view showing a flow of wind obtained at the time when the propeller fan is rotated at a low speed in the electric fan in Embodiment A1 of the present invention.
Figure 9:
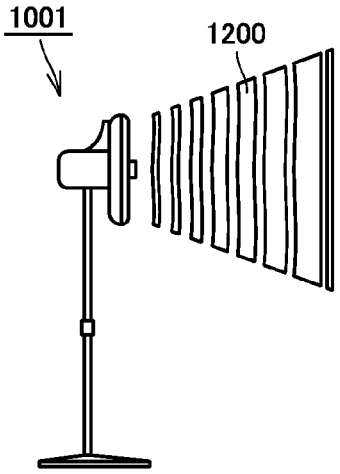
FIG. 9 is a diagram schematically showing a state of wind obtained at the time when the propeller fan is rotated at a low speed in the electric fan in Embodiment A1 of the present invention.
Figure 10:
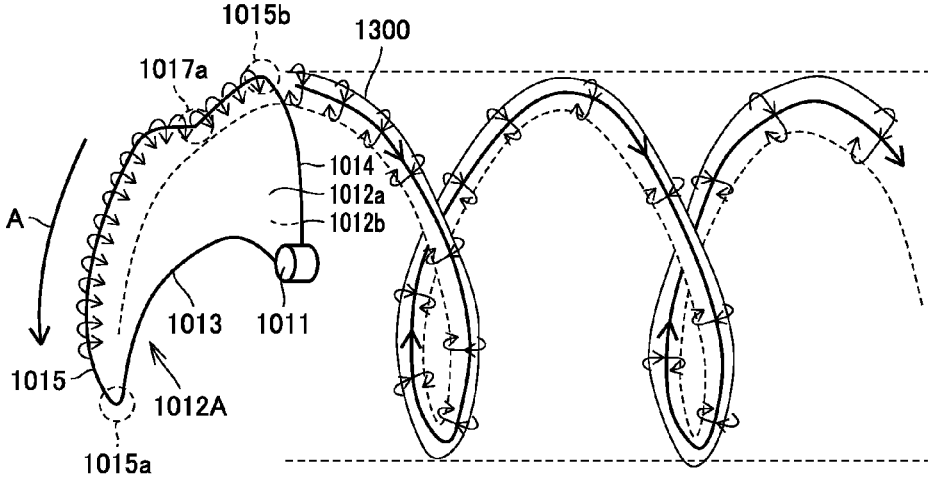
FIG. 10 is a conceptual view showing a flow of wind obtained at the time when the propeller fan is rotated at a high speed in the electric fan in Embodiment A1 of the present invention.
Figure 11:
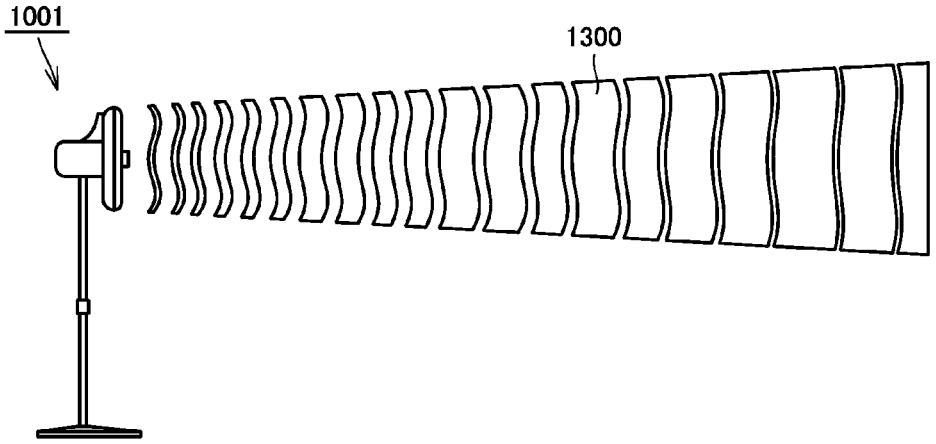
FIG. 11 is a diagram schematically showing a state of wind obtained at the time when the propeller fan is rotated at a high speed in the electric fan in Embodiment A1 of the present invention.

FIG. 8 is a conceptual diagram showing a flow of wind obtained at the time when a propeller fan is rotated at a low speed in the electric fan in the present embodiment, and FIG. 9 is a diagram schematically showing a state of wind obtained at the time when the propeller fan is rotated at a low speed. FIG. 10 is a conceptual diagram showing a flow of wind obtained at the time when the propeller fan is rotated at a high speed in the electric fan in the present embodiment, and FIG. 11 is a diagram schematically showing a state of wind obtained at the time when the propeller fan is rotated at a high speed. In FIGS. 8 and 10, as a track representative of a blade tip end vortex, a track of a blade tip end vortex generated around front end 1015*a* of outer edge portion 1015 is schematically shown with a thin dashed line, a track representative of a horseshoe vortex is schematically shown with a thin line, and a track of wind generated at a position closer to outer edge portion 1015 of blade 1012A is further shown schematically with a bold line.

As described above, in the present embodiment, recessed connection portion 1017*a* is formed at a position on outer edge portion 1015 of blade 1012A. The position on outer edge portion 1015 corresponds to a position downstream of the blade tip end portion including front end 1015*a* of outer edge portion 1015, along a streamline of the blade tip end vortex which flows over the blade surface.

As shown in FIG. 8, when blade 1012A rotates at a low speed, kinetic energy of the blade tip end vortex and the horseshoe vortex generated as a result of rotation of blade 1012A is low, and hence separation of the blade tip end vortex and the horseshoe vortex is promoted in recessed connection portion 1017*a* without the vortexes being trapped therein. Thus, the blade tip end vortex and the horseshoe vortex are both dispelled radially outward by centrifugal force in a portion where recessed connection portion 1017*a* is formed. Therefore, as shown in FIG. 9, wind generated by blade 1012A is diffused in front of electric fan 1001, and comfortably impinging wind 1200 can be sent over a wide range. Therefore, in a case that the electric fan is desirably operated during bedtime such as night without wind being substantially felt, a breezy operation satisfying such a desire can also be realized.

On the other hand, as shown in FIG. 10, when blade 1012A is rotated at a high speed, kinetic energy of the blade tip end vortex and the horseshoe vortex generated as a result of rotation of blade 1012A is great, and hence the blade tip end vortex and the horseshoe vortex are trapped and held in recessed connection portion 1017*a* and fluctuation or development of the blade tip end vortex and the horseshoe vortex is suppressed. In that case, the blade tip end vortex and the horseshoe vortex will also move inward along recessed connection portion 1017*a*, and hence, thereafter, the blade tip end vortex and the horseshoe vortex which are separated at rear end 1015*b* of outer edge portion 1015 are dispelled in an axial direction by a large quantity of wind and a high static pressure resulting from rotation at a high speed. Therefore, as shown in FIG. 11, wind generated by blade 1012A converges in front of electric fan 1001, and wind 1300 high in straightness and reaching farther can be sent. Therefore, wind can efficiently be sent and generation of noise can also be suppressed owing to enhanced straightness of wind.

Thus, according to propeller fan 1010A and electric fan 1001 including the same in the present embodiment, generated wind can be less in pressure fluctuation and comfortably impinging wind can be sent, and reduction in noise can be achieved.

In addition to the effect above, propeller fan 1010A in the present embodiment can achieve an effect as below.

As described above, in the present embodiment, a portion of front edge portion 1013 except for a portion closer to the radially outer side is located on the end surface on the suction side. Therefore, capability to send wind can be enhanced in a portion of blade 1012A closer to the radially inner side. A velocity of wind generated in the portion closer to the radially inner side can be higher, which can be closer to a velocity of wind generated in a portion closer to outer edge portion 1015, and wind velocity distribution in a radial direction is more uniform. Therefore, variation in wind velocity can be suppressed and comfortably impinging wind can be obtained.

In addition, as described above, in the present embodiment, rear edge portion 1014 is constructed to be away from the end surface on the burst side toward the radially outer side. Therefore, wind velocity increasing radially outward substantially in proportion is lessened in the portion closer to outer edge portion 1015. Then, a velocity of wind generated in the portion closer to the radially inner side is close to a velocity of wind generated in the portion closer to outer edge portion 1015, and hence wind velocity distribution in the radial direction is more uniform. Therefore, variation in wind velocity can be suppressed and comfortably impinging wind can be obtained.

Furthermore, as described above, in the present embodiment, at a boundary between blade inner region 1018*a* and blade outer region 1018*b*, coupling portion 1016 coupling them in a curved manner is provided. Therefore, a horseshoe vortex is generated over coupling portion 1016, and the horseshoe vortex suppresses separation of a mainstream which flows over the blade surface. Thus, noise is lowered and capability to send wind is enhanced. Additionally, as described above, since coupling portion 1016 is provided substantially along the direction of rotation in the present embodiment, in addition to the horseshoe vortex generated over coupling portion 1016, the blade tip end vortex is also held over coupling portion 1016, and separation of the mainstream can further be suppressed. Coupling portion 1016 does not have to be curved but may be, for example, bent.

Additionally, as described above, in the present embodiment, entire outer edge portion 1015 is located as being spaced apart from the end surface on the suction side along the direction of extension of central axis 1020, and its entirety is located away from the end surface on the burst side along the direction of extension of central axis 1020. Therefore, in the radially outer portion, a thickness of blade 1012A as a whole of propeller fan 1010A in the direction along central axis 1020 is significantly decreased, and hence a long distance between front guard 1002 and rear guard 1003 described above can be ensured in this portion. Therefore, occurrence of jamming of a finger in electric fan 1001 can be suppressed and safety can be enhanced.

A first verification test in which relation between a shape of the connection portion provided in the outer edge portion described above and the effect described above was verified will now be described. In the first verification test, a plurality of samples different in position along the direction of rotation and the radial direction of the connection portion provided on the outer edge portion were prepared, and based thereon, a quantity of wind obtained at the time when each sample was rotated and pressure fluctuation included in obtained wind were measured. In each sample, the blade inner region and the blade outer region described above were not different in shape of a blade surface but constructed such that the entire blade surface had a single blade surface shape.

Here, in each sample, a position where the connection portion is to be provided was predetermined, a parallelogram having the connection portion as one vertex was drawn in a portion closer to the rear end of the outer edge portion of the blade and closer to the outer end of the rear edge portion of the blade, and a part of the blade was cut in a shape substantially in conformity with the parallelogram. From a point of view of lowering in noise generated during rotation, the outer edge portion was moderately curved such that the connection portion as well as the front outer edge portion and the rear outer edge portion formed with the connection portion being defined as a boundary were all in a smooth shape without a corner.

A quantity of wind and pressure fluctuation were measured at a position corresponding to a position distant by 30 mm on the burst side along the central axis of the propeller fan, at which a distance in the radial direction from the center of rotation of the propeller fan was 70% of the maximum radius of the outer edge portion. The position corresponding to the position at which the distance in the radial direction from the center of rotation of the propeller fan is 70% of the maximum radius of the outer edge portion is generally a position at which a wind velocity is highest and hence also a position where pressure fluctuation is maximal.

Figure 12:
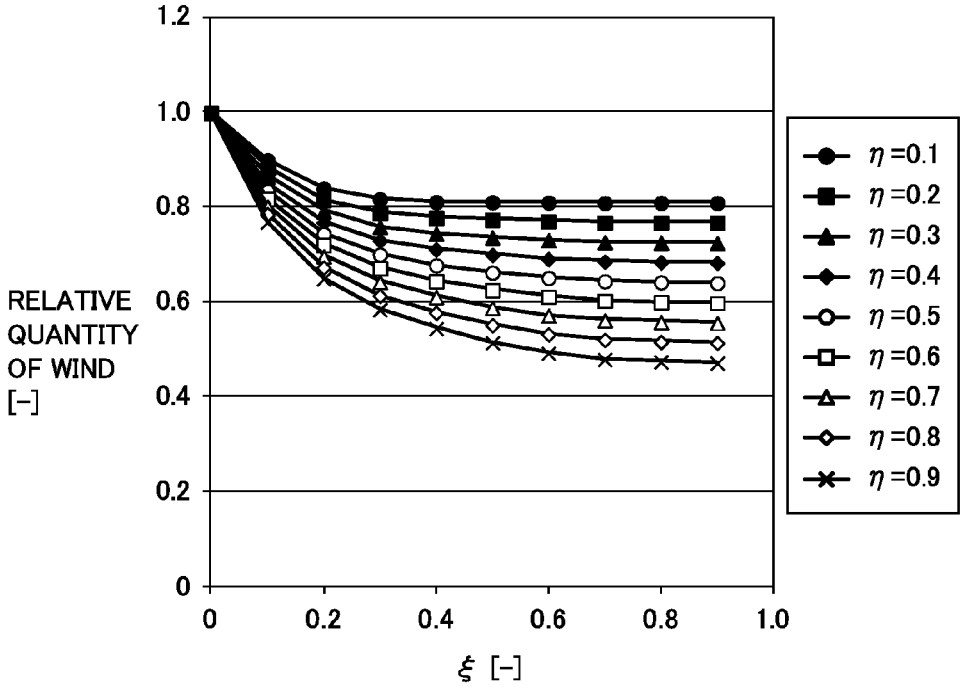
FIG. 12 is a graph showing relation between a shape of a blade and a relative quantity of wind obtained in a first verification test.

FIG. 12 is a graph showing relation between a shape of a blade and a relative quantity of wind obtained in the first verification test. Here, in FIG. 12, the abscissa represents a position along the direction of rotation of the connection portion and the ordinate represents a relative quantity of wind. $\xi$ shown on the abscissa represents a value represented by w/W using distance W and distance w described above, and $\eta$ represents a value expressed by $(R1_{max}-R)/(R1_{max}-r)$ using maximum radius $R1_{max}$, radius R, and a radius r of the boss hub portion (see FIG. 7) described above. The relative quantity of wind shown on the ordinate is a value calculated by dividing a quantity of wind measured in each sample by a quantity of wind in the propeller fan not having the recessed connection portion formed in the outer edge portion.

As shown in FIG. 12, it is understood that, when the connection portion is located closer to the rear end of the outer edge portion along the direction of rotation, the quantity of wind tends to gradually decrease as the connection portion is located toward the front end from the rear end of the outer edge portion, and when the connection portion is located closer to the front end of the outer edge portion along the direction of rotation, no more lowering in quantity of wind tends to be caused. It is understood that the quantity of wind tends to gradually decrease as the connection portion is located toward a position closer to the center of rotation from a position close to the outer edge portion along the radial direction.

Figure 13:
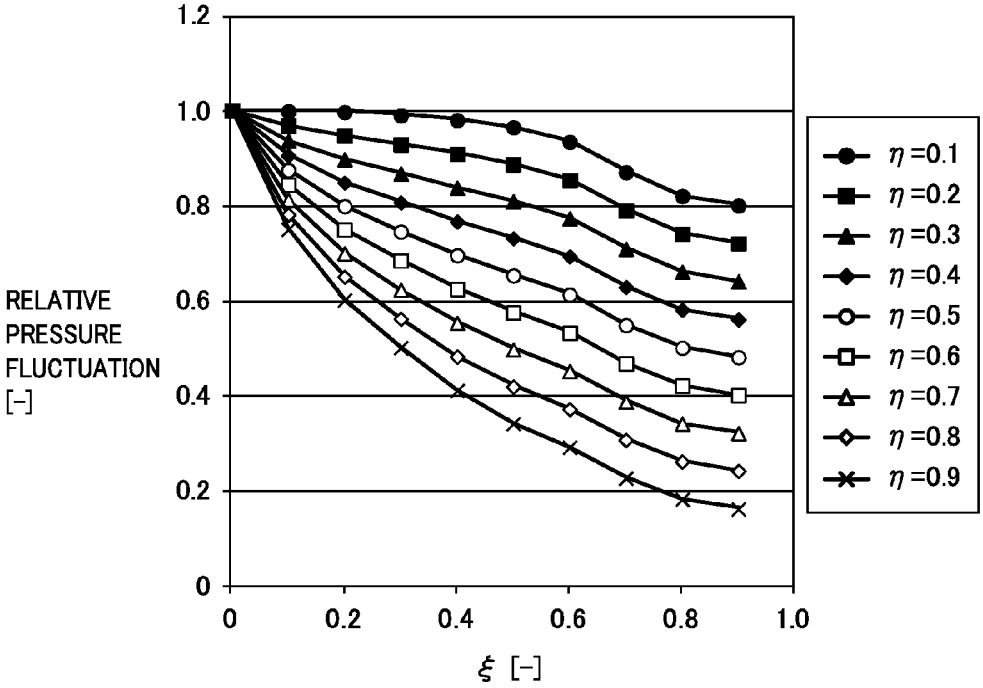
FIG. 13 is a graph showing relation between a shape of a blade and relative pressure fluctuation obtained in the first verification test.

FIG. 13 is a graph showing relation between a shape of a blade and relative pressure fluctuation obtained in the first verification test. Here, in FIG. 13, the abscissa represents a position along the direction of rotation of the connection portion and the ordinate represents relative pressure fluctuation. Relative pressure fluctuation shown on the ordinate is represented by a value calculated by dividing a maximum value of a pressure difference measured in each sample by a maximum value of a pressure difference in the propeller fan not having a recessed connection portion formed in the outer edge portion.

As shown in FIG. 13, it is understood that pressure fluctuation tends to gradually decrease as the connection portion is located toward a position closer to the front end from a position close to the rear end of the outer edge portion along the direction of rotation. It is understood that pressure fluctuation tends to further decrease as the connection portion is located toward a position closer to the center of rotation from a position close to the outer edge portion along the radial direction.

Figure 14:
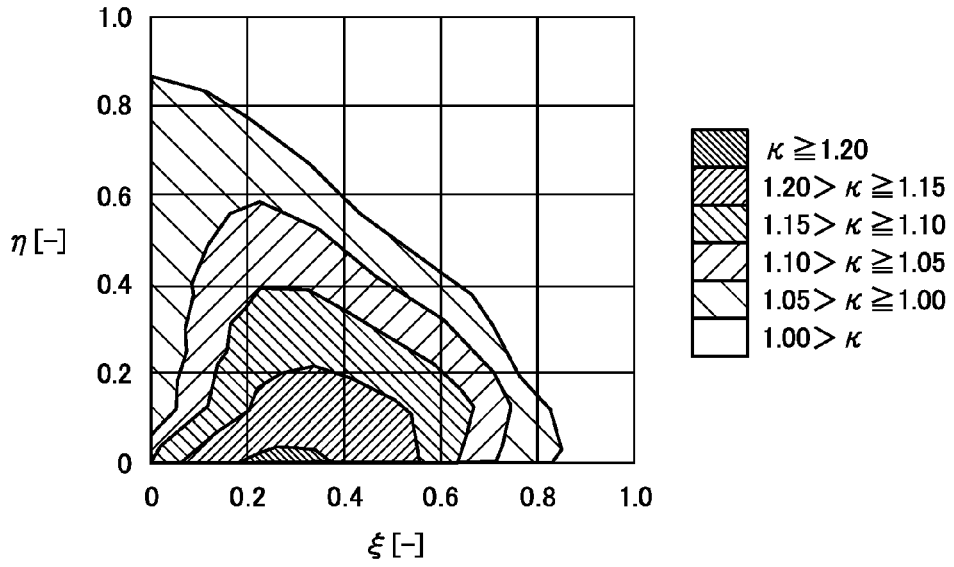
FIG. 14 is a contour diagram showing relation between a shape of a blade and a comfort index obtained in the first verification test.

FIG. 14 is a contour diagram showing relation between a shape of a blade and a comfort index obtained in the first verification test. The contour diagram represents results in the first verification test as fan performance including a comfort index $\kappa$ based on the results shown in FIGS. 12 an 13 described above. Comfort index $\kappa$ is calculated by dividing the relative quantity of wind shown in FIG. 12 by relative pressure fluctuation shown in FIG. 13, and a higher value thereof indicates higher comfort. In FIG. 14, the abscissa represents a position along the direction of rotation of the connection portion and the ordinate represents a position along the radial direction of the connection portion.

As shown in FIG. 14, with attention being paid to $\xi$, in order to improve comfort index $\kappa$ by 5% r more as compared with the propeller fan not having a recessed connection portion formed in the outer edge portion, at least $\xi$ should substantially satisfy a condition of $0<\xi\leq 0.75$. On the other hand, with attention being paid to in order to improve comfort index $\kappa$ by 5% or more as compared with the propeller fan not having a recessed connection portion formed in the outer edge portion, at least $\eta$ should substantially satisfy a condition of $0<\eta\leq 0.6$.

Furthermore, with attention being paid to both of $\xi$ and $\eta$, when $\xi$ satisfies a condition of $0.2\leq\xi\leq 0.6$ and $\eta$ satisfies a condition of $0<\eta\leq 0.2$, as compared with the propeller fan not having a recessed connection portion formed in the outer edge portion, comfort index $\kappa$ reliably improves by 10% or more.

Then, a second verification test in which relation between the shape of the connection portion provided in the outer edge portion described above and the effect described above was verified will now be described. In the second verification test, the propeller fan in the present embodiment described above was actually prototyped, which was defined as an Example 1, a propeller fan different in shape therefrom was actually prototyped, which was defined as a Comparative Example 1, and a wind velocity at the time when the propeller fans in Example 1 and Comparative Example 1 were rotated was measured to calculate wind velocity distribution in the radial direction.

Here, the propeller fan according to Comparative Example 1 was different from the propeller fan according to Example 1 in that no recessed connection portion was formed in the outer edge portion, the entire blade surface was constructed to have a single blade surface shape, and the front edge portion was formed as being substantially monotonously inclined along the radial direction, and they were otherwise common in shape.

A wind velocity was measured at a position distant by 30 mm on the burst side along the central axis of the propeller fan, and in order to grasp distribution in the radial direction, a point of measurement was disposed at a position every 0.1 time of a distance from the central axis, up to a position at which a distance from the central axis was 1.1 time as large as the maximum radius of the outer edge portion.

Figure 15:
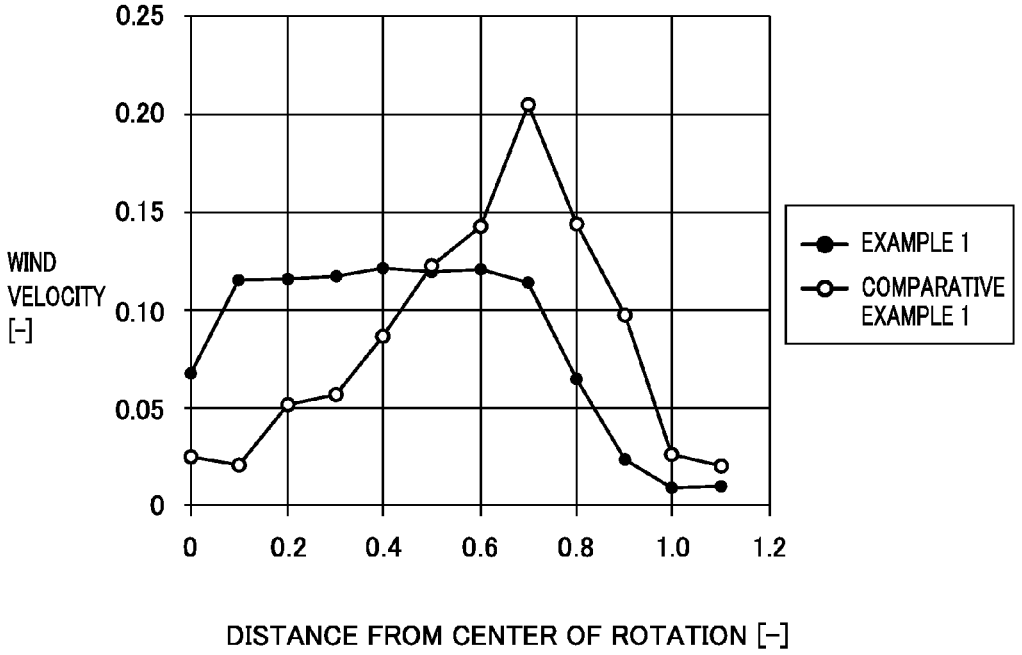
FIG. 15 is a graph showing relation between a wind velocity and a distance from a center of rotation of propeller fans according to an Example 1 and a Comparative Example 1, which is obtained in a second verification test.

FIG. 15 is a graph showing relation between a wind velocity and a distance from the center of rotation of the propeller fans according to Example 1 and Comparative Example 1, which was obtained in the second verification test. Here, in FIG. 15, the abscissa represents a distance from the center of rotation and the ordinate represents a wind velocity. The abscissa represents a distance from the center of rotation with a dimensionless value, with a position corresponding to the center of rotation being defined as 0 and a position corresponding to the outer edge portion being defined as 1, and the ordinate represents a wind velocity with a dimensionless value obtained by matching a quantity of wind between Example 1 and Comparative Example 1 and dividing an actually measured value of the wind velocity by a quantity of wind.

As shown in FIG. 15, in the propeller fan according to Comparative Example 1, such a tendency that a wind velocity is low on the radially inner side, the wind velocity gradually increases radially outward, the wind velocity exhibits a maximum value at a position 0.7 time as large as the maximum radius of the outer edge portion, and the wind velocity gradually decreases radially outward is observed. In contrast, in the propeller fan according to Example 1, such a tendency that a wind velocity is higher than in Comparative Example 1 on the radially inner side, the wind velocity substantially does not vary toward the radially outer side, the wind velocity starts to decrease at a position 0.7 time as large as the maximum radius of the outer edge portion, and the wind velocity gradually decreases radially outward is observed. Here, the maximum value of the wind velocity was lower in Example 1 than in Comparative Example 1.

Thus, it was confirmed that, with the propeller fan according to Example 1, wind velocity distribution along the radial direction was considerably made uniform, variation in wind velocity could be suppressed, and comfortably impinging wind could be obtained.

Figure 16:
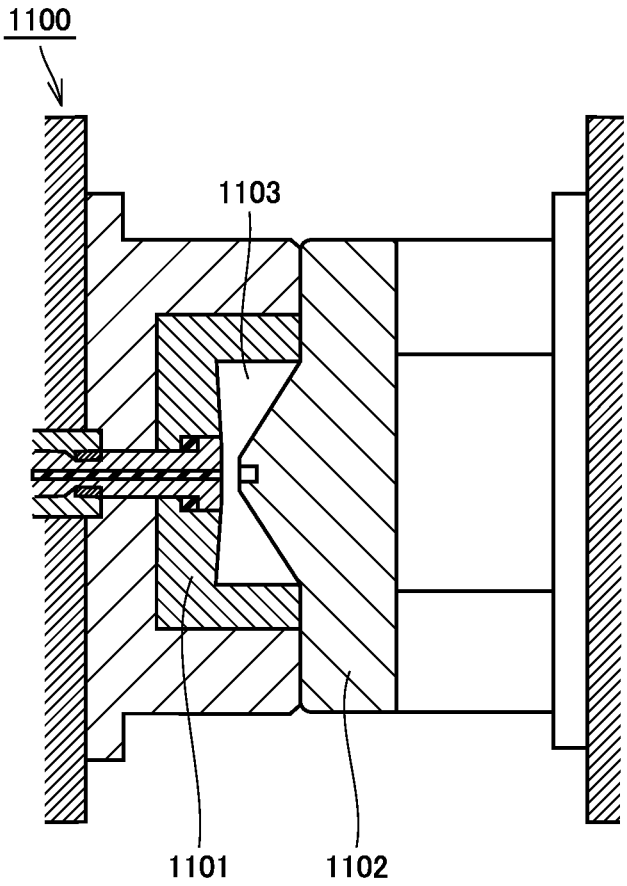
FIG. 16 is a schematic cross-sectional view showing a molding die for the propeller fan in Embodiment A1 of the present invention.

FIG. 16 is a schematic cross-sectional view showing a molding die for the propeller fan in the present embodiment. A molding die 1100 for the propeller fan in the present embodiment will now be described with reference to FIG. 16.

As described above, propeller fan 1010A in the present embodiment is formed from a resin molded product. In molding propeller fan 1010A, molding die 1100 for injection molding as shown, for example, in FIG. 16 is made use of.

As shown in FIG. 16, molding die 1100 has a fixed die 1101 and a movable die 1102. Fixed die 1101 and movable die 1102 define a cavity 1103 substantially the same in shape as propeller fan 1010A, into which a fluid resin is injected.

Molding die 1100 may be provided with a not-shown heater for enhancing fluidity of the resin injected into cavity 1103. Such provision of a heater is particularly effective in using a synthetic resin having increased strength such as an AS resin filled with glass fibers.

With regard to molding die 1100 shown in the figure, it is assumed that a surface on the side of positive pressure surface 1012*b* in propeller fan 1010A is molded with fixed die 1101 and a surface on the side of negative pressure surface 1012*a* is molded with movable die 1102, however, the surface on the side of negative pressure surface 1012*a* of propeller fan 1010A may be molded with fixed die 1101 and the surface on the side of positive pressure surface 1012*b* of propeller fan 1010A may be molded with movable die 1102.

Generally, a propeller fan is integrally formed with a metal as a material and through drawing by pressing. For such molding, a thin metal plate is generally employed, because a thick metal plate is difficult to draw and a mass thereof is also great. In this case, it is difficult to maintain strength (rigidity) in a large propeller fan. In contrast, some propeller fans include a part called a spider formed from a metal plate greater in thickness than a blade portion and have the blade portion fixed to a rotation shaft, however, the mass is great and fan balance is also poor. Generally, since a metal plate which is thin and has a constant thickness is employed, a cross-sectional shape of a blade cannot be in a blade shape.

In contrast, by molding propeller fan 1010A with a resin as in the present embodiment, such problems can collectively be solved.

In a case that a DC motor is employed for the drive motor described above to which the propeller fan is fixed, for further lowering in noise as measures against cocking noise specific to the DC motor, a cylindrical rubber boss may be insert molded in a shaft hole of boss hub portion 1011 provided for insertion of rotation shaft 1004*a*. In that case, a rubber boss as an insert part should only be provided prior to injection molding in a die for molding the surface on the side of negative pressure surface 1012*a* of propeller fan 1010A.

Propeller fans 1010B to 1010K according to Variations 1 to 10 based on the present embodiment described above will be described below. Propeller fans 1010B to 1010K according to Variations 1 to 10 shown below are basically different from propeller fan 1010A in the present embodiment described above in a shape or a position of connection portion 1017*a* provided in outer edge portion 1015.

(Variation 1)

Figure 17:
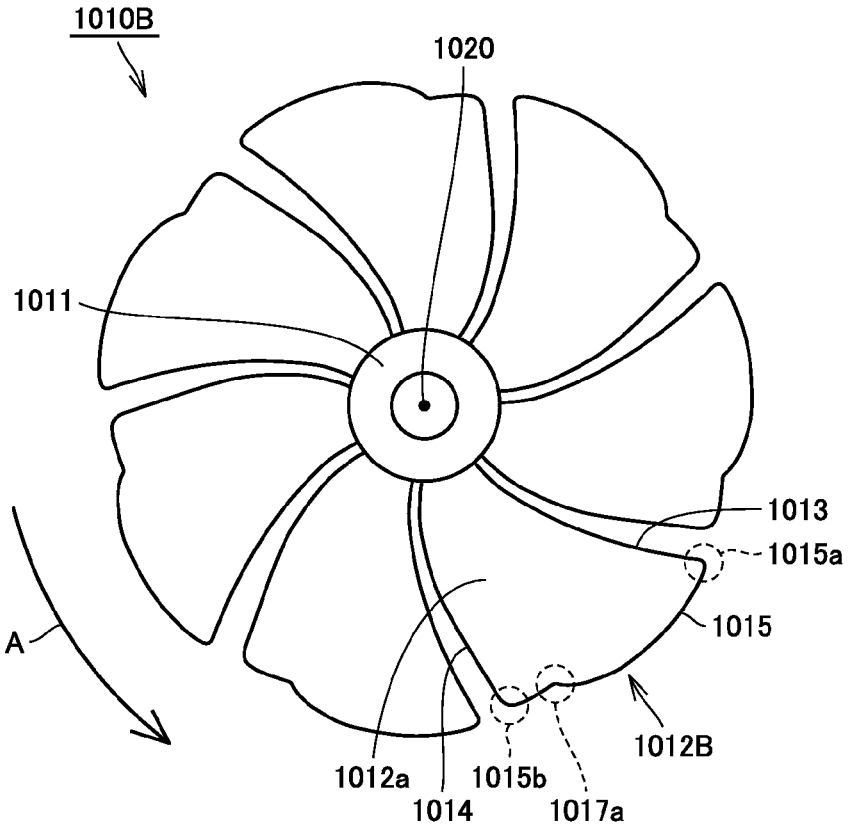
FIG. 17 is a rear view of a propeller fan according to a Variation 1.
Figure 18:
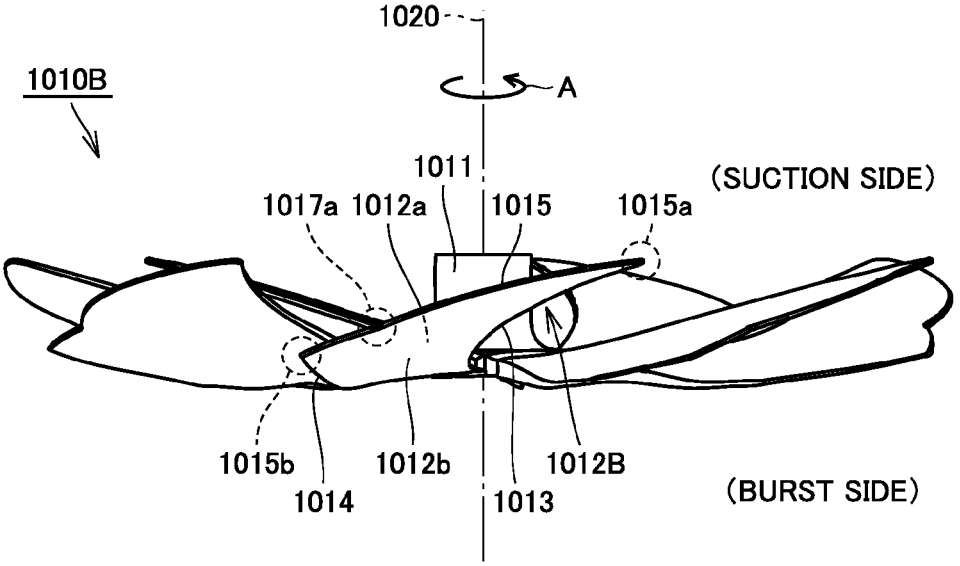
FIG. 18 is a side view of the propeller fan according to Variation 1.
Figure 19:
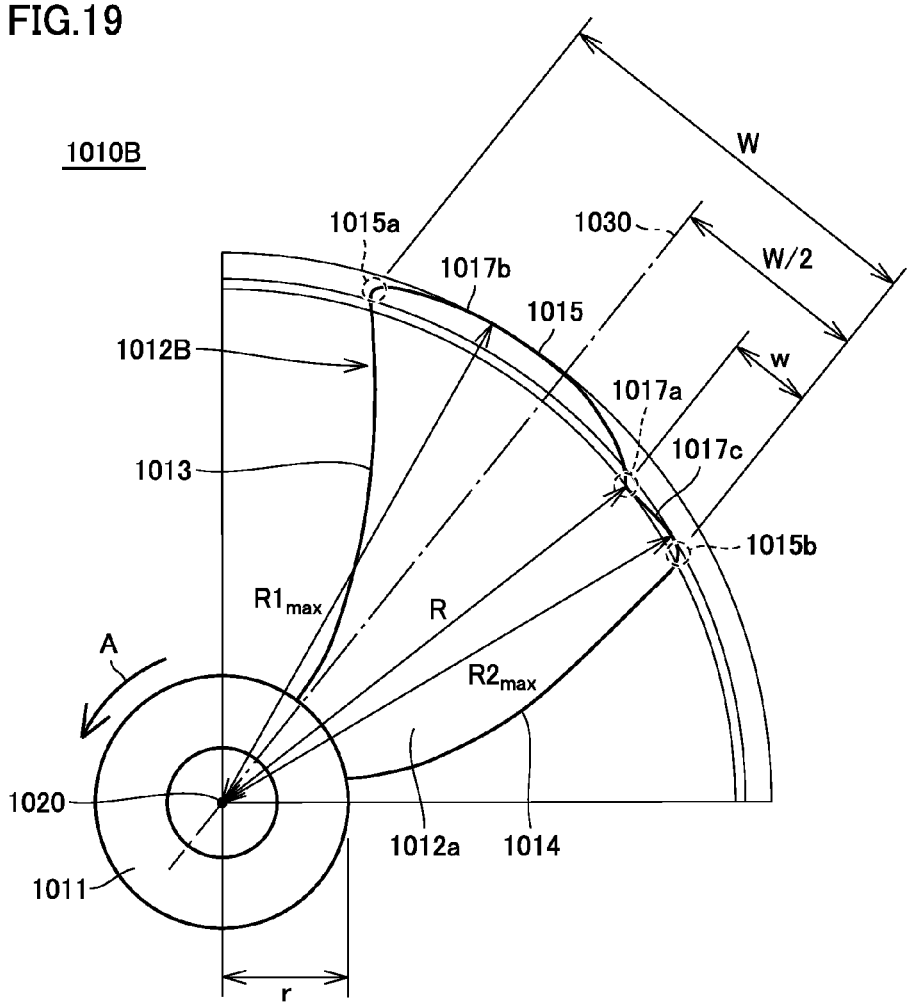
FIG. 19 is an enlarged rear view showing a shape of a blade of the propeller fan according to Variation 1.

FIGS. 17 and 18 are a rear view and a side view of the propeller fan according to Variation 1, respectively, and FIG. 19 is an enlarged rear view showing a shape of a blade of the propeller fan according to Variation 1.

As shown in FIGS. 17 to 19, propeller fan 1010B according to Variation 1 is different from propeller fan 1010A in the present embodiment described above in that the blade inner region and the blade outer region are not different in a blade surface shape but constructed such that the entire blade surface has a single blade surface shape, and entire outer edge portion 1015 is not located as being spaced apart from the end surface on the suction side along the direction of extension of central axis 1020, and they are otherwise common in construction to propeller fan 1010A in the present embodiment described above.

Namely, in propeller fan 1010B, recessed connection portion 1017*a* is provided in outer edge portion 1015, and front outer edge portion 1017*b* located on the side of front end 1015*a* of outer edge portion 1015 and rear outer edge portion 1017*c* located on the side of rear end 1015*b* of outer edge portion 1015 are provided in outer edge portion 1015 of blade 1012B. In the present Variation 1, since connection portion 1017*a* is formed as being relatively shallowly recessed, connection portion 1017*a* has a shape substantially at an obtuse angle.

Here, in blade 1012B of propeller fan 1010B according to the present Variation 1, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effects other than the effect obtained by providing coupling portion 1016 described in the present embodiment described above are all obtained, and hence pressure fluctuation in generated wind is less, comfortably impinging wind can be sent, and noise can be lowered.

(Variation 2)

Figure 20:
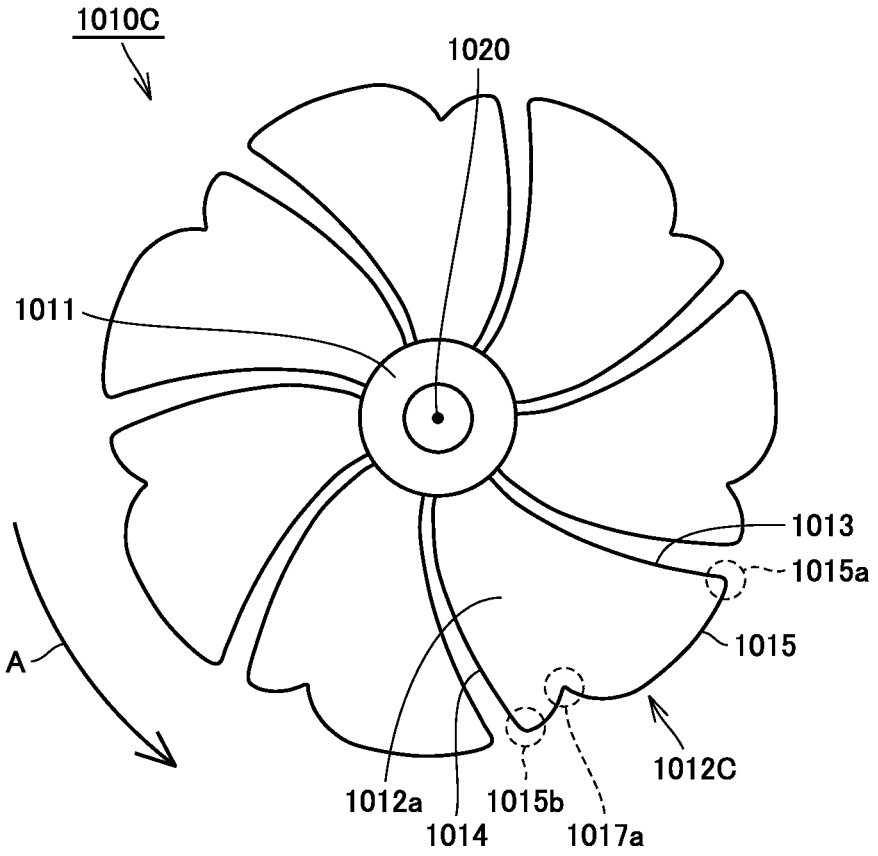
FIG. 20 is a rear view of a propeller fan according to a Variation 2.
Figure 21:
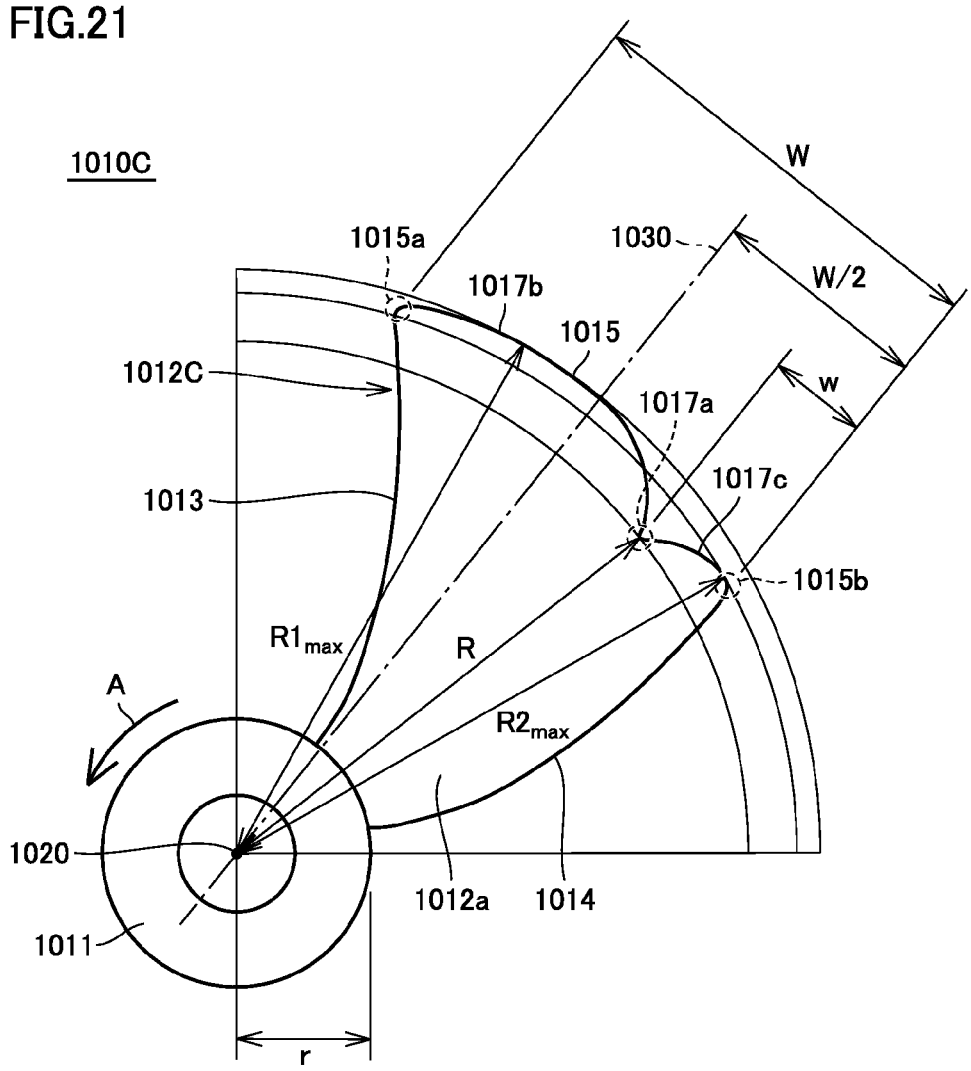
FIG. 21 is an enlarged rear view showing a shape of a blade of the propeller fan according to Variation 2.

FIGS. 20 and 21 are a rear view of the propeller fan according to Variation 2 and an enlarged rear view showing a shape of a blade, respectively.

As shown in FIGS. 20 and 21, propeller fan 1010C according to Variation 2 is different from propeller fan 1010B according to Variation 1 described above only in a shape of recessed connection portion 1017*a* provided in outer edge portion 1015, and they are otherwise common in construction to propeller fan 1010B according to Variation 1 described above. Specifically, in propeller fan 1010C, connection portion 1017*a* provided in outer edge portion 1015 is formed as being relatively deeply recessed, and connection portion 1017*a* has a shape substantially at an acute angle.

Here, in blade 1012C of propeller fan 1010C according to the present Variation 2, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 1 described above is obtained, and hence pressure fluctuation in generated wind is less, comfortably impinging wind can be sent, and noise can be lowered. In the present Variation 2, uniformity in wind velocity distribution along the radial direction can more effectively be realized because recessed connection portion 1017*a* provided in outer edge portion 1015 is greater than in Variation 1 described above.

(Variation 3)

Figure 22:
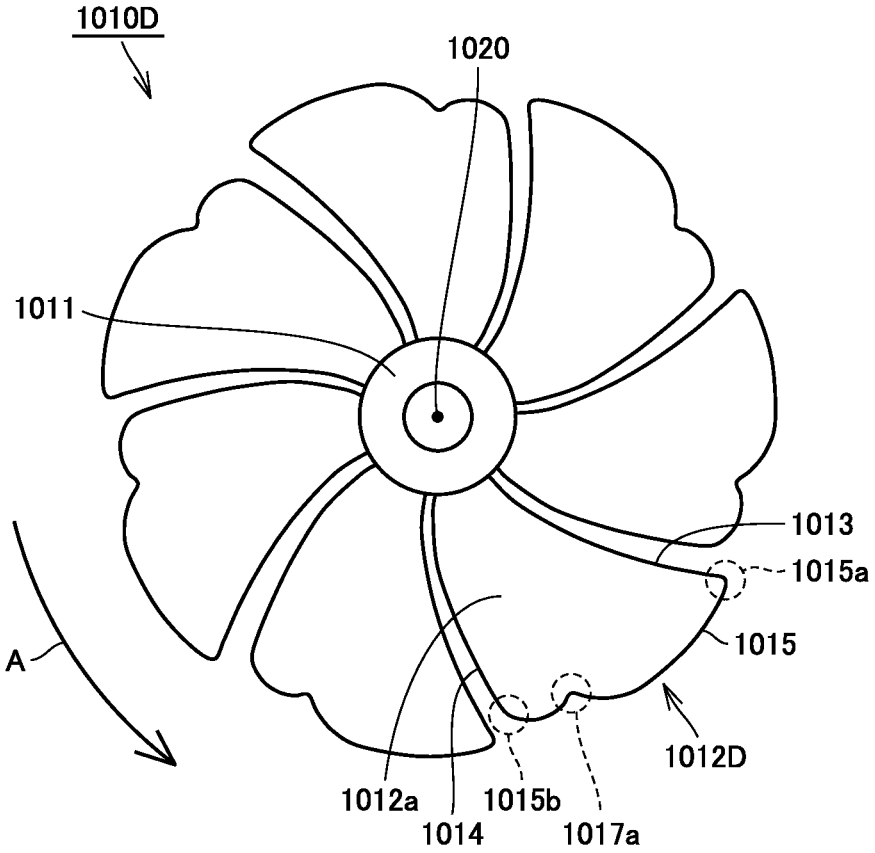
FIG. 22 is a rear view of a propeller fan according to a Variation 3.
Figure 23:
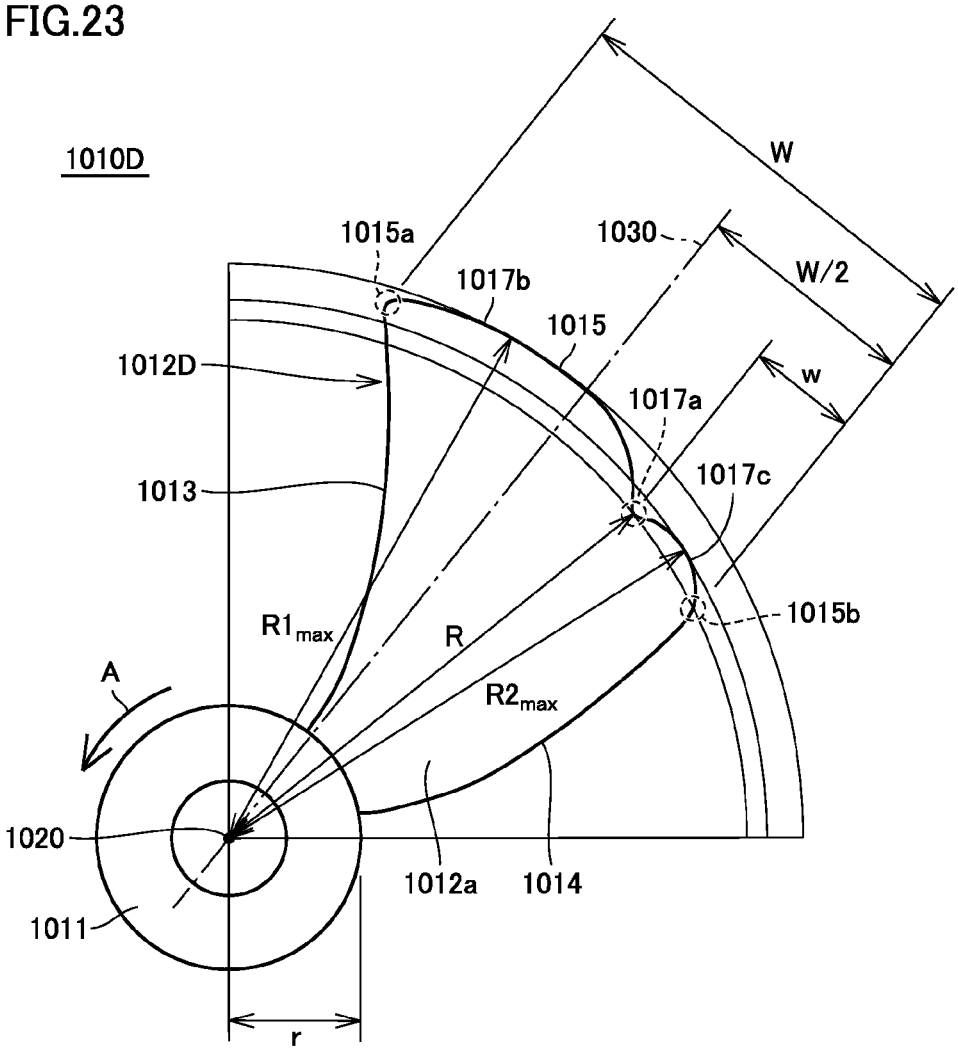
FIG. 23 is an enlarged rear view showing a shape of a blade of the propeller fan according to Variation 3.

FIGS. 22 and 23 are a rear view of the propeller fan according to Variation 3 and an enlarged rear view showing a shape of a blade, respectively.

As shown in FIGS. 22 and 23, propeller fan 1010D according to Variation 3 is different from propeller fan 1010B according to Variation 1 described above only in a shape of recessed connection portion 1017*a* provided in outer edge portion 1015, and they are otherwise common in construction to propeller fan 1010B according to Variation 1 described above. Specifically, in propeller fan 1010D, connection portion 1017*a* provided in outer edge portion 1015 is formed as being relatively deeply recessed, and connection portion 1017*a* has a shape substantially at an obtuse angle.

Here, in blade 1012D of propeller fan 1010D according to the present Variation 3, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 1 described above is obtained, and hence pressure fluctuation in generated wind is less, comfortably impinging wind can be sent, and noise can be lowered. In the present Variation 3, uniformity in wind velocity distribution along the radial direction can more effectively be realized because recessed connection portion 1017*a* provided in outer edge portion 1015 is greater than in Variation 1 described above.

(Variation 4)

Figure 24:
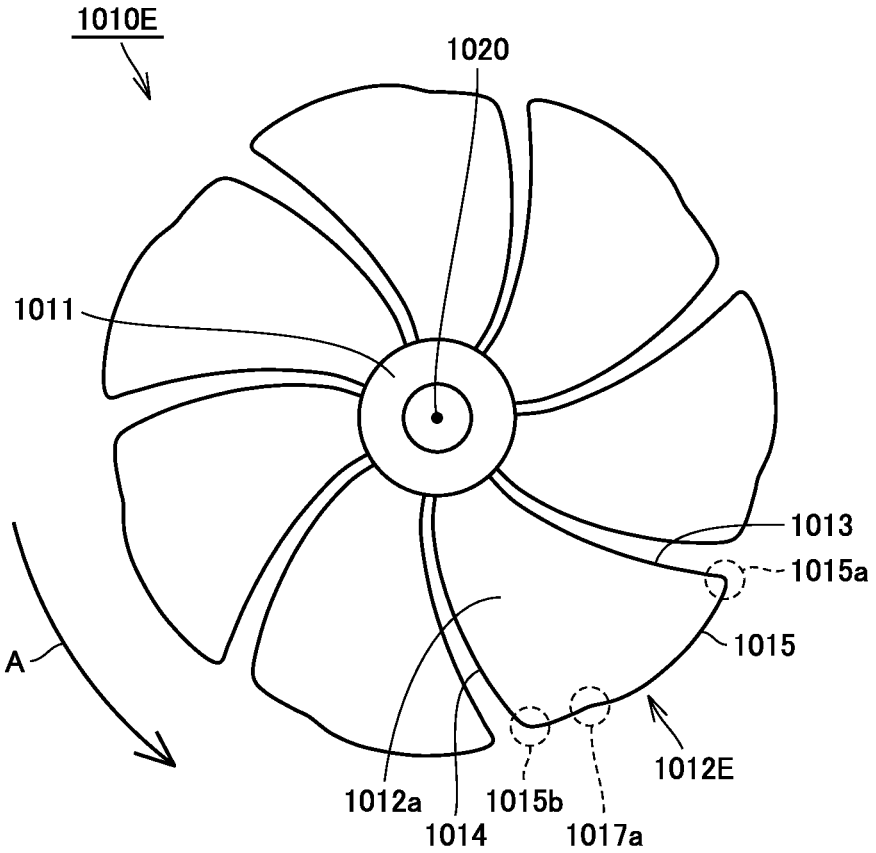
FIG. 24 is a rear view of a propeller fan according to a Variation 4.
Figure 25:
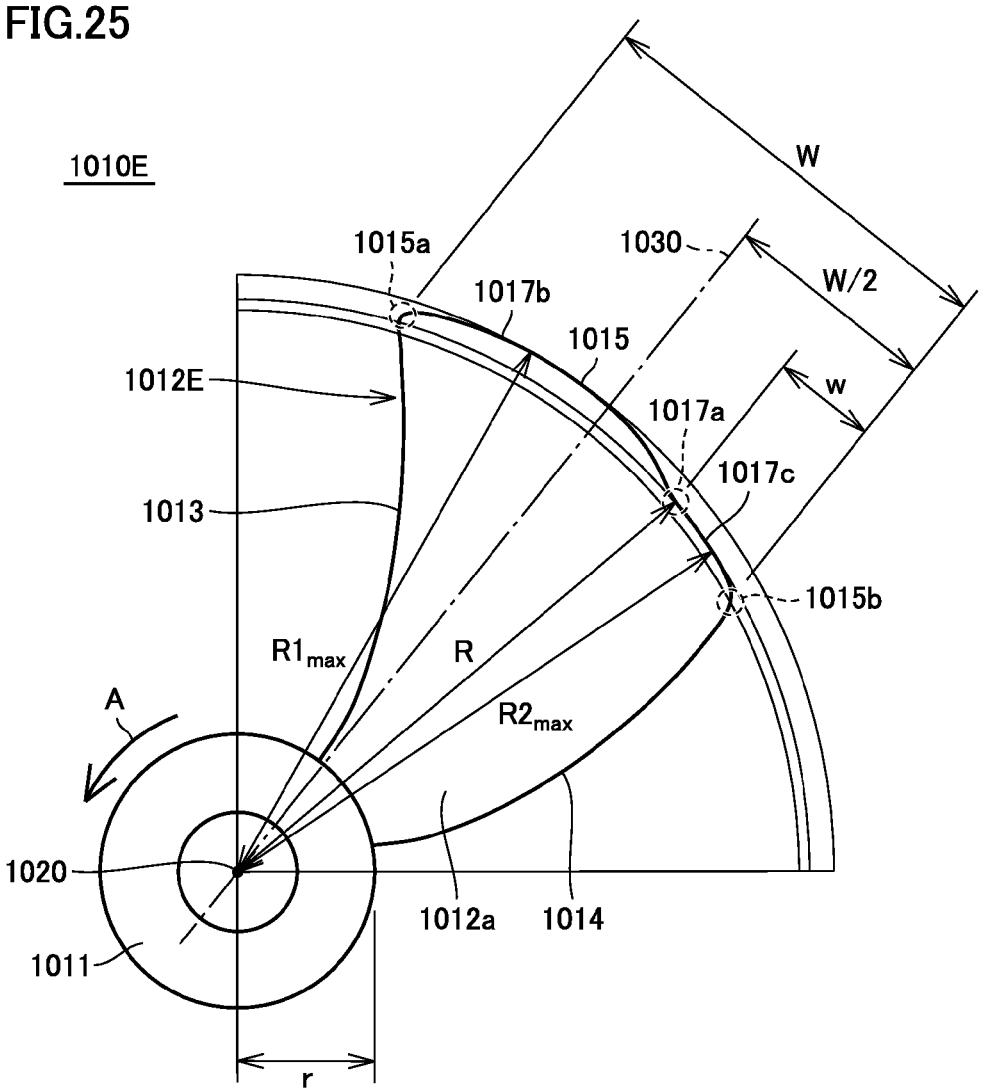
FIG. 25 is an enlarged rear view showing a shape of a blade of the propeller fan according to Variation 4.

FIGS. 24 and 25 are a rear view of the propeller fan according to Variation 4 and an enlarged rear view showing a shape of a blade, respectively.

As shown in FIGS. 24 and 25, propeller fan 1010E according to Variation 4 is different from propeller fan 1010B according to Variation 1 described above only in a shape of recessed connection portion 1017*a* provided in outer edge portion 1015, and they are otherwise common in construction to propeller fan 1010B according to Variation 1 described above. Specifically, in propeller fan 1010E, connection portion 1017*a* provided in outer edge portion 1015 is formed such that front outer edge portion 1017*b* and rear outer edge portion 1017*c* form a height difference and constructed such that maximum radius $R2_{max}$ of rear outer edge portion 1017*c* is smaller than maximum radius $R1_{max}$ of front outer edge portion 1017*b*.

Here, in blade 1012E of propeller fan 1010E according to the present Variation 4, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy a condition of $R=R2_{max}$.

With such a construction as well, the effect the same as the effect obtained in Variation 1 described above is obtained, and hence pressure fluctuation in generated wind is less, comfortably impinging wind can be sent, and noise can be lowered. In the present Variation 4, uniformity in wind velocity distribution along the radial direction can more effectively be realized because recessed connection portion 1017*a* provided in outer edge portion 1015 is greater than in Variation 1 described above.

(Variation 5)

Figure 26:
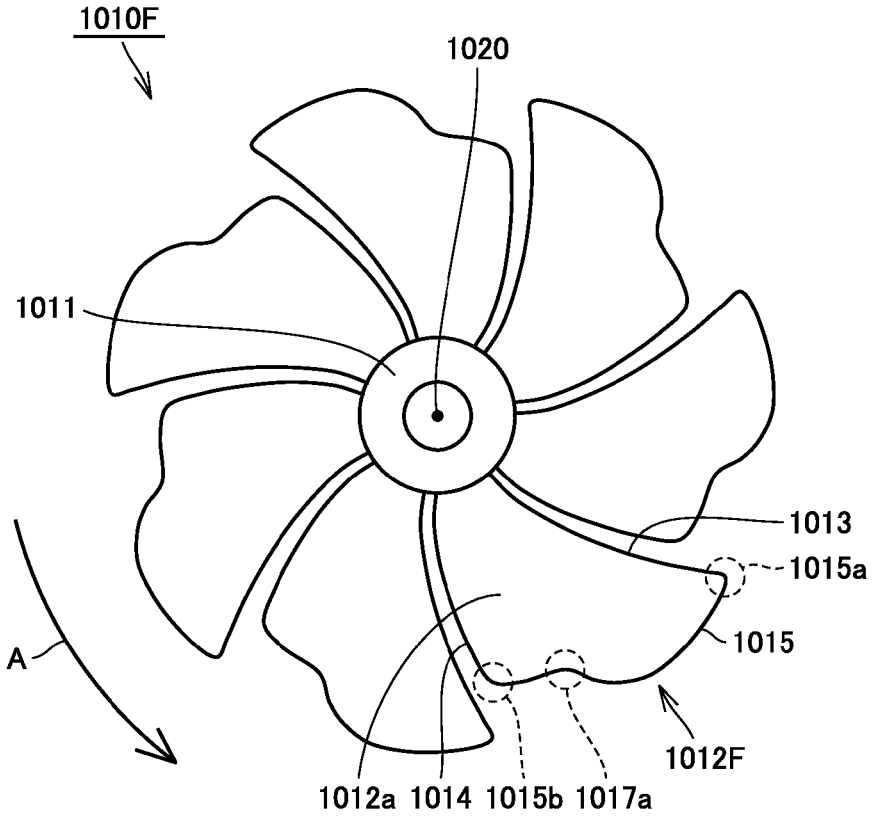
FIG. 26 is a rear view of a propeller fan according to a Variation 5.
Figure 27:
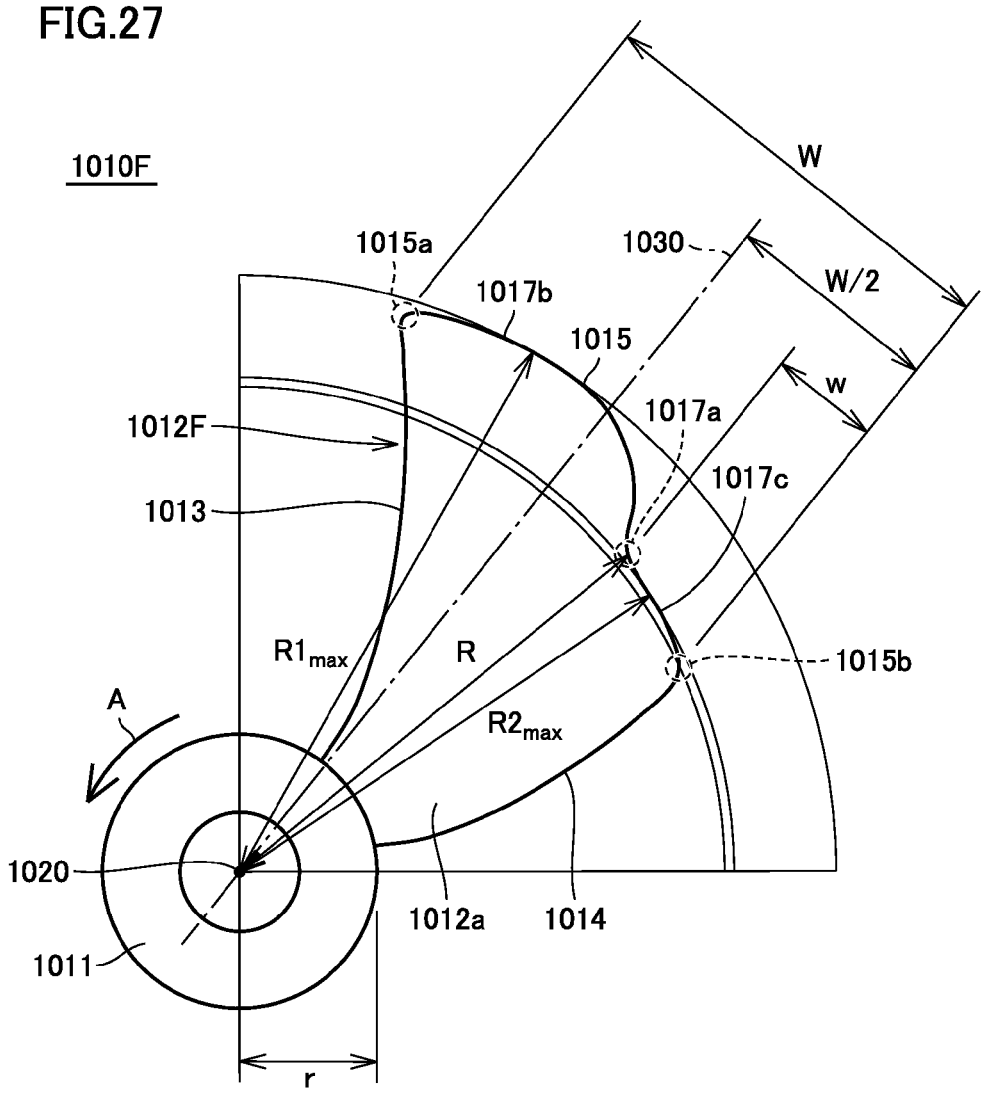
FIG. 27 is an enlarged rear view showing a shape of a blade of the propeller fan according to Variation 5.

FIGS. 26 and 27 are a rear view of the propeller fan according to Variation 5 and an enlarged rear view showing a shape of a blade, respectively.

As shown in FIGS. 26 and 27, propeller fan 1010F according to Variation 5 is different from propeller fan 1010B according to Variation 1 described above only in a shape of recessed connection portion 1017*a* provided in outer edge portion 1015, and they are otherwise common in construction to propeller fan 1010B according to Variation 1 described above. Specifically, in propeller fan 1010E, connection portion 1017*a* provided in outer edge portion 1015 is formed such that front outer edge portion 1017*b* and rear outer edge portion 1017*c* form a height difference and constructed such that maximum radius $R2_{max}$ of rear outer edge portion 1017*c* is significantly smaller than maximum radius $R1_{max}$ of front outer edge portion 1017*b*.

Here, in blade 1012F of propeller fan 1010F according to the present Variation 5, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy a condition of $R>R2_{max}$.

With such a construction as well, the effect the same as the effect obtained in Variation 1 described above is obtained, and hence pressure fluctuation in generated wind is less, comfortably impinging wind can be sent, and noise can be lowered. In the present Variation 5, uniformity in wind velocity distribution along the radial direction can more effectively be realized because recessed connection portion 1017*a* provided in outer edge portion 1015 is greater than in Variation 1 described above.

(Variation 6)

Figure 28:
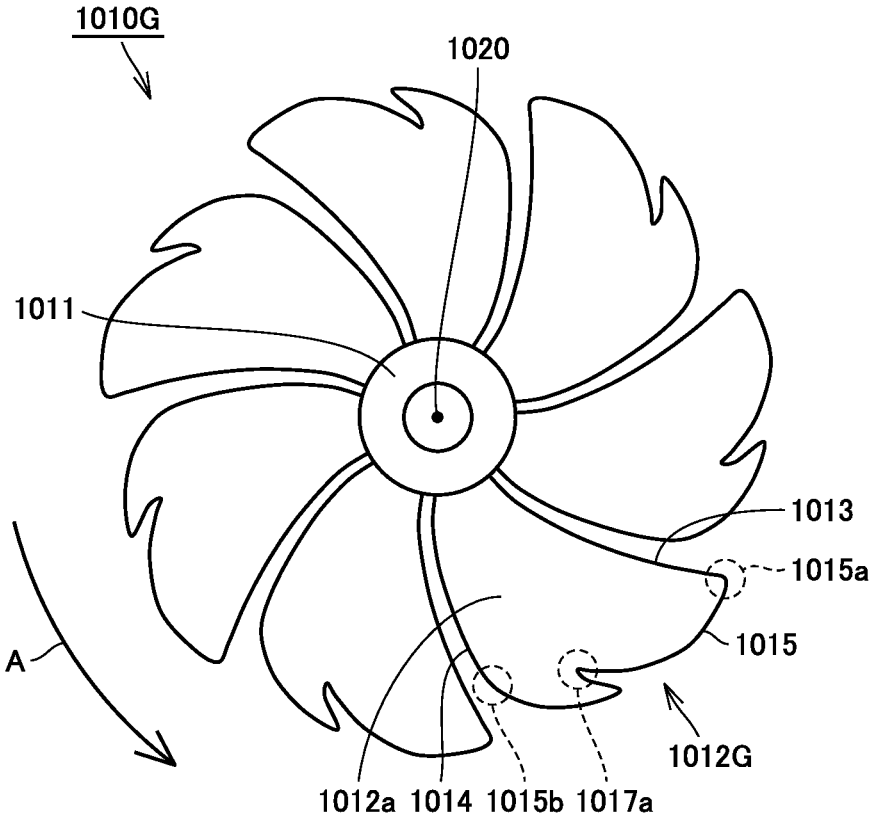
FIG. 28 is a rear view of a propeller fan according to a Variation 6.
Figure 29:
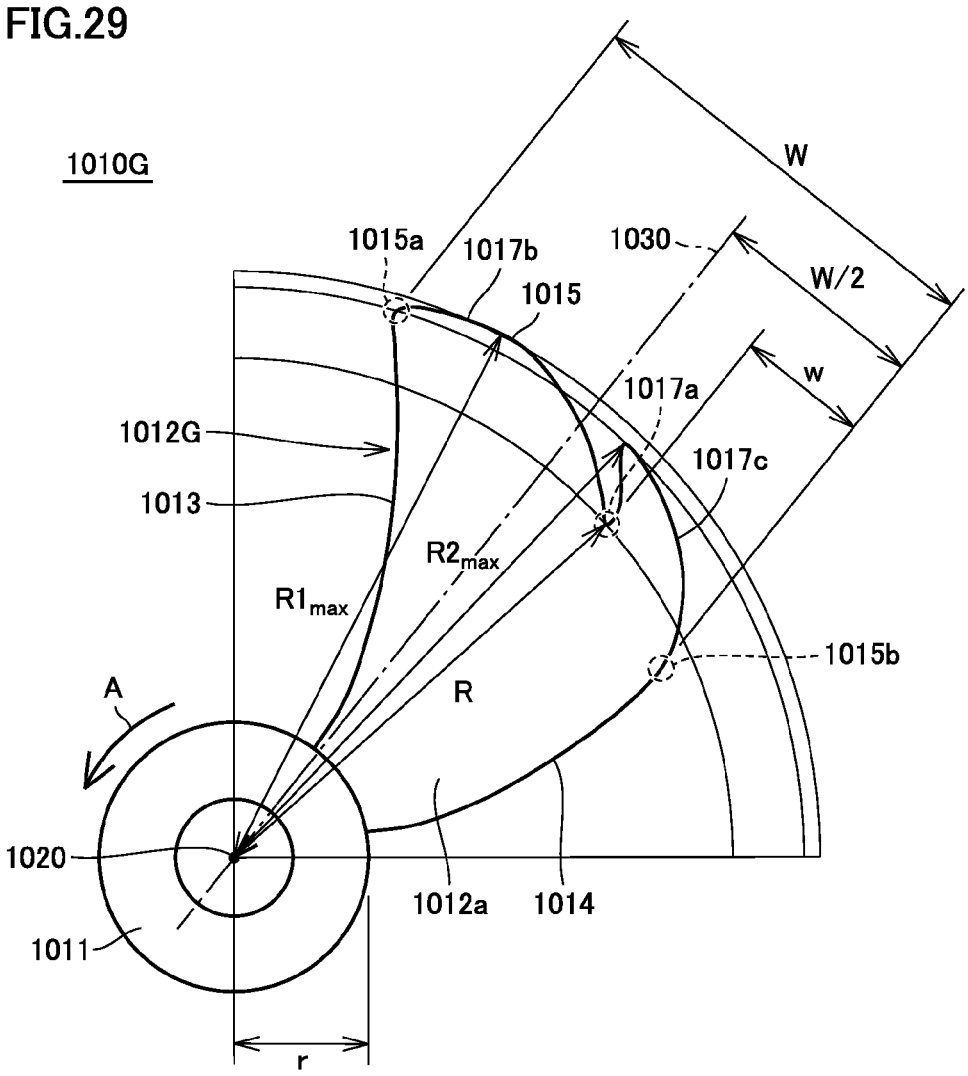
FIG. 29 is an enlarged rear view showing a shape of a blade of the propeller fan according to Variation 6.

FIGS. 28 and 29 are a rear view of the propeller fan according to Variation 6 and an enlarged rear view showing a shape of a blade, respectively.

As shown in FIGS. 28 and 29, propeller fan 1010G according to Variation 6 is different from propeller fan 1010B according to Variation 1 described above only in a shape of recessed connection portion 1017*a* provided in outer edge portion 1015, and they are otherwise common in construction to propeller fan 1010B according to Variation 1 described above. Specifically, in propeller fan 1010G, connection portion 1017*a* provided in outer edge portion 1015 is formed as being relatively deeply recessed and recessed connection portion 1017*a* is formed at a sharply pointed acute angle so as to have a wedge shape.

Here, in blade 1012G of propeller fan 1010G according to the present Variation 6, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 1 described above is obtained, and hence pressure fluctuation in generated wind is less, comfortably impinging wind can be sent, and noise can be lowered. In the present Variation 6, as compared with Variation 1 described above, such a function that front outer edge portion 1017*b* and rear outer edge portion 1017*c* provided in one blade 1012G function as if two blades sent wind more clearly appears, and as a whole, comfortably impinging wind less in pressure fluctuation can more effectively be realized.

With the construction above, a horseshoe vortex is generated in a portion where connection portion 1017*a* is provided, and the horseshoe vortex suppresses separation of a mainstream which flows over the blade surface. Therefore, noise is lowered and capability to send wind is enhanced. Furthermore, since the tip end of rear outer edge portion 1017*c* in the direction of rotation is located forward in the direction of rotation of connection portion 1017*a*, in addition to the horseshoe vortex generated over connection portion 1017*a*, the blade tip end vortex is also held over connection portion 1017*a* and separation of the mainstream can further be suppressed.

(Variation 7)

Figure 30:
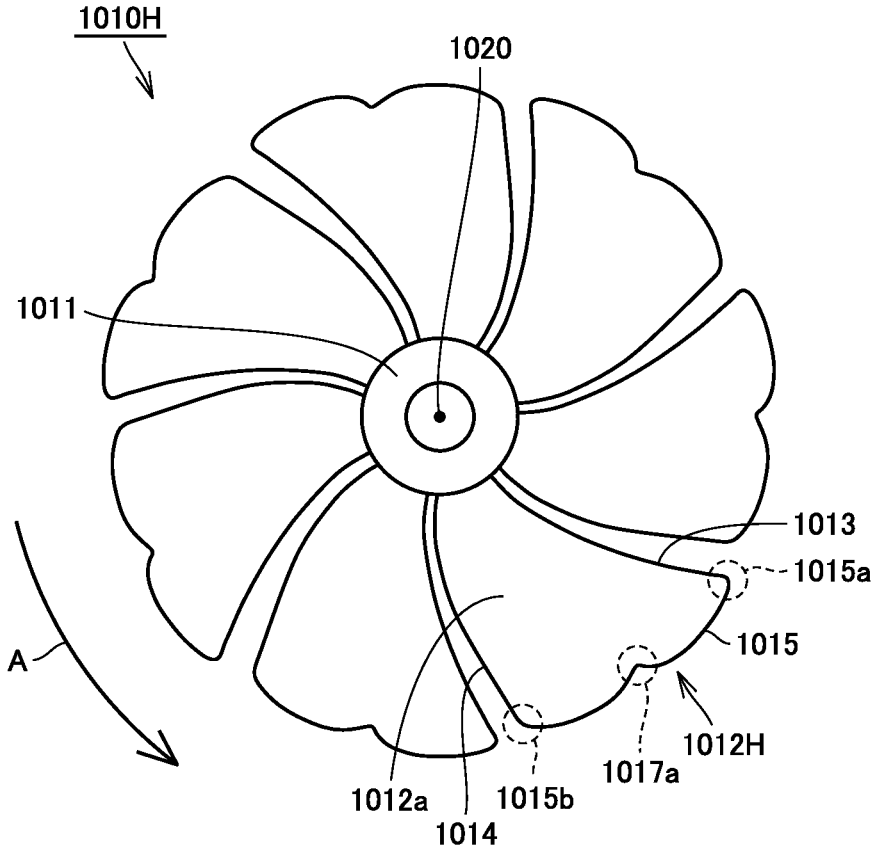
FIG. 30 is a rear view of a propeller fan according to a Variation 7.
Figure 31:
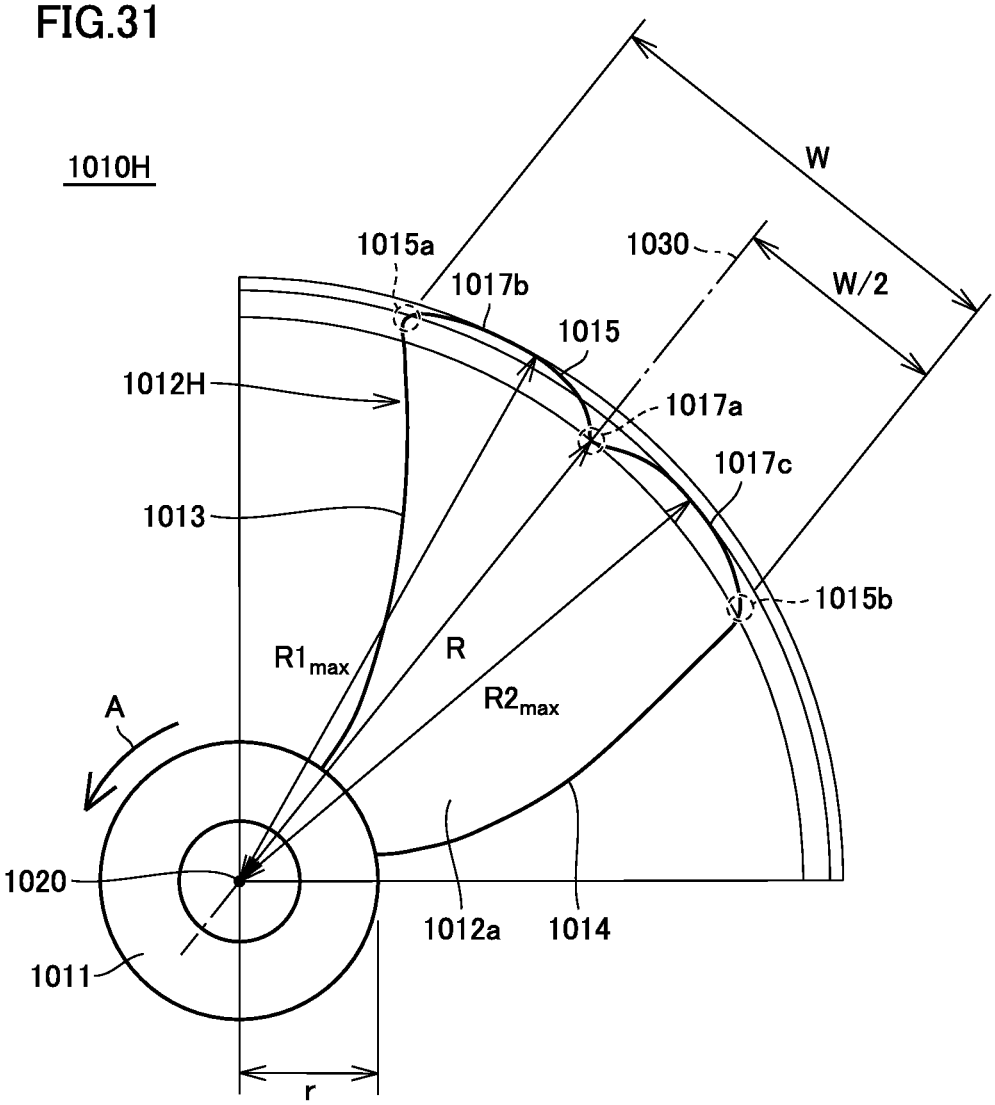
FIG. 31 is an enlarged rear view showing a shape of a blade of the propeller fan according to Variation 7.

FIGS. 30 and 31 are a rear view of the propeller fan according to Variation 7 and an enlarged rear view showing a shape of a blade, respectively.

As shown in FIGS. 30 and 31, propeller fan 1010H according to Variation 7 is different from propeller fan 1010B according to Variation 1 described above only in a position of recessed connection portion 1017*a* provided in outer edge portion 1015, and they are otherwise common in construction to propeller fan 1010B according to Variation 1 described above. Specifically, in propeller fan 1010H, connection portion 1017*a* is provided in a central portion along the direction of rotation of outer edge portion 1015.

Here, in blade 1012H of propeller fan 1010H according to the present Variation 7, distance W and distance w satisfy a condition of W/2=w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 1 described above is obtained, and hence pressure fluctuation in generated wind is less, comfortably impinging wind can be sent, and noise can be lowered.

(Variation 8)

Figure 32:
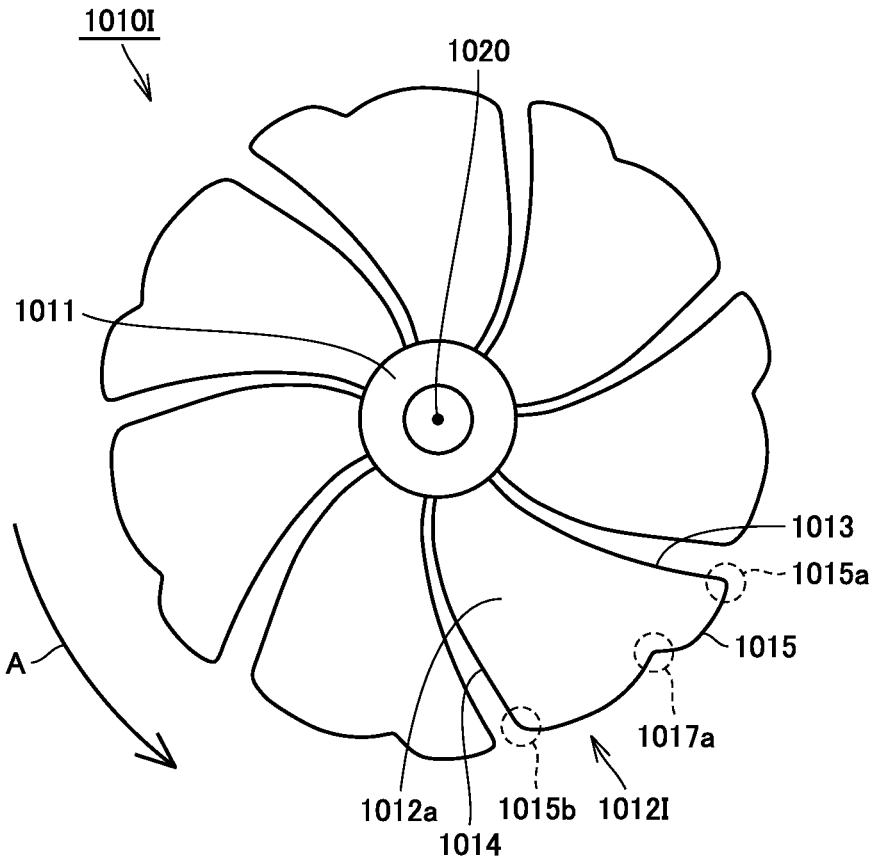
FIG. 32 is a rear view of a propeller fan according to a Variation 8.
Figure 33:
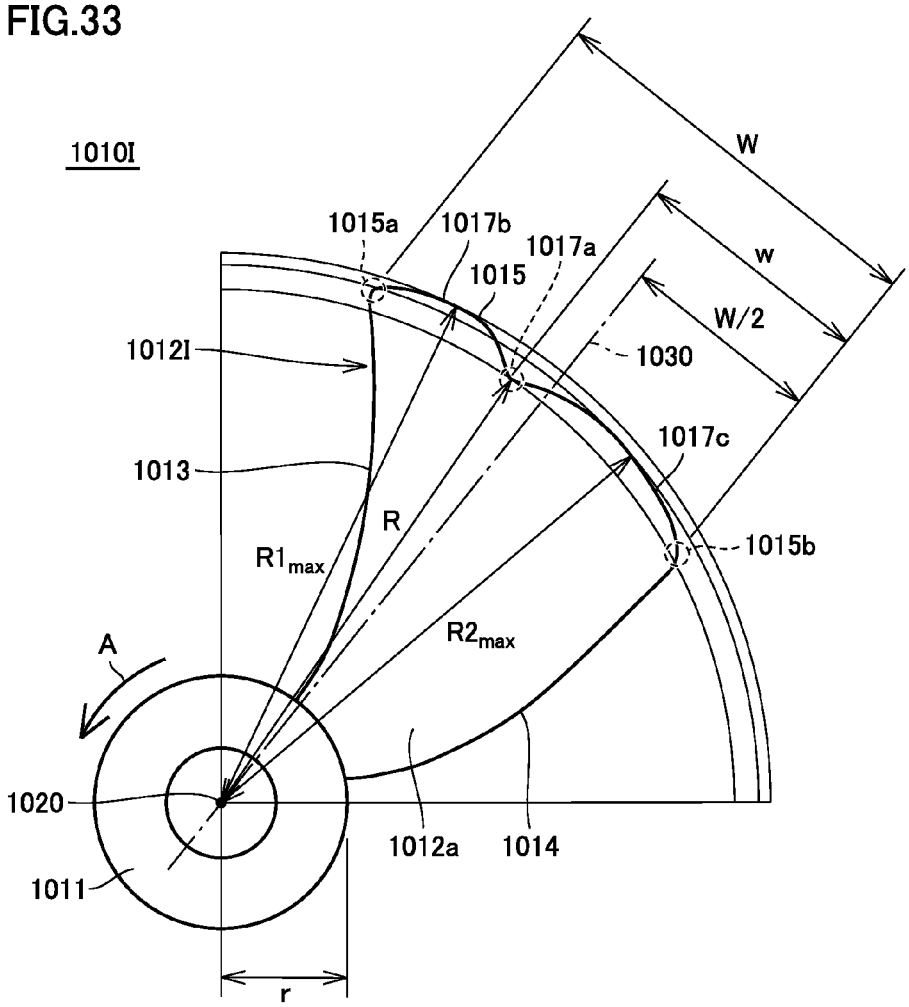
FIG. 33 is an enlarged rear view showing a shape of a blade of the propeller fan according to Variation 8.

FIGS. 32 and 33 are a rear view of the propeller fan according to Variation 8 and an enlarged rear view showing a shape of a blade, respectively.

As shown in FIGS. 32 and 33, propeller fan 1010I according to Variation 8 is different from propeller fan 1010B according to Variation 1 described above only in a position of recessed connection portion 1017*a* provided in outer edge portion 1015, and they are otherwise common in construction to propeller fan 1010B according to Variation 1 described above. Specifically, in propeller fan 1010I, connection portion 1017*a* is provided at a position close to front end 1015*a* of outer edge portion 1015.

Here, in blade 1012I of propeller fan 1010I according to the present Variation 8, distance W and distance w satisfy a condition of W/2<w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 1 described above is obtained, and hence pressure fluctuation in generated wind is less, comfortably impinging wind can be sent, and noise can be lowered.

(Variation 9)

Figure 34:
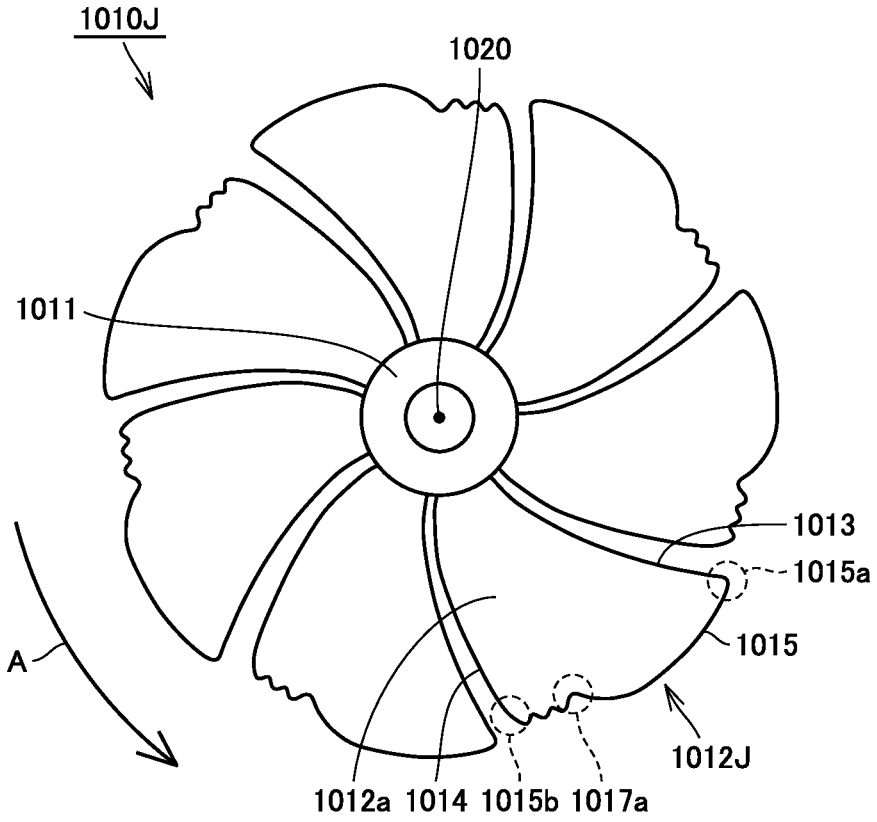
FIG. 34 is a rear view of a propeller fan according to a Variation 9.
Figure 35:
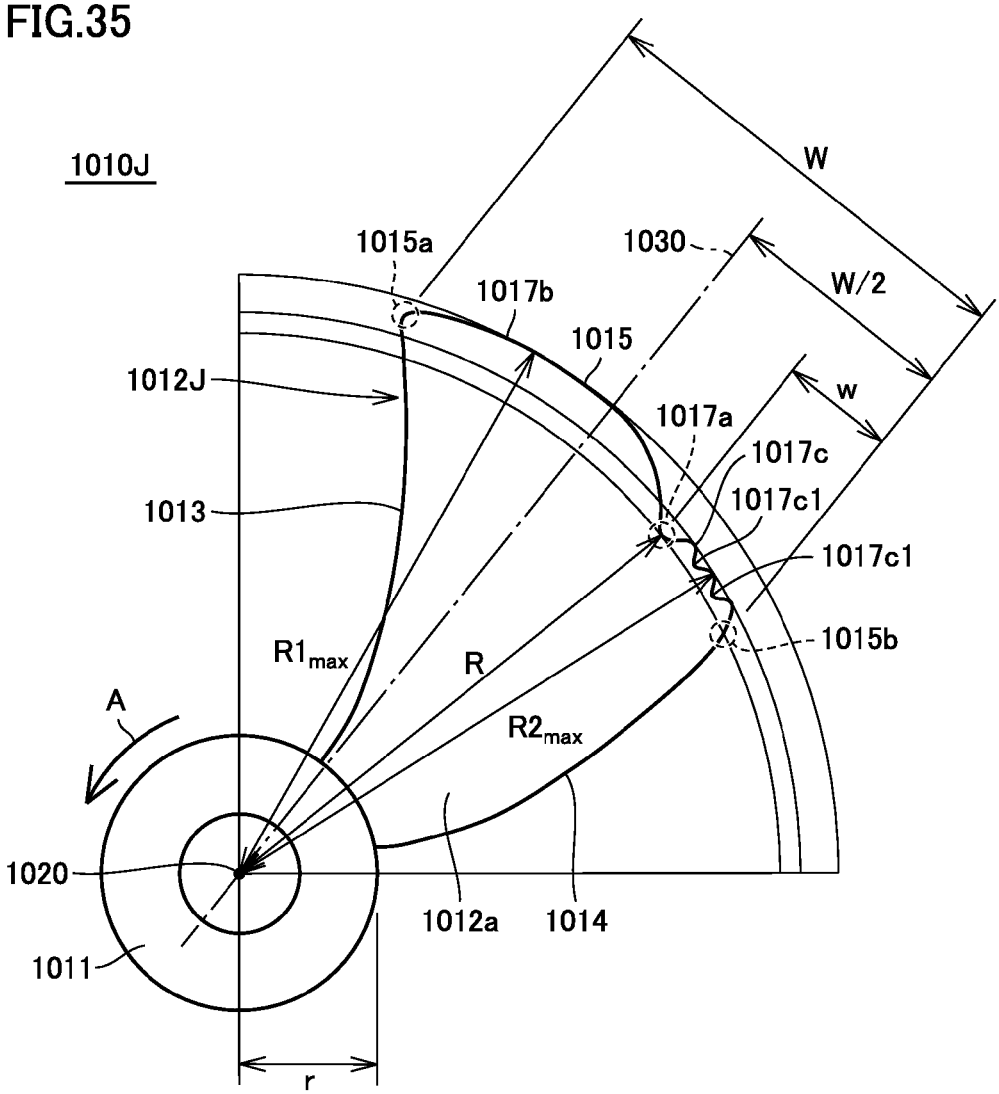
FIG. 35 is an enlarged rear view showing a shape of a blade of the propeller fan according to Variation 9.

FIGS. 34 and 35 are a rear view of the propeller fan according to Variation 9 and an enlarged rear view showing a shape of a blade, respectively.

As shown in FIGS. 34 and 35, propeller fan 1010) according to Variation 9 is different from propeller fan 1010D according to Variation 3 described above only in a shape of rear outer edge portion 1017*c* provided in outer edge portion 1015, and they are otherwise common in construction to propeller fan 1010D according to Variation 3 described above. Specifically, in propeller fan 1010J, a plurality of recesses 17*c*1 are further provided in rear outer edge portion 1017*c* formed by providing recessed connection portion 1017*a* in outer edge portion 1015.

Recess 17*c*1 has a recessed shape smaller than connection portion 1017*a* provided in outer edge portion 1015, and hence propeller fan 1010J according to the present Variation 9 has a shape similar to propeller fan 1010D according to Variation 3 as a whole. The number of recesses 17*c*1 is not limited to two as shown in the figures, and the number may be set to one or three or more.

Here, in blade 1012J of propeller fan 1010J according to the present Variation 9, distance W and distance w satisfy the condition of W/2>w, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, the effect the same as the effect obtained in Variation 3 described above is obtained, and hence pressure fluctuation in generated wind is less, comfortably impinging wind can be sent, and noise can be lowered. In the present Variation 9, as compared with Variation 3 described above, owing to a plurality of recesses 17*c*1 provided in rear outer edge portion 1017*c*, such a function that one blade 1012J functions as if a plurality of blades sent wind more clearly appears, and as a whole, comfortably impinging wind less in pressure fluctuation can more effectively be realized.

(Variation 10)

Figure 36:
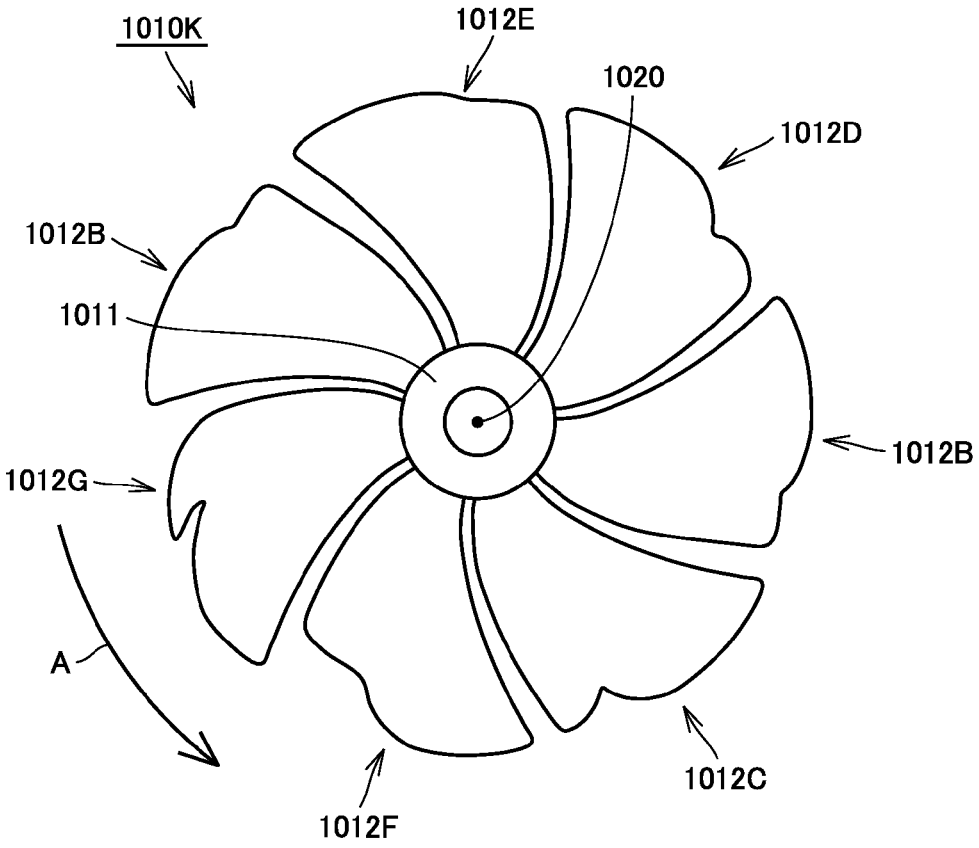
FIG. 36 is a rear view of a propeller fan according to a Variation 10.

FIG. 36 is an enlarged rear view showing a shape of a blade of the propeller fan according to Variation 10. As shown in FIG. 36, in propeller fan 1010K according to the present Variation 10, a plurality of blades projecting radially outward from boss hub portion 1011 are different in shape from one another.

Here, the blades are arranged, for example, in such a manner that blades 1012A to 1012J shown in the present embodiment described above and Variations 1 to 9 based thereon are selected as appropriate. Thus, the blades do not necessarily have to be identical in shape and may be different from one another.

It has generally been known that, when a blade passes by a portion in the vicinity of a fixed point of a casing covering the propeller fan (a guard in the electric fan) in a constant cycle, narrow-band noise called blade passage noise is generated. Therefore, with propeller fan 1010K having blades different from one another in a specific shape of recessed connection portion 1017*a* provided in outer edge portion 1015 as in the present Variation 10, a cycle of passage of recessed connection portion 1017*a* by a portion in the vicinity of a fixed point of the casing is positively shifted. Therefore, generation of blade passage noise described above can be suppressed and noise is further lowered.

Embodiment A2

Figure 37:
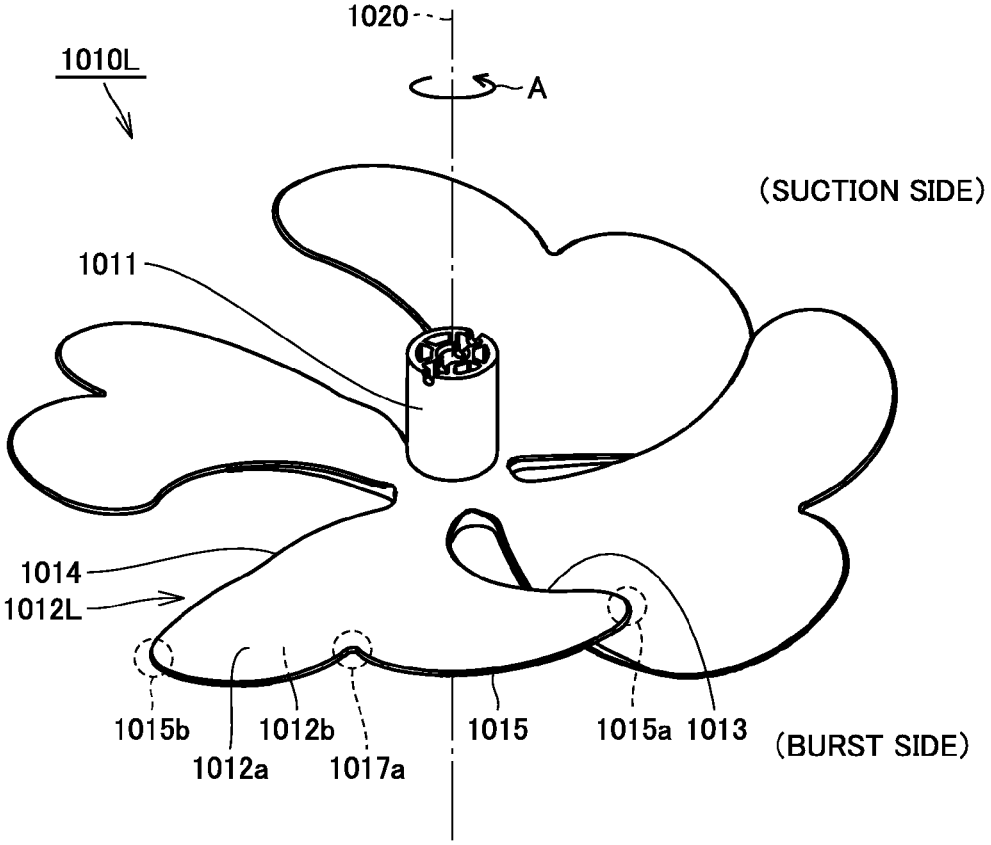
FIG. 37 is a perspective view of a propeller fan in an Embodiment A2 of the present invention viewed from a rear surface side.
Figure 38:
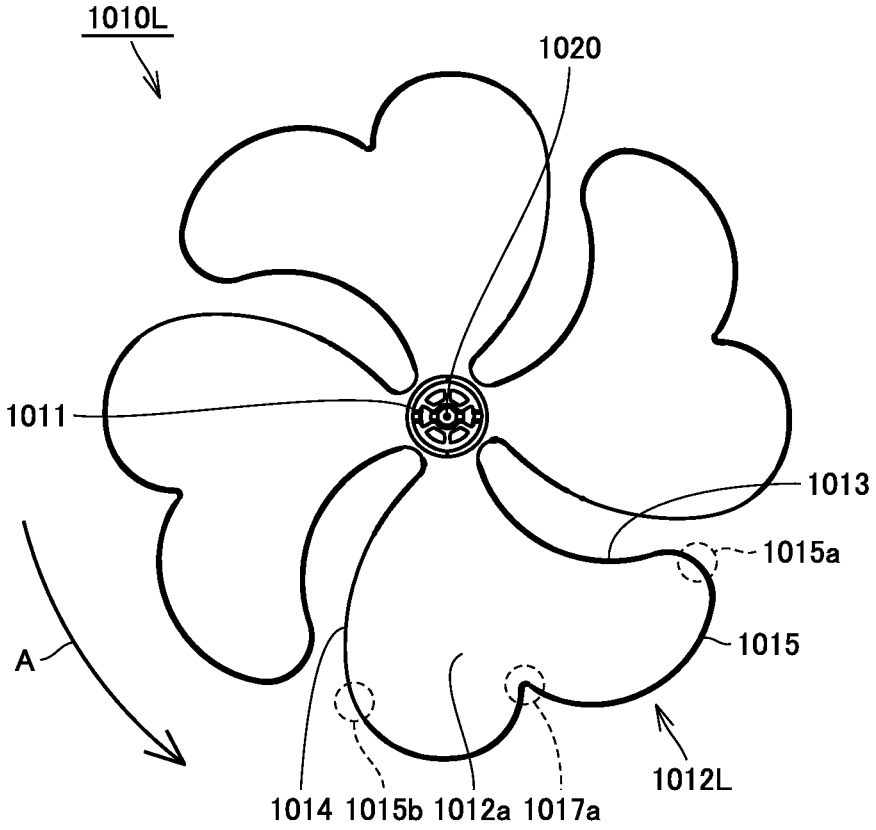
FIG. 38 is a rear view of the propeller fan in Embodiment A2 of the present invention.
Figure 39:
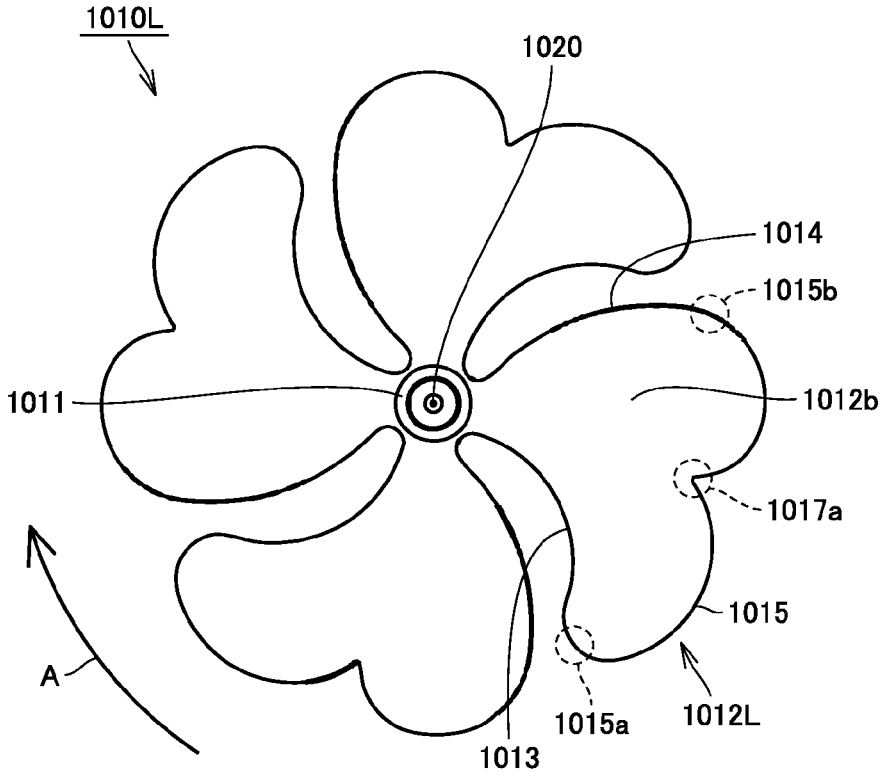
FIG. 39 is a front view of the propeller fan in Embodiment A2 of the present invention.
Figure 40:
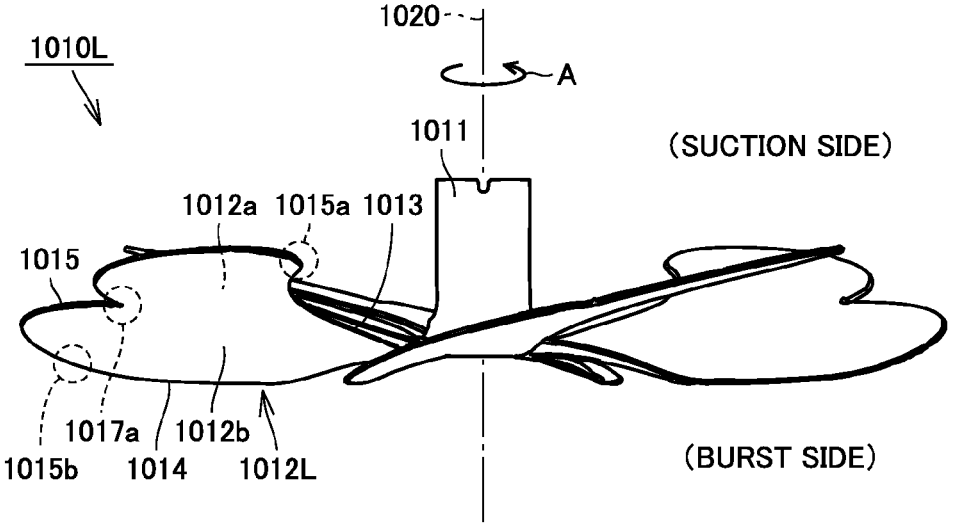
FIG. 40 is a side view of the propeller fan in Embodiment A2 of the present invention.
Figure 41:
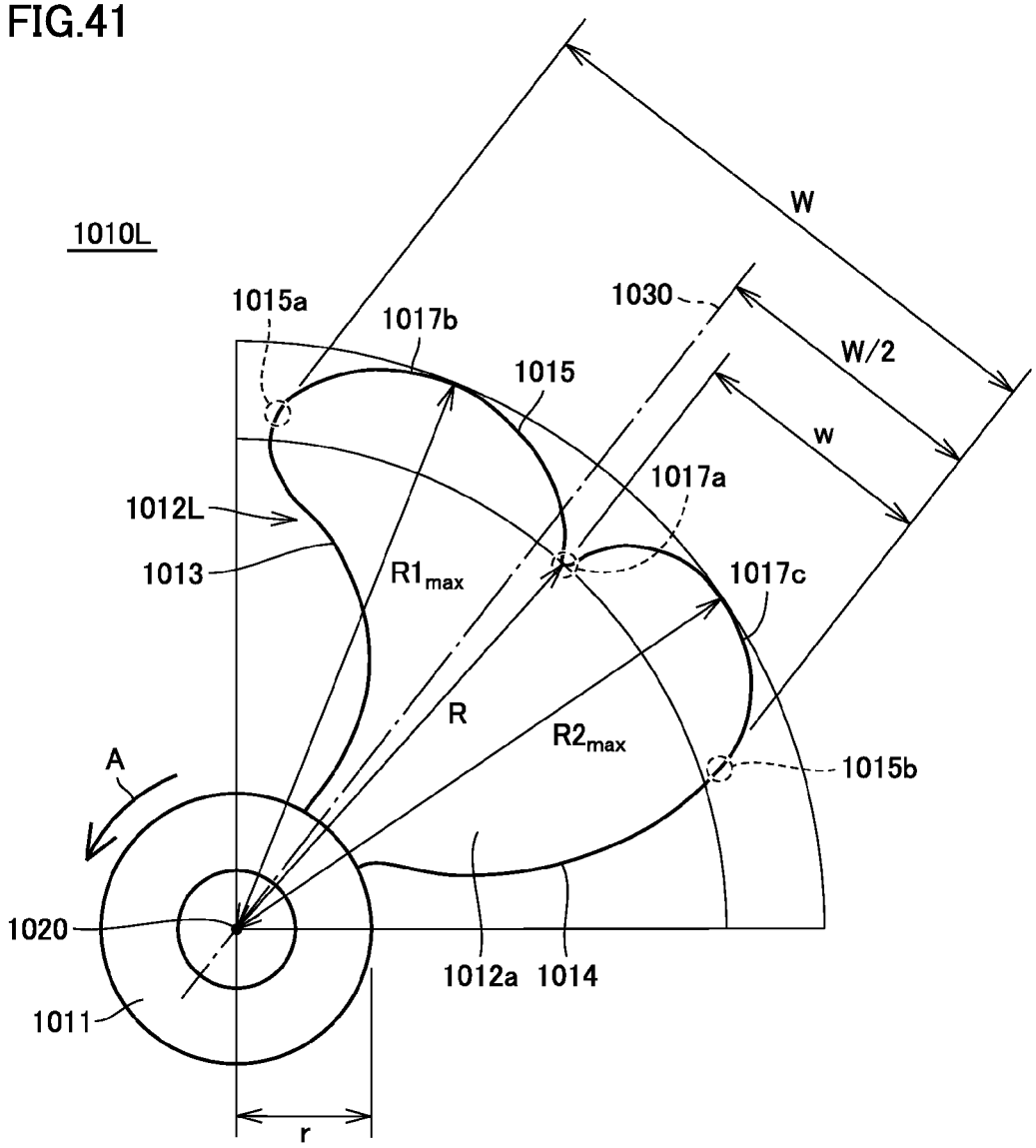
FIG. 41 is an enlarged rear view showing a shape of a blade of the propeller fan in Embodiment A2 of the present invention.

FIG. 37 is a perspective view of a propeller fan in Embodiment A2 of the present invention viewed from a rear surface side, and FIGS. 38 to 40 are a rear view, a front view, and a side view of the propeller fan in the present embodiment, respectively. FIG. 41 is an enlarged rear view showing a shape of a blade of the propeller fan in the present embodiment. A propeller fan 1010L in the present embodiment will be described below with reference to FIGS. 37 to 41. Propeller fan 1010L in the present embodiment is used as being mounted on electric fan 1001 similarly to propeller fan 1010A shown in Embodiment A1 described above.

As shown in FIGS. 37 to 40, propeller fan 1010L in the present embodiment has four blades, and each blade 1012L has front edge portion 1013, rear edge portion 1014, and outer edge portion 1015 in a smooth shape which is curved more than in blade 1012B of propeller fan 1010B according to Variation 1 based on Embodiment A1 described above. Blade 1012L provided in propeller fan 1010L in the present embodiment is the same in basic structure as blade 1012B provided in propeller fan 1010B according to Variation 1 based on Embodiment A1 described above, except for having front edge portion 103, rear edge portion 1014, and outer edge portion 1015 in a more curved, smoother shape. A shape of blade 1012L provided in propeller fan 1010L will be described below in further detail.

As shown in FIGS. 37 to 41, in outer edge portion 1015 of blade 1012L, connection portion 1017*a* having a shape recessed toward central axis 1020 is formed. Connection portion 1017*a* is formed at a position in midway between front end 1015*a* and rear end 1015*b* of outer edge portion 1015.

As connection portion 1017*a* described above is formed in outer edge portion 1015, in outer edge portion 1015 of blade 1012L, front outer edge portion 1017*b* (see FIG. 41) located on the side of front end 1015*a* of outer edge portion 1015 and rear outer edge portion 1017*c* (see FIG. 41) located on the side of rear end 1015*b* of outer edge portion 1015 are provided.

Here, though connection portion 1017*a* is preferably formed in a smoothly curved shape as illustrated, it does not necessarily have to be in a curved shape but it may be in a bent shape. In the present embodiment, since connection portion 1017*a* is formed as being relatively deeply recessed, connection portion 1017*a* has a shape substantially at an acute angle.

A position where connection portion 1017*a* is formed is not particularly limited so long as the position is toward rear end 1015*b* relative to the central portion along the direction of rotation of outer edge portion 1015. In the present embodiment, however, connection portion 1017*a* is formed at a position close to the central portion, among positions close to rear end 1015*b* of outer edge portion 1015. Therefore, in the present embodiment, a width of front outer edge portion 1017*b* along the direction of rotation is formed to be slightly greater than a width of rear outer edge portion 1017*c* along the direction of rotation.

More specifically, as shown in FIG. 41, when bisector 1030 of an angle formed by a line segment connecting front end 1015*a* of outer edge portion 1015 and central axis 1020 to each other and a line segment connecting rear end 1015*b* of outer edge portion 1015 and central axis 1020 to each other is drawn, distance W and distance w satisfy the condition of $W/2>w$, where W represents a distance between front end 1015*a* and rear end 1015*b* along a direction orthogonal to bisector 1030 and w represents a distance between rear end 1015*b* and a point located on the radially innermost side in connection portion 1017*a*, along the direction orthogonal to bisector 1030.

As shown in FIG. 41, in the present embodiment, in a plan view of blade 1012A along central axis 1020, maximum radius $R1_{max}$ from central axis 1020 of front outer edge portion 1017*b* and maximum radius $R2_{max}$ from central axis 1020 of rear outer edge portion 1017*c* satisfy a condition of $R1_{max}=R2_{max}$.

Furthermore, as shown in FIG. 41, in the present embodiment, in the plan view of blade 1012L along central axis 1020, radius R and maximum radius $R2_{max}$ satisfy the condition of $R<R2_{max}$, where R represents a radius from central axis 1020, of the point located on the radially innermost side in connection portion 1017*a*.

With blade 1012L in a shape satisfying such a condition as illustrated, an effect as below is obtained.

Firstly, with blade 1012L constructed as above, wind velocity distribution in a radial direction can be more uniform, variation in wind velocity can be suppressed, and comfortably impinging wind can be obtained. Since the effect is the same as the effect described in Embodiment A1 described above, details thereof will not be repeated.

Secondly, with blade 1012L constructed as above, pressure fluctuation included in wind generated in a portion close to the radially outer side is less and comfortably impinging wind is obtained.

Namely, in a case of a blade shape not having a recessed connection portion formed in the outer edge portion, air passes through a relatively large space between blades and great pressure fluctuation is caused in generated wind. This is particularly noticeable in a portion on the side of the outer edge portion where wind higher in velocity is generated, and wind greater in pressure difference is generated as the number of blades is smaller.

In contrast, in the present embodiment, the blade shape is such that recessed connection portion 1017*a* is formed in outer edge portion 1015. Therefore, a relatively small space (that is, a space where recessed connection portion 1017*a* is located) is formed between front outer edge portion 1017*b* and rear outer edge portion 1017*c* in one blade 1012L, and the space is present as a space in blade 1012L where no wind is generated. Consequently, in a portion on the side of outer edge portion 1015 where wind high in velocity is generated, a pressure difference caused in generated wind is lessened as a result of decrease in area of the blade, and in addition, a pressure fluctuates in a more finely stepwise manner. Therefore, front outer edge portion 1017*b* and rear outer edge portion 1017*c* provided in one blade 1012L function as if two blades sent wind, and comfortably impinging wind less in pressure fluctuation as a whole can be generated.

Figure 42:
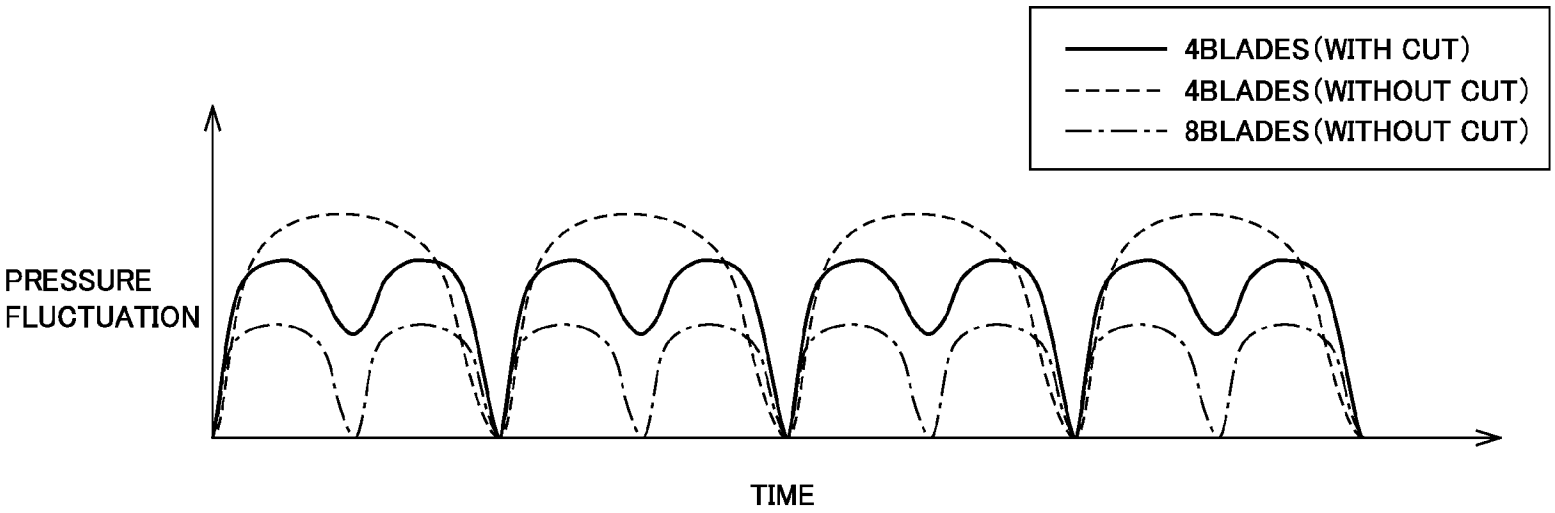
FIG. 42 is a graph conceptually showing pressure fluctuation at the time when various propeller fans including the propeller fan in Embodiment A2 of the present invention are rotated.

Details of the effect will be described here with reference to the drawings. FIG. 42 is a graph conceptually showing pressure fluctuation at the time when various propeller fans including the propeller fan in the present embodiment are rotated. In FIG. 42, the abscissa represents time and the ordinate represents pressure fluctuation at a fixed point on the burst side of the propeller fan (a position corresponding to the outer edge portion of the blade).

Pressure fluctuation at the fixed point observed at the time when a 4-blade propeller fan having a recessed connection portion formed in the outer edge portion as in the present embodiment, a 4-blade propeller fan not having a recessed connection portion formed in the outer edge portion, and a 8-blade propeller fan not having a recessed connection portion formed in the outer edge portion are rotated is generally as shown in FIG. 42.

As understood from FIG. 42, in the 4-blade propeller fan having a recessed connection portion formed in the outer edge portion as in the present embodiment, as compared with the 4-blade propeller fan not having a recessed connection portion formed in the outer edge portion, pressure fluctuation was suppressed and a peak thereof appears at the timing close to that of the 8-blade propeller fan not having a recessed connection portion formed in the outer edge portion. This indicates that front outer edge portion 1017*b* and rear outer edge portion 1017*c* provided in one blade 1012L function as if two blades sent wind, and consequently, it is understood that, with propeller fan 1010L in the present embodiment, comfortably impinging wind with pressure fluctuation being suppressed can be generated.

Thirdly, with blade 1012L constructed as above, during rotation at a low speed, comfortably impinging wind diffusing over a wide range can be obtained, and during rotation at a high speed, wind high in straightness and reaching farther can be obtained. Since the effect is the same as the effect described in Embodiment A1 described above, description of details thereof will not be repeated.

Thus, with propeller fan 1010L in the present embodiment, pressure fluctuation in generated wind is less, comfortably impinging wind can be sent, and noise can be lowered.

Then, a third verification test in which relation between a shape of the connection portion provided in the outer edge portion described above and the effect described above was verified will now be described. In the third verification test, a plurality of samples different in position along the direction of rotation and the radial direction of the connection portion provided on the outer edge portion were prepared, and based thereon, each sample was rotated and a quantity of wind obtained at that time and pressure fluctuation included in obtained wind were measured.

Here, in each sample, a position where the connection portion is provided is predetermined, a triangle having the connection portion as one vertex is drawn in a portion close to the outer edge portion of the blade, and a part of the blade was cut in a shape substantially in conformity with the triangle. From a point of view of lowering in noise generated during rotation, however, the outer edge portion was moderately curved such that the connection portion and the front outer edge portion and the rear outer edge portion formed with the connection portion lying as the boundary are all in a smooth shape without a corner.

A quantity of wind and pressure fluctuation were measured at a position corresponding to a position distant by 30 mm on the burst side along the central axis of the propeller fan, at which a distance in the radial direction from the center of rotation of the propeller fan was 70% of the maximum radius of the outer edge portion. The position corresponding to the position where a distance in the radial direction from the center of rotation of the propeller fan is 70% of the maximum radius of the outer edge portion is substantially a position at which a wind velocity is highest and hence also a position where pressure fluctuation is maximal.

Figure 43:
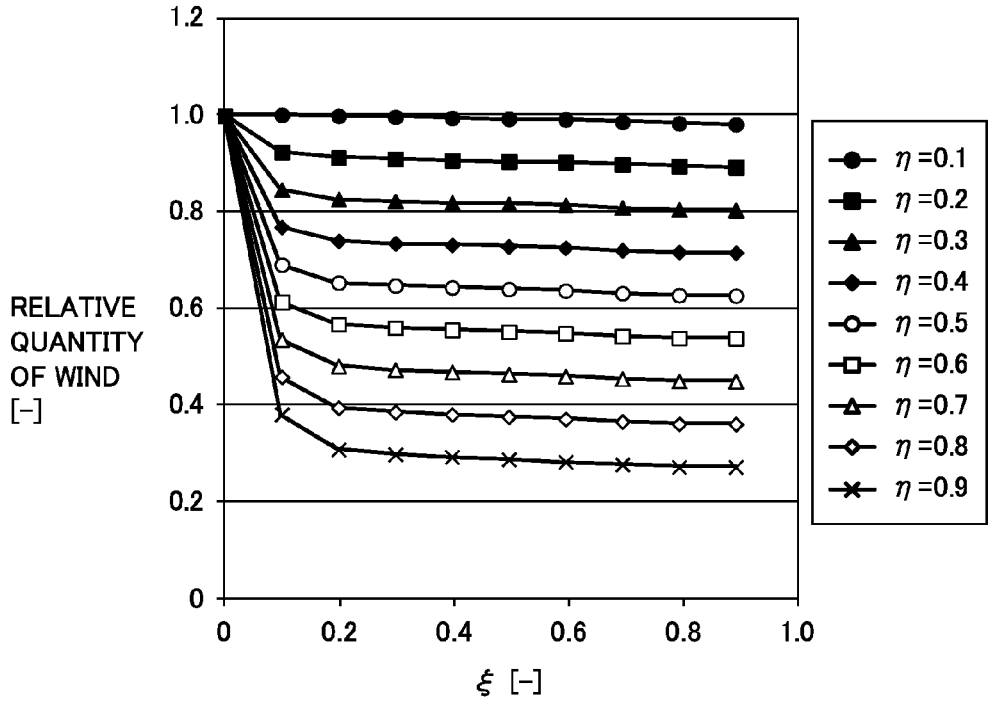
FIG. 43 is a graph showing relation between a shape of a blade and a relative quantity of wind obtained in a third verification test.

FIG. 43 is a graph showing relation between a shape of a blade and a relative quantity of wind obtained in the third verification test. Here, in FIG. 43, the abscissa represents a position along the direction of rotation of the connection portion and the ordinate represents a relative quantity of wind. $\xi$ shown on the abscissa represents a value represented by w/W using distance W and distance w described above, and $\eta$ represents a value expressed by $(R1_{max}-R)/(R1_{max}-r)$ using maximum radius $R1_{max}$, radius R, and radius r of the boss hub portion (see FIG. 41) described above. The relative quantity of wind shown on the ordinate is a value calculated by dividing a quantity of wind measured in each sample by a quantity of wind in the propeller fan not having a recessed connection portion formed in the outer edge portion.

As shown in FIG. 43, it is understood that the quantity of wind tends to gradually decrease as the connection portion is located toward the front end from the rear end of the outer edge portion along the direction of rotation, and the quantity of wind tends to gradually decrease as the connection portion is located toward the center of rotation from a position close to the outer edge portion along the radial direction.

Figure 44:
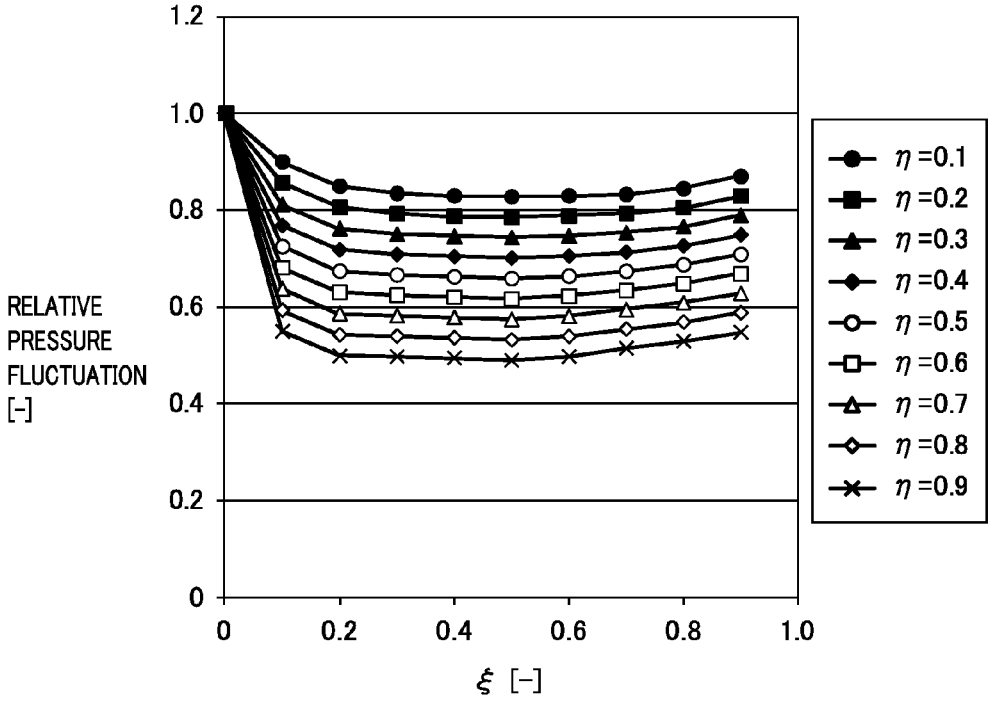
FIG. 44 is a graph showing relation between a shape of a blade and relative pressure fluctuation obtained in the third verification test.

FIG. 44 is a graph showing relation between a shape of a blade and a relative pressure fluctuation obtained in the third verification test. Here, in FIG. 44, the abscissa represents a position along the direction of rotation of the connection portion and the ordinate represents relative pressure fluctuation. Relative pressure fluctuation shown on the ordinate is represented by a value calculated by dividing a maximum value of a pressure difference measured in each sample by a maximum value of a pressure difference in the propeller fan not having a recessed connection portion formed in the outer edge portion.

As shown in FIG. 44, it is understood that, when the connection portion is located close to the rear end of the outer edge portion along the direction of rotation, pressure fluctuation tends to gradually decrease as the connection portion is located toward the front end from the rear end of the outer edge portion, and when the connection portion is located close to the front end of the outer edge portion along the direction of rotation, pressure fluctuation tends to gradually increase as the connection portion is located toward the front end from the rear end of the outer edge portion. It is understood that pressure fluctuation tends to gradually decrease as the connection portion is located toward a position close to the center of rotation, from a position close to the outer edge portion along the radial direction.

Based on the results in FIGS. 43 and 44, in order to prevent lowering in quantity of wind while pressure fluctuation is effectively suppressed, it can be concluded that $\xi$ suitably satisfies relation of $0<\xi<0.5$. Namely, it can be seen that, as the recessed connection portion is provided at a position close to the rear end of the outer edge portion, lowering in quantity of wind can be prevented while pressure fluctuation is effectively suppressed.

Figure 45:
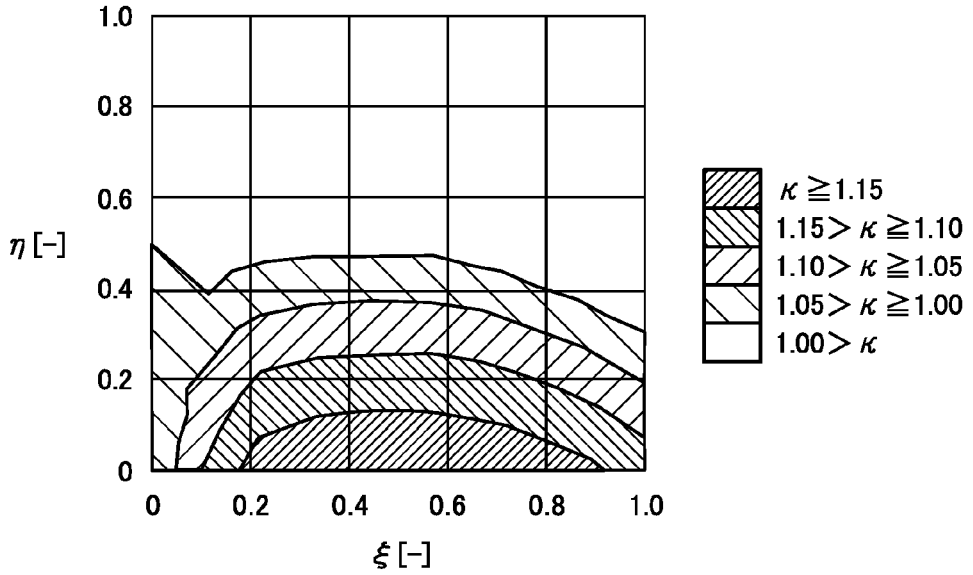
FIG. 45 is a contour diagram showing relation between a shape of a blade and a comfort index obtained in the third verification test.

FIG. 45 is a contour diagram showing relation between a shape of a blade and a comfort index obtained in the third verification test. The contour diagram represents results in the third verification test as fan performance including comfort index $\kappa$ based on the results shown in FIGS. 43 and 44 described above. Comfort index $\kappa$ is calculated by dividing the relative quantity of wind shown in FIG. 43 by relative pressure fluctuation shown in FIG. 44, and a higher value thereof indicates higher comfort. In FIG. 45, the abscissa represents a position along the direction of rotation of the connection portion and the ordinate represents a position along the radial direction of the connection portion.

As shown in FIG. 45, with attention being paid to $\xi$, in order to improve comfort index $\kappa$ by 5% or more as compared with the propeller fan not having a recessed connection portion formed in the outer edge portion, at least $\xi$ should substantially satisfy a condition of $0.05\leq\xi$. On the other hand, with attention being paid to $\eta$, in order to improve comfort index $\kappa$ by 5% or more as compared with the propeller fan not having a recessed connection portion formed in the outer edge portion, at least $\eta$ should substantially satisfy a condition of $0<\eta\leq0.4$.

Furthermore, with attention being paid to both of $\xi$ and $\eta$, as $\xi$ satisfies a condition of $0.2\leq\xi\leq0.8$ and $\eta$ satisfies a condition of $0<\eta\leq0.2$, as compared with the propeller fan not having a recessed connection portion formed in the outer edge portion, comfort index $\kappa$ reliably improves by 10% or more.

Then, a fourth verification test in which relation between the shape of the connection portion provided in the outer edge portion described above and the effect described above was verified will now be described. In the fourth verification test, the propeller fan in the present embodiment described above was actually prototyped, which was defined as an Example 2, a propeller fan different in shape therefrom was actually prototyped, which was defined as a Comparative Example 1, and a wind velocity at the time when the propeller fans in Example 2 and Comparative Example 1 were rotated was measured to calculate wind velocity distribution in the radial direction. Here, the propeller fan according to Comparative Example 1 is the same as described in the embodiment described above.

A wind velocity was measured at a position distant by 30 mm on the burst side along the central axis of the propeller fan, and in order to grasp distribution in the radial direction, a point of measurement was disposed at a position every 0.1 time of a distance from the central axis, up to a position at which a distance from the central axis was 1.1 time as large as the maximum radius of the outer edge portion.

Figure 46:
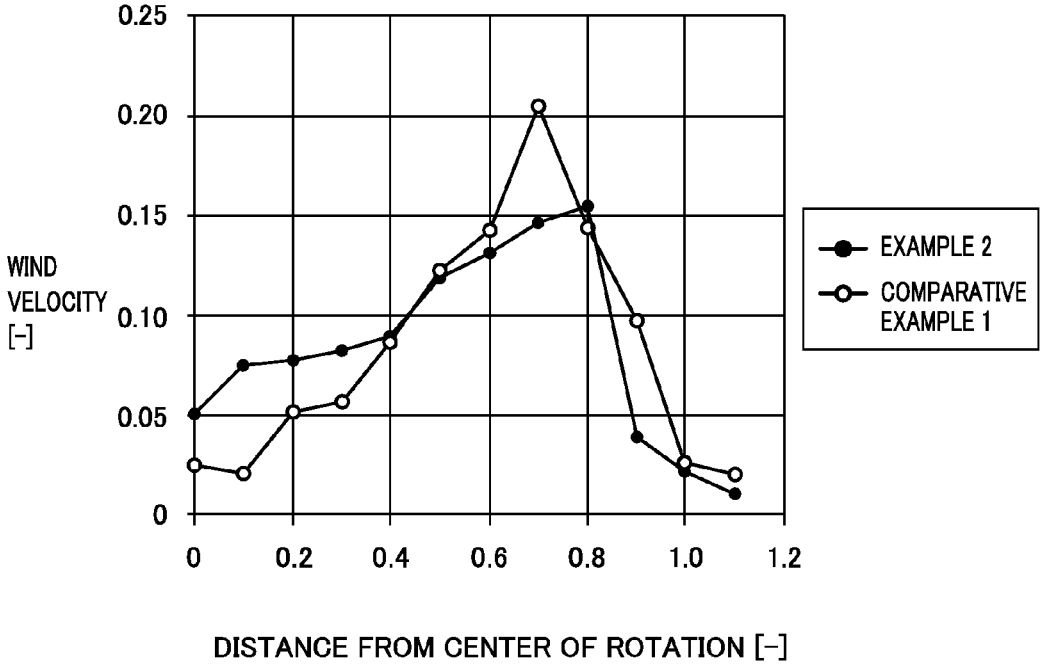
FIG. 46 is a graph showing relation between a wind velocity and a distance from a center of rotation of propeller fans according to an Example 2 and a Comparative Example 1, which is obtained in a fourth verification test.

FIG. 46 is a graph showing relation between a wind velocity and a distance from the center of rotation of the propeller fans according to Example 2 and Comparative Example 1, which was obtained in the fourth verification test. Here, in FIG. 46, the abscissa represents a distance from the center of rotation and the ordinate represents a wind velocity. The abscissa represents a distance from the center of rotation with a dimensionless value, with a position corresponding to the center of rotation being defined as 0 and a position corresponding to the outer edge portion being defined as 1, and the ordinate represents a wind velocity with a dimensionless value obtained by matching a quantity of wind between Example 2 and Comparative Example 1 and dividing an actually measured value of the wind velocity by a quantity of wind.

As shown in FIG. 46, in the propeller fan according to Comparative Example 1, such a tendency that a wind velocity is low on the radially inner side, the wind velocity gradually increases radially outward, the wind velocity exhibits a maximum value at a position 0.7 time as large as the maximum radius of the outer edge portion, and the wind velocity gradually decreases radially outward is observed. In contrast, in the propeller fan according to Example 2, such a tendency that a wind velocity is higher than in Comparative Example 1 on the radially inner side, the wind velocity gradually increases radially outward, the wind velocity starts to decrease at a position 0.8 time as large as the maximum radius of the outer edge portion, and the wind velocity gradually decreases radially outward is observed. Here, the maximum value of the wind velocity was lower in Example 2 than in Comparative Example 1.

Thus, it was confirmed that, with the propeller fan according to Example 2, wind velocity distribution along the radial direction was made uniform, variation in wind velocity could be suppressed, and comfortably impinging wind could be obtained.

Then, a fifth verification test in which relation between the shape of the connection portion provided in the outer edge portion described above and the effect described above was verified will now be described. In the fifth verification test, the propeller fan in the present embodiment described above was actually prototyped, which was defined as Example 2, propeller fans different in shape therefrom were actually prototyped, which were defined as Comparative Examples 2 and 3, and noise for each frequency at the time when the propeller fans according to Example 2 and Comparative Examples 2 and 3 were rotated was measured.

Here, the propeller fan according to Comparative Example 2 is different from the propeller fan according to Example 2 in not having a recessed connection portion formed in the outer edge portion, and they are otherwise common in shape. The propeller fan according to Comparative Example 3 is different from the propeller fan according to Comparative Example 2 in having eight blades, and they are otherwise common in shape.

Noise was measured at a point distant by 1 m on the burst side along the central axis of the propeller fan while the propeller fan was each rotated at the number of rotations of 800 rpm.

Figure 47:
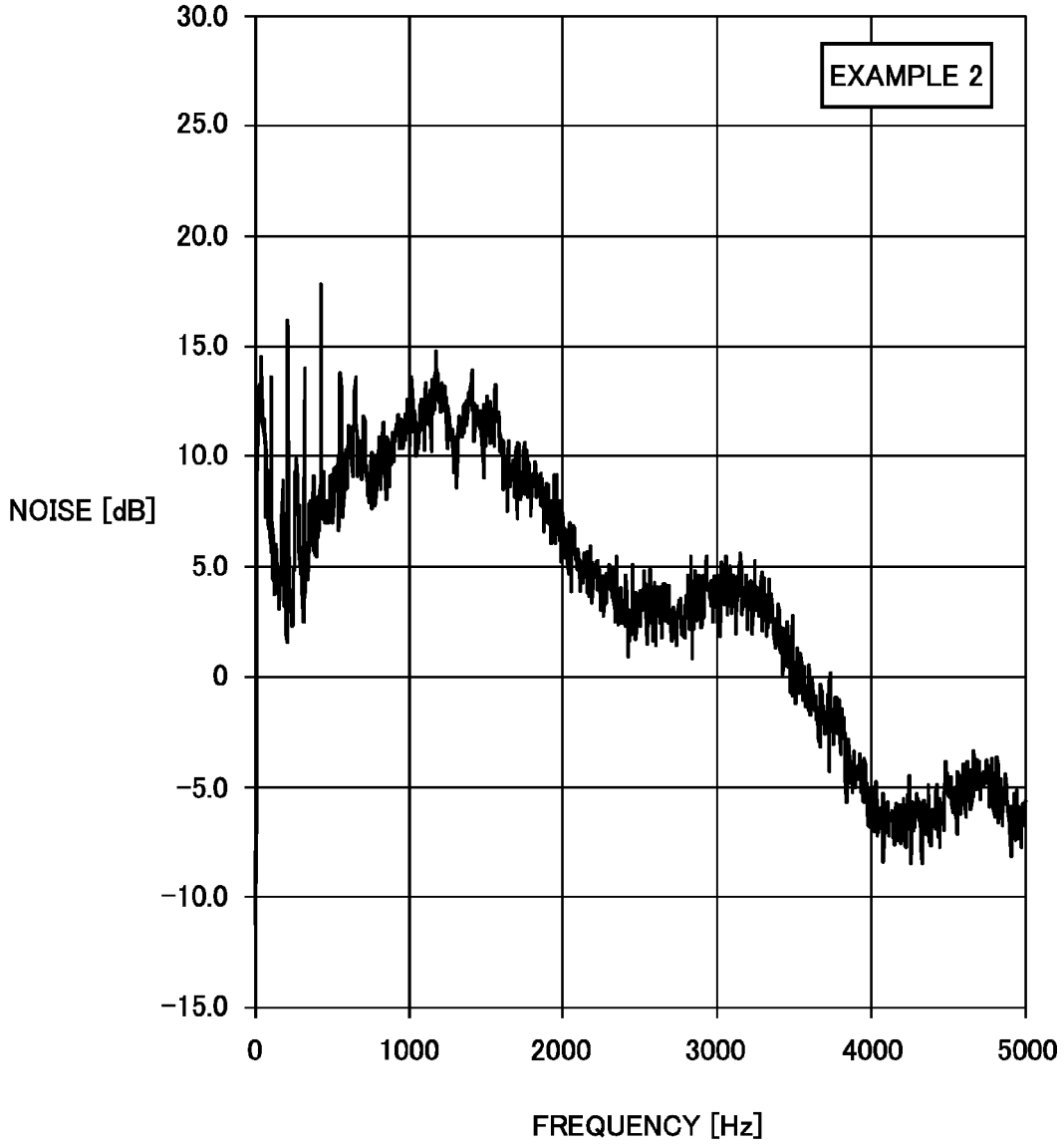
FIG. 47 is a graph showing noise for each frequency of the propeller fan according to Example 2, which is obtained in a fifth verification test.
Figure 48:
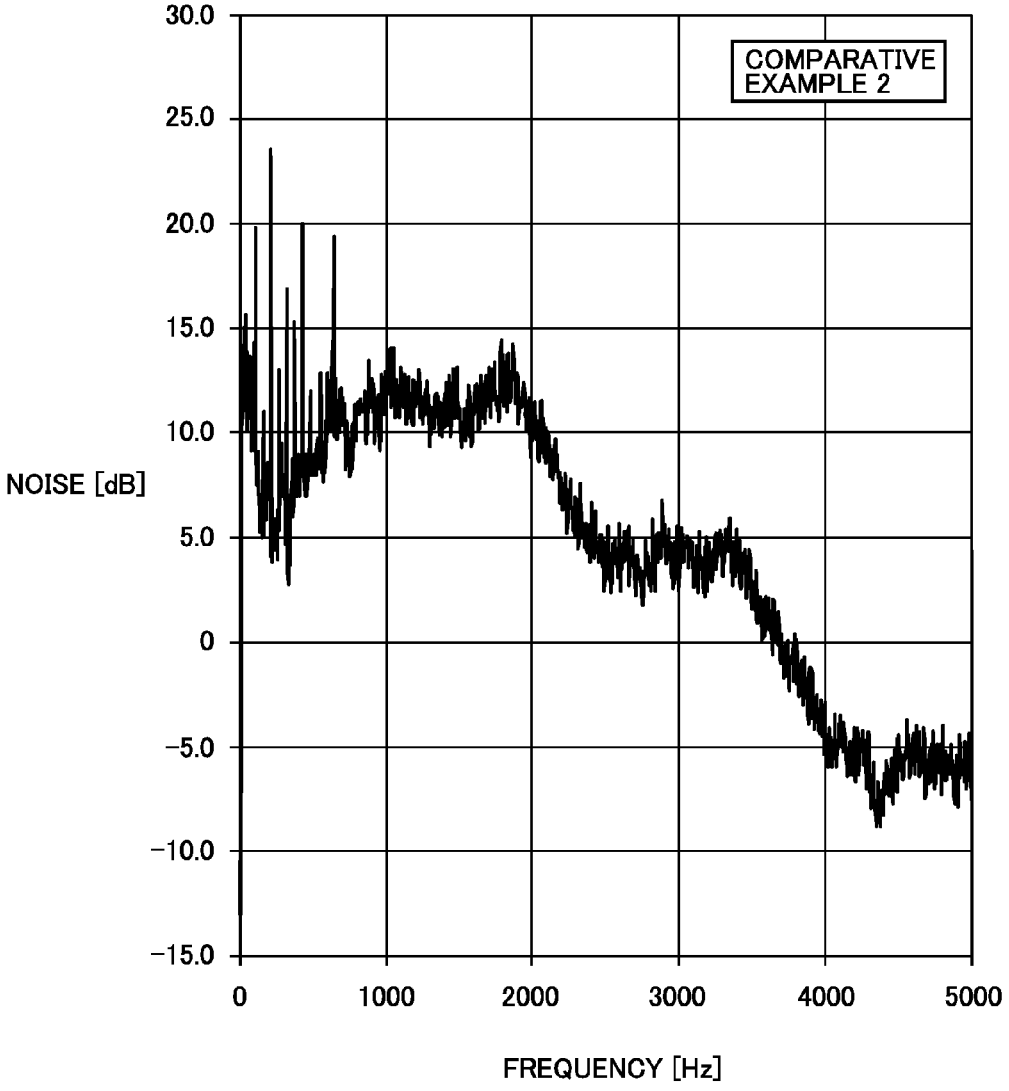
FIG. 48 is a graph showing noise for each frequency of a propeller fan according to a Comparative Example 2, which is obtained in the fifth verification test.
Figure 49:
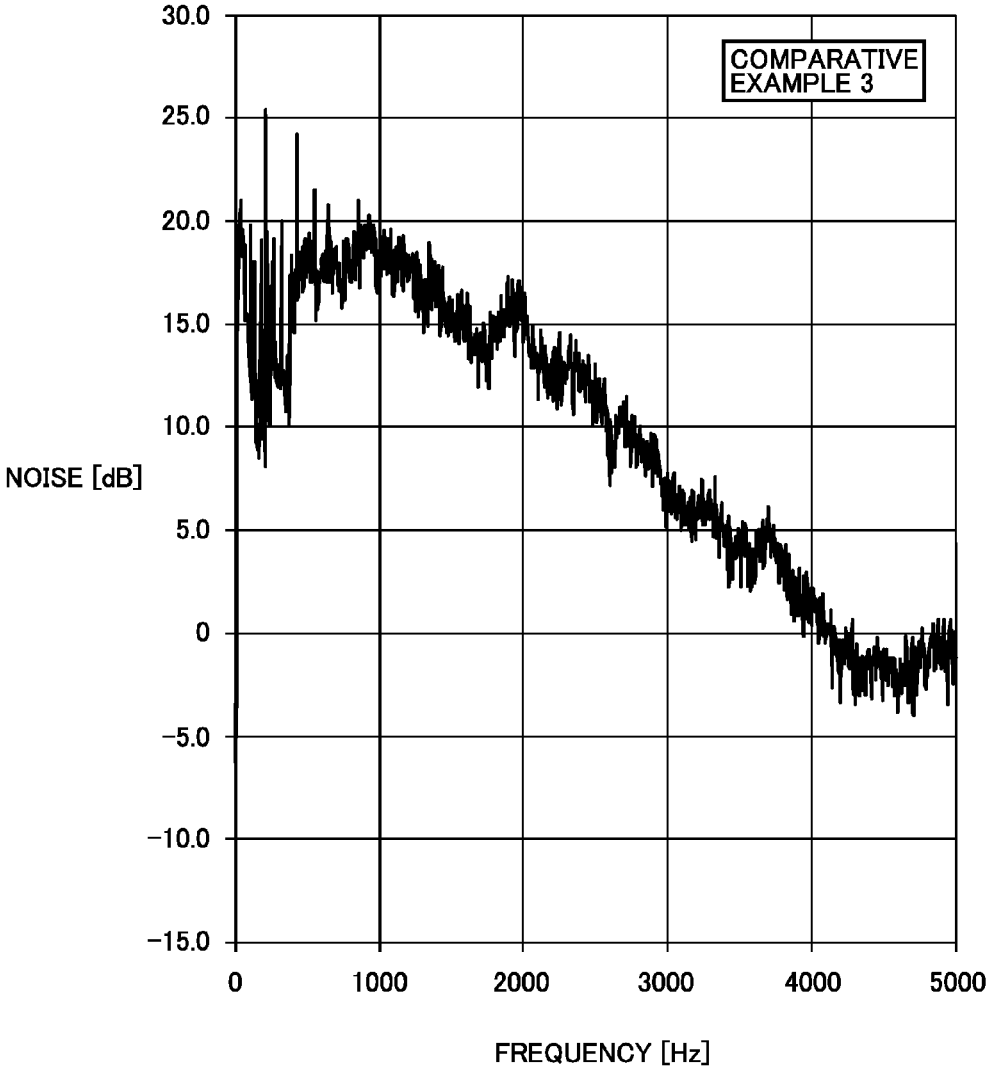
FIG. 49 is a graph showing noise for each frequency of a propeller fan according to a Comparative Example 3, which is obtained in the fifth verification test.

FIGS. 47 to 49 are graphs showing noise for each frequency of the propeller fans according to Example 2, Comparative Example 2, and Comparative Example 3 obtained in the fifth verification test, respectively. Here, in FIGS. 47 to 49, the abscissa represents a frequency and the ordinate represents noise.

As shown in FIGS. 47 to 49, with attention being paid to nZ noise (the number of rotations of the propeller fan×noise originating from the number of blades) which relates in particular to the number of blades of the propeller fan, of narrow-band noise which appears as abnormal noise among noises, it can be seen that a part of peak noise measured in Comparative Example 2 disappears in Example 2. Consequently, noise measured in Example 2 is very similar to noise measured in Comparative Example 3.

It is considered that, given the fact that the nZ noise originates from the number of blades of the propeller fan as described above, in the propeller fan according to Example 2, the front outer edge portion and the rear outer edge portion provided in one blade function as if two blades sent wind.

Namely, it is considered that the propeller fan according to Example 2 behaves as if it had eight blades.

It was also confirmed from the result above that noise was lowered by approximately 1 dB by providing a recessed connection portion in the outer edge portion. Therefore, it was confirmed that noise was lowered with the propeller fan according to Example 2.

Embodiment A3

Figure 50:
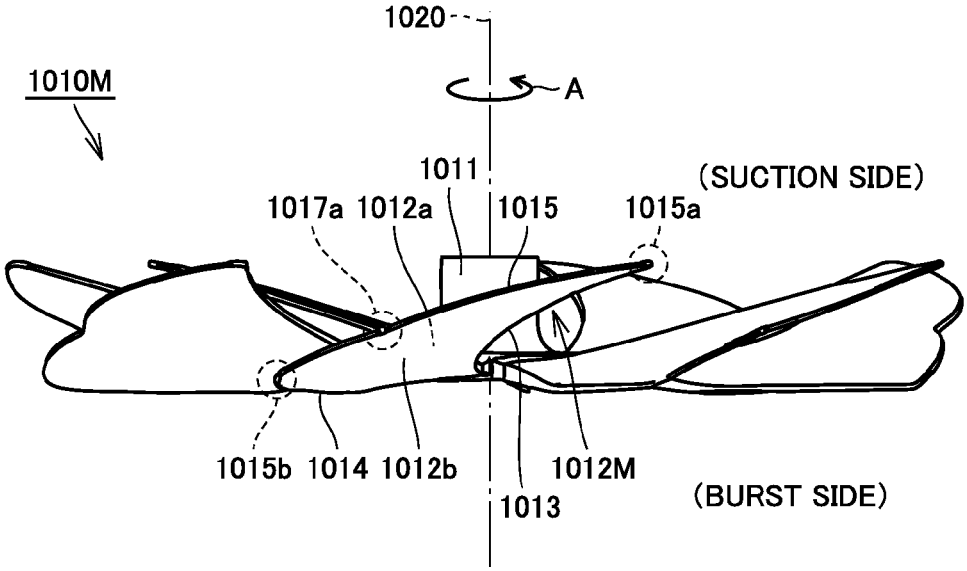
FIG. 50 is a side view of a propeller fan in an Embodiment A3 of the present invention.

FIG. 50 is a side view of a propeller fan in an Embodiment A3 of the present invention. A propeller fan 1010M in the present embodiment will be described below with reference to FIG. 50. Propeller fan 1010M in the present embodiment is used as being mounted on electric fan 1001 similarly to propeller fan 1010A shown in Embodiment A1 described above.

As shown in FIG. 50, propeller fan 1010M in the present embodiment is different from propeller fan 1010A in Embodiment A1 described above in that the blade inner region and the blade outer region are not different in a shape of a blade surface but the entire blade surface is constructed to have a single blade surface shape, that rear edge portion 1014 is not constructed to be away radially outward from the end surface on the burst side, and that the entire outer edge portion 1015 is not located as being spaced apart from the end surface on the suction side along the direction of extension of central axis 1020, and they are otherwise common in construction to propeller fan 1010A in Embodiment A1 described above.

Here, though detailed description is not provided, in blade 1012M of propeller fan 1010M in the present embodiment as well, distance W and distance w satisfy the condition of $W/2>w$, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, basically, pressure fluctuation in generated wind is less, comfortably impinging wind can be sent, and noise can also be lowered, although the extent of the obtained effect is less than in the case as constructed in Embodiment A1 described above.

Embodiment A4

Figure 51:
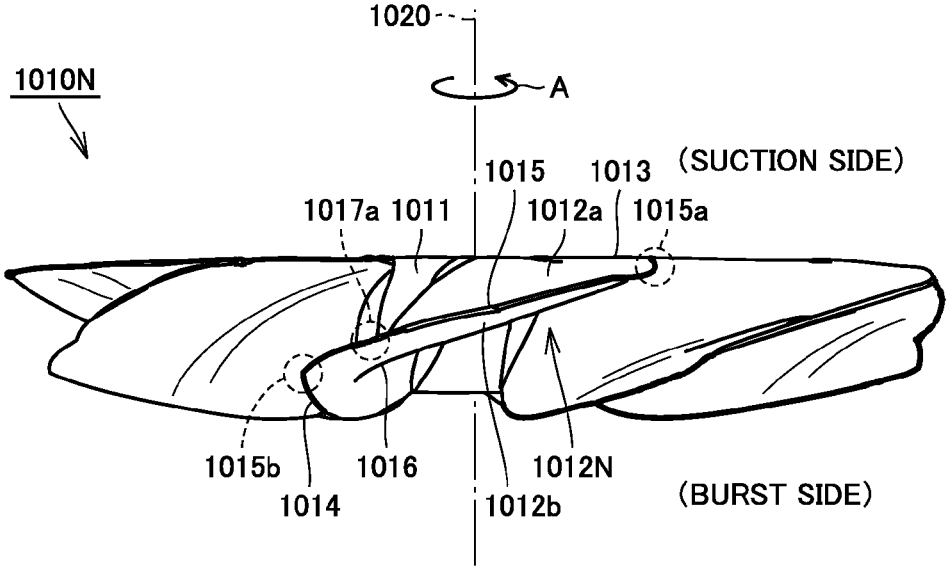
FIG. 51 is a side view of a propeller fan in an Embodiment A4 of the present invention.

FIG. 51 is a side view of a propeller fan in an Embodiment A4 of the present invention. A propeller fan 1010N in the present embodiment will be described below with reference to FIG. 51. Propeller fan 1010N in the present embodiment is used as being mounted on electric fan 1001 similarly to propeller fan 1010A shown in Embodiment A1 described above.

As shown in FIG. 51, propeller fan 1010N in the present embodiment is different from propeller fan 1010A in Embodiment A1 described above only in that the entire outer edge portion 1015 is not located as being spaced apart from the end surface on the suction side along the direction of extension of central axis 1020, and otherwise they are common in construction to propeller fan 1010A in Embodiment A1 described above.

Here, though detailed description is not provided, in blade 1012N of propeller fan 1010N in the present embodiment as well, distance W and distance w satisfy the condition of $W/2>w$, maximum radius $R1_{max}$ and maximum radius $R2_{max}$ satisfy the condition of $R1_{max}>R2_{max}$, and radius R and maximum radius $R2_{max}$ satisfy the condition of $R<R2_{max}$.

With such a construction as well, as in Embodiment A1 described above, pressure fluctuation in generated wind is less, comfortably impinging wind can be sent, and noise can also be lowered.

In the embodiment and the variations thereof in the present invention described above, a propeller fan integrally molded with a synthetic resin has been exemplified as the propeller fan to which the present invention has been applied, however, applications of the present invention are not limited thereto. For example, the present invention may be applied to a propeller fan formed by twisting a sheet metal, or the present invention may be applied to a propeller fan formed from an integrated small-thickness material formed to have a curved surface. In such a case, a blade may be joined to a separately molded boss hub portion.

In the embodiment and the variations thereof in the present invention described above, a case that the present invention has been applied to a propeller fan having seven blades or four blades has been exemplified, however, the present invention may be applied to a propeller fan having a plurality of blades other than seven or four, or the present invention may be applied to a propeller fan having a single blade. When the present invention is applied to the propeller fan having a single blade, a weight serving as a balancer is preferably provided on a side opposite to the blade with respect to the central axis.

In the embodiment and the variations thereof in the present invention described above, an electric fan has been exemplified as a fluid feeder to which the present invention is applied and a propeller fan mounted on an electric fan has been exemplified as a propeller fan to which the present invention is applied. Other than the above, the present invention can naturally be applied also to various fluid feeders such as a circulator, an air-conditioner, an air cleaner, a humidifier, a dehumidifier, a fan heater, a cooling apparatus, or a ventilator as well as a propeller fan mounted thereon.

Embodiment B1

[Basic Structure of Propeller Fan]

Figure 52:
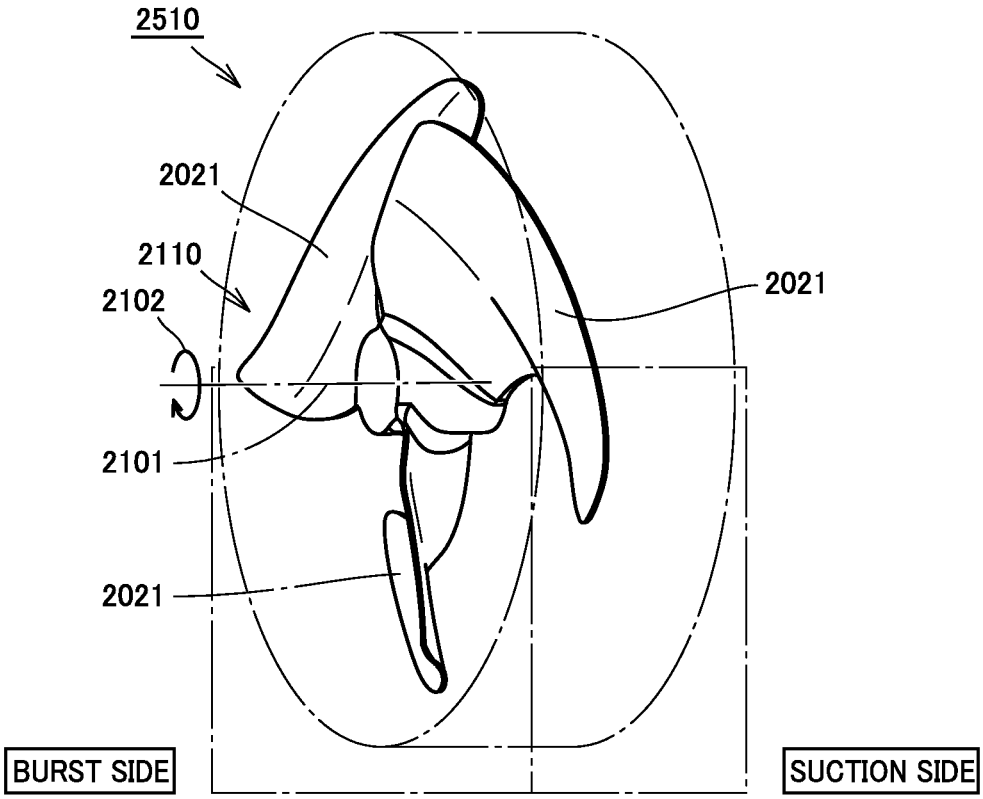
FIG. 52 is a perspective view showing a circulator including a propeller fan in an Embodiment B1 of this invention.
Figure 53:
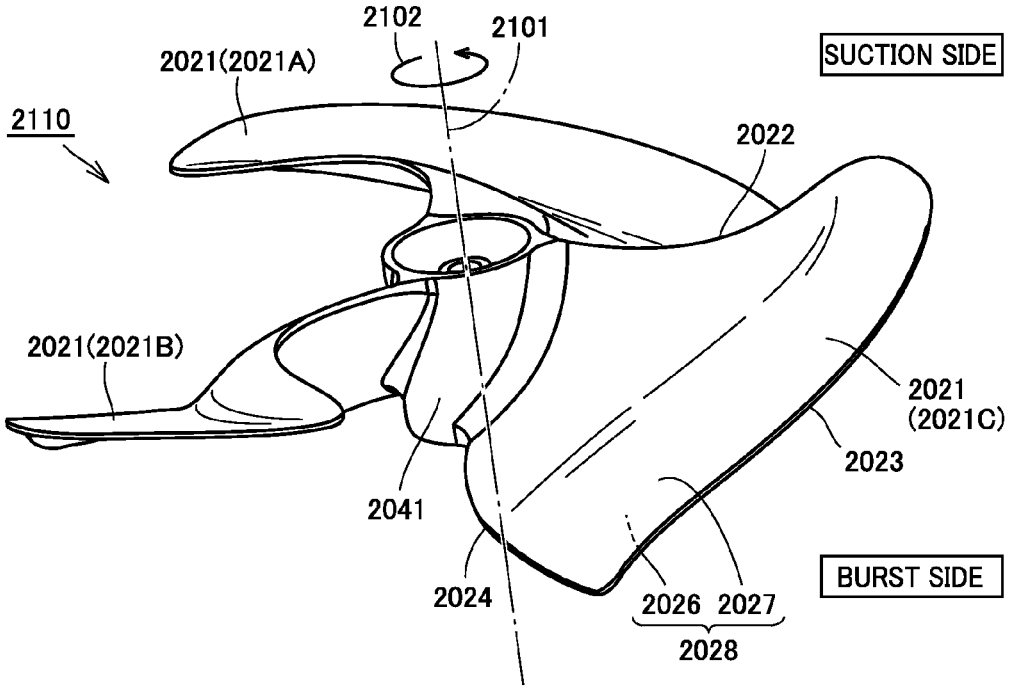
FIG. 53 is a perspective view of the propeller fan in Embodiment B1 of this invention viewed from a suction side.
Figure 54:
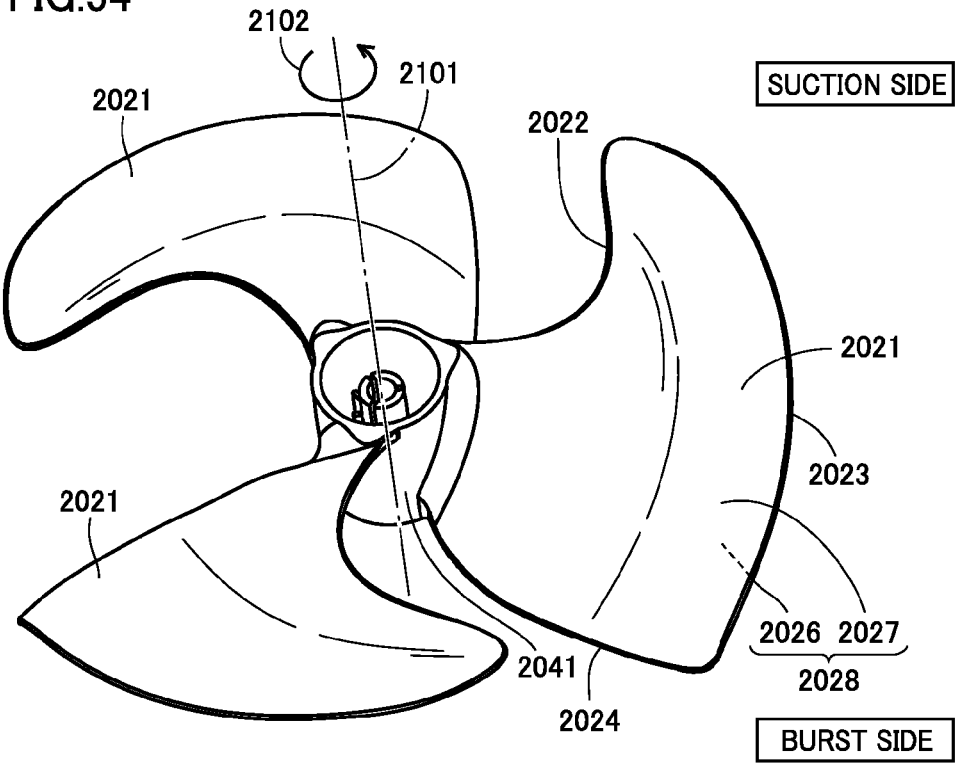
FIG. 54 is another perspective view of the propeller fan in FIG. 53 viewed from the suction side.
Figure 55:
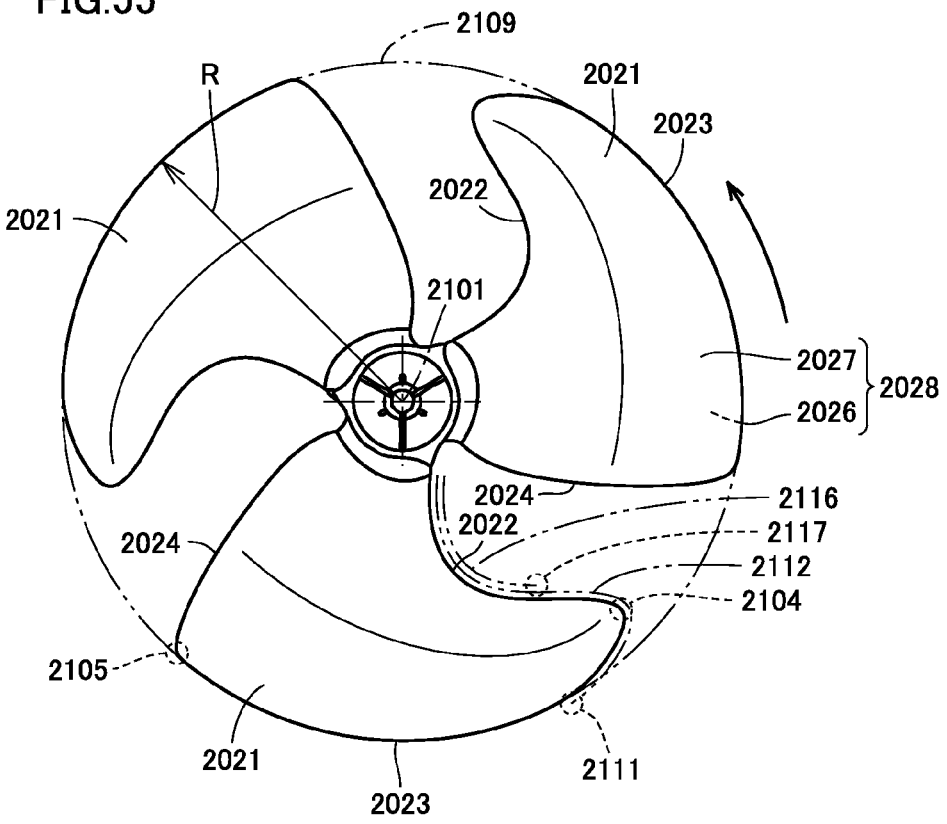
FIG. 55 is a plan view of the propeller fan in FIG. 53 viewed from the suction side.
Figure 56:
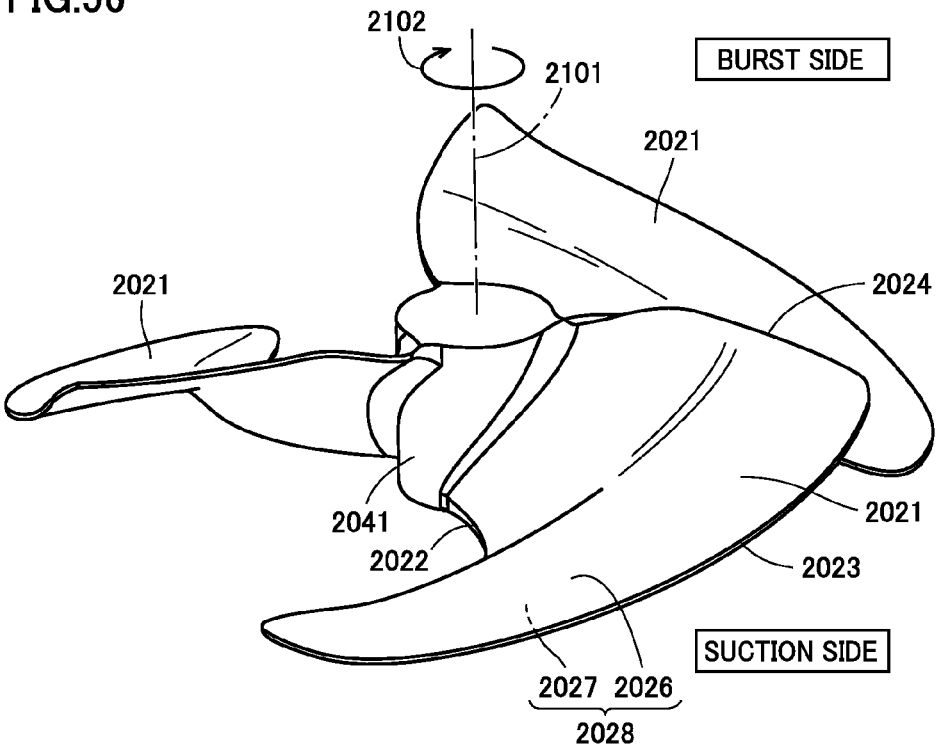
FIG. 56 is a perspective view of the propeller fan in FIG. 53 viewed from a burst side.
Figure 57:
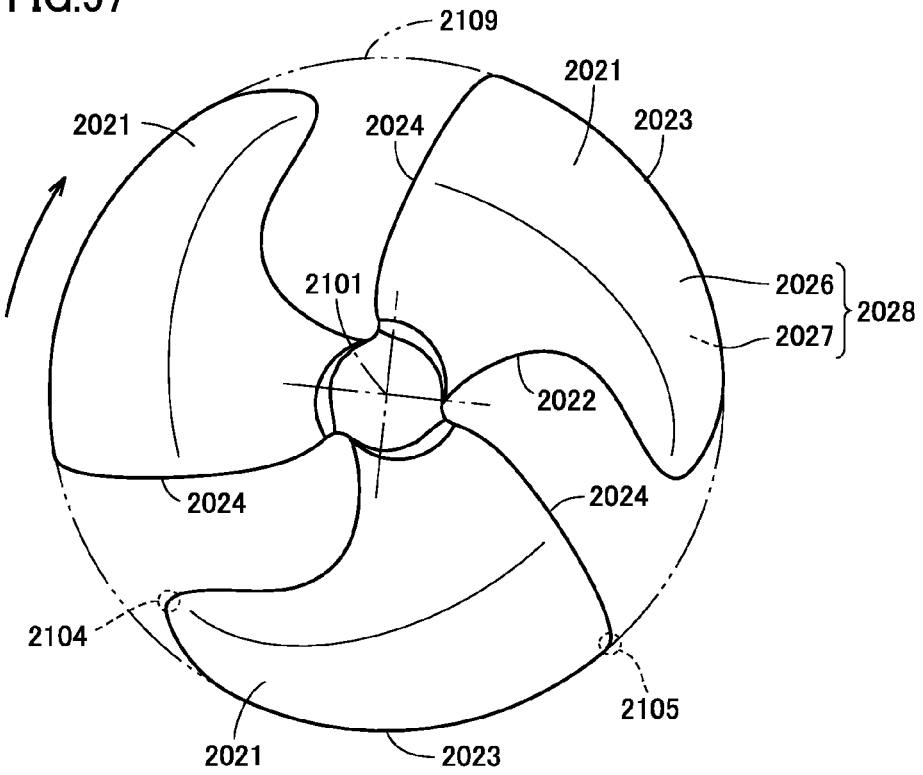
FIG. 57 is a plan view of the propeller fan in FIG. 53 viewed from the burst side.

FIG. 52 is a perspective view showing a circulator including a propeller fan in an Embodiment B1 of this invention. FIG. 53 is a perspective view of the propeller fan in Embodiment B1 of this invention viewed from the suction side. FIG. 54 is another perspective view of the propeller fan in FIG. 53 viewed from the suction side. FIG. 55 is a plan view of the propeller fan in FIG. 53 viewed from the suction side. FIG. 56 is a perspective view of the propeller fan in FIG. 53 viewed from the burst side. FIG. 57 is a plan view of the propeller fan in FIG. 53 viewed from the burst side. FIGS. 58 to 61 are side views showing the propeller fan in FIG. 53.

Initially, a basic structure of the propeller fan in the present embodiment will be described with reference to FIGS. 52 to 61.

A propeller fan 2110 in the present embodiment is a propeller fan having three blades, and it is integrally molded with a synthetic resin such as an AS (acrylonitrile-styrene) resin.

Propeller fan 2110 has, as a plurality of blades, a blade 2021A, a blade 2021B, and a blade 2021C (hereinafter referred to as a blade 2021 unless particularly distinguished). Blade 2021 rotates in a direction shown with an arrow 2102 in the figures, around a central axis 2101 which is a virtual axis. The plurality of blades 2021 send wind from the suction side toward the burst side in the figures as they rotate around central axis 2101.

Blade 2021A, blade 2021B, and blade 2021C are arranged at regular intervals in a circumferential direction around the axis of rotation, that is, central axis 2101, of propeller fan 2110. In the present embodiment, blade 2021A, blade 2021B, and blade 2021C are formed to be identical in shape, and formed such that, when any blade 2021 is rotated around central axis 2101, that blade 2021 and another blade 2021 match in shape. Blade 2021B is arranged adjacent to blade 2021A on a side in the direction of rotation of propeller fan 2110, and blade 2021C is arranged adjacent to blade 2021B on a side in the direction of rotation of propeller fan 2110.

Blade 2021 has a front edge portion 2022 arranged on a side in the direction of rotation of propeller fan 2110, a rear edge portion 2024 arranged on a side opposite in the direction of rotation, and an outer edge portion 2023 connecting front edge portion 2022 and rear edge portion 2024 to each other.

When propeller fan 2110 is viewed in an axial direction of central axis 2101, that is, when propeller fan 2110 is viewed two-dimensionally, front edge portion 2022 and rear edge portion 2024 extend from a boss hub portion 2041 which will be described later, from the inner side to the outer side in the direction of radius around central axis 2101. Front edge portion 2022 extends in the direction of rotation of propeller fan 2110 as being curved from the inner side to the outer side in the direction of radius around central axis 2101. Rear edge portion 2024 is arranged as opposed to front edge portion 2022, in the circumferential direction around central axis 2101. Outer edge portion 2023 as a whole extends in an arc shape between front edge portion 2022 and rear edge portion 2024.

Outer edge portion 2023 as a whole extends along the circumferential direction around central axis 2101. As shown in FIG. 55, outer edge portion 2023 intersects with front edge portion 2022 at a front edge side connection portion 2104 located most on a side in the direction of rotation of propeller fan 2110 on a line extending in the circumferential direction and intersects with rear edge portion 2024 at a rear edge side connection portion 2105 located most on an opposite side in the direction of rotation of propeller fan 2110 on the line extending in the circumferential direction.

FIG. 55 shows a circumscribed circle 2109 of the plurality of blades 2021. Circumscribed circle 2109 has radius R around central axis 2101 and the plurality of blades 2021 are inscribed therein. Circumscribed circle 2109 is in contact with outer edge portion 2023 of blade 2021. Blade 2021 has maximum radius R around central axis 2101. Outer edge portion 2023 has a maximum diameter end portion 2111 at a boundary between a position overlapping with circumscribed circle 2109 and a position leaving circumscribed circle 2109. Outer edge portion 2023 is curved inward in the direction of radius, as it extends along the circumferential direction around central axis 2101 from maximum diameter end portion 2111 toward front edge side connection portion 2104.

Front edge side connection portion 2104 and rear edge side connection portion 2105 are arranged adjacent to circumscribed circle 2109. Front edge side connection portion 2104 and rear edge side connection portion 2105 are arranged on an outer circumferential side relative to a position distant from central axis 2101 by R/2 (R representing a maximum radius of blade 2021 in a plan view of the propeller fan). Front edge side connection portion 2104 has a curvature which attains to a relative maximum around a portion where front edge portion 2022 and outer edge portion 2023 are connected to each other. Rear edge side connection portion 2105 has a curvature which attains to a relative maximum around a portion where outer edge portion 2023 and rear edge portion 2024 are connected to each other.

In a plan view of propeller fan 2110 shown in FIG. 55, front edge portion 2022 extends as being curved between boss hub portion 2041 which will be described later and front edge side connection portion 2104. Rear edge portion 2024 extends as being curved between boss hub portion 2041 which will be described later and rear edge side connection portion 2105.

In the plan view of propeller fan 2110, an outer shape of blade 2021 is formed by front edge portion 2022, outer edge portion 2023, and rear edge portion 2024. In the plan view of propeller fan 2110, blade 2021 has a shape pointed like a sickle with front edge side connection portion 2104 where front edge portion 2022 and outer edge portion 2023 intersect with each other being defined as the tip end. Front edge side connection portion 2104 is located most on the side in the direction of rotation of propeller fan 2110 in blade 2021.

In blade 2021, a blade surface 2028 for sending wind (sending air from the suction side to the burst side) with rotation of propeller fan 2110 is formed.

Blade surfaces 2028 are formed on sides facing the suction side and the burst side in the axial direction of central axis 2101, respectively. Blade surface 2028 is formed in a region surrounded by front edge portion 2022, outer edge portion 2023, and rear edge portion 2024. Blade surface 2028 is formed on the entire surface of the region surrounded by front edge portion 2022, outer edge portion 2023, and rear edge portion 2024. Blade surface 2028 is formed from a curved surface inclined from the suction side to the burst side in the circumferential direction from front edge portion 2022 toward rear edge portion 2024.

Blade surface 2028 is constituted of a positive pressure surface 2026 and a negative pressure surface 2027 arranged on the back of positive pressure surface 2026. Positive pressure surface 2026 is formed on a side of blade surface 2028 facing the burst side, and negative pressure surface 2027 is formed on a side of blade surface 2028 facing the suction side. As a flow of air is generated over blade surface 2028 during rotation of propeller fan 2110, such pressure distribution that a pressure is relatively high over positive pressure surface 2026 and a pressure is relatively low over negative pressure surface 2027 is generated.

Propeller fan 2110 has boss hub portion 2041 serving as a rotation shaft portion. Boss hub portion 2041 is a portion connecting propeller fan 2110 to a rotation shaft of a not-shown motor which is a drive source thereof. Boss hub portion 2041 has a cylindrical shape extending in the axial direction of central axis 2101. Blade 2021 is formed to extend from boss hub portion 2041 outward in the direction of radius of central axis 2101. Front edge portion 2022 and rear edge portion 2024 extend outward in the direction of radius of central axis 2101, from boss hub portion 2041 toward outer edge portion 2023.

A ratio between a diameter of boss hub portion 2041 and a diameter (2R) of blade 2021 is preferably not lower than 0.16. A ratio between a height of blade 2021 in the axial direction of central axis 2101 and the diameter (2R) of blade 2021 is preferably not lower than 0.19.

Blade 2021 is formed in a shape of a blade such that a thickness of a cross-sectional shape in the circumferential direction connecting front edge portion 2022 and rear edge portion 2024 to each other increases from front edge portion 2022 and rear edge portion 2024 toward a portion around the center of the blade and the thickness is greatest at a position closer to front edge portion 2022 relative to the center of the blade.

Though propeller fan 2110 integrally molded with a synthetic resin has been described above, a propeller fan in the present invention is not limited to that made of a resin. For example, propeller fan 2110 may be formed by twisting a sheet metal, or a propeller fan may be formed from an integrated small-thickness material formed to have a curved surface. In such a case, blade 2021A, blade 2021B, and blade 2021C may be joined to separately molded boss hub portion 2041.

The present invention is not limited to propeller fan 2110 having three blades, and it may be a propeller fan including a plurality of blades 2021 other than three blades or a propeller fan including single blade 2021. In a case of the propeller fan having a single blade, a weight serving as a balancer is provided on a side opposite to blade 2021 with respect to central axis 2101.

In FIG. 52, a circulator 2510 is shown as one example of a fluid feeder having propeller fan 2110 in the present embodiment. Circulator 2510 is used, for example, for agitating cold air sent from an air-conditioner in a large room. Circulator 2510 has propeller fan 2110 and a not-shown drive motor to which boss hub portion 2041 of propeller fan 2110 is coupled, for rotating the plurality of blades 2021.

Propeller fan 2110 is not limited to circulator 2510, and it may be employed in various fluid feeders such as an electric fan, an air-conditioner, an air cleaner, a humidifier, a dehumidifier, a fan heater, a cooling apparatus, or a ventilator.

[Height of Front Edge Portion and Rear Edge Portion of Blade]

Figure 62:
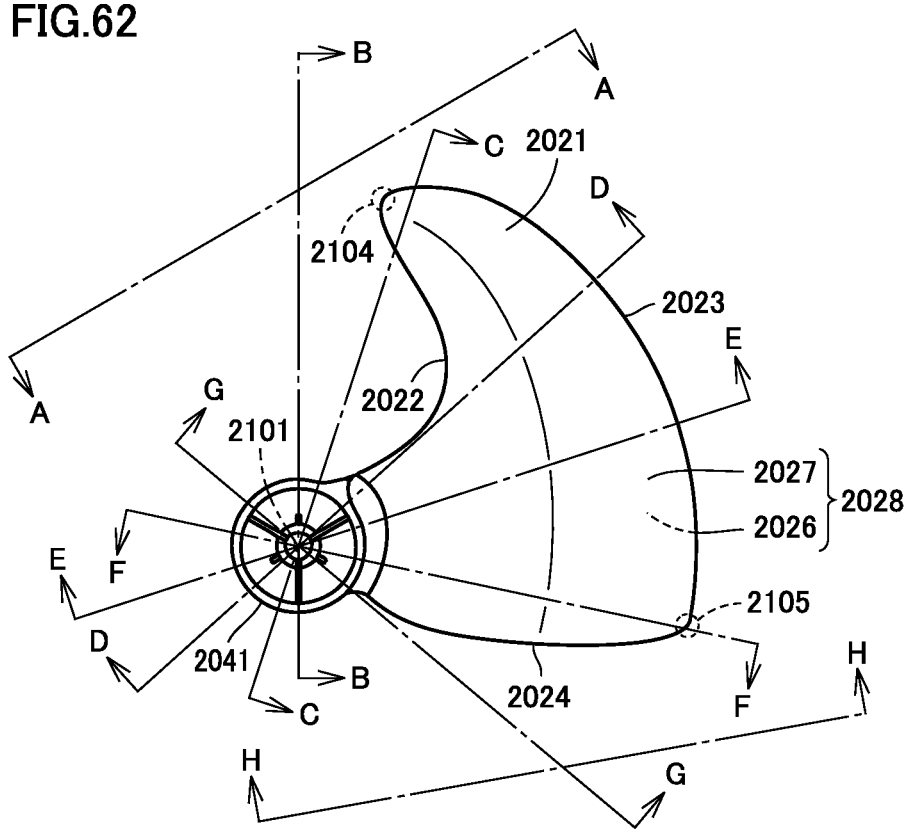
FIG. 62 is a partially enlarged plan view of the propeller fan in FIG. 55.
Figure 63:
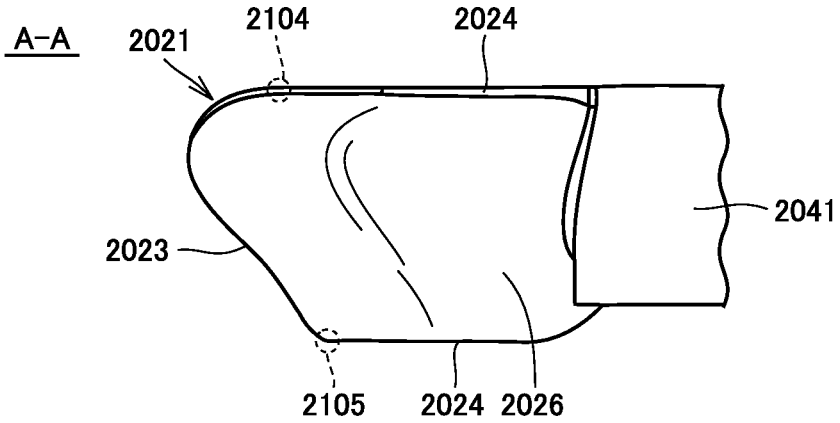
FIG. 63 is a side view showing the propeller fan viewed above the line A-A in FIG. 62.
Figure 64:
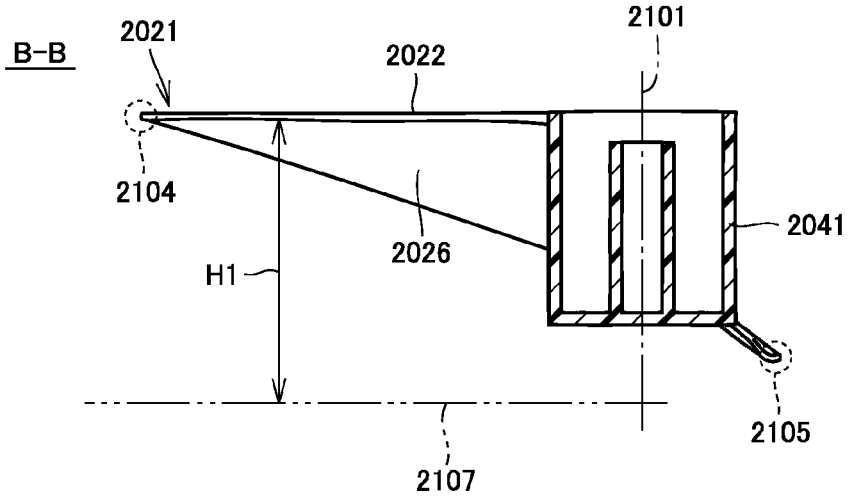
FIG. 64 is a cross-sectional view showing the propeller fan along the line B-B in FIG. 62.
Figure 65:
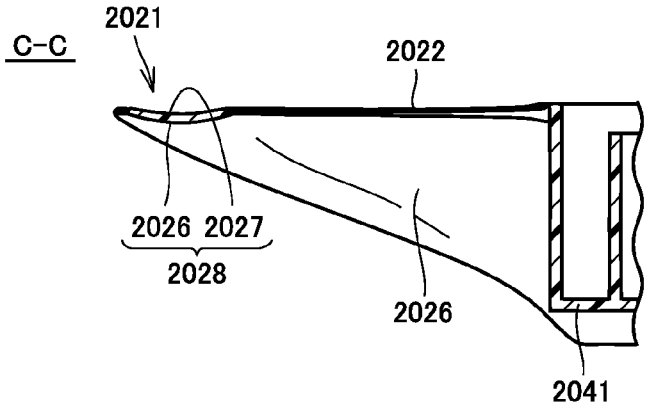
FIG. 65 is a cross-sectional view showing the propeller fan along the line C-C in FIG. 62.
Figure 66:
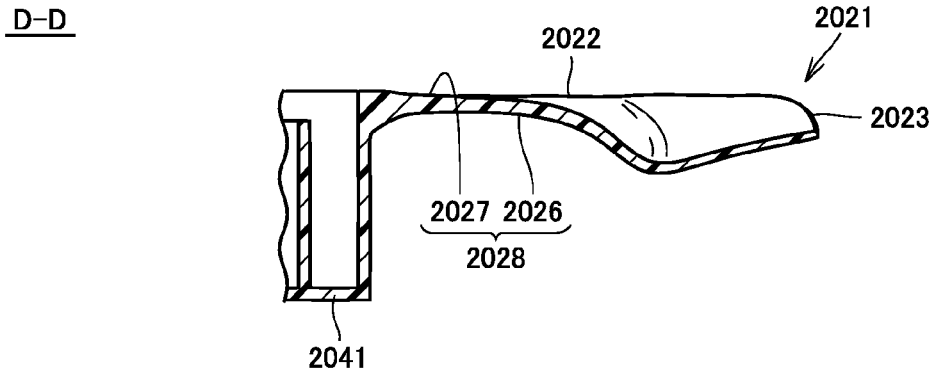
FIG. 66 is a cross-sectional view showing the propeller fan along the line D-D in FIG. 62.
Figure 67:
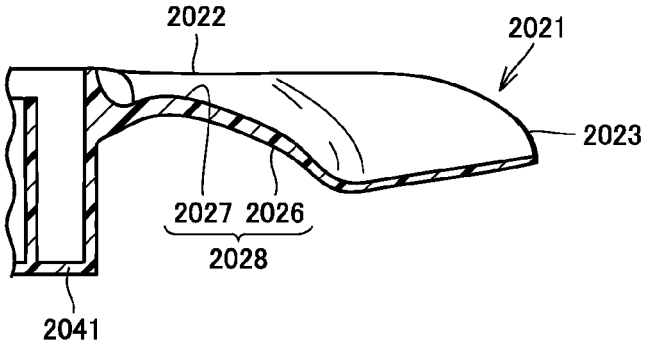
FIG. 67 is a cross-sectional view showing the propeller fan along the line E-E in FIG. 62.
Figure 68:
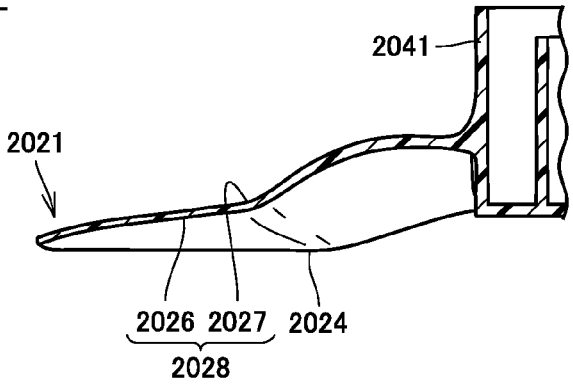
FIG. 68 is a cross-sectional view showing the propeller fan along the line F-F in FIG. 62.
Figure 69:
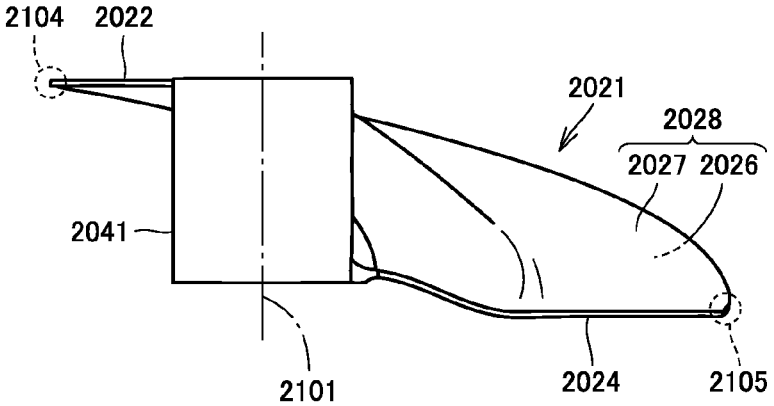
FIG. 69 is a cross-sectional view showing the propeller fan along the line G-G in FIG. 62.
Figure 70:
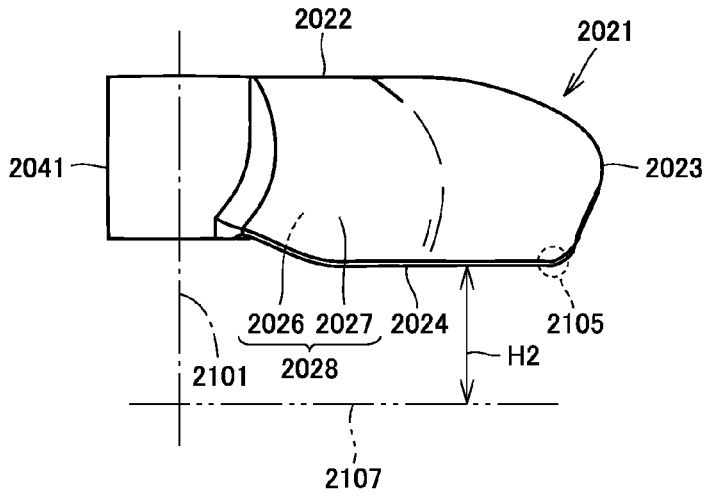
FIG. 70 is a side view showing the propeller fan viewed above the line H-H in FIG. 62.

FIG. 62 is a partially enlarged plan view of the propeller fan in FIG. 55. FIG. 63 is a side view showing the propeller fan viewed above the line A-A in FIG. 62. FIG. 64 is a cross-sectional view showing the propeller fan along the line B-B in FIG. 62. FIG. 65 is a cross-sectional view showing the propeller fan along the line C-C in FIG. 62. FIG. 66 is a cross-sectional view showing the propeller fan along the line D-D in FIG. 62. FIG. 67 is a cross-sectional view showing the propeller fan along the line E-E in FIG. 62. FIG. 68 is a cross-sectional view showing the propeller fan along the line F-F in FIG. 62. FIG. 69 is a cross-sectional view showing the propeller fan along the line G-G in FIG. 62. FIG. 70 is a side view showing the propeller fan viewed above the line H-H in FIG. 62.

Referring to FIGS. 62 to 70, in propeller fan 2110 in the present embodiment, front edge portion 2022 has a constant height in the axial direction of central axis 2101 between boss hub portion 2041 and a position distant from boss hub portion 2041 outward in the direction of radius of central axis 2101.

In FIG. 64, a virtual plane 2107 orthogonal to central axis 2101 which is an axis of rotation of propeller fan 2110 is shown on the burst side of propeller fan 2110, that is, on a side of blade 2021 facing positive pressure surface 2026. With this plane 2107 being defined as the reference, front edge portion 2022 has a constant height H1 between boss hub portion 2041 and a position distant from boss hub portion 2041 outward in the direction of radius of central axis 2101. With plane 2107 being defined as the reference, height H1 has a greatest value among all heights of blade 2021. Height H1 is equal to or greater than a height of front edge side connection portion 2104 with plane 2107 being defined as the reference.

Referring to FIG. 55, preferably, front edge portion 2022 has a constant height in the axial direction of central axis 2101 between boss hub portion 2041 and a position distant by 0.4R to 0.6R from central axis 2101 (R representing a maximum radius of blade 2021 in the plan view of the propeller fan). More preferably, front edge portion 2022 has a constant height in the axial direction of central axis 2101 between boss hub portion 2041 and front edge side connection portion 2104. In this case, front edge portion 2022 has a constant height in the entire range between boss hub portion 2041 and outer edge portion 2023. Further preferably, outer edge portion 2023 has a constant height in the axial direction of central axis 2102 between front edge side connection portion 2104 and a position distant from front edge side connection portion 2104 outward in the direction of radius of central axis 2101.

In the present embodiment, as a most preferred form, front edge portion 2022 has a constant height in the axial direction of central axis 2101 between boss hub portion 2041 and front edge side connection portion 2104, and furthermore, outer edge portion 2023 has a constant height in the axial direction of central axis 2101 between front edge side connection portion 2104 and maximum diameter end portion 2111. Namely, blade 2021 is formed such that front edge portion 2022 and outer edge portion 2023 maintain a constant height in the axial direction of central axis 2101 between boss hub portion 2041 and maximum diameter end portion 2111 (a range shown with a chain double dotted line 2112 in FIG. 55).

In a general propeller fan, front edge portion 2022 is provided to be high on the outer circumferential side of central axis 2101 and low on the inner circumferential side, with plane 2107 assumed on the burst side being defined as the reference. In this case, a height of blade 2021 is extremely smaller on the inner circumferential side than on the outer circumferential side around central axis 2101, and capability of blade 2021 to send wind on that inner circumferential side is extremely low.

In contrast, in propeller fan 2110 in the present embodiment, front edge portion 2022 has a constant height between the inner circumferential side and the outer circumferential side around central axis 2101. With such a construction, on the inner circumferential side around central axis 2101, a height of blade 2021 is set to be great so that capability to send wind can be improved. Thus, as compared with a general propeller fan having a blade having the same diameter and height, a quantity of wind sent from the propeller fan can significantly be increased.

Figure 58:
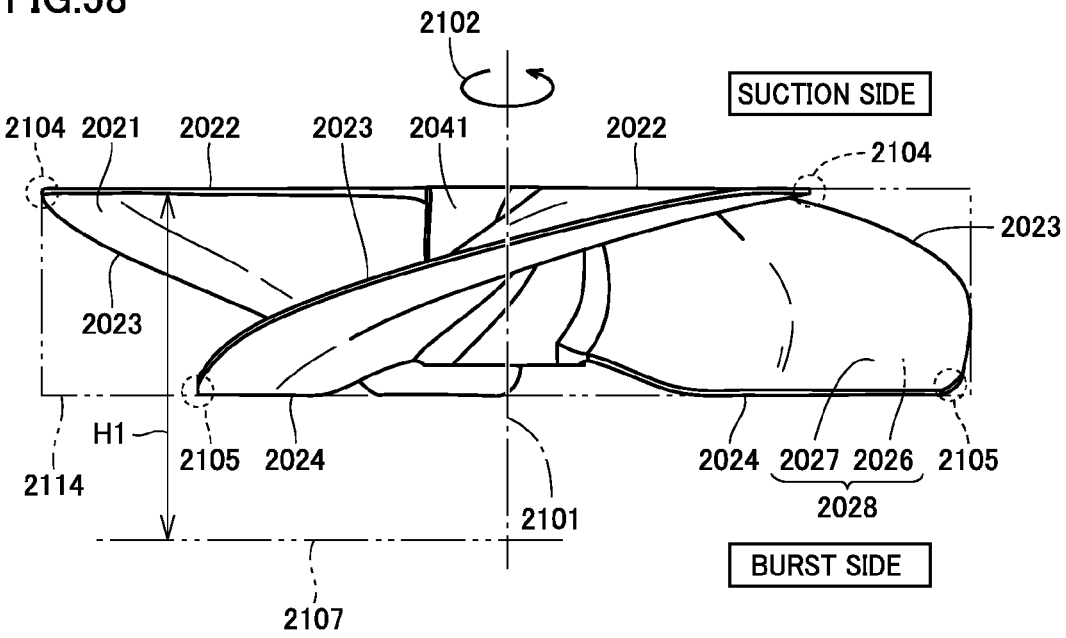
FIG. 58 is a side view showing the propeller fan in FIG. 53.
Figure 59:
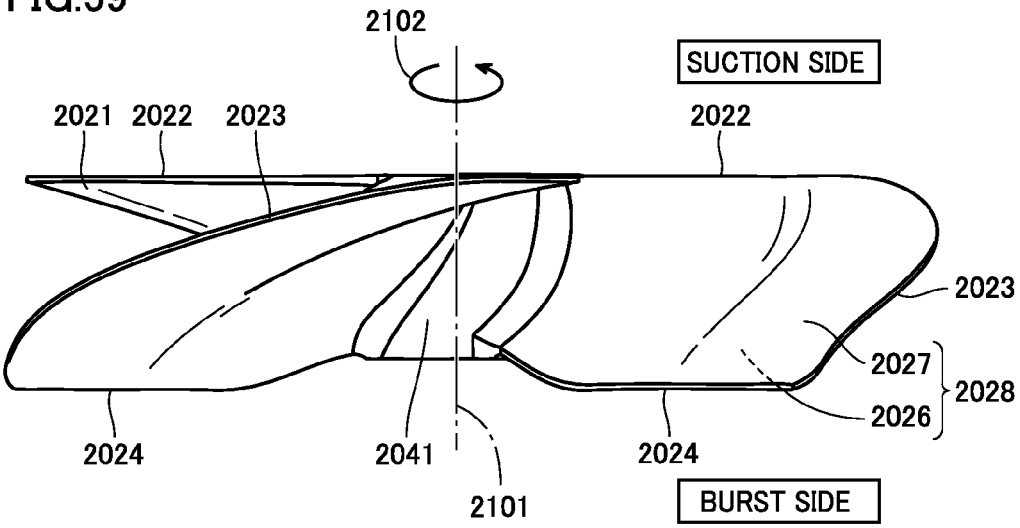
FIG. 59 is another side view showing the propeller fan in FIG. 53.
Figure 60:
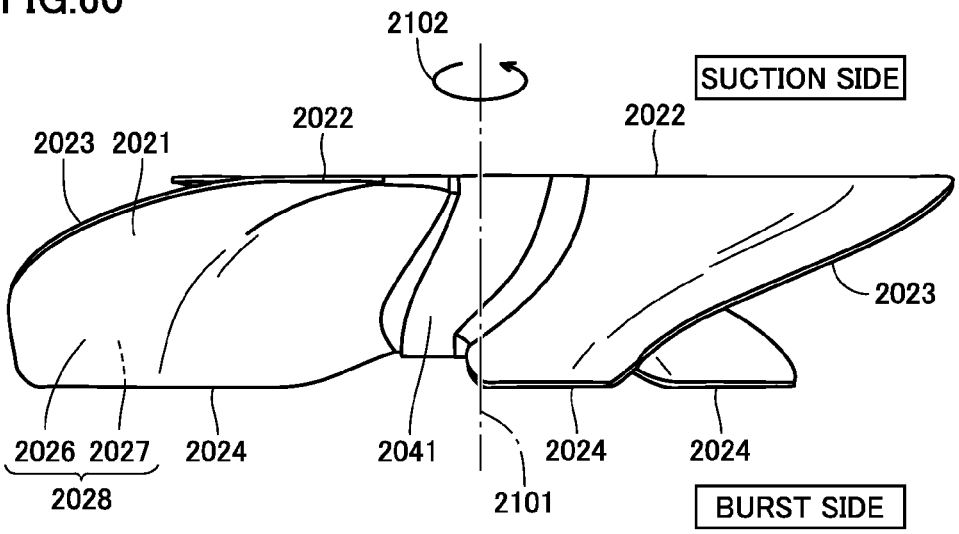
FIG. 60 is yet another side view showing the propeller fan in FIG. 53.
Figure 61:
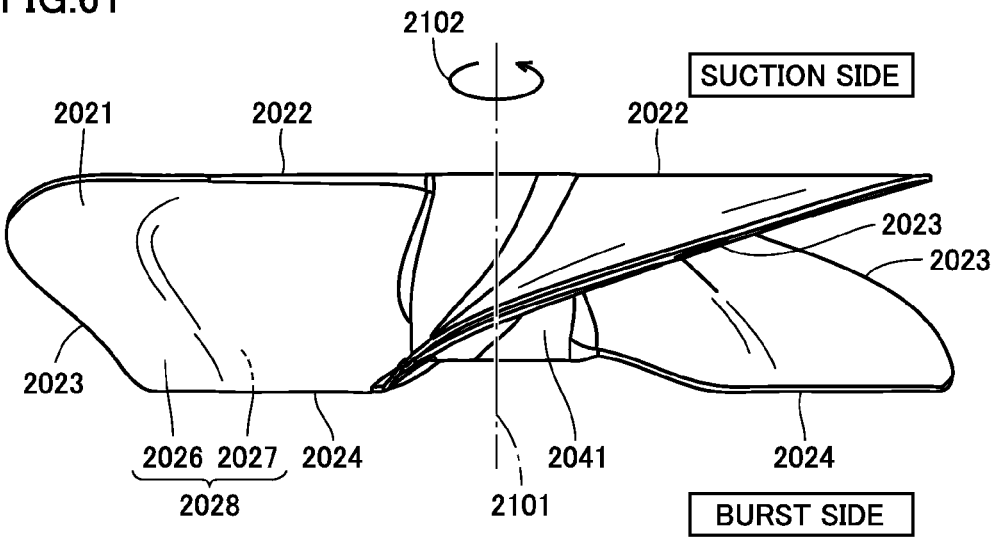
FIG. 61 is yet another side view showing the propeller fan in FIG. 53.

Namely, in the present embodiment, by enhancing capability to send wind on the inner circumferential side around central axis 2101, efficiency in blowing with respect to a volume of a space 2114 occupied by the plurality of blades 2021 shown in FIG. 58 can be enhanced. In this case, in sending wind of the same quantity as well, the number of rotations of blade 2021 can be suppressed to a lower value and hence it is advantageous in terms of energy saving or lowering in noise.

By enhancing capability to send wind on the inner circumferential side around central axis 2101, a difference in quantity of wind (wind velocity) between the inner circumferential side and the outer circumferential side can be lessened. Thus, more uniform blowing from propeller fan 2110 can be achieved and uncomfortableness of a person who has received wind can be prevented.

Referring to FIGS. 69 and 70, in propeller fan 2110 in the present embodiment, rear edge portion 2024 has a constant height in the axial direction of central axis 2101 on the outer circumferential side around central axis 2101. FIG. 70 shows virtual plane 2107 orthogonal to central axis 2101 on the burst side of propeller fan 2110. With this plane 2107 being defined as the reference, rear edge portion 2024 has a constant height H2 on the outer circumferential side around central axis 2101.

With such a construction, a height of blade 2021 can be maintained great also on the outer circumferential side around central axis 2101. Thus, efficiency in blowing by propeller fan 2110 with respect to a volume of space 2114 occupied by the plurality of blades 2021 can further be enhanced.

In the present embodiment, for the purpose of avoiding interference between a not-shown spinner for fixing boss hub portion 2041 to a rotation shaft extending from the drive motor and blade 2021, a height of rear edge portion 2024 is larger on the inner circumferential side around central axis 2101. Without being limited to such a construction, boss hub portion 2041 may be extended to the burst side such that a height of rear edge portion 2024 is constant between boss hub portion 2041 and outer edge portion 2023.

A structure of propeller fan 2110 in Embodiment B1 of this invention described above will be summarized. Propeller fan 2110 in the present embodiment includes boss hub portion 2041 serving as the rotation shaft portion rotating around virtual central axis 2101 and blade 2021 extending from boss hub portion 2041 outward in the direction of radius of central axis 2101. Blade 2021 has front edge portion 2022 arranged on the side in the direction of rotation, rear edge portion 2024 arranged on the side opposite in the direction of rotation, and outer edge portion 2023 extending in the circumferential direction around central axis 2101 and connecting front edge portion 2022 and rear edge portion 2024 to each other. Front edge portion 2022 has a constant height in the axial direction of central axis 2101 between boss hub portion 2041 and the position distant from boss hub portion 2041 outward in the direction of radius of central axis 2101.

According to propeller fan 2110 in Embodiment B1 of this invention thus constructed, capability to send wind is enhanced on the inner circumferential side around central axis 2101, so that a propeller fan achieving lowered uncomfortableness caused by wind sent from a fan while enhancing efficiency in blowing with respect to a volume of a region which can be occupied by the fan can be realized.

[Description of Variation of Propeller Fan]

Figure 71:
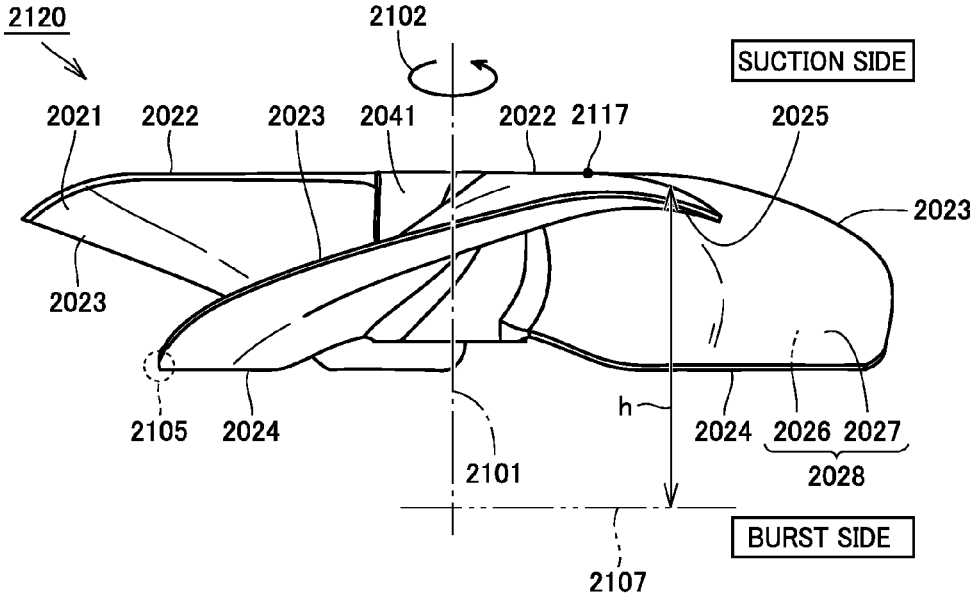
FIG. 71 is a side view showing a Variation 1 of the propeller fan in FIG. 53.

FIG. 71 is a side view showing a Variation 1 of the propeller fan in FIG. 53. The propeller fan in the present Variation has a plan view the same as the plan view shown in FIG. 55. Referring to FIGS. 55 and 71, a propeller fan 2120 in the present Variation is different from propeller fan 2110 in a range where front edge portion 2022 has a constant height.

More specifically, front edge portion 2022 has a constant height in the axial direction of central axis 2101 between boss hub portion 2041 and a position 2117 between boss hub portion 2041 and front edge side connection portion 2104 (a range shown with a chain double dotted line 2116 in FIG. 55). FIG. 71 shows virtual plane 2107 orthogonal to central axis 2101 on the burst side of propeller fan 2120. Front edge portion 2022 is formed to be gradually smaller in height h with plane 2107 being defined as the reference, from position 2117 toward front edge side connection portion 2104.

Figure 72:
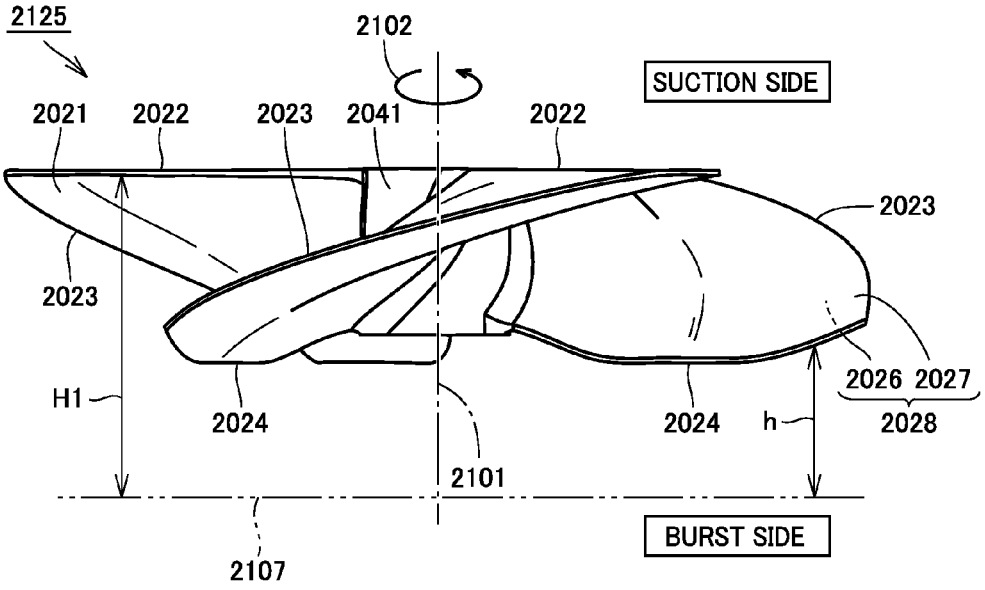
FIG. 72 is a side view showing a Variation 2 of the propeller fan in FIG. 53.

FIG. 72 is a side view showing a Variation 2 of the propeller fan in FIG. 53. The propeller fan in the present Variation has a plan view the same as the plan view shown in FIG. 55. Referring to FIG. 72, a propeller fan 2125 in the present Variation is different from propeller fan 2110 in a shape of rear edge portion 2024.

FIG. 72 shows virtual plane 2107 orthogonal to central axis 2101 on the burst side of propeller fan 2120. More specifically, rear edge portion 2024 is formed to be greater in height h with plane 2107 being defined as the reference, toward outer edge portion 2023 on the outer circumferential side around central axis 2101.

According to propeller fan 2120 and propeller fan 2125 constructed as such as well, the effect of propeller fan 2110 above can similarly be achieved.

[Example for Confirming Function and Effect]

In succession, an example for confirming the function and effect achieved by propeller fan 2110 in the present embodiment and propeller fan 2120 in Variation 1 will be described.

Figure 73:
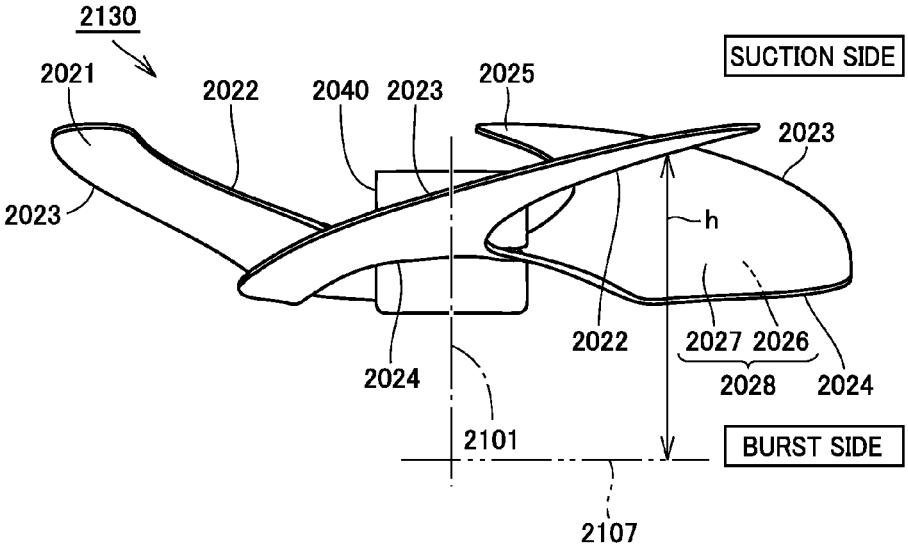
FIG. 73 is a side view showing a propeller fan in a Comparative Example.

FIG. 73 is a side view showing a propeller fan in a Comparative Example. FIG. 73 corresponds to FIGS. 58 and 71. The propeller fan in the present Comparative Example has a plan view the same as the plan view shown in FIG. 55. Referring to FIG. 73, on the burst side of a propeller fan 2130, virtual plane 2107 orthogonal to central axis 2101 is shown in the figure. In propeller fan 2130 in the present Comparative Example, front edge portion 2022 is formed to be greater in height h with plane 2107 being defined as the reference, from boss hub portion 2041 toward outer edge portion 2023.

Propeller fan 2110 in Embodiment B1 shown in FIG. 58, propeller fan 2120 in Variation 1 shown in FIG. 71, and propeller fan 2130 in Comparative Example shown in FIG. 73 which were identical in a diameter (ϕ 180 mm) and a height (40 mm) of blade 2021 and in a diameter (ϕ 30 mm) of boss hub portion 2041 were prepared. Then, relation between a distance from the center of rotation and a wind velocity, relation between the number of rotations and a quantity of wind, relation between a quantity of wind and power consumption, and relation between a quantity of wind and noise were found based on actual measurement in each propeller fan and results of measurement were compared.

As can be seen in FIGS. 58 and 73, propeller fan 2110 in Embodiment B1 and propeller fan 2130 in Comparative Example are basically the same in a shape of a blade. Propeller fan 2130 in Variation is different from propeller fan 2110 in Embodiment B1 in that a height of front edge portion 2022 increases from boss hub portion 2041 toward outer edge portion 2023 in propeller fan 2130 in Variation whereas a height of front edge portion 2022 is constant in propeller fan 2110 in Embodiment B1. As can be seen in FIGS. 58 and 71, propeller fan 2110 in Embodiment B1 and propeller fan 2120 in Variation 1 are basically the same in a shape of a blade, however, a range where front edge portion 2022 has a constant height is greater in propeller fan 2110 in Embodiment B1 than in propeller fan 2120 in Variation 1.

Figure 74:
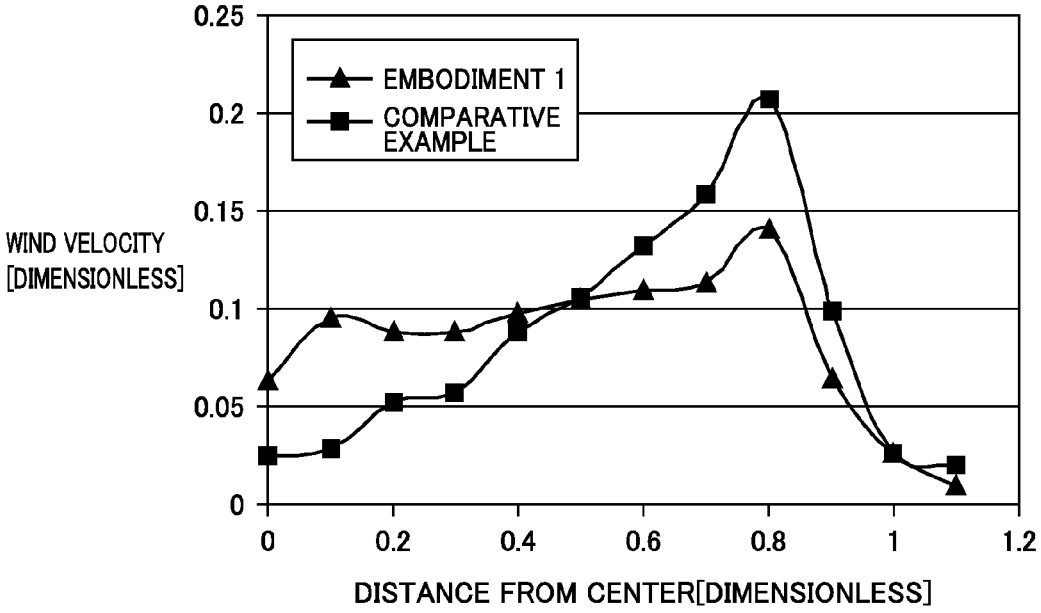
FIG. 74 is a graph showing relation between a distance from a center of rotation and a wind velocity in the propeller fan in Embodiment B1 in FIG. 53 and the propeller fan in Comparative Example in FIG. 73.

FIG. 74 is a graph showing relation between a distance from the center of rotation and a wind velocity in the propeller fan in Embodiment B1 in FIG. 53 and the propeller fan in Comparative Example in FIG. 73.

Referring to FIG. 74, in propeller fan 2130 in Comparative Example in FIG. 73, a wind velocity exhibited a large peak value at a position distant by 0.8R (R representing a maximum radius of blade 2021 in the plan view of the propeller fan) from central axis 2101. In propeller fan 2110 in Embodiment B1, the peak of the wind velocity was eliminated by enhancing capability to send wind on the inner circumferential side around central axis 2101.

Figure 75:
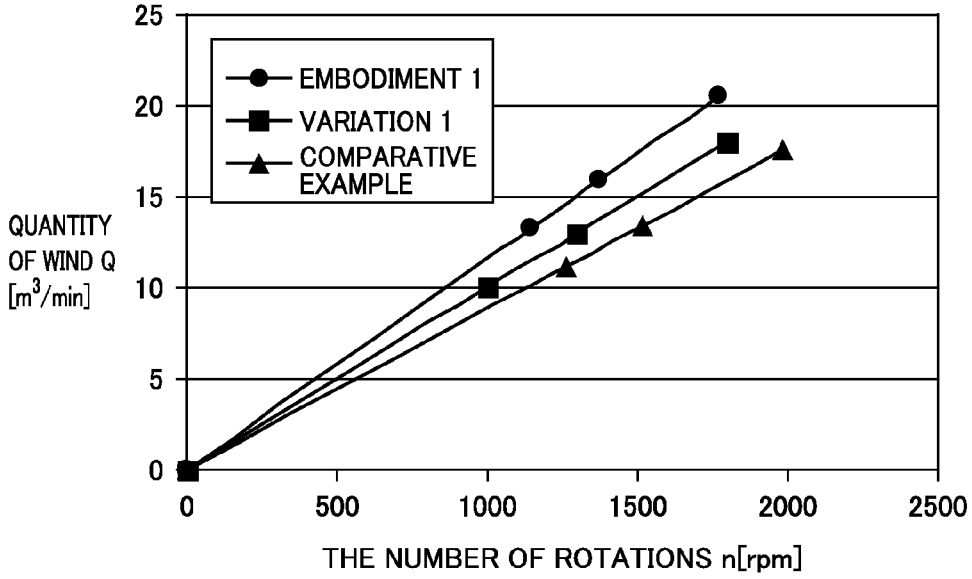
FIG. 75 is a graph showing relation between the number of rotations and a quantity of wind in the propeller fan in Embodiment B1 in FIG. 53, the propeller fan in Variation 1 in FIG. 71, and the propeller fan in Comparative Example in FIG. 73.
Figure 76:
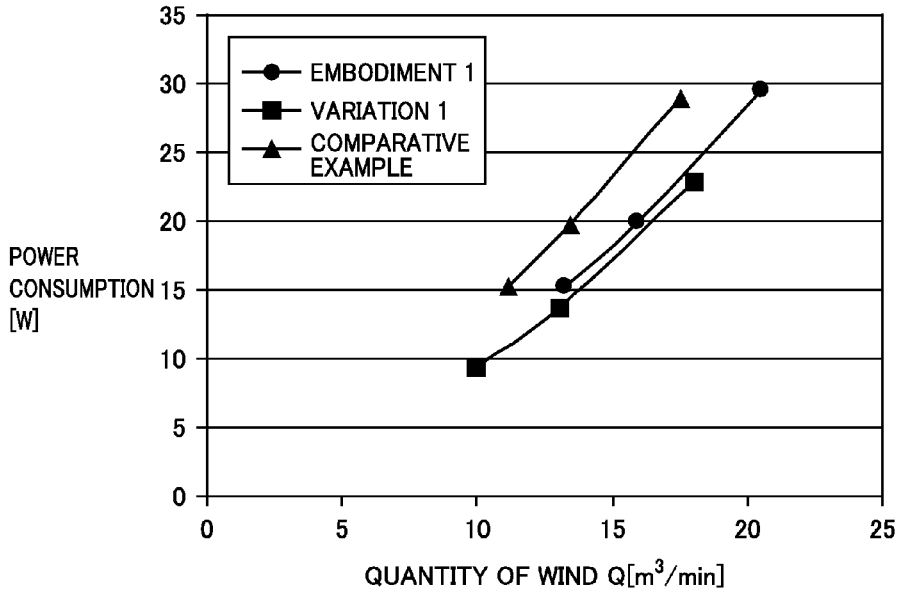
FIG. 76 is a graph showing relation between a quantity of wind and power consumption in the propeller fan in Embodiment B1 in FIG. 53, the propeller fan in Variation 1 in FIG. 71, and the propeller fan in Comparative Example in FIG. 73.
Figure 77:
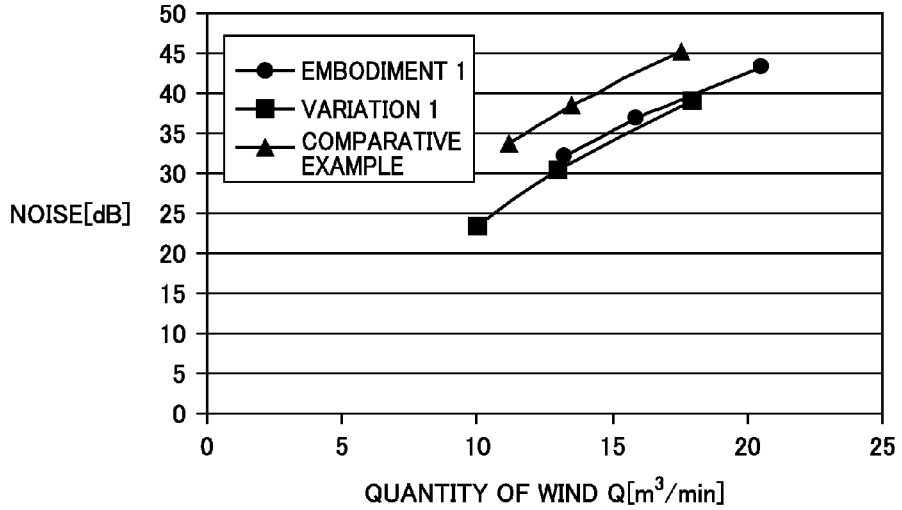
FIG. 77 is a graph showing relation between a quantity of wind and noise in the propeller fan in Embodiment B1 in FIG. 53, the propeller fan in Variation 1 in FIG. 71, and the propeller fan in Comparative Example in FIG. 73.

FIG. 75 is a graph showing relation between the number of rotations and a quantity of wind in the propeller fan in Embodiment B1 in FIG. 53, the propeller fan in Variation 1 in FIG. 71, and the propeller fan in Comparative Example in FIG. 73. FIG. 76 is a graph showing relation between a quantity of wind and power consumption in the propeller fan in Embodiment B1 in FIG. 53, the propeller fan in Variation 1 in FIG. 71, and the propeller fan in Comparative Example in FIG. 73. FIG. 77 is a graph showing relation between a quantity of wind and noise in the propeller fan in Embodiment B1 in FIG. 53, the propeller fan in Variation 1 in FIG. 71, and the propeller fan in Comparative Example in FIG. 73.

Referring to FIG. 75, when a quantity of wind at the same number of rotations is compared, propeller fan 2110 in Embodiment B1 and propeller fan 2120 in Variation 1 were greater in quantity of wind than propeller fan 2130 in Comparative Example, and propeller fan 2110 in Embodiment B1 was further greater in quantity of wind than propeller fan 2120 in Variation 1.

Referring to FIGS. 76 and 77, when power consumption and noise at the same quantity of wind were compared, propeller fan 2110 in Embodiment B1 and propeller fan 2120 in Variation 1 were lower in power consumption and noise than propeller fan 2130 in Comparative Example, and propeller fan 2110 in Embodiment B1 was further lower in power consumption and noise than propeller fan 2120 in Variation 1.

Embodiment B2

Figure 78:
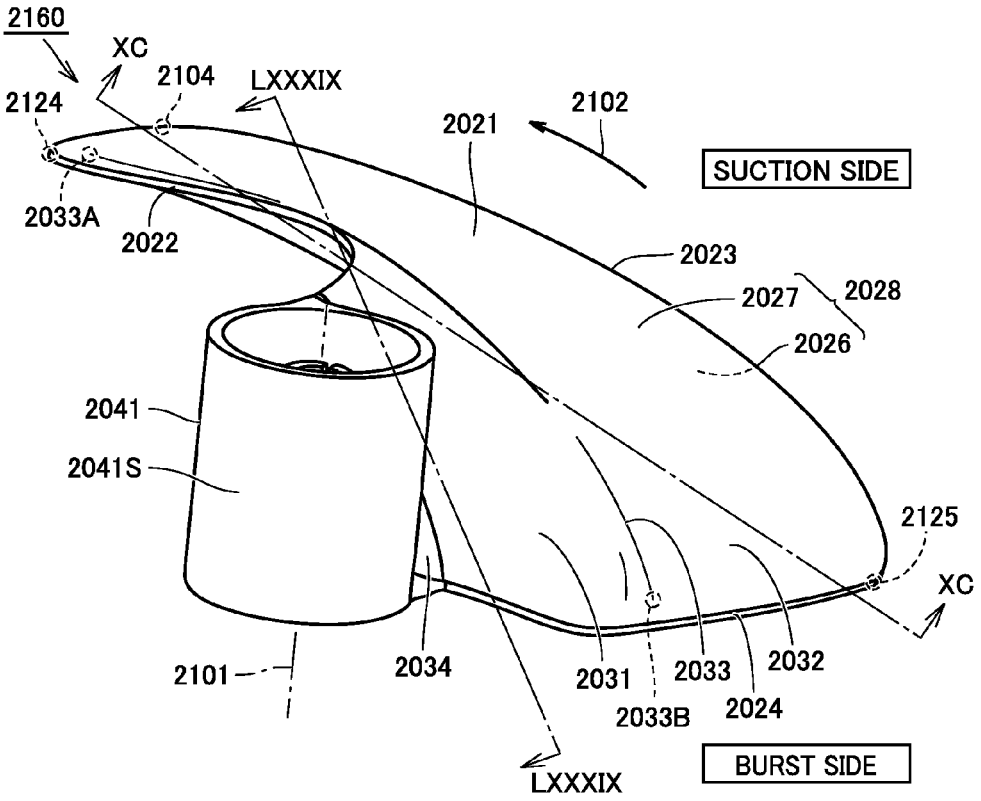
FIG. 78 is a perspective view showing a propeller fan in an Embodiment B2 of this invention.
Figure 79:
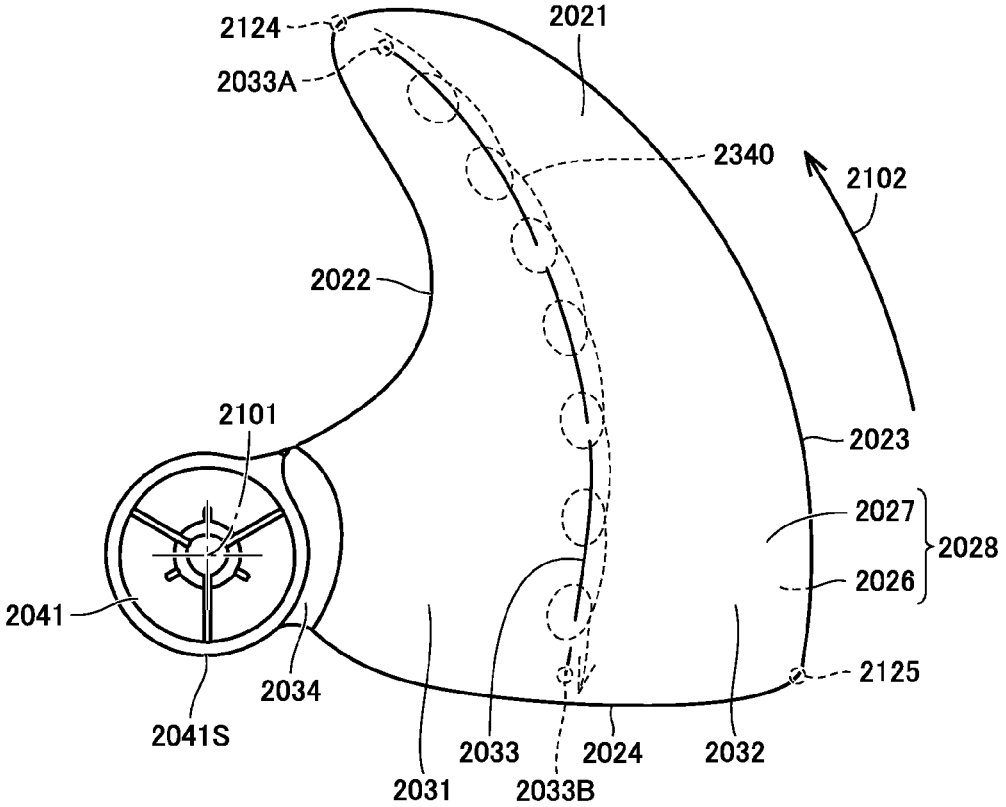
FIG. 79 is a plan view showing the propeller fan in FIG. 78.
Figure 80:
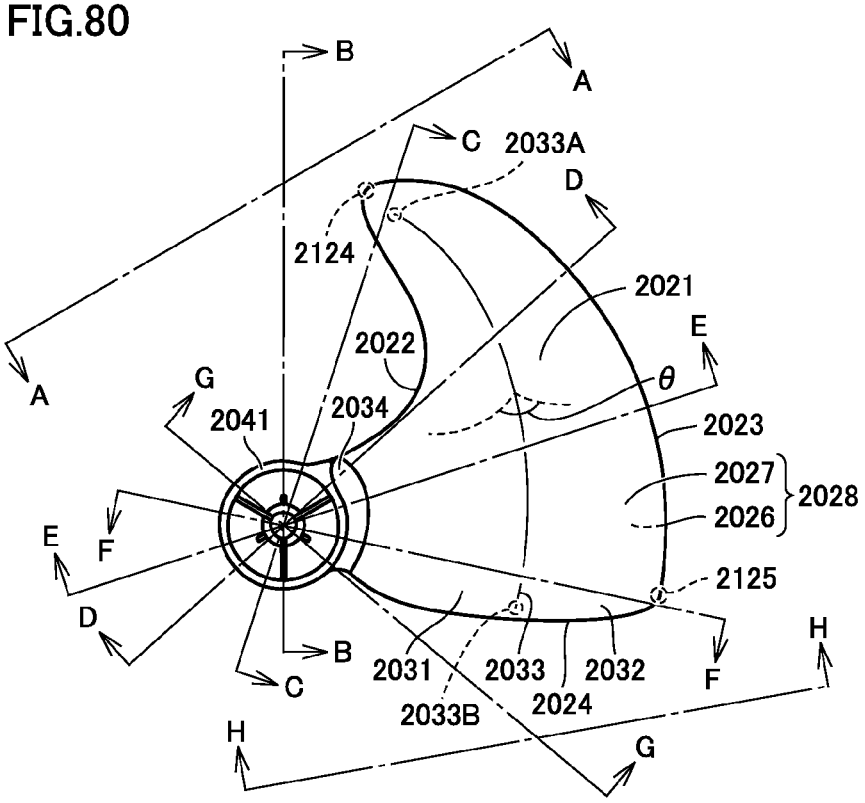
FIG. 80 is another plan view showing the propeller fan in FIG. 78.
Figure 81:
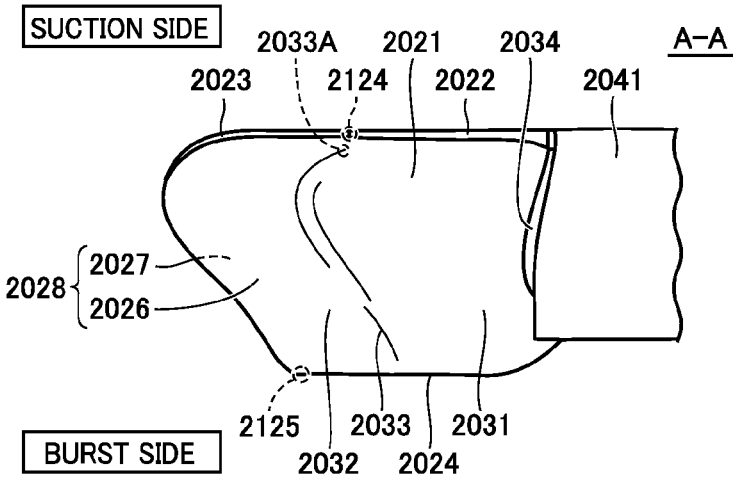
FIG. 81 is a side view showing the propeller fan viewed above the line A-A in FIG. 80.
Figure 82:
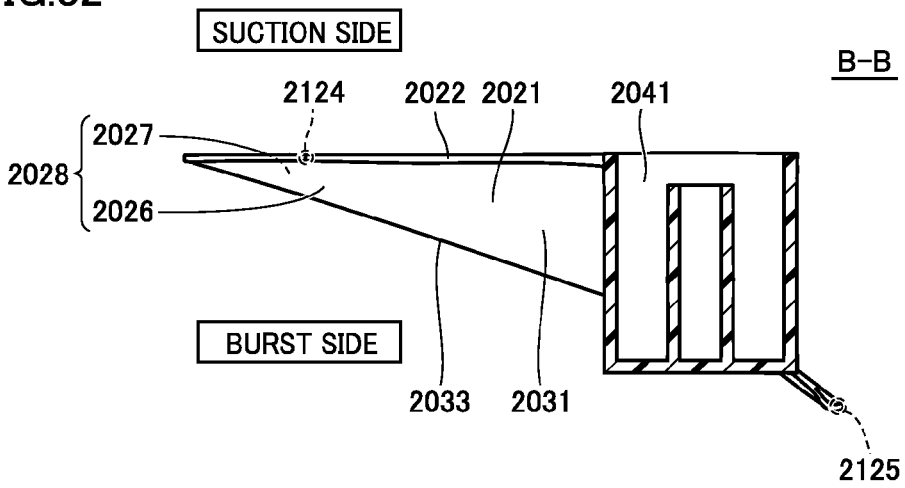
FIG. 82 is a cross-sectional view showing the propeller fan along the line B-B in FIG. 80.
Figure 83:
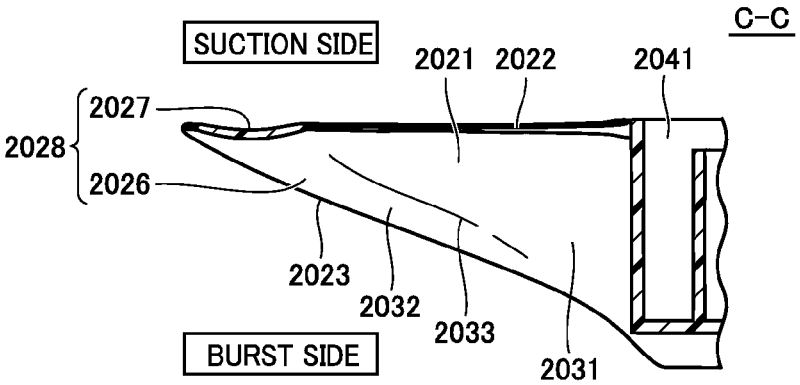
FIG. 83 is a cross-sectional view showing the propeller fan along the line C-C in FIG. 80.
Figure 84:
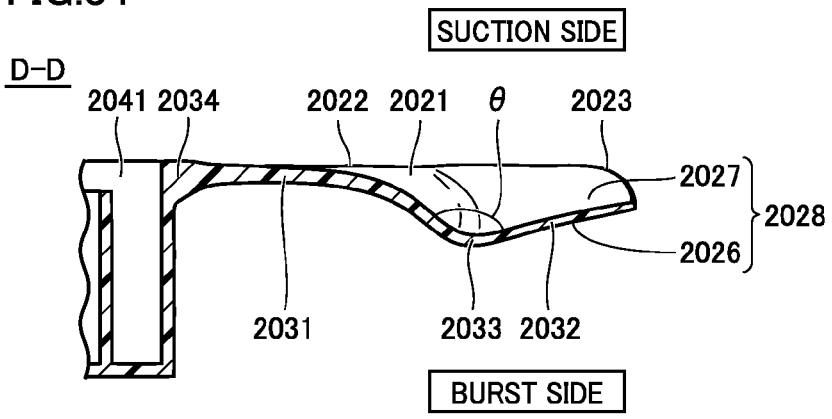
FIG. 84 is a cross-sectional view showing the propeller fan along the line D-D in FIG. 80.
Figure 85:
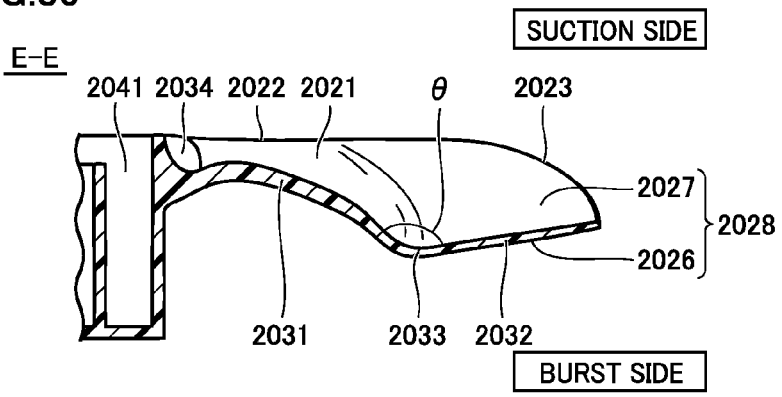
FIG. 85 is a cross-sectional view showing the propeller fan along the line E-E in FIG. 80.
Figure 86:
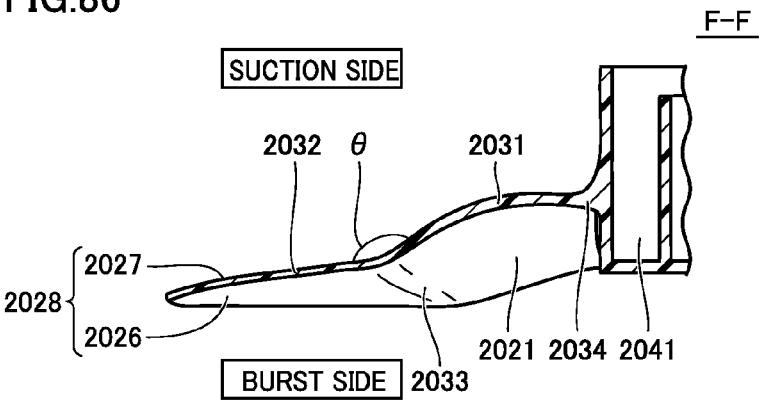
FIG. 86 is a cross-sectional view showing the propeller fan along the line F-F in FIG. 80.
Figure 87:
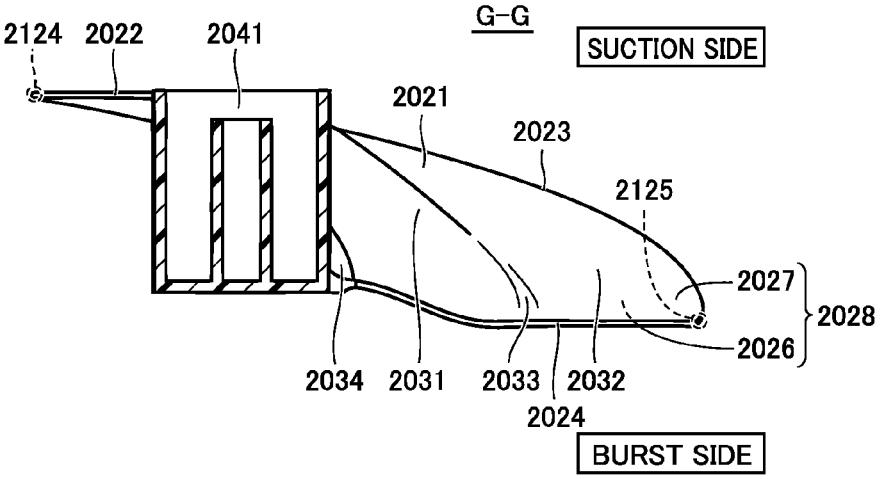
FIG. 87 is a cross-sectional view showing the propeller fan along the line G-G in FIG. 80.
Figure 88:
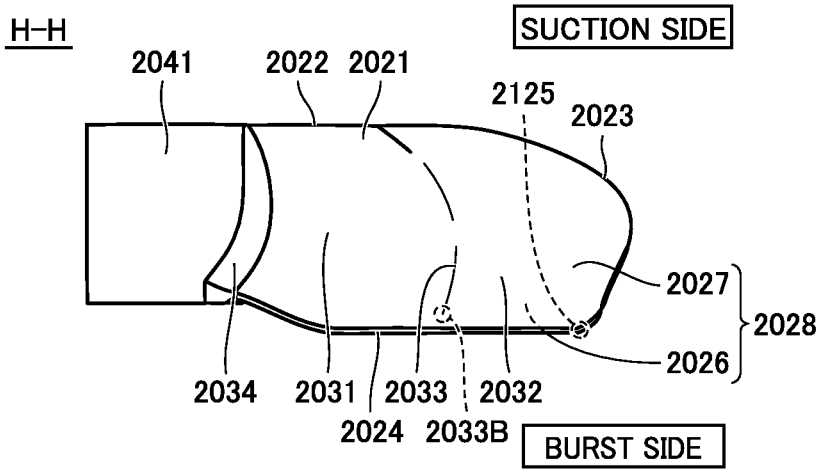
FIG. 88 is a side view showing the propeller fan viewed above the line H-H in FIG. 80.

FIG. 78 is a perspective view showing a propeller fan in an Embodiment B2 of this invention. FIGS. 79 and 80 are each a plan view showing the propeller fan in FIG. 78. FIG. 81 is a side view showing the propeller fan viewed above the line A-A in FIG. 80. FIG. 82 is a cross-sectional view showing the propeller fan along the line B-B in FIG. 80. FIG. 83 is a cross-sectional view showing the propeller fan along the line C-C in FIG. 80. FIG. 84 is a cross-sectional view showing the propeller fan along the line D-D in FIG. 80. FIG. 85 is a cross-sectional view showing the propeller fan along the line E-E in FIG. 80. FIG. 86 is a cross-sectional view showing the propeller fan along the line F-F in FIG. 80. FIG. 87 is a cross-sectional view showing the propeller fan along the line G-G in FIG. 80. FIG. 88 is a side view showing the propeller fan viewed above the line H-H in FIG. 80.

Referring to FIGS. 78 to 88, a propeller fan 2160 in the present embodiment is the same in a shape of a blade as propeller fan 2110 in Embodiment B1. FIGS. 78 to 80 show only one of three blades 2021 of propeller fan 2160. In the present embodiment, a fold structure in blade 2021 will be described.

Blade 2021 has a blade root portion 2034 and blade surface 2028 extending like a plate from blade root portion 2034. Blade root portion 2034 is arranged between blade 2021 and an outer surface 2041S of boss hub portion 2041 (a boundary). On a periphery of blade surface 2028, front edge portion 2022, a blade tip end portion 2124, outer edge portion 2023, a blade rear end portion 2125, and rear edge portion 2024 are annularly arranged in this order from a portion on the side in the direction of rotation of blade root portion 2034 toward a portion opposite in the direction of rotation of blade root portion 2034.

In a plan view of blade 2021, blade 2021 has a shape pointed like a sickle, with blade tip end portion 2124 where front edge portion 2022 intersects with outer edge portion 2023 being defined as the tip end. Blade tip end portion 2124 is arranged on the outer side in a direction of radius in front edge portion 2022 when viewed from central axis 2101. Blade tip end portion 2124 is a portion where front edge portion 2022 and outer edge portion 2023 are connected to each other. Blade tip end portion 2124 in the present embodiment is located most on the side in the direction of rotation in blade 2021. Blade rear end portion 2125 is arranged on the outer side in the direction of radius in rear edge portion 2024 when viewed from central axis 2101. Blade rear end portion 2125 is a portion where rear edge portion 2024 and outer edge portion 2023 are connected to each other.

Front edge portion 2022, blade tip end portion 2124, outer edge portion 2023, blade rear end portion 2125, and rear edge portion 2024 constitute a peripheral portion forming a periphery of blade 2021 together with blade root portion 2034. This peripheral portion (front edge portion 2022, blade tip end portion 2124, outer edge portion 2023, blade rear end portion 2125, and rear edge portion 2024) is in a smooth shape not having a corner portion, as it is formed substantially in an arc shape. Blade surface 2028 is formed over the entire region inside a region surrounded by blade root portion 2034 and this peripheral portion (front edge portion 2022, blade tip end portion 2124, outer edge portion 2023, blade rear end portion 2125, and rear edge portion 2024).

[Description of Inner Region 2031, Outer Region 2032, and Coupling Portion 2033]

Blade surface 2028 of propeller fan 2160 has an inner region 2031, an outer region 2032, and a coupling portion 2033. Inner region 2031, outer region 2032, and coupling portion 2033 are formed in both of positive pressure surface 2026 and negative pressure surface 2027.

Inner region 2031 includes blade root portion 2034 in a part thereof, and it is located on the inner side in the direction of radius of central axis 2101, relative to outer region 2032. Outer region 2032 includes blade rear end portion 2125 in a part thereof and it is located on the outer side in the direction of radius of central axis 2101, relative to coupling portion 2033 and inner region 2031. Positive pressure surface 2026 in inner region 2031 and positive pressure surface 2026 in outer region 2032 are formed to be different in surface shape from each other. Negative pressure surface 2027 in inner region 2031 and negative pressure surface 2027 in outer region 2032 are formed to be different in surface shape from each other.

Coupling portion 2033 couples inner region 2031 and outer region 2032 to each other such that a side of positive pressure surface 2026 of blade surface 2028 is projecting and a side of negative pressure surface 2027 of blade surface 2028 is recessed. Coupling portion 2033 is provided to substantially extend along the direction of rotation, and extends from a front end portion 2033A located most upstream in the direction of rotation of coupling portion 2033 toward a rear end portion 2033B located most downstream in the direction of rotation of coupling portion 2033.

Coupling portion 2033 is formed such that blade surface 2028 is curved with slightly sharp variation in curvature from inner region 2031 toward outer region 2032, and couples in a curved manner, inner region 2031 and outer region 2032 different from each other in surface shape to each other at a boundary therebetween.

Coupling portion 2033 is provided such that a curvature in a cross-sectional view along the direction of radius of blade surface 2028 attains to relative maximum around the same, appears as a projection projecting in a curved manner on positive pressure surface 2026 as extending like a streak from front end portion 2033A toward rear end portion 2033B, and appears as a groove portion recessed in a curved manner on negative pressure surface 2027 as extending like a streak from front end portion 2033A toward rear end portion 2033B.

Front end portion 2033A of coupling portion 2033 is located close to blade tip end portion 2124 and provided as being spaced apart from rear edge portion 2024. Front end portion 2033A of coupling portion 2033 in the present embodiment is provided at a position displaced slightly inward in blade surface 2028 from blade tip end portion 2124 toward the side opposite in the direction of rotation.

Front end portion 2033A of coupling portion 2033 may be located close to front edge portion 2022 or located close to outer edge portion 2023, so long as it is spaced apart from rear edge portion 2024. Front end portion 2033A of coupling portion 2033 is provided such that front edge portion 2022, blade tip end portion 2124, or outer edge portion 2023 is located on a line drawn by smoothly extending coupling portion 2033 in the direction of rotation.

Rear end portion 2033B of coupling portion 2033 is located close to rear edge portion 2024 and provided as being spaced apart from all of front edge portion 2022, blade tip end portion 2124, and outer edge portion 2023. Rear end portion 2033B of coupling portion 2033 in the present embodiment is provided at a position slightly displaced inward in blade surface 2028 from a substantially central position in rear edge portion 2024 in the direction of radius of central axis 2101 toward the direction of rotation. Rear end portion 2033B of coupling portion 2033 is provided such that rear edge portion 2024 is located on a line drawn by smoothly extending coupling portion 2033 toward a side opposite to the direction of rotation.

As shown in FIG. 79, when blade 2021 is rotated in a direction shown with arrow 2102 around central axis 2101, a blade tip end vortex 2340 is generated over blade surface 2028, which flows from each of front edge portion 2022, blade tip end portion 2124, and outer edge portion 2023 toward rear edge portion 2024, around a portion around blade tip end portion 2124. This blade tip end vortex 2340 is generated over each of positive pressure surface 2026 and negative pressure surface 2027. Preferably, coupling portion 2033 is provided to extend along a flow of this blade tip end vortex 2340.

As shown in FIGS. 80 to 82, coupling portion 2033 in the present embodiment is provided such that front end portion 2033A of coupling portion 2033 does not reach (does not overlap with) any of front edge portion 2022, blade tip end portion 2124, and outer edge portion 2023. A curve originating from presence of coupling portion 2033 appears in none of front edge portion 2022, blade tip end portion 2124, and outer edge portion 2023, and blade surface 2028 located around front end portion 2033A of coupling portion 2033 (positive pressure surface 2026 and negative pressure surface 2027) is formed to be flat at 180° in a cross-sectional view along the direction of radius of central axis 2101, which passes through front end portion 2033A.

As shown in FIGS. 80 and 83, coupling portion 2033 is provided such that blade surface 2028 (positive pressure surface 2026 and negative pressure surface 2027) relatively sharply curves in the vicinity of front end portion 2033A in coupling portion 2033, on the side opposite to the direction of rotation. As shown in FIGS. 80, 84, and 85, coupling portion 2033 is provided such that an interior angle θ virtually formed on the side of negative pressure surface 2027 of coupling portion 2033 is gradually smaller from front end portion 2033A toward a portion around the center of coupling portion 2033 in the direction of rotation. Preferably, this interior angle θ is formed to be smallest around the center of coupling portion 2033 in the direction of rotation.

As shown in FIGS. 80 and 86, coupling portion 2033 is provided such that interior angle θ virtually formed on the side of negative pressure surface 2027 of coupling portion 2033 is gradually greater from the portion around the center of coupling portion 2033 in the direction of rotation toward rear end portion 2033B. As shown in FIGS. 80, 87, and 88, coupling portion 2033 in the present embodiment is provided such that rear end portion 2033B of coupling portion 2033 does not reach (overlap with) rear edge portion 2024. A curve originating from presence of coupling portion 2033 does not appear in rear edge portion 2024, and blade surface 2028 located around rear end portion 2033B of coupling portion 2033 (positive pressure surface 2026 and negative pressure surface 2027) is formed to be flat at 180° in a cross-sectional view along the direction of radius of central axis 2101, which passes through rear end portion 2033B.

[Description of Stagger Angle θA, θB]

Figure 89:
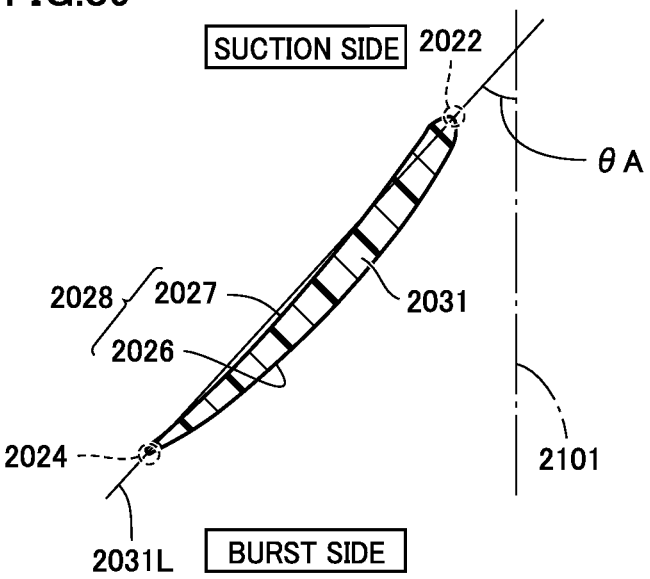
FIG. 89 is a cross-sectional view along the line LXXXIX-LXXXIX in FIG. 78.

FIG. 89 is a cross-sectional view along the line LXXXIX-LXXXIX in FIG. 78. Referring to FIGS. 78 and 89, inner region 2031 of blade surface 2028 located on the inner side in the direction of radius relative to coupling portion 2033 has a prescribed stagger angle θA. By connecting a point on front edge portion 2022 in inner region 2031 and a point on rear edge portion 2024 in inner region 2031 to each other, a virtual straight line 2031L is formed. Stagger angle θA refers to an angle formed by virtual straight line 2031L and central axis 2101 therebetween.

As shown in FIG. 89, inner region 2031 of blade 2021 in the present embodiment is curved such that a bulge portion of inner region 2031 is away from virtual straight line 2031L with front edge portion 2022 and rear edge portion 2024 being defined as opposing ends, and has a warped shape such that the side of positive pressure surface 2026 of blade surface 2028 (inner region 2031) is projecting and the side of negative pressure surface 2027 of blade surface 2028 (inner region 2031) is recessed. Blade 2021 in the present embodiment is formed such that stagger angle θA in a portion on the inner side in the direction of radius relative to coupling portion 2033 in blade 2021 is smaller toward boss hub portion 2041.

Figure 90:
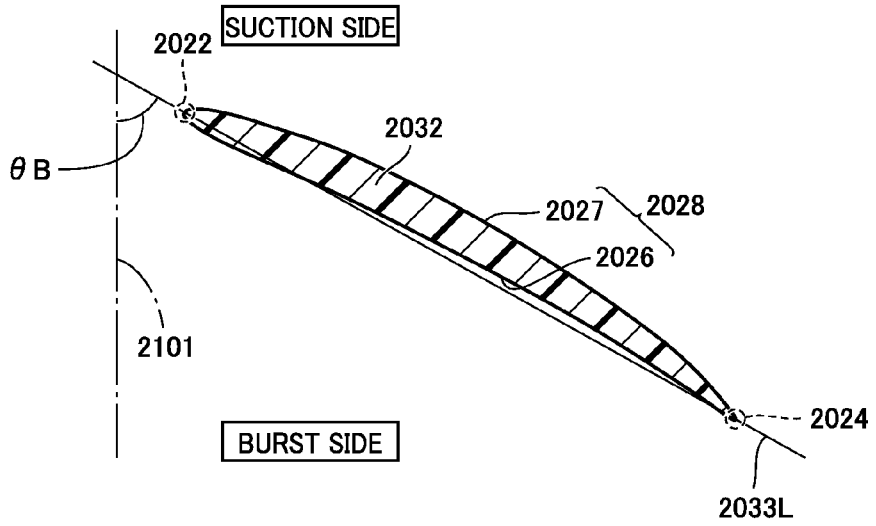
FIG. 90 is a cross-sectional view along the line XC-XC in FIG. 78.

FIG. 90 is a cross-sectional view along the line XC-XC in FIG. 78. Referring to FIGS. 78 and 90, outer region 2032 of blade surface 2028 located on the outer side in the direction of radius relative to coupling portion 2033 has a prescribed stagger angle θB. By connecting a point on front edge portion 2022 in outer region 2032 and a point on rear edge portion 2024 in outer region 2032 to each other, a virtual straight line 2033L is formed. Stagger angle θB refers to an angle formed by virtual straight line 2033L and central axis 2101 therebetween.

As shown in FIG. 90, outer region 2032 of blade 2021 in the present embodiment is curved such that a bulge portion of outer region 2032 is away from virtual straight line 2033L with front edge portion 2022 and rear edge portion 2024 being defined as opposing ends, and has a warped shape such that the side of positive pressure surface 2026 of blade surface 2028 (outer region 2032) is recessed and the side of negative pressure surface 2027 of blade surface 2028 (outer region 2032) is projecting.

Referring to FIGS. 89 and 90, blade 2021 in the present embodiment is formed such that stagger angle θA is smaller than stagger angle θB. Blade 2021 is formed such that stagger angle θA in blade root portion 2034 is also smaller than stagger angle θB in outer edge portion 2023. Furthermore, blade 2021 has a warped shape such that the side of positive pressure surface 2026 is projecting and the side of negative pressure surface 2027 is recessed on the inner side in the direction of radius relative to coupling portion 2033, and has a warped shape such that the side of positive pressure surface 2026 is recessed and the side of negative pressure surface 2027 is projecting on the outer side in the direction of radius relative to coupling portion 2033. Namely, in the present embodiment, blade 2021 is formed to be warped toward opposing sides, with coupling portion 2033 being defined as a boundary.

[Description of Function and Effect]

A function and effect achieved by propeller fan 2160 in the present embodiment will be described with reference to FIGS. 91 to 93.

Figure 91:
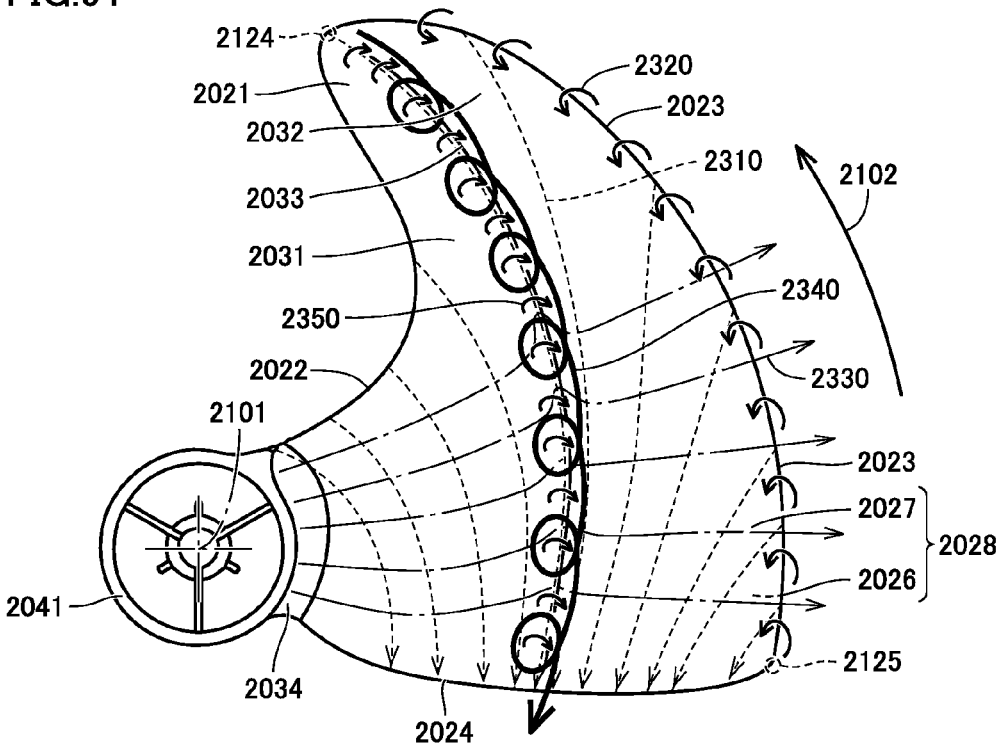
FIG. 91 is a plan view of a manner during rotation of a blade of a propeller fan viewed from a suction side.

FIG. 91 is a plan view of a manner during rotation of a blade of a propeller fan viewed from the suction side. FIG. 92 is a plan view of a manner during rotation of a blade of a propeller fan viewed from the burst side. FIG. 93 is a cross-sectional view of a propeller fan virtually cut along a coupling portion, which is a diagram showing a manner during rotation of a blade of a propeller fan.

Figure 92:
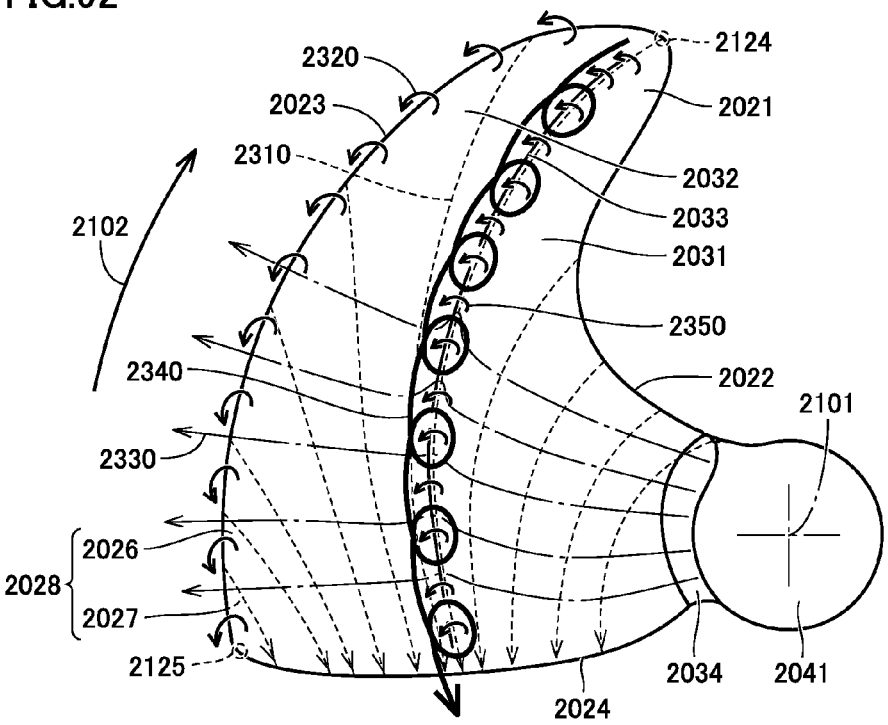
FIG. 92 is a plan view of a manner during rotation of a blade of a propeller fan viewed from a burst side.

Referring to FIGS. 91 and 92, blade 2021 rotates in a direction shown with arrow 2102 around central axis 2101. Over blade surface 2028 (both of positive pressure surface 2026 and negative pressure surface 2027) of blade 2021 in propeller fan 2160 in the present embodiment, blade tip end vortex 2340, a mainstream 2310, a secondary flow 2330, a horseshoe vortex 2320, and a horseshoe vortex 2350 are generated as flows of air.

Blade tip end vortex 2340 is formed as blade tip end portion 2124 mainly collides with air during rotation of propeller fan 2160. Blade tip end vortex 2340 originates mainly from blade tip end portion 2124 and flows from blade tip end portion 2124, a portion closer to blade tip end portion 2124 of front edge portion 2022 located in the vicinity of blade tip end portion 2124, and a portion close to blade tip end portion 2124 of outer edge portion 2023 located in the vicinity of blade tip end portion 2124 over blade surface 2028 toward rear edge portion 2024.

Mainstream 2310 is formed on a further upper side of blade surface 2028 than blade tip end vortex 2340 during rotation of propeller fan 2160. In other words, mainstream 2310 is formed on an opposite side of blade surface 2028 with respect to a surface layer of blade surface 2028 over which blade tip end vortex 2340 is formed, with blade tip end vortex 2340 lying therebetween. Mainstream 2310 flows in from front edge portion 2022, blade tip end portion 2124, and outer edge portion 2023 over blade surface 2028 toward rear edge portion 2024.

Horseshoe vortex 2320 is generated along outer edge portion 2023 to flow from positive pressure surface 2026 to negative pressure surface 2027, owing to a pressure difference between positive pressure surface 2026 and negative pressure surface 2027 caused by rotation of propeller fan 2160. Secondary flow 2330 is generated to flow from boss hub portion 2041 toward outer edge portion 2023, owing to centrifugal force caused by rotation of the propeller fan. Horseshoe vortex 2350 is generated as secondary flow 2330 flows across a portion where coupling portion 2033 is provided in blade surface 2028.

As described above, front end portion 2033A of coupling portion 2033 in the present embodiment is provided at a position slightly displaced inward in blade surface 2028 from blade tip end portion 2124 toward the side opposite to the direction of rotation, and rear end portion 2033B of coupling portion 2033 is provided at a position slightly displaced inward in blade surface 2028 from a substantially central position in rear edge portion 2024 in the direction of radius of central axis 2101 toward the direction of rotation. According to such a construction, coupling portion 2033 is formed to substantially extend along the direction of flow of mainstream 2310 and blade tip end vortex 2340.

Figure 93:
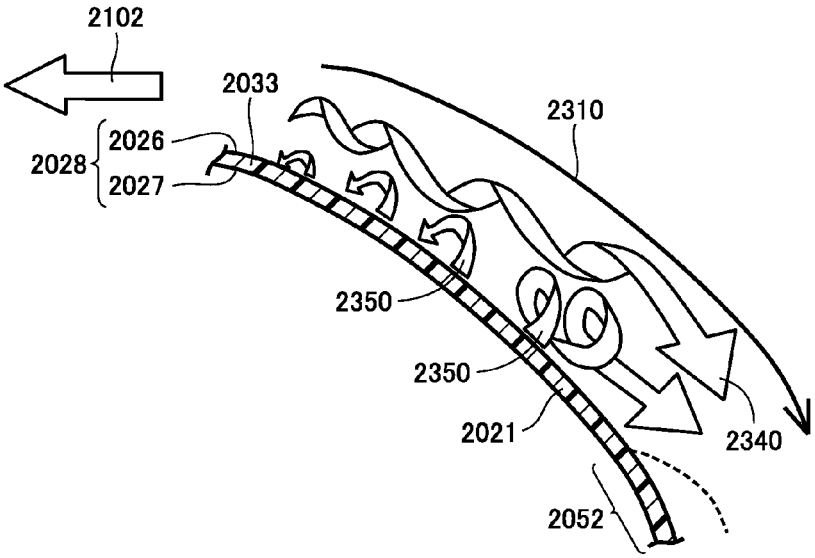
FIG. 93 is a cross-sectional view of a propeller fan virtually cut along a coupling portion, which is a diagram showing a manner during rotation of a blade of the propeller fan.

Referring to FIG. 93, coupling portion 2033 coupling inner region 2031 and outer region 2032 to each other in a curved manner has horseshoe vortex 2350 and blade tip end vortex 2340 held in the vicinity of coupling portion 2033 at a surface layer of blade surface 2028, and suppresses separation of horseshoe vortex 2350 and blade tip end vortex 2340 from the surface layer of blade surface 2028. Coupling portion 2033 also suppresses development or fluctuation of horseshoe vortex 2350 which is generated in the vicinity of coupling portion 2033 and flows as being held by coupling portion 2033.

Blade tip end vortex 2340 which is generated in the vicinity of blade tip end portion 2124 and flows as being held by coupling portion 2033 and horseshoe vortex 2350 which is generated in the vicinity of coupling portion 2033 and flows as being held by coupling portion 2033 provide kinetic energy to mainstream 2310. Mainstream 2310 provided with kinetic energy is less likely to separate from blade surface 2028 on the downstream side over blade surface 2028. Consequently, a separation region 2052 can be made smaller or eliminated. Propeller fan 2160 can achieve lowering in noise generated during rotation owing to suppression of separation, as well as increase in quantity of wind as compared with a case not provided with coupling portion 2033 and resulting higher efficiency.

Figure 94:
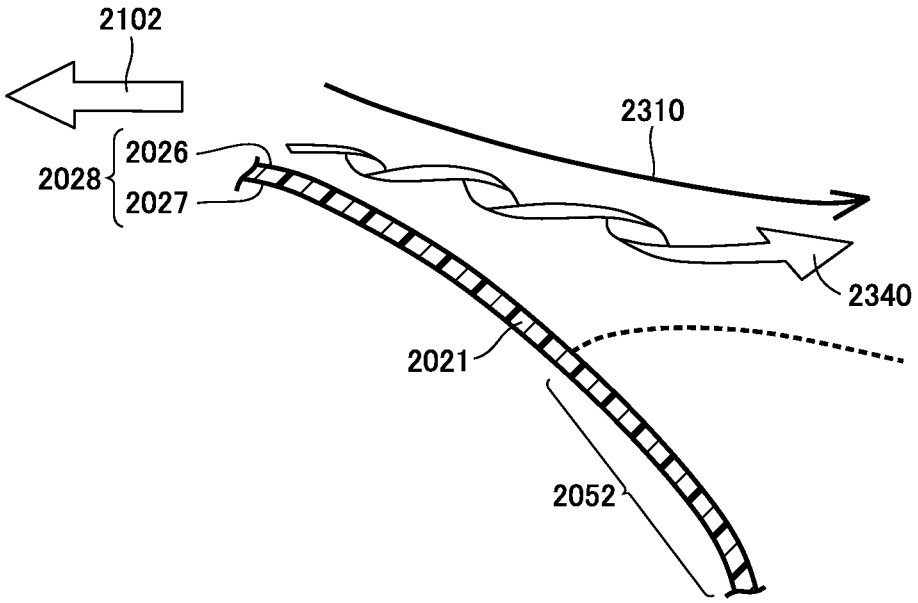
FIG. 94 is a cross-sectional view of a propeller fan for comparison virtually cut along a portion corresponding to a coupling portion in the present embodiment, which is a diagram showing a manner during rotation of a blade of this propeller fan.

FIG. 94 is a cross-sectional view of a propeller fan for comparison virtually cut along a portion corresponding to a coupling portion in the present embodiment, which is a diagram showing a manner during rotation of a blade of this propeller fan. The propeller fan for comparison is constructed substantially similarly to propeller fan 2160, except for not having coupling portion 2033.

Referring to FIG. 94, in such a propeller fan for comparison, mainstream 2310 and blade tip end vortex 2340 generated over positive pressure surface 2026 and negative pressure surface 2027 of blade surface 2028 flow along blade surface 2028 on the upstream side over blade surface 2028 close to front edge portion 2022, blade tip end portion 2124, and outer edge portion 2023, however, it is less likely to flow along blade surface 2028 on the downstream side over blade surface 2028 close to rear edge portion 2024. Since no kinetic energy is provided from blade tip end vortex 2340 to mainstream 2310 on the downstream side, separation region 2052 where mainstream 2310 separates from blade surface 2028 is likely to be created. In this propeller fan, it is difficult to lower noise generated during rotation. Such tendency is noticeable in particular over negative pressure surface 2027, of positive pressure surface 2026 and negative pressure surface 2027.

During rotation of propeller fan 2160 in the present embodiment, in the vicinity of a region where coupling portion 2033 is provided, mainstream 2310 flows from the outer side in the direction of radius inward in that direction. Therefore, by forming coupling portion 2033 substantially along a flow of mainstream 2310 and adopting a blade shape also for a region where coupling portion 2033 is provided, the blade shape can be realized for all flows of mainstream 2310 and hence wind can more efficiently be sent.

As coupling portion 2033 is provided such that blade surface 2028 is smoothly curved from the side of inner region 2031 toward outer region 2032, a degree of freedom in terms of design of a shape of blade surface 2028 can be ensured. For example, in order to suppress generation of a horseshoe vortex, such a complicated shape of blade surface 2028 that a height of blade surface 2028 is increased around boss hub portion 2041 while a sickle shape decreasing in width of front edge portion 2022 and outer edge portion 2023 toward blade tip end portion 2124 is maintained can also be implemented.

In propeller fan 2160 in the present embodiment, blade surface 2028 (positive pressure surface 2026 and negative pressure surface 2027) located around front end portion 2033A of coupling portion 2033 is formed to be flat at 180° in a cross-sectional view along the direction of radius of central axis 2101, which passes through front end portion 2033A, and furthermore, blade surface 2028 (positive pressure surface 2026 and negative pressure surface 2027) located around rear end portion 2033B of coupling portion 2033 is formed to be flat at 180° in a cross-sectional view along the direction of radius of central axis 2101, which passes through rear end portion 2033B. According to such a construction, since wind which flows into blade surface 2028 and wind which flows out of blade surface 2028 are not disturbed, resistance against mainstream 2310 can be lessened. Such a feature is desirably provided as necessary.

Blade 2021 in the present embodiment has a warped shape in blade root portion 2034 and inner region 2031 such that the side of positive pressure surface 2026 is projecting and the side of negative pressure surface 2027 is recessed and has a warped shape in outer region 2032 and outer edge portion 2023 such that the side of positive pressure surface 2026 is recessed and the side of negative pressure surface 2027 is projecting. Such a construction can be referred to as a reverse camber structure.

In a general propeller fan, owing to its structure, a peripheral velocity in a portion on the inner side in the direction of radius is low and a peripheral velocity in a portion on the outer side in the direction of radius is high. An inflow angle of air is different between the side of the blade root portion located on the inner side in the direction of radius and the side of the outer edge portion (a blade end side) located on the outer side in the direction of radius. Therefore, when an inflow angle (a camber angle) on the side of the outer edge portion (the blade end side) is designed such that inflow of air is appropriate on the side of the outer edge portion (the blade end side), good inflow of air is less likely on the side of the blade root portion, and separation may occur in a flow of air on the side of the blade root portion (vice versa).

Therefore, as in propeller fan 2160 in the present embodiment, a camber angle is varied appropriately on the side of blade root portion 2034 located on the inner side in the direction of radius and the side of outer edge portion 2023 (the blade end side) located on the outer side in the direction of radius and the reverse camber structure is provided in a region where an inflow angle of air on the side of blade root portion 2034 is large, so that air can flow in at an appropriate inflow angle with respect to blade surface 2028 over the entire region in the direction of radius and in addition separation of a flow of air can be prevented.

A construction of blade surface 2028 having a warped shape in blade root portion 2034 and inner region 2031 such that the side of positive pressure surface 2026 is projecting and the side of negative pressure surface 2027 is recessed and having a warped shape in outer region 2032 and outer edge portion 2023 such that the side of positive pressure surface 2026 is recessed and the side of negative pressure surface 2027 is projecting (the reverse camber structure) can be enabled independently of such a technical concept that coupling portion 2033 is provided in blade surface 2028.

Even when coupling portion 2033 is not provided in the propeller fan, according to blade surface 2028 having the reverse camber structure, air can flow in at an appropriate inflow angle with respect to blade surface 2028 over the entire region in the direction of radius, and in addition, the object to prevent separation of a flow of air can be achieved.

In propeller fan 2160 in the present embodiment, blade 2021 is formed such that stagger angle θA is smaller than stagger angle θB. Blade 2021 is formed such that stagger angle θA in blade root portion 2034 is also smaller than stagger angle θB in outer edge portion 2023. According to such a construction, inclination of blade surface 2028 is steeper on the inner circumferential side and gentler on the outer circumferential side, and hence a peak of a wind velocity on the outer side in the direction of radius causing uncomfortableness can be adjusted.

Blade 2021 in the present embodiment is formed such that stagger angle θA in a portion on the inner side in the direction of radius relative to coupling portion 2033 in blade 2021 is smaller toward boss hub portion 2041. According to such a construction, on the inner circumferential side around central axis 2101, capability to send wind is higher toward central axis 2101.

In a general propeller fan, there is a great difference in distribution of a wind velocity at the time of blowing off in the direction of radius. A wind velocity is high on the outer side in the direction of radius and highest around the tip end portion of the blade, and the wind velocity has an extreme peak point. A difference in wind velocity is excessive between a portion where blade 2021 does not function in the vicinity of central axis 2101 and a portion where blade 2021 functions most, and variation in wind velocity at the time of blowing off is caused, which is a major cause of uncomfortableness.

In contrast, according to propeller fan 2160 in the present embodiment, a difference in quantity of wind (wind velocity) between the inner circumferential side and the outer circumferential side can be lessened. Propeller fan 2160 can achieve more uniform blowing and uncomfortableness of a person who has received wind can be suppressed. With propeller fan 2160, a space which can be occupied by the fan can be utilized as much as possible and strong blowing can also be achieved. Such a feature is desirably provided as necessary.

From a point of view of more uniform blowing by propeller fan 2160, blade 2021 is desirably formed such that an area of a blade in a portion on the inner side (inner region 2031) in the direction of radius relative to coupling portion 2033 in blade 2021 is equal to or greater than an area of a blade in a portion on the outer side (outer region 2032) in the direction of radius relative to coupling portion 2033 in blade 2021.

With such a construction, capability to send wind in the portion on the inner side (inner region 2031) in the direction of radius relative to coupling portion 2033 in blade 2021 can be enhanced, and capability to send wind in the portion on the outer side (outer region 2032) in the direction of radius relative to coupling portion 2033 in blade 2021 can be lowered. A difference in quantity of wind (wind velocity) between the inner circumferential side and the outer circumferential side can be lessened, more uniform blowing by propeller fan 2110 can be achieved, and uncomfortableness of a person who has received wind can be suppressed. Such a feature is desirably provided as necessary.

[Description of Various Variations]

Figure 95:
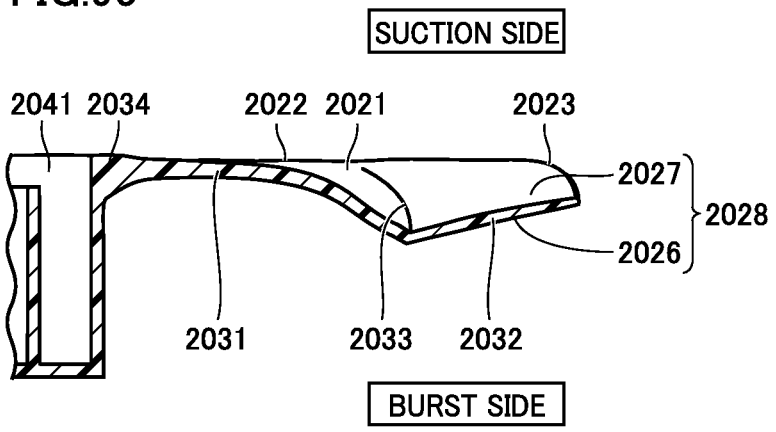
FIG. 95 is a cross-sectional view showing a Variation 1 of the propeller fan in FIG. 78.

FIG. 95 is a cross-sectional view showing a Variation 1 of the propeller fan in FIG. 78. FIG. 95 is a diagram corresponding to FIG. 84.

Coupling portion 2033 of propeller fan 2160 described above is formed such that blade surface 2028 is curved with slightly sharp variation in curvature from inner region 2031 toward outer region 2032 and couples in a curved manner, inner region 2031 and outer region 2032 different from each other in surface shape to each other at a boundary therebetween.

Referring to FIG. 95, coupling portion 2033 may be formed such that blade surface 2028 is curved with slightly sharp variation in curvature from inner region 2031 toward outer region 2032 and may couple in a bent manner, inner region 2031 and outer region 2032 different from each other in surface shape to each other at a boundary therebetween. According to such a construction as well, an effect the same as in propeller fan 2160 described above can be achieved.

If blade surface 2028 is bent too extremely in coupling portion 2033, that shape of coupling portion 2033 is likely to affect a secondary flow which is not a mainstream generated over blade surface 2028. In a case of maximum use of the same space as well, desirably, an appropriate degree of curving or bending is determined in consideration of a flow of air in coupling portion 2033.

Figure 96:
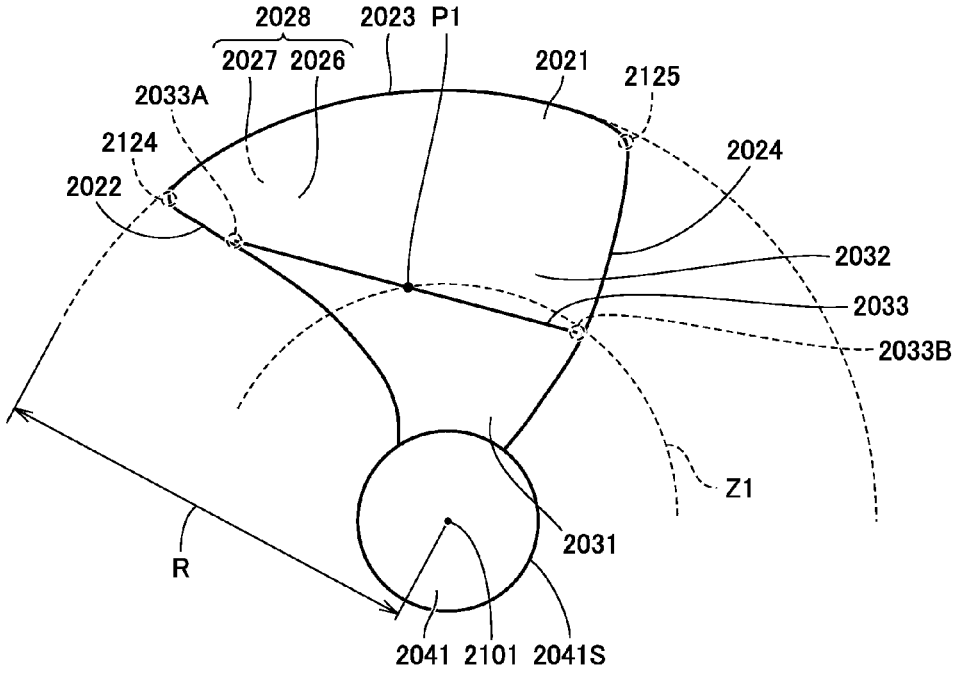
FIG. 96 is a plan view showing a Variation 2 of the propeller fan in FIG. 78.

FIG. 96 is a plan view showing a Variation 2 of the propeller fan in FIG. 78. Referring to FIG. 96, in the present Variation, when a virtual concentric circle Z1 centered around central axis 2101 passing through a central position P1 in coupling portion 2033 in the direction of rotation is drawn, coupling portion 2033 is provided such that front end portion 2033A of coupling portion 2033 is located on the outer side in the direction of radius of concentric circle Z1 and rear end portion 2033B of coupling portion 2033 is located on the inner side in the direction of radius of concentric circle Z1. According to such a construction, a mainstream formed over blade surface 2028 is in a direction from the outer side to the inner side in the direction of radius, and hence coupling portion 2033 can be provided along such a flow of the mainstream.

Embodiment B3

Figure 97:
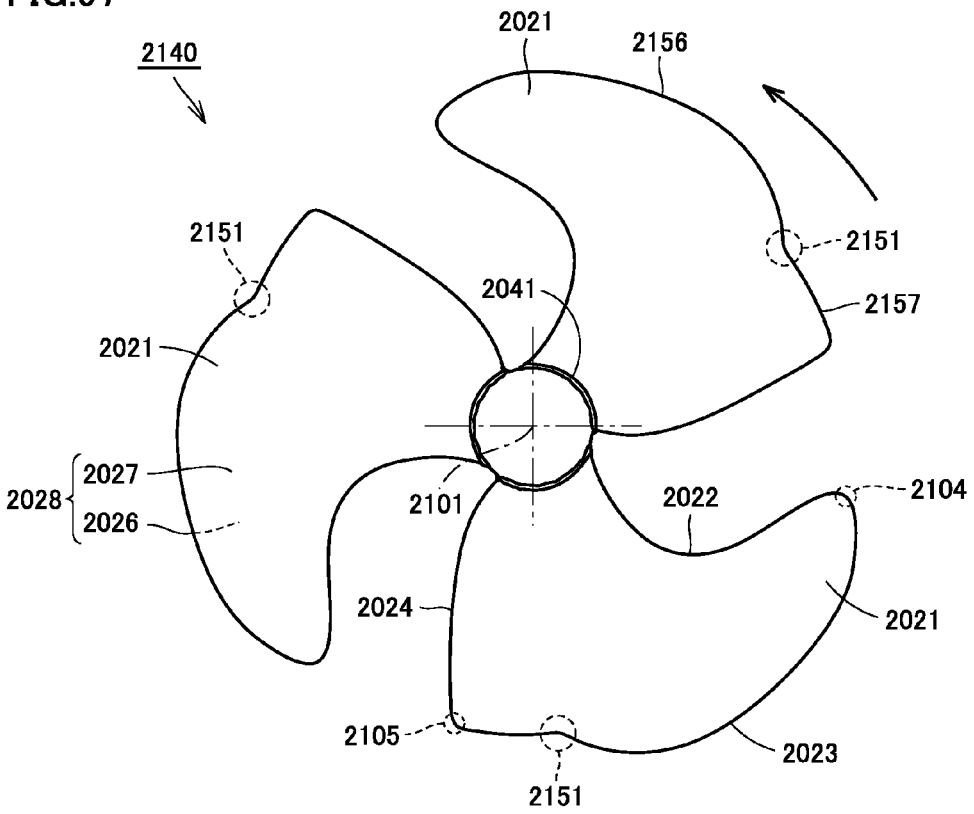
FIG. 97 is a plan view showing a propeller fan in an Embodiment B3 of this invention.
Figure 98:
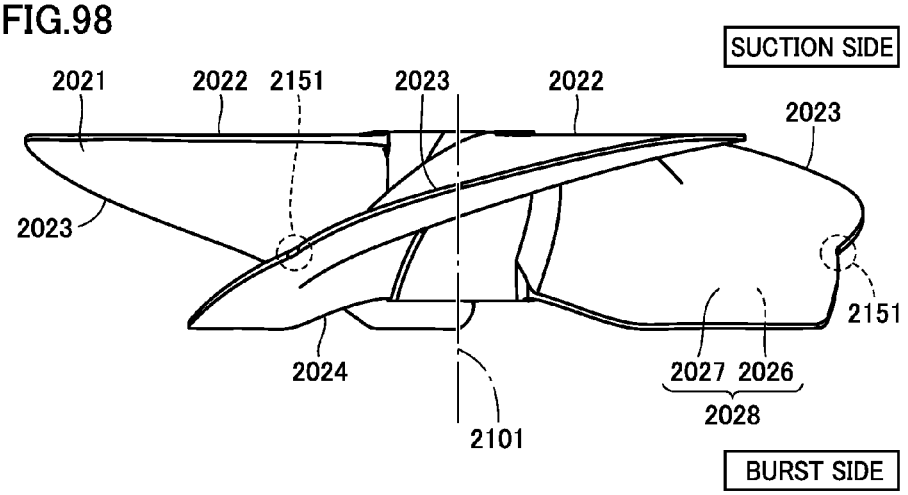
FIG. 98 is a side view showing the propeller fan in FIG. 97.

FIG. 97 is a plan view showing a propeller fan in an Embodiment B3 of this invention. FIG. 98 is a side view showing the propeller fan in FIG. 97. The propeller fan in the present embodiment is basically the same in structure as propeller fan 2110 in Embodiment B1. Description of a redundant structure will not be repeated below.

Referring to FIGS. 97 and 98, in a propeller fan 2140 in the present embodiment, outer edge portion 2023 of blade 2021 includes a front outer edge portion 2156 located on the side of front edge portion 2022, a rear outer edge portion 2157 located on the side of rear edge portion 2024, and a connection portion 2151 in a prescribed shape connecting front outer edge portion 2156 and rear outer edge portion 2157 to each other. With outer edge portion 2023 in such a shape, various effects which will be described later are exhibited.

In outer edge portion 2023, connection portion 2151 recessed toward central axis 2101 is formed. Connection portion 2151 is formed at a position in midway between front edge side connection portion 2104 and rear edge side connection portion 2105.

As connection portion 2151 described above is formed in outer edge portion 2023, in outer edge portion 2023 of blade 2021, front outer edge portion 2156 located on the side of front edge side connection portion 2104 (see FIG. 55) and rear outer edge portion 2157 located on the side of rear edge side connection portion 2105 (see FIG. 55) are provided.

Connection portion 2151 may be in a smoothly curved shape or in a bent shape. In the present embodiment, since connection portion 2151 is formed as being relatively shallowly recessed, connection portion 2151 has a shape substantially at an obtuse angle.

A position where connection portion 2151 is formed is not particularly limited so long as it is a position on outer edge portion 2023. In the present embodiment, however, connection portion 2151 is formed at a position close to rear edge side connection portion 2105 relative to front edge side connection portion 2104. Therefore, in the present embodiment, a width of front outer edge portion 2156 along the direction of rotation is formed to be greater than a width of rear outer edge portion 2157 along the direction of rotation.

By forming such connection portion 2151 in blade 2021, an effect as follows is achieved.

Firstly, wind velocity distribution in a radial direction can be more uniform and variation in wind velocity can be suppressed. Thus, comfortably impinging wind can be obtained.

Namely, in a case of a blade shape not having recessed connection portion 2151 formed in outer edge portion 2023, a wind velocity is greater radially outward substantially in proportion, and there is a great difference in velocity between wind generated in a portion close to the radially inner side and wind generated in a portion close to the radially outer side. Thus, significant pressure fluctuation is caused in generated wind.

In contrast, in the present embodiment, recessed connection portion 2151 is formed in outer edge portion 2023. Therefore, as compared with a case where no recessed connection portion 2151 is formed in outer edge portion 2023, an area of a blade is decreased in the vicinity of outer edge portion 2023 (that is, a portion close to the radially outer side). Therefore, a wind velocity increasing radially outward substantially in proportion is lowered in a portion close to outer edge portion 2023. A velocity of wind generated in the portion close to the radially inner side and a velocity of wind generated in a portion close to outer edge portion 2023 are close to each other and wind velocity distribution in the radial direction is more uniform. Therefore, variation in wind velocity can be suppressed and comfortably impinging wind can be obtained.

Secondly, pressure fluctuation included in wind generated in a portion close to the radially outer side is less, and comfortably impinging wind can be generated.

Namely, in a case of a blade shape not having a recessed connection portion formed in outer edge portion 2023, air passes through a relatively large space between blades and great pressure fluctuation is caused in generated wind. This is particularly noticeable in a portion on the side of outer edge portion 2023 where wind high in velocity is generated, and wind greater in pressure difference is generated as the number of blades is smaller.

In contrast, in the present embodiment, the blade shape is such that recessed connection portion 2151 is formed in outer edge portion 2023. Therefore, in each blade 2021, a relatively small space (that is, a space where recessed connection portion 2151 is located) is formed between front outer edge portion 2156 and rear outer edge portion 2157 in one blade 2021, and the space is present in blade 2021 as a space where no wind is generated. Consequently, in a portion on the side of outer edge portion 2023 where wind high in velocity is generated, a pressure difference caused in generated wind is lessened as a result of decrease in area of the blade, and in addition, a pressure fluctuates in a more finely stepwise manner. Therefore, front outer edge portion 2156 and rear outer edge portion 2157 provided in one blade 2021 function as if two blades sent wind, and comfortably impinging wind less in pressure fluctuation as a whole can be generated.

Thirdly, during rotation at a low speed, comfortably impinging wind diffusing over a wide range can be obtained, and during rotation at a high speed, wind high in straightness and reaching farther can be obtained, which will be described in further detail with reference to FIGS. 99 to 102.

Figure 99:
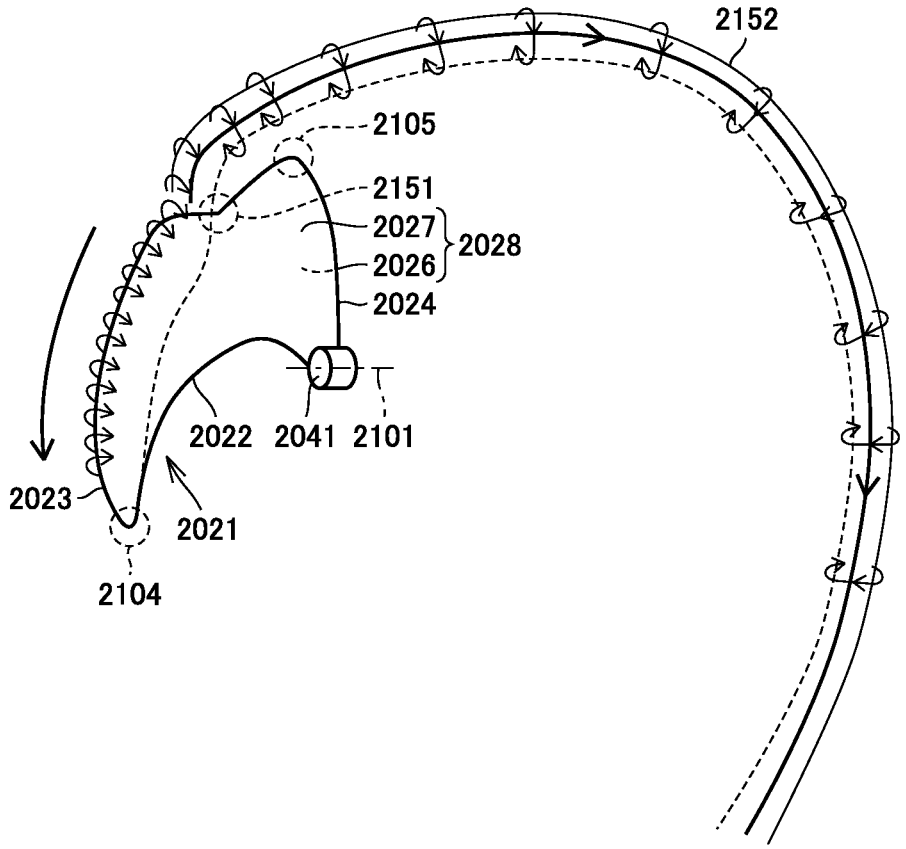
FIG. 99 is a conceptual view showing a flow of wind obtained at the time when the propeller fan in Embodiment B3 of this invention is rotated at a low speed.
Figure 100:
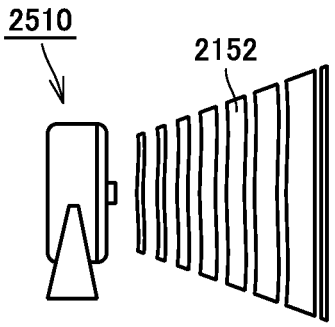
FIG. 100 is a diagram schematically showing a state of wind obtained at the time when the propeller fan in Embodiment B3 of this invention is rotated at a low speed.
Figure 101:
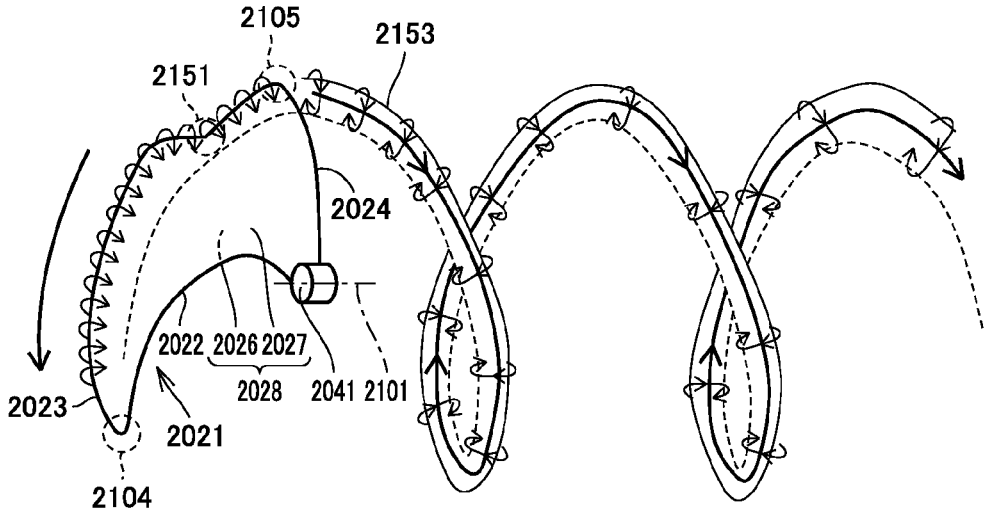
FIG. 101 is a conceptual view showing a flow of wind obtained at the time when the propeller fan in Embodiment B3 of this invention is rotated at a high speed.
Figure 102:
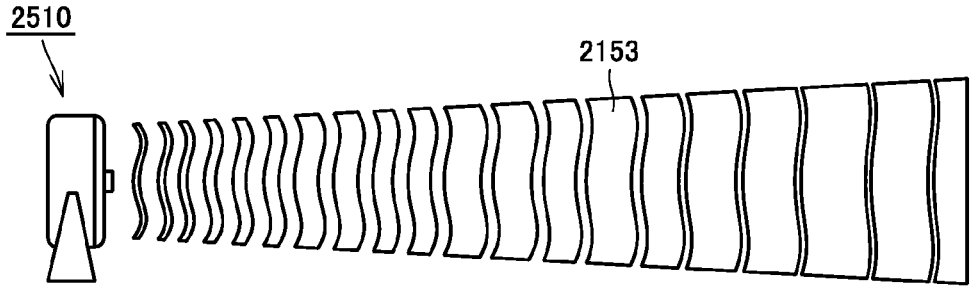
FIG. 102 is a diagram schematically showing a state of wind obtained at the time when the propeller fan in Embodiment B3 of this invention is rotated at a high speed.

FIG. 99 is a conceptual view showing a flow of wind obtained at the time when the propeller fan in Embodiment B3 of this invention is rotated at a low speed. FIG. 100 is a diagram schematically showing a state of wind obtained at the time when the propeller fan in Embodiment B3 of this invention is rotated at a low speed. FIG. 101 is a conceptual view showing a flow of wind obtained at the time when the propeller fan in Embodiment B3 of this invention is rotated at a high speed. FIG. 102 is a diagram schematically showing a state of wind obtained at the time when the propeller fan in Embodiment B3 of this invention is rotated at a high speed.

In FIGS. 99 and 101, as a track representative of a blade tip end vortex, a track of a blade tip end vortex generated around front edge side connection portion 2104 is schematically shown with a thin dashed line, a track representative of a horseshoe vortex is schematically shown with a thin line, and a track of wind generated at a position closer to outer edge portion 2023 of blade 2021 is further shown schematically with a bold line.

As described above, in the present embodiment, recessed connection portion 2151 is formed in outer edge portion 2023 of blade 2021. The position on outer edge portion 2023 corresponds to a position downstream of the blade tip end portion including front edge side connection portion 2104, along a streamline of the blade tip end vortex which flows over blade surface 2028.

Referring to FIGS. 99 and 100, when blade 2021 rotates at a low speed, kinetic energy of the blade tip end vortex and the horseshoe vortex generated as a result of rotation of blade 2021 is low, and hence separation of the blade tip end vortex and the horseshoe vortex is promoted in recessed connection portion 2151 without the vortexes being trapped therein. Thus, the blade tip end vortex and the horseshoe vortex are both dispelled radially outward by centrifugal force in a portion where recessed connection portion 2151 is formed. Therefore, as shown in FIG. 93, wind generated by blade 2021 is diffused in front of circulator 2510, and comfortably impinging wind 2152 can be sent over a wide range. Therefore, in a case that circulator 2510 is desirably operated during bedtime such as night without wind substantially being felt, a breezy operation satisfying such a desire can also be realized.

Referring to FIGS. 101 and 102, when blade 2021 rotates at a high speed, kinetic energy of the blade tip end vortex and the horseshoe vortex generated as a result of rotation of blade 2021 is great and hence the blade tip end vortex and the horseshoe vortex are trapped and held in recessed connection portion 2151 and fluctuation or development of the blade tip end vortex and the horseshoe vortex is suppressed. In that case, the blade tip end vortex and the horseshoe vortex will move inward along recessed connection portion 2151, and hence, thereafter, the blade tip end vortex and the horseshoe vortex which are separated in rear edge side connection portion 2105 are dispelled in an axial direction by a large quantity of wind and a high static pressure resulting from rotation at a high speed. Therefore, as shown in FIG. 102, wind generated by blade 2021 converges in front of circulator 2510, and wind 2153 high in straightness and reaching farther can be sent. Therefore, wind can efficiently be sent and generation of noise can also be suppressed owing to enhanced straightness of wind.

Thus, according to propeller fan 2140 and circulator 2510 including the same in the present embodiment, generated wind can be less in pressure fluctuation and comfortable wind can be sent, and noise can be lowered.

Embodiment B4

Figure 103:
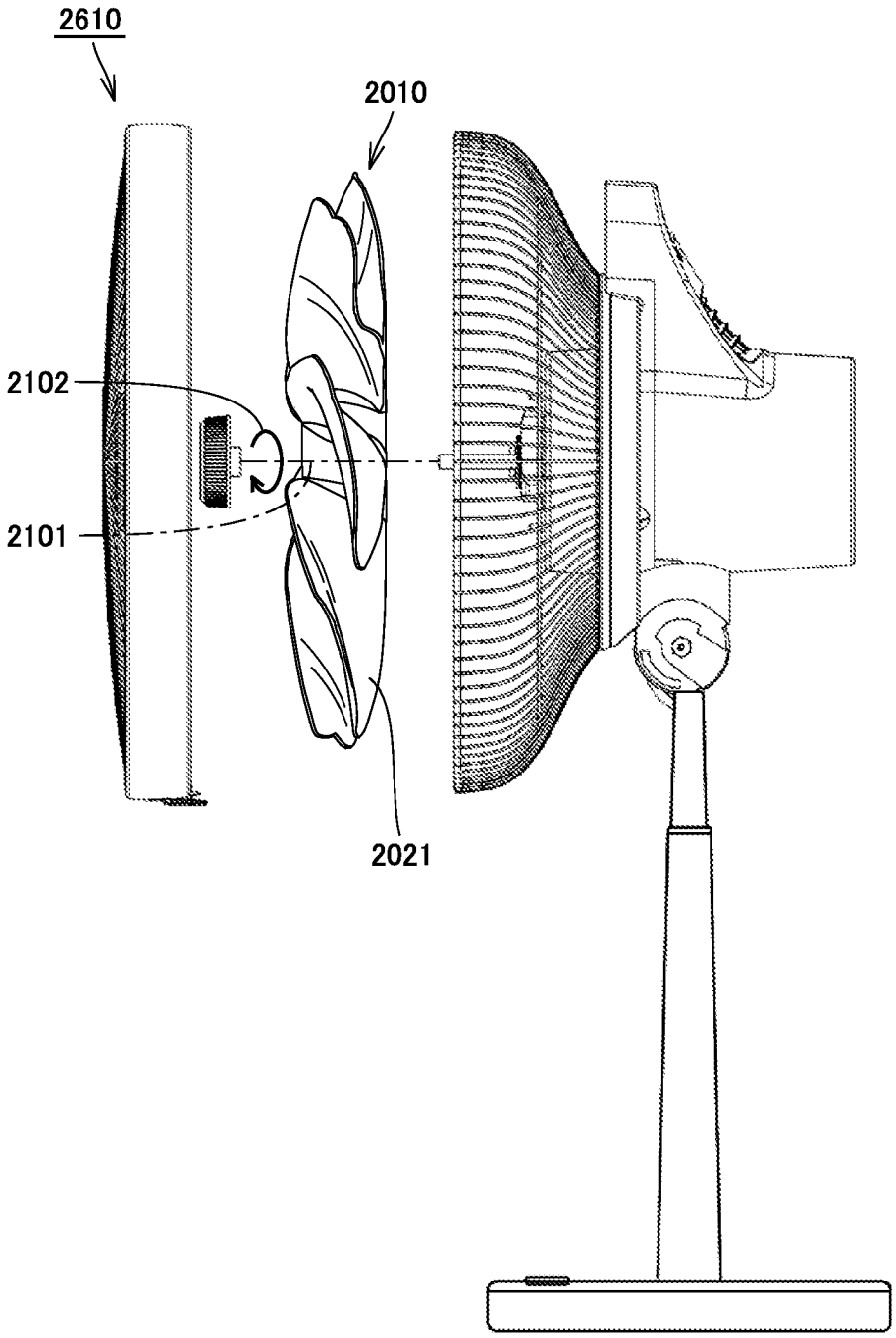
FIG. 103 is a side view showing an electric fan including a propeller fan in an Embodiment B4 of this invention.
Figure 104:
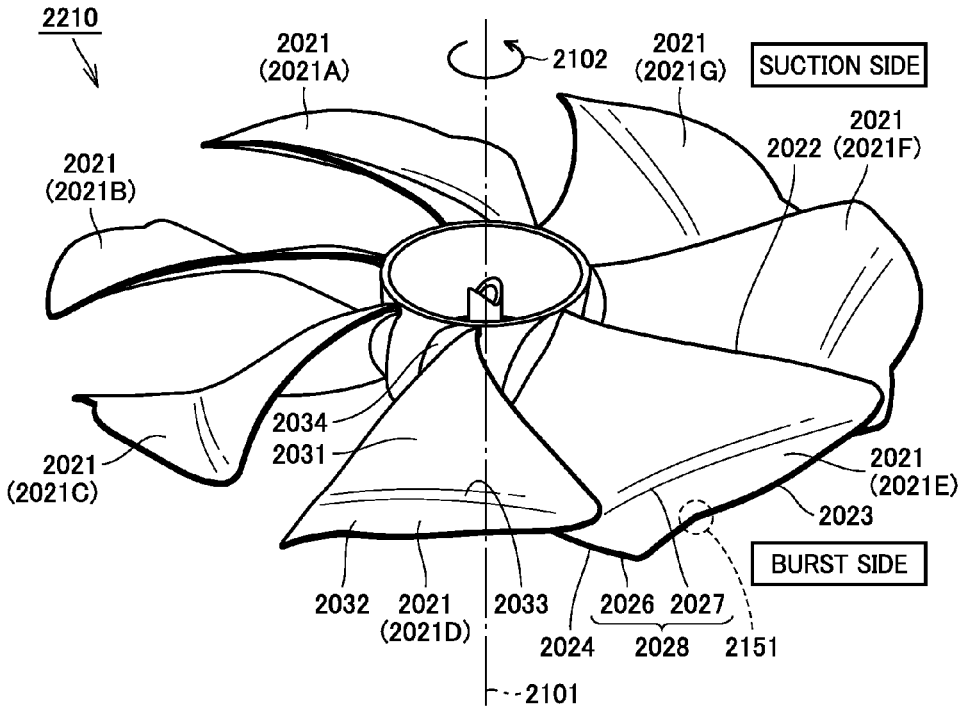
FIG. 104 is a perspective view of the propeller fan in Embodiment B4 of this invention viewed from a suction side.
Figure 105:
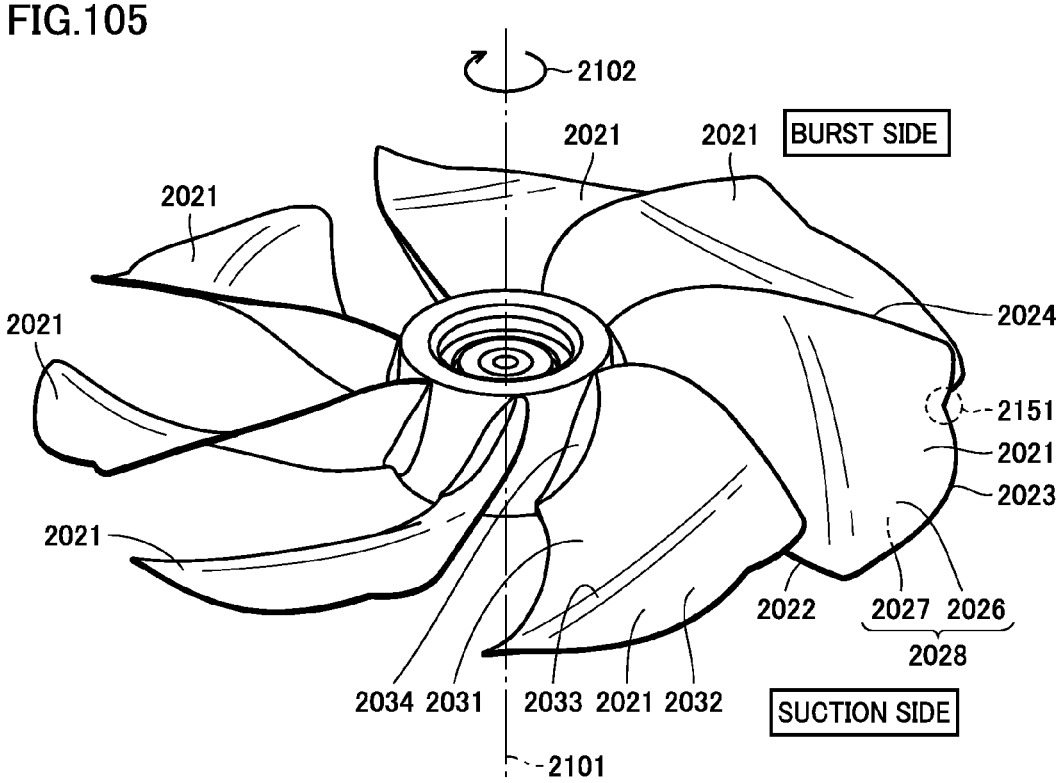
FIG. 105 is a perspective view of the propeller fan in FIG. 104 viewed from a burst side.
Figure 106:
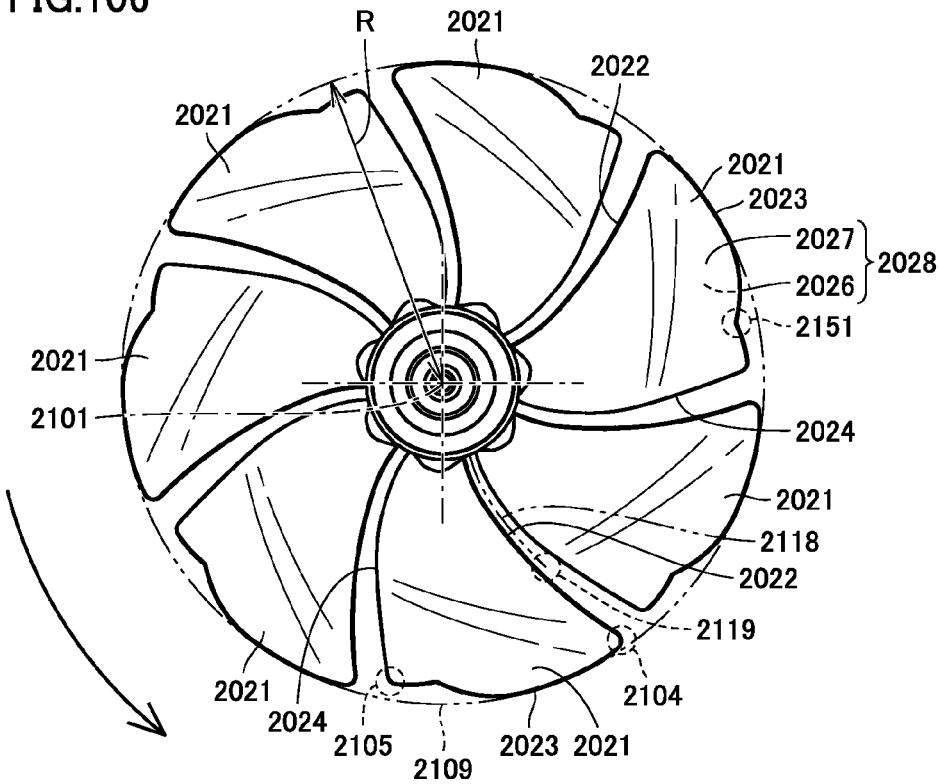
FIG. 106 is a plan view of the propeller fan in FIG. 104 viewed from the suction side.
Figure 107:
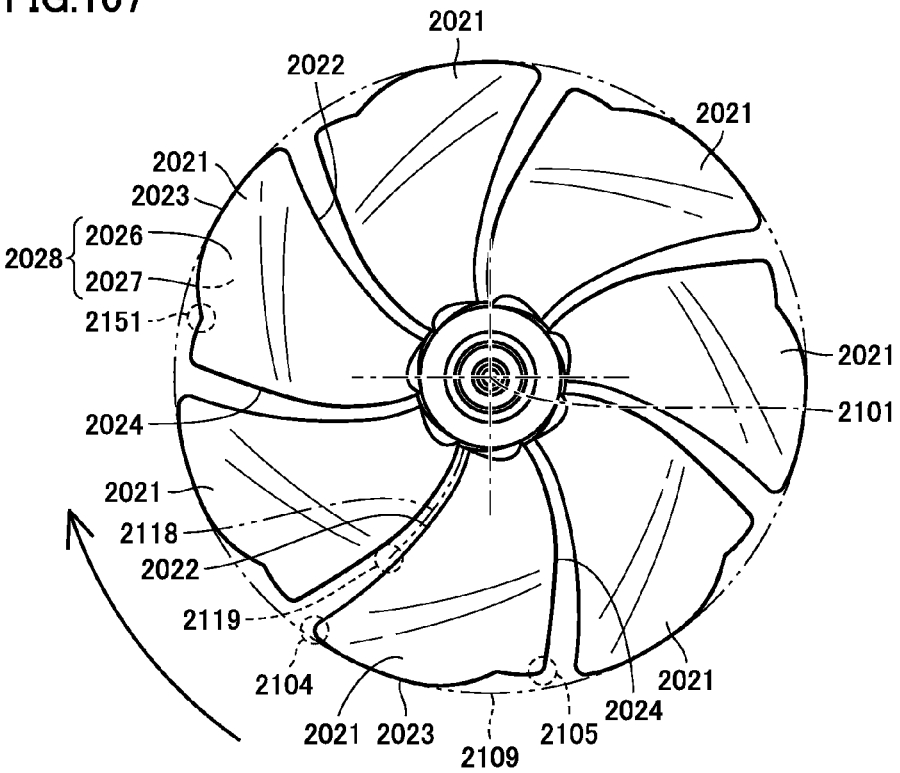
FIG. 107 is a plan view of the propeller fan in FIG. 104 viewed from the burst side.
Figure 108:
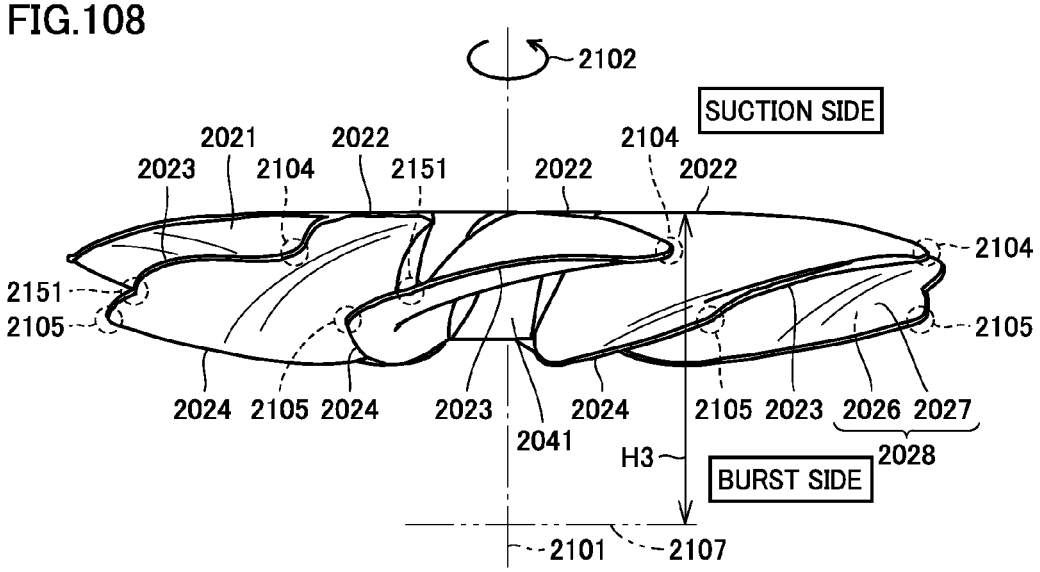
FIG. 108 is a side view showing the propeller fan in FIG. 104.

FIG. 103 is a side view showing an electric fan including a propeller fan in an Embodiment B4 of this invention. FIG. 104 is a perspective view of the propeller fan in Embodiment B4 of this invention viewed from the suction side. FIG. 105 is a perspective view of the propeller fan in FIG. 104 viewed from the burst side. FIG. 106 is a plan view of the propeller fan in FIG. 104 viewed from the suction side. FIG. 107 is a plan view of the propeller fan in FIG. 104 viewed from the burst side. FIG. 108 is a side view showing the propeller fan in FIG. 104.

The propeller fan in the present embodiment is basically the same in structure as propeller fan 2110 in Embodiment B1. Description of a structure the same as in propeller fan 2110 will not be repeated below.

Referring to FIGS. 103 to 108, a propeller fan 2210 in the present embodiment is a propeller fan having seven blades, and has, as a plurality of blades, blade 2021A, blade 2021B, blade 2021C, a blade 2021D, a blade 2021E, a blade 2021F, and a blade 2021G (hereinafter referred to as a blade 2021 unless particularly distinguished).

Propeller fan 2210 is mounted on an electric fan 2610. Electric fan 2610 is used, for example, for cooling by direct impingement of wind to a person. Electric fan 2610 has propeller fan 2210 and a not-shown drive motor for rotating the plurality of blades 2021, to which boss hub portion 2041 of propeller fan 2210 is coupled.

In propeller fan 2210 in the present embodiment, front edge portion 2022 has a constant height in the axial direction of central axis 2101, between boss hub portion 2041 and a position distant from boss hub portion 2041 outward in the direction of radius of central axis 2101.

In FIG. 108, virtual plane 2107 orthogonal to central axis 2101 which is an axis of rotation of propeller fan 2110 is shown on the burst side of propeller fan 2210, that is, on a side of blade 2021 facing positive pressure surface 2026. With this plane 2107 being defined as the reference, front edge portion 2022 has a constant height H3 between boss hub portion 2041 and the position distant from boss hub portion 2041 outward in the direction of radius of central axis 2101. More specifically, front edge portion 2022 has a constant height in the axial direction of central axis 2101 between boss hub portion 2041 and a position 2119 between boss hub portion 2041 and front edge side connection portion 2104 (a range shown with a chain double dotted line 2118 in FIG. 106) and has a height decreasing toward outer edge portion 2023 on the outer circumferential side relative to position 2119.

According to propeller fan 2210 in Embodiment B4 of this invention constructed as such, the effect described in Embodiment B1 can similarly be achieved.

A new propeller fan may be constructed by combining as appropriate various blade structures of the propeller fans in Embodiments B1 to B4 described above.

Embodiment B5

In the present embodiment, a structure of a molding die for molding various propeller fans in Embodiments B1 to B4 with a resin will be described.

Figure 109:
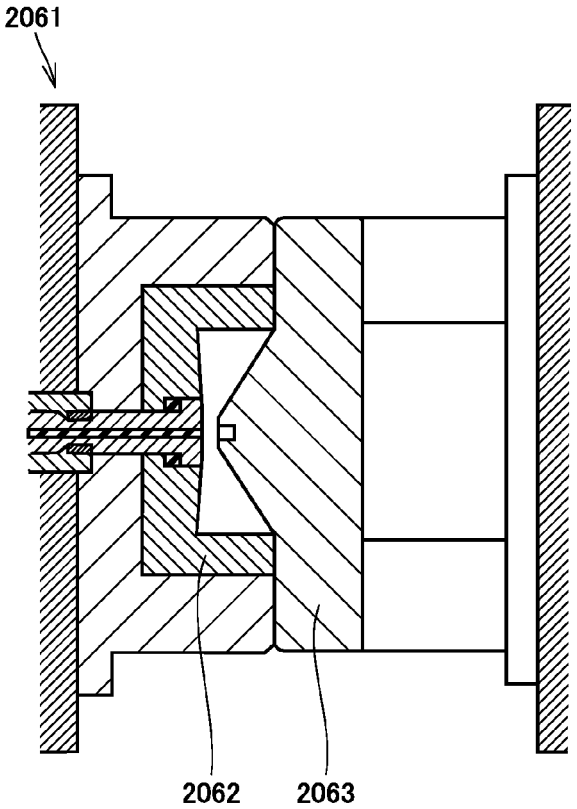
FIG. 109 is a cross-sectional view showing a molding die used for manufacturing of a propeller fan.

FIG. 109 is a cross-sectional view showing a molding die used for manufacturing of a propeller fan. Referring to FIG. 109, a molding die 2061 has a fixed die 2062 and a movable die 2063. Fixed die 2062 and movable die 2063 define a cavity substantially the same in shape as the propeller fan, into which a fluid resin is injected.

Molding die 2061 may be provided with a not-shown heater for enhancing fluidity of the resin injected into the cavity. Such provision of a heater is particularly effective in using a synthetic resin having increased strength such as an AS resin filled with glass fibers.

With regard to molding die 2061 shown in FIG. 63, it is assumed that the surface on the side of the positive pressure surface in the propeller fan is formed with fixed die 2062 and the surface on the side of the negative pressure surface is formed with movable die 2063, however, the surface on the side of the negative pressure surface of the propeller fan may be formed with fixed die 2062 and the surface on the side of the positive pressure surface of the propeller fan may be formed with movable die 2063.

Some propeller fans are integrally formed with a metal as a material and through drawing by pressing. For such molding, a thin metal plate is generally employed, because a thick metal plate is difficult to draw and a mass thereof is also great. In this case, it is difficult to maintain strength (rigidity) in a large propeller fan. In contrast, some propeller fans include a part called a spider formed from a metal plate greater in thickness than a blade portion and have the blade portion fixed to a rotation shaft, however, the mass is great and fan balance is also poor. Generally, since a metal plate which is thin and has a constant thickness is employed, a cross-sectional shape of a blade portion cannot be in a blade shape.

In contrast, by forming the propeller fan with a resin, such problems can collectively be solved.

Embodiment C1

Basic Structure of Propeller Fan

Figure 110:
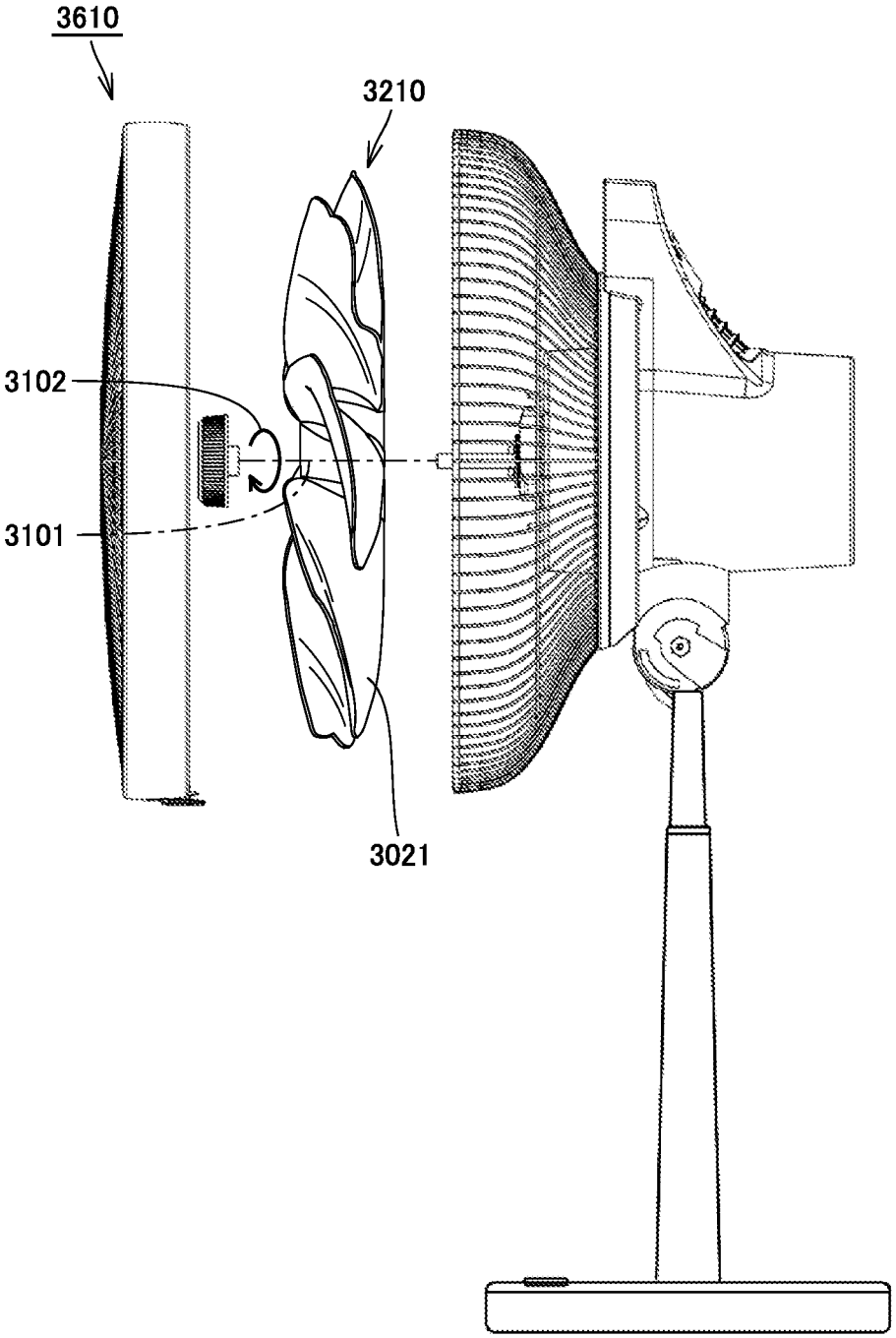
FIG. 110 is a side view showing an electric fan including a propeller fan in an Embodiment C1 of this invention.
Figure 111:
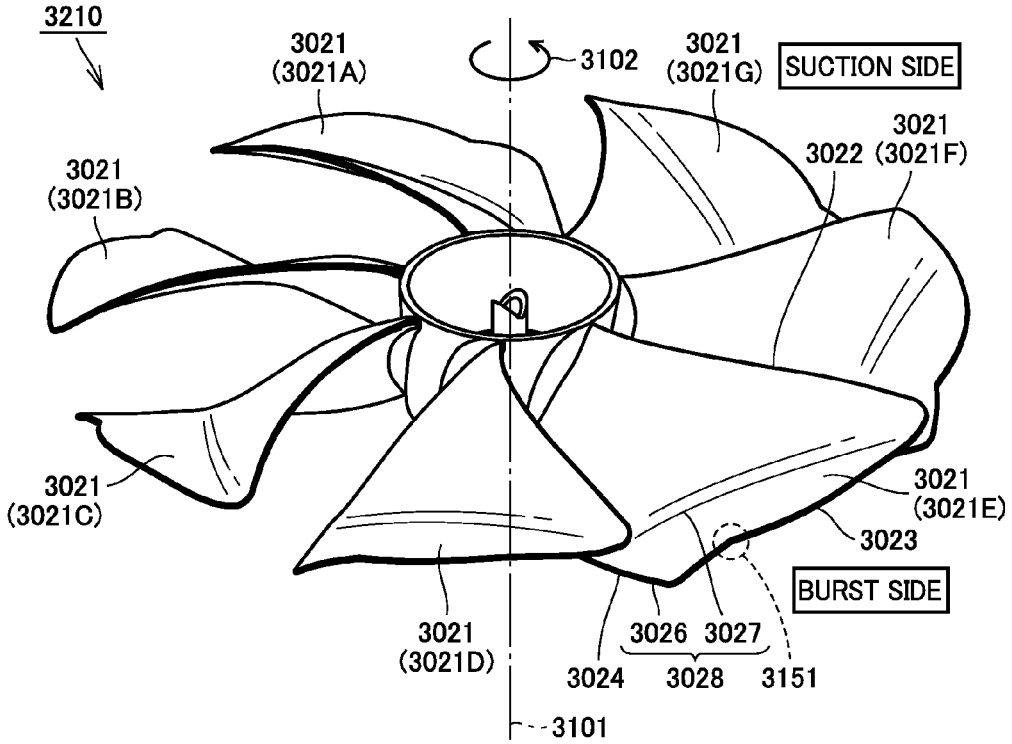
FIG. 111 is a perspective view of the propeller fan in Embodiment C1 of this invention viewed from a suction side.
Figure 112:
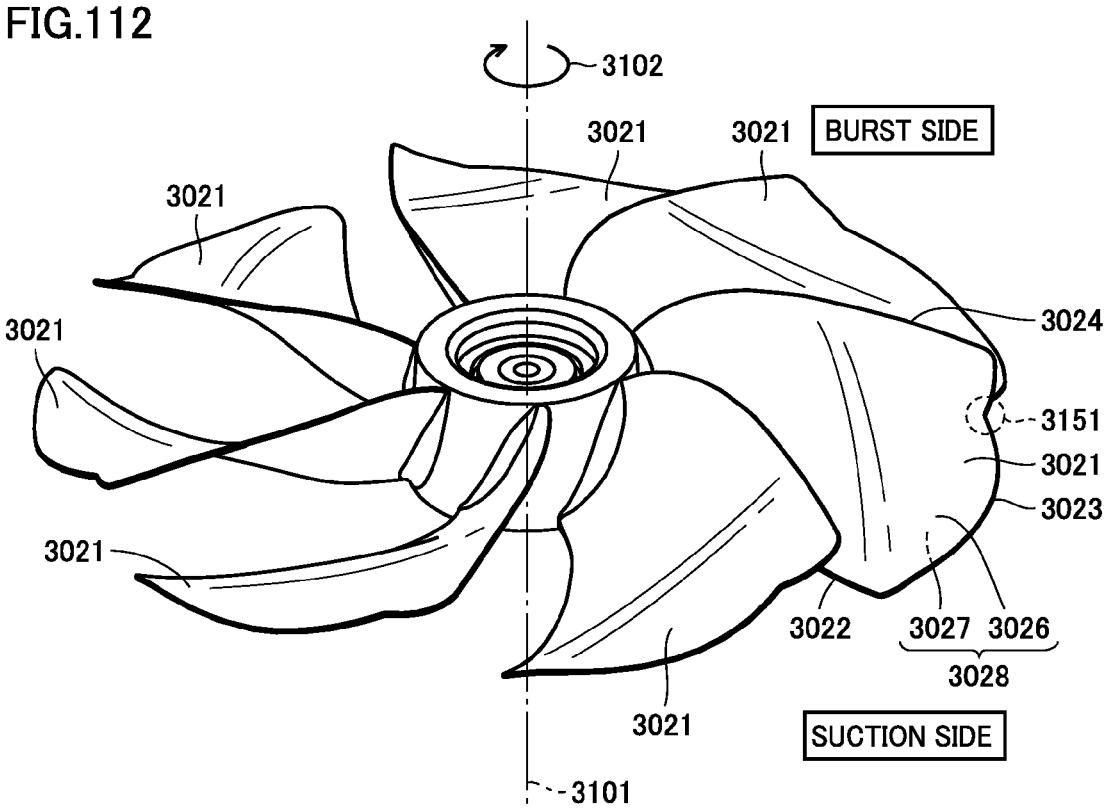
FIG. 112 is a perspective view of the propeller fan in FIG. 111 viewed from a burst side.
Figure 113:
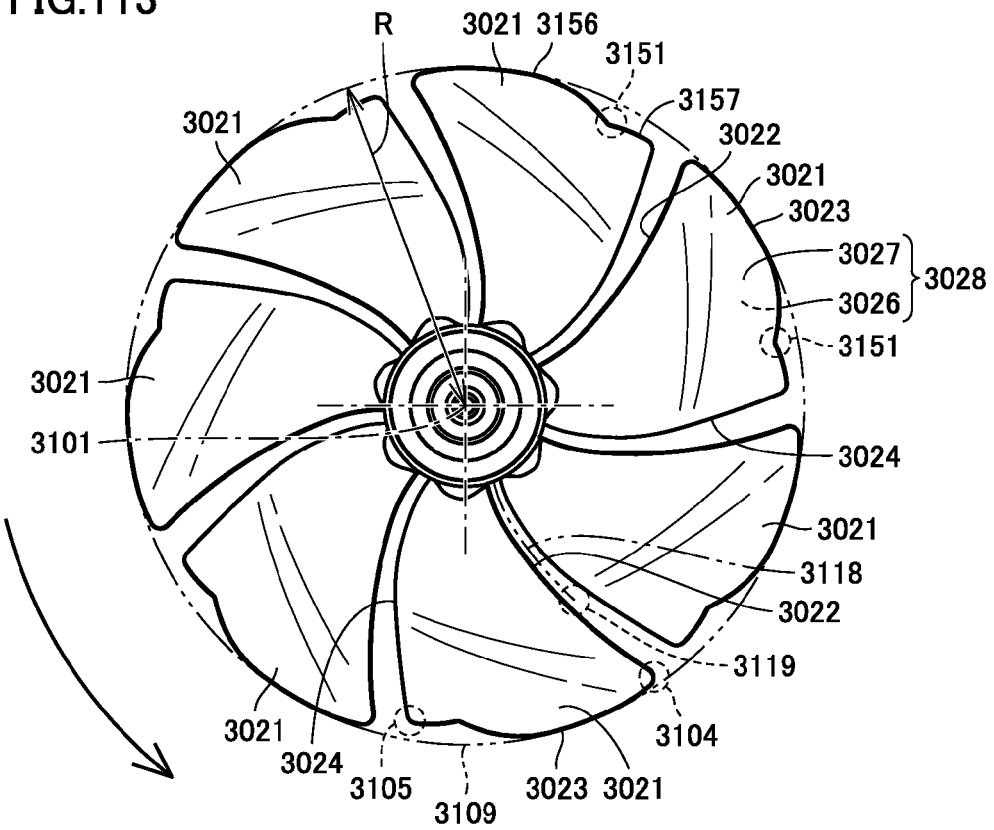
FIG. 113 is a plan view of the propeller fan in FIG. 111 viewed from the suction side.
Figure 114:
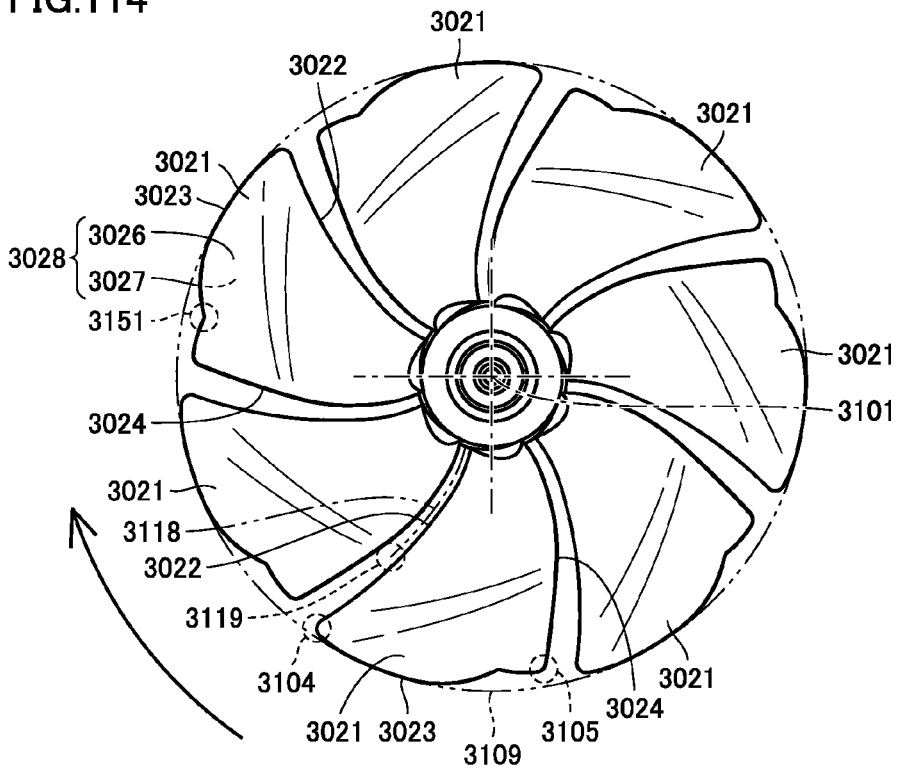
FIG. 114 is a plan view of the propeller fan in FIG. 111 viewed from the burst side.
Figure 115:
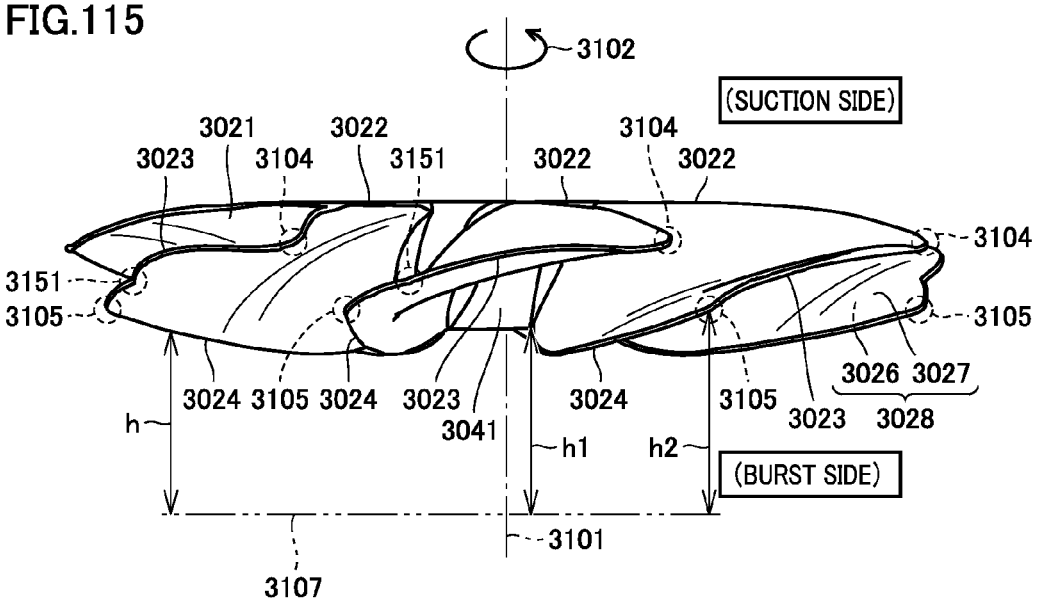
FIG. 115 is a side view showing the propeller fan in FIG. 111.

FIG. 110 is a side view showing an electric fan including a propeller fan in an Embodiment C1 of this invention. FIG. 111 is a perspective view of the propeller fan in Embodiment C1 of this invention viewed from the suction side. FIG. 112 is a perspective view of the propeller fan in FIG. 111 viewed from the burst side. FIG. 113 is a plan view of the propeller fan in FIG. 111 viewed from the suction side. FIG. 114 is a plan view of the propeller fan in FIG. 111 viewed from the burst side. FIG. 115 is a side view showing the propeller fan in FIG. 111.

A basic structure of the propeller fan in the present embodiment will be described initially with reference to FIGS. 110 to 115.

A propeller fan 3210 in the present embodiment has seven blades, and is integrally formed with a synthetic resin such as an AS (acrylonitrile-styrene) resin.

Propeller fan 3210 has, as a plurality of blades, a blade 3021A, a blade 3021B, a blade 3021C, a blade 3021D, a blade 3021E, a blade 3021F, and a blade 3021G (hereinafter referred to as a blade 3021 unless particularly distinguished). Blade 3021 rotates in a direction shown with an arrow 102 in the drawings around a central axis 3101 which is a virtual axis. The plurality of blades 3021 send wind from the suction side toward the burst side in the drawings with rotation around central axis 3101.

Blade 3021A to blade 3021G are arranged at regular intervals in a circumferential direction around the axis of rotation, that is, central axis 3101, of propeller fan 3210. In the present embodiment, blade 3021A to blade 3021G are formed to be identical in shape, and formed such that, when any blade 3021 is rotated around central axis 3101, that blade 3021 and another blade 3021 match in shape. Blade 3021A, blade 3021B, blade 3021C, blade 3021D, blade 3021E, blade 3021F, and blade 3021G are aligned in the direction of rotation of propeller fan 3210 in this order. For example, blade 3021B is arranged adjacent to blade 3021A on a side in the direction of rotation of propeller fan 3210, and blade 3021C is arranged adjacent to blade 3021B on a side in the direction of rotation of propeller fan 3210.

Blade 3021 has a front edge portion 3022 arranged on a side in the direction of rotation of propeller fan 3210, a rear edge portion 3024 arranged on a side opposite in the direction of rotation, and an outer edge portion 3023 connecting front edge portion 3022 and rear edge portion 3024 to each other.

When propeller fan 3210 is viewed in the axial direction of central axis 3101, that is, when propeller fan 3210 is viewed two-dimensionally, front edge portion 3022 and rear edge portion 3024 extend from a boss hub portion 3041 which will be described later, from the inner side to the outer side in the direction of radius around central axis 3101. Front edge portion 3022 extends in the direction of rotation of propeller fan 3210 as being curved from the inner side to the outer side in the direction of radius around central axis 3101. Rear edge portion 3024 is arranged as opposed to front edge portion 3022, in the circumferential direction around central axis 3101. Outer edge portion 3023 as a whole extends in an arc shape between front edge portion 3022 and rear edge portion 3024.

Outer edge portion 3023 as a whole extends along the circumferential direction around central axis 3101. As shown in FIG. 113, outer edge portion 3023 intersects with front edge portion 3022 at a front edge side connection portion 3104 located most on a side in the direction of rotation of propeller fan 3210 on a line extending in the circumferential direction and intersects with rear edge portion 3024 at a rear edge side connection portion 3105 located most on an opposite side in the direction of rotation of propeller fan 3210 on the line extending in the circumferential direction.

FIG. 113 shows a circumscribed circle 3109 of the plurality of blades 3021. Circumscribed circle 3109 has radius R around central axis 3101 and the plurality of blades 3021 are inscribed therein. Circumscribed circle 3109 is in contact with outer edge portion 3023 of blade 3021. Blade 3021 has maximum radius R around central axis 3101. Outer edge portion 3023 is curved inward in the direction of radius, as it extends along the circumferential direction around central axis 3101 from a position in contact with circumscribed circle 3109 toward front edge side connection portion 3104.

Front edge side connection portion 3104 and rear edge side connection portion 3105 are arranged adjacent to circumscribed circle 3109. Front edge side connection portion 3104 and rear edge side connection portion 3105 are arranged on an outer circumferential side relative to a position distant from central axis 3101 by R/2 (R representing a maximum radius of blade 3021 in a plan view of the propeller fan). Front edge side connection portion 3104 has a curvature which attains to a relative maximum around a portion where front edge portion 3022 and outer edge portion 3023 are connected to each other. Rear edge side connection portion 3105 has a curvature which attains to a relative maximum around a portion where outer edge portion 3023 and rear edge portion 3024 are connected to each other.

In the plan view of propeller fan 3210 shown in FIG. 113, front edge portion 3022 extends as being curved between boss hub portion 3041 which will be described later and front edge side connection portion 3104. Rear edge portion 3024 extends as being curved between boss hub portion 3041 which will be described later and rear edge side connection portion 3105.

In the plan view of propeller fan 3210, an outer shape of blade 3021 is formed by front edge portion 3022, outer edge portion 3023, and rear edge portion 3024. In the plan view of propeller fan 3210, blade 3021 has a shape pointed like a sickle with front edge side connection portion 3104 where front edge portion 3022 and outer edge portion 3023 intersect with each other being defined as the tip end. Front edge side connection portion 3104 is located most on the side in the direction of rotation of propeller fan 3210 in blade 3021.

In blade 3021, a blade surface 3028 for sending wind (sending air from the suction side to the burst side) with rotation of propeller fan 3210 is formed.

Blade surfaces 3028 are formed on sides facing the suction side and the burst side in the axial direction of central axis 3101, respectively. Blade surface 3028 is formed in a region surrounded by front edge portion 3022, outer edge portion 3023, and rear edge portion 3024. Blade surface 3028 is formed on the entire surface of the region surrounded by front edge portion 3022, outer edge portion 3023, and rear edge portion 3024. Blade surface 3028 is formed from a curved surface inclined from the suction side to the burst side in the circumferential direction from front edge portion 3022 toward rear edge portion 3024.

Blade surface 3028 is constituted of a positive pressure surface 3026 and a negative pressure surface 3027 arranged on the back of positive pressure surface 3026. Positive pressure surface 3026 is formed on a side of blade surface 3028 facing the burst side, and negative pressure surface 3027 is formed on a side of blade surface 3028 facing the suction side. As a flow of air is generated over blade surface 3028 during rotation of propeller fan 3210, such pressure distribution that a pressure is relatively high over positive pressure surface 3026 and a pressure is relatively low over negative pressure surface 3027 is generated.

Propeller fan 3210 has boss hub portion 3041 serving as a rotation shaft portion. Boss hub portion 3041 is a portion connecting propeller fan 3210 to a rotation shaft of a not-shown motor which is a drive source thereof. Boss hub portion 3041 has a cylindrical shape extending in the axial direction of central axis 3101. Blade 3021 is formed to extend outward from boss hub portion 3041 in the direction of radius of central axis 3101. Front edge portion 3022 and rear edge portion 3024 extend outward from boss hub portion 3041 toward outer edge portion 3023, in the direction of radius of central axis 3101.

Blade 3021 is formed in a shape of a blade such that a thickness of a cross-sectional shape in the circumferential direction connecting front edge portion 3022 and rear edge portion 3024 to each other increases from front edge portion 3022 and rear edge portion 3024 toward a portion around the center of the blade and the thickness is greatest at a position closer to front edge portion 3022 relative to the center of the blade.

Though propeller fan 3210 integrally molded with a synthetic resin has been described above, a propeller fan in the present invention is not limited to that made of a resin. For example, propeller fan 3210 may be formed by twisting a sheet metal, or a propeller fan may be formed from an integrated small-thickness material formed to have a curved surface. In such a case, blade 3021A to blade 3021G may be joined to separately molded boss hub portion 3041.

The present invention is not limited to propeller fan 3210 having seven blades, and it may be a propeller fan including a plurality of blades 3021 other than three blades or a propeller fan including single blade 3021. In a case of a propeller fan having a single blade, a weight serving as a balancer is provided on a side opposite to blade 3021 with respect to central axis 3101.

In FIG. 110, an electric fan 3610 is shown as one example of a fluid feeder having propeller fan 3210 in the present embodiment. Electric fan 3610 is used, for example, for cooling by direct impingement of wind to a person. Electric fan 3610 has propeller fan 3210 and a not-shown drive motor to which boss hub portion 3041 of propeller fan 3210 is coupled, for rotating the plurality of blades 3021.

Propeller fan 3210 is not limited to electric fan 3610, and it may be employed in a fluid feeder such as a circulator, an air-conditioner, an air cleaner, a humidifier, a dehumidifier, a fan heater, a cooling apparatus, or a ventilator.

[Height of Rear Edge Portion and Front Edge Portion of Blade]

FIG. 115 shows a virtual plane 3107 orthogonal to central axis 3101 which is the axis of rotation of propeller fan 3210 on the burst side of propeller fan 3210, that is, on a side of blade 3021 facing positive pressure surface 3026.

Referring to FIGS. 111 to 115, when a length in the axial direction of central axis 3101 from plane 3107 to rear edge portion 3024 is referred to as a height of rear edge portion 3024, in propeller fan 3210 in the present embodiment, rear edge portion 3024 has height h increasing toward outer edge portion 3023 on the outer circumferential side around central axis 3101.

The height of rear edge portion 3024 decreases as a distance from boss hub portion 3041 is greater on the inner circumferential side around central axis 3101, and increases toward outer edge portion 3023 on the outer circumferential side around central axis 3101. In other words, rear edge portion 3024 extends as being curved convexly on the burst side in the axial direction of central axis 3101 between boss hub portion 3041 and outer edge portion 3023.

A position where a height of rear edge portion 3024 starts to increase toward outer edge portion 3023 is preferably within a range from 0.4R to 0.7R (R representing a maximum radius of blade 3021 in a plan view of the propeller fan) around central axis 3101.

In the present embodiment, a height h2 of rear edge portion 3024 at a position continuing to outer edge portion 3023 (rear edge side connection portion 3105) is greater than a height h1 of rear edge portion 3024 at a position continuing to boss hub portion 3041 ($h2>h1$). Without being limited to such a construction, rear edge portion 3024 may be formed to satisfy relation of $h1=h2$ or formed to satisfy relation of $h1>h2$.

In the present embodiment, for the purpose of avoiding interference between a not-shown spinner for fixing boss hub portion 3041 to a rotation shaft extending from the drive motor and blade 3021, a height of rear edge portion 3024 is great on the inner circumferential side around central axis 3101. Without being limited to such a construction, boss hub portion 3041 may be extended to the burst side such that a height of rear edge portion 3024 continues to increase from boss hub portion 3041 toward outer edge portion 3023.

In a general propeller fan, a height of blade 3021 is extremely larger on the outer circumferential side than on the inner circumferential side around central axis 3101. Therefore, capability of blade 3021 to send wind on the outer circumferential side is extremely high.

In contrast, in propeller fan 3210 in the present embodiment, rear edge portion 3024 has a height increasing toward outer edge portion 3023 on the outer circumferential side around central axis 3101. According to such a construction, on the outer circumferential side around central axis 3101, a height of blade 3021 is suppressed to be small and inclination of blade surface 3028 is gentle, so that capability to send wind on the outer circumferential side is suppressed. Thus, a difference in quantity of wind (wind velocity) between the inner circumferential side and the outer circumferential side is lessened and more uniform blowing from propeller fan 3210 can be achieved. Consequently, uncomfortableness of a person who has received wind from propeller fan 3210 can be prevented.

Figure 116:
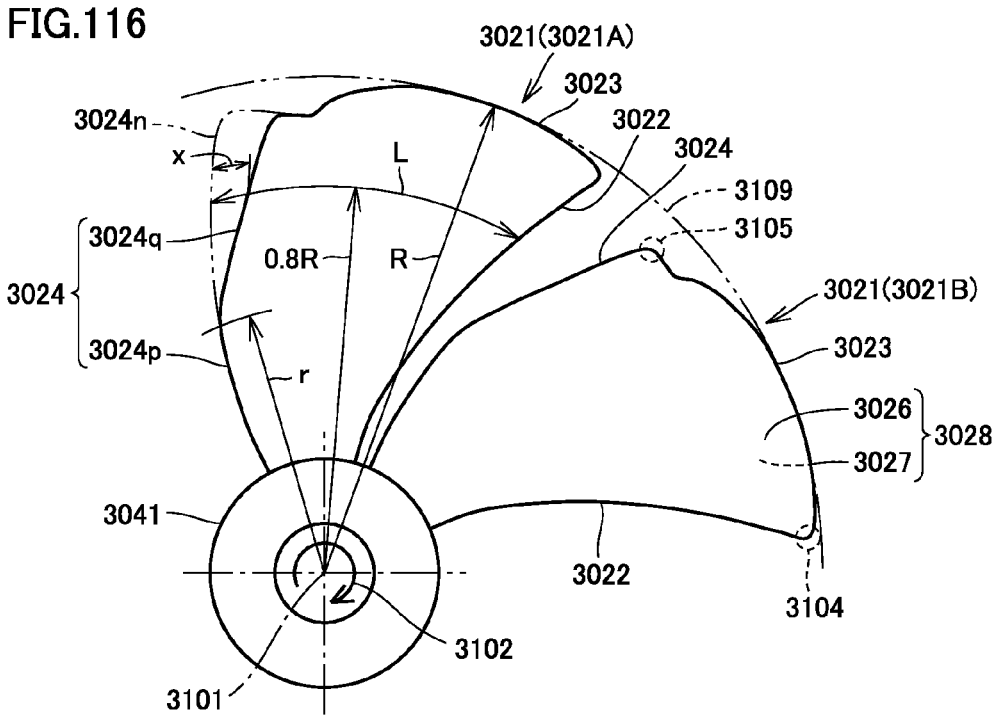
FIG. 116 is a plan view showing in a partially enlarged manner, the propeller fan in FIG. 114.

FIG. 116 is a plan view showing in a partially enlarged manner, the propeller fan in FIG. 114. Referring to FIG. 116, in propeller fan 3210 in the present embodiment, rear edge portion 3024 is constituted of an inner circumferential portion 3024*p* and an outer circumferential portion 3024*q*. Inner circumferential portion 3024*p* implements rear edge portion 3024 on the inner circumferential side around central axis 3101 and outer circumferential portion 3024*q* implements rear edge portion 3024 on the outer circumferential side around central axis 3101. In the plan view of propeller fan 3210 shown in FIG. 116, rear edge portion 3024 has a shape bent between inner circumferential portion 3024*p* and outer circumferential portion 3024*q*.

More specifically, inner circumferential portion 3024*p* extends in a prescribed direction from boss hub portion 3041 outward in the direction of radius of central axis 3101. In the present embodiment, inner circumferential portion 3024*p* extends in the direction of radius around central axis 3101. Outer circumferential portion 3024*q* extends from inner circumferential portion 3024*p* toward outer edge portion 3023, with inclination being varied in the direction of rotation of blade 3021 from a prescribed direction in which inner circumferential portion 3024*p* extends, that is, toward front edge portion 3022. Outer circumferential portion 3024*q* extends linearly or in an arc shape having a sufficiently large diameter.

A virtual line 3024*r* shown in FIG. 116 represents a trace of rear edge portion 3024 in a case that inner circumferential portion 3024*p* smoothly extends toward outer edge portion 3023. Outer circumferential portion 3024*q* is preferably formed such that a cord length at a position of 0.8R (R representing a maximum radius of blade 3021 in a plan view of the propeller fan) is shorter by 5% or more than in a case where this inner circumferential portion 3024*p* smoothly extends ($x \geq 0.05L$). FIG. 116 shows as a most preferred form, a case that outer circumferential portion 3024*q* satisfies relation of $x=0.1L$.

A position where inclination of rear edge portion 3024 starts to vary, that is, a boundary position between inner circumferential portion 3024*p* and outer circumferential portion 3024*q*, in the plan view of propeller fan 3210 shown in FIG. 116 is preferably on the outer circumferential side relative to a position of 0.4R (R representing a maximum radius of blade 3021 in the plan view of the propeller fan) around central axis 3101 ($r>0.4R$).

According to such a construction, on the outer circumferential side around central axis 3101, a height of blade 3021 can be suppressed to be small while an area of blade 3021 viewed in the axial direction of central axis 3101 is decreased. Thus, since capability of blade 3021 to send wind on the outer circumferential side is further suppressed, a difference in quantity of wind between the inner circumferential side and the outer circumferential side can more effectively be lessened. A trace of rear edge portion 3024 is shifted in the direction of rotation on the outer circumferential side around central axis 3101, so that a gap between adjacent blades 3021 is made larger. Thus, since a horseshoe vortex generated in blade 3021 (for example, blade 3021B in FIG. 116) is less likely to interfere with blade 3021 adjacent in the rear in the direction of rotation with respect to that blade 3021 (for example, blade 3021A in FIG. 116), noise can be lowered.

Referring to FIGS. 111 to 115, in propeller fan 3210 in the present embodiment, front edge portion 3022 has a constant height in the axial direction of central axis 3101 between boss hub portion 3041 and the position distant outward from boss hub portion 3041 in the direction of radius of central axis 3101.

With plane 3107 shown in FIG. 115 being defined as the reference, front edge portion 3022 has a constant height between boss hub portion 3041 and the position distant outward from boss hub portion 3041 in the direction of radius of central axis 3101. More specifically, front edge portion 3022 has a constant height in the axial direction of central axis 3101 between boss hub portion 3041 and a position 3119 between boss hub portion 3041 and front edge side connection portion 3104 (a range shown with a chain double dotted line 3118 in FIG. 113), and has a height decreasing toward outer edge portion 3023 on the outer circumferential side relative to position 3119.

Thus, in propeller fan 3210 in the present embodiment, front edge portion 3022 has a constant height on the inner circumferential side around central axis 3101. According to such a construction, on the inner circumferential side around central axis 3101, a height of blade 3021 is set to be large and capability to send wind can be enhanced. Thus, a difference in quantity of wind between the inner circumferential side and the outer circumferential side can further be lessened.

A structure of propeller fan 3210 in Embodiment C1 of this invention described above will be summarized. Propeller fan 3210 in the present embodiment includes boss hub portion 3041 serving as the rotation shaft portion rotating around virtual central axis 3101 and blade 3021 extending outward from boss hub portion 3041 in the direction of radius of central axis 3101. Blade 3021 has front edge portion 3022 arranged on a side in the direction of rotation, rear edge portion 3024 arranged on a side opposite in the direction of rotation, and outer edge portion 3023 extending in the circumferential direction around central axis 3101 and connecting front edge portion 3022 and rear edge portion 3024 to each other. When plane 3107 orthogonal to the central axis is assumed on the burst side of blade 3021 and a length in the axial direction of central axis 3101 from that plane 3107 is defined as a height, rear edge portion 3024 has a height increasing toward outer edge portion 3023 on the outer circumferential side around central axis 3101.

According to propeller fan 3210 in Embodiment C1 of this invention thus constructed, capability to send wind is suppressed on the outer circumferential side around central axis 3101, so that a propeller fan achieving less uncomfortableness of blowing from the fan can be realized.

[Description of Variation of Propeller Fan]

Figure 117:
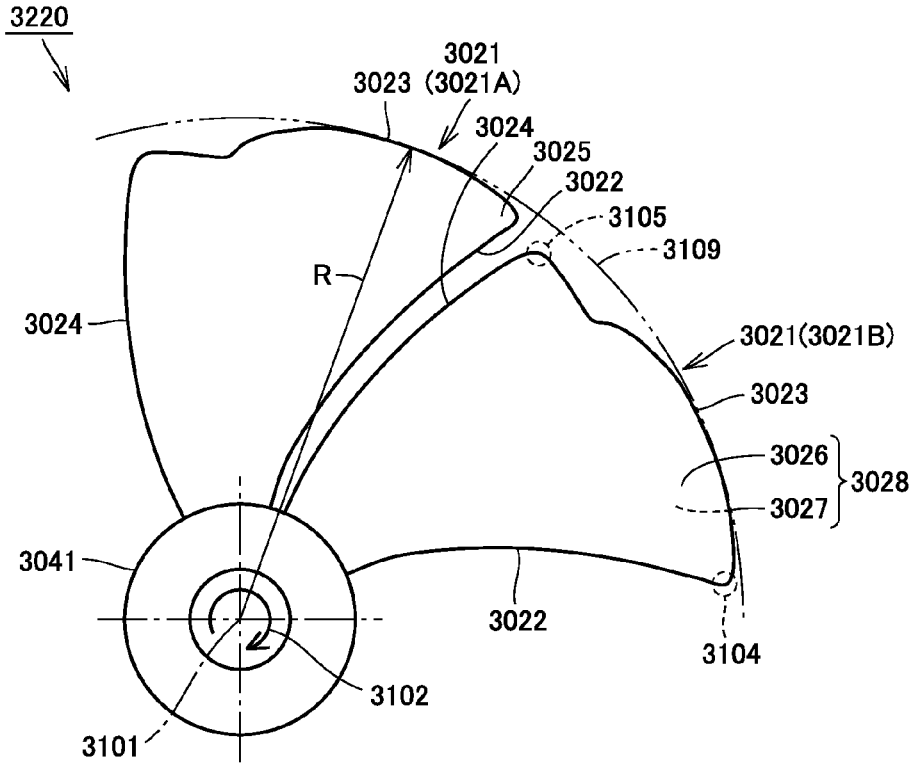
FIG. 117 is a plan view showing a Variation 1 of the propeller fan shown in FIG. 111.

FIG. 117 is a side view showing a Variation 1 of the propeller fan shown in FIG. 111. The propeller fan in the present Variation has a side view the same as the side view shown in FIG. 115.

Referring to FIGS. 115 and 117, a propeller fan 3220 in the present Variation is different from propeller fan 3210 in Embodiment C1 only in a trace of rear edge portion 3024 in a plan view of the propeller fan. More specifically, in propeller fan 3220, inner circumferential portion 3024*p* in FIG. 116 extends smoothly toward outer edge portion 3023 and the outer circumferential side of rear edge portion 3024 is not shifted toward the direction of rotation.

Figure 118:
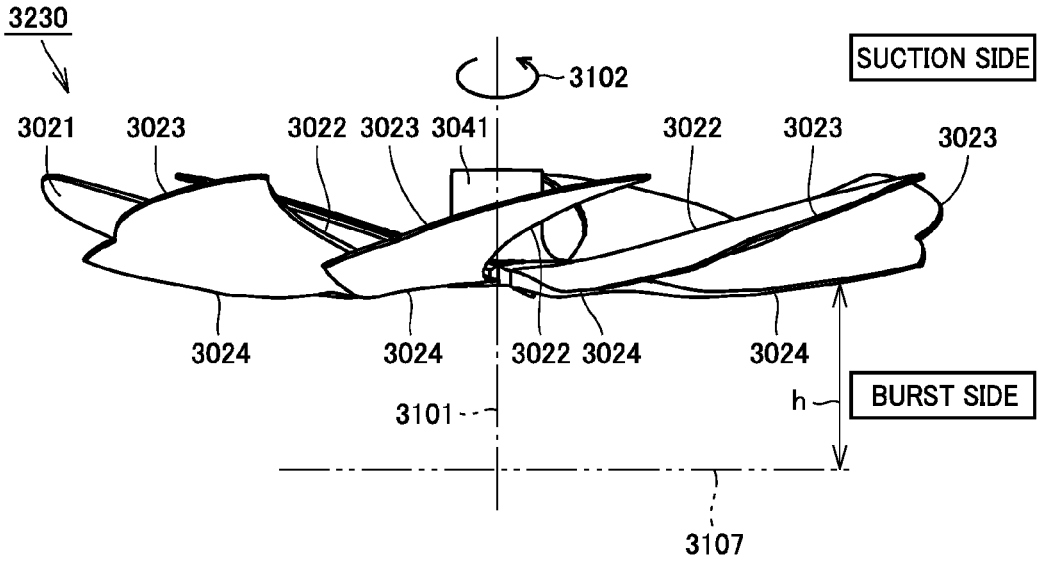
FIG. 118 is a side view showing a Variation 2 of the propeller fan shown in FIG. 111.

FIG. 118 is a side view showing a Variation 2 of the propeller fan shown in FIG. 111. The propeller fan in the present Variation has a plan view the same as the plan view shown in FIG. 117.

Referring to FIGS. 117 and 118, a propeller fan 3230 in the present Variation is different from propeller fan 3210 in Embodiment C1 in a trace of rear edge portion 3024 and a shape of front edge portion 3022 in a plan view of the propeller fan. More specifically, in propeller fan 3230, inner circumferential portion 3024*p* in FIG. 116 smoothly extends toward outer edge portion 3023 and the outer circumferential side of rear edge portion 3024 is not shifted toward the direction of rotation. In addition, in the present Variation, front edge portion 3022 is formed such that a height with plane 3107 being defined as the reference increases from boss hub portion 3041 toward outer edge portion 3023.

Figure 119:
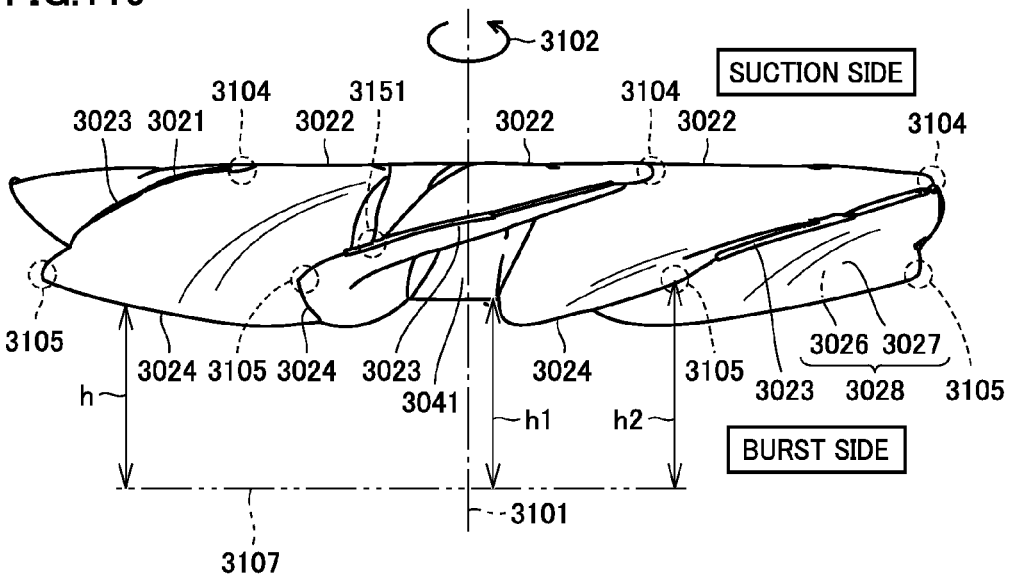
FIG. 119 is a side view showing a Variation 3 of the propeller fan shown in FIG. 111.

FIG. 119 is a side view showing a Variation 3 of the propeller fan shown in FIG. 111. The propeller fan in the present Variation has a plan view the same as the plan view shown in FIGS. 113 and 114.

Referring to FIGS. 113, 114, and 119, a propeller fan 3260 in the present Variation is different from propeller fan 3210 in Embodiment C1 only in a shape of front edge portion 3022. More specifically, in the present Variation, front edge portion 3022 has a constant height in the axial direction of central axis 3101 in the entire range between boss hub portion 3041 and outer edge portion 3023.

According to propeller fan 3220, propeller fan 3230, and propeller fan 3260 constructed as such as well, the effect of propeller fan 3210 above can similarly be achieved.

Description of Example

In succession, an example for confirming the function and effect achieved by propeller fan 3210 in Embodiment C1, propeller fan 3220 in Variation 1, and propeller fan 3230 in Variation 2 will be described.

Figure 120:
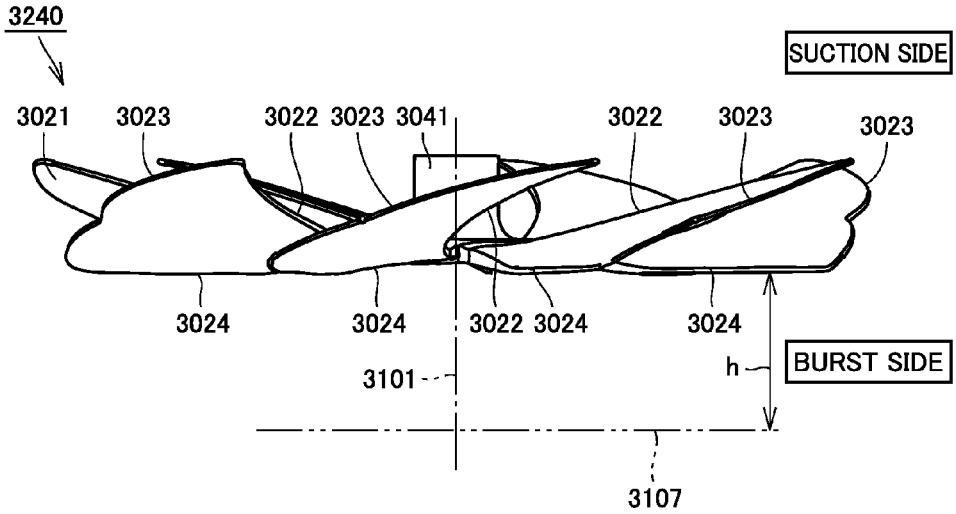
Figure 121:
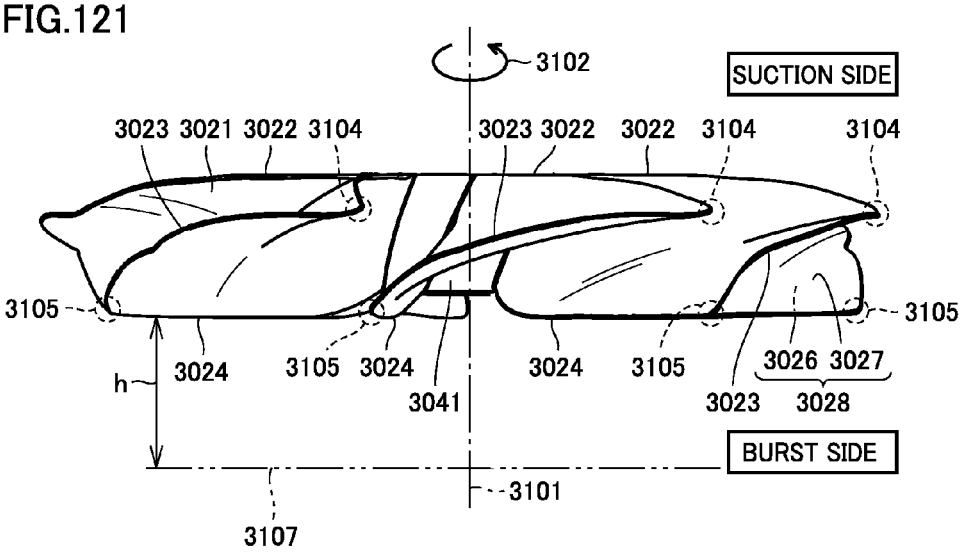

FIG. 120 is a side view showing a propeller fan in a Comparative Example 1. FIG. 121 is a side view showing a propeller fan in a Comparative Example 2. The propeller fans in these Comparative Examples have a plan view the same as the plan view shown in FIG. 117.

Referring to FIG. 120, a propeller fan 3240 in the present Comparative Example is basically similar in structure to propeller fan 3230 shown in FIG. 118. Rear edge portion 3024, however, has a constant height in the axial direction of central axis 3101 on the outer circumferential side around central axis 3101. Referring to FIG. 121, a propeller fan 3250 in the present Comparative Example is basically similar in structure to propeller fan 3210 shown in FIG. 115. Rear edge portion 3024, however, has a constant height in the axial direction of central axis 3101 on the outer circumferential side around central axis 3101.

Propeller fan 3230 in Variation 2 shown in FIG. 118 and propeller fan 3240 in Comparative Example 1 shown in FIG. 120 which were identical in a diameter and a height of blade 3021 and in a diameter of boss hub portion 3041 were prepared. Then, relation between the number of rotations and a quantity of wind, relation between a quantity of wind and power consumption, relation between a quantity of wind and noise, and relation between a distance from the center of rotation and a wind velocity were found based on actual measurement in each propeller fan and results of measurement were compared.

As can be seen in FIGS. 118 and 120, propeller fan 3230 in Variation 2 and propeller fan 3240 in Comparative Example 1 are basically the same in a shape of a blade. Propeller fan 3230 in Variation 2, however, is different from propeller fan 3240 in Comparative Example 1 in that a height of rear edge portion 3024 is greater on the outer circumferential side in propeller fan 3230 in Variation 2 whereas a height of rear edge portion 3024 is constant in propeller fan 3240 in Comparative Example 1.

Figure 122:
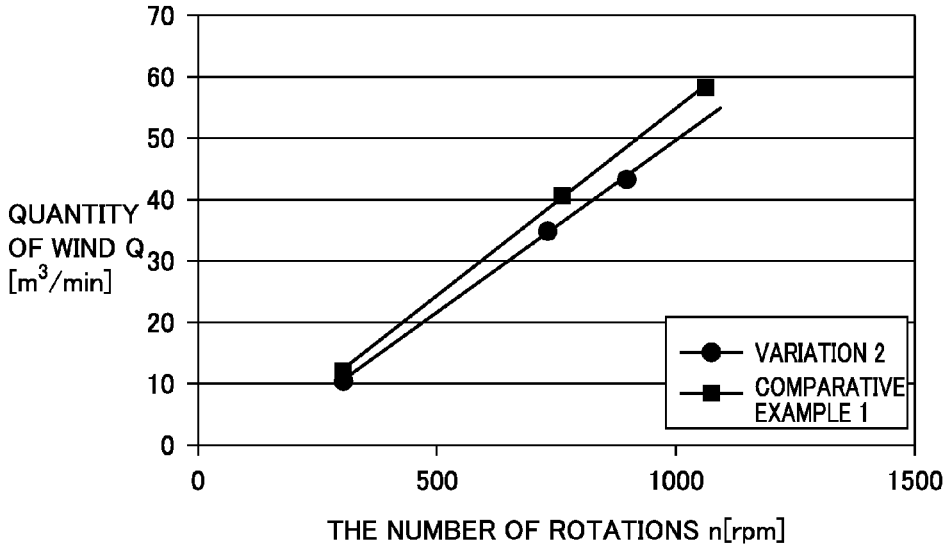
Figure 123:
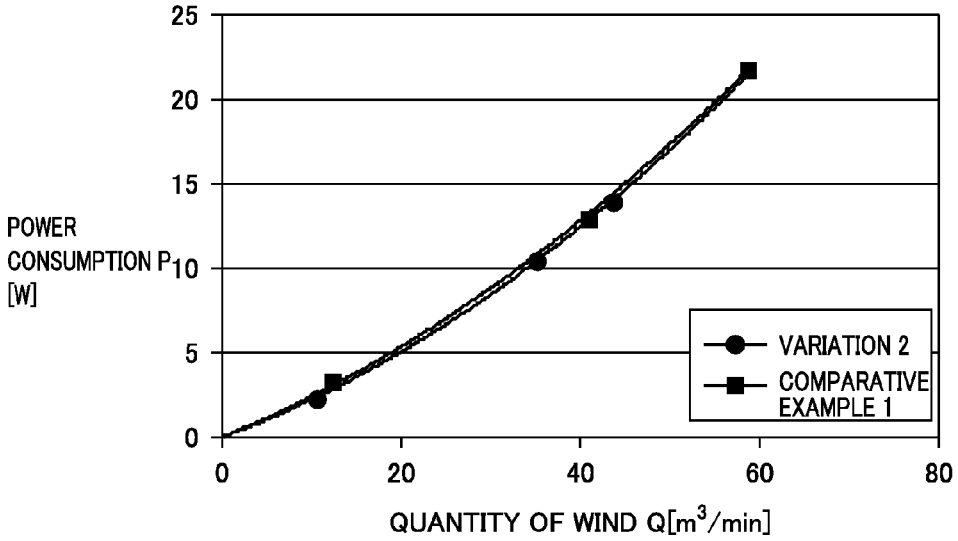
Figure 124:
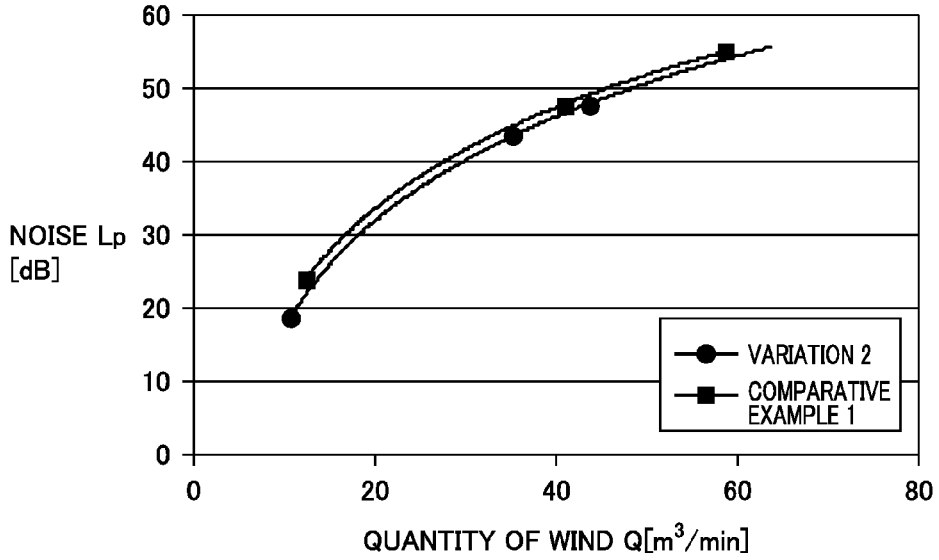

FIG. 122 is a graph showing relation between the number of rotations and a quantity of wind in the propeller fan in Variation 2 in FIG. 118 and the propeller fan in Comparative Example 1 in FIG. 120. FIG. 123 is a graph showing relation between a quantity of wind and power consumption in the propeller fan in Variation 2 in FIG. 118 and the propeller fan in Comparative Example 1 in FIG. 120. FIG. 124 is a graph showing relation between a quantity of wind and noise in the propeller fan in Variation 2 in FIG. 118 and the propeller fan in Comparative Example 1 in FIG. 120.

Referring to FIGS. 122 to 124, in propeller fan 3230 in Variation 2, a height of blade 3021 is suppressed to be small on the outer circumferential side around central axis 3101, and hence a quantity of wind was slightly smaller than in propeller fan 3240 in Comparative Example 1. Regarding power consumption and noise, however, substantially the same result was obtained in propeller fan 3230 in Variation 2 and propeller fan 3240 in Comparative Example 1.

Figure 125:
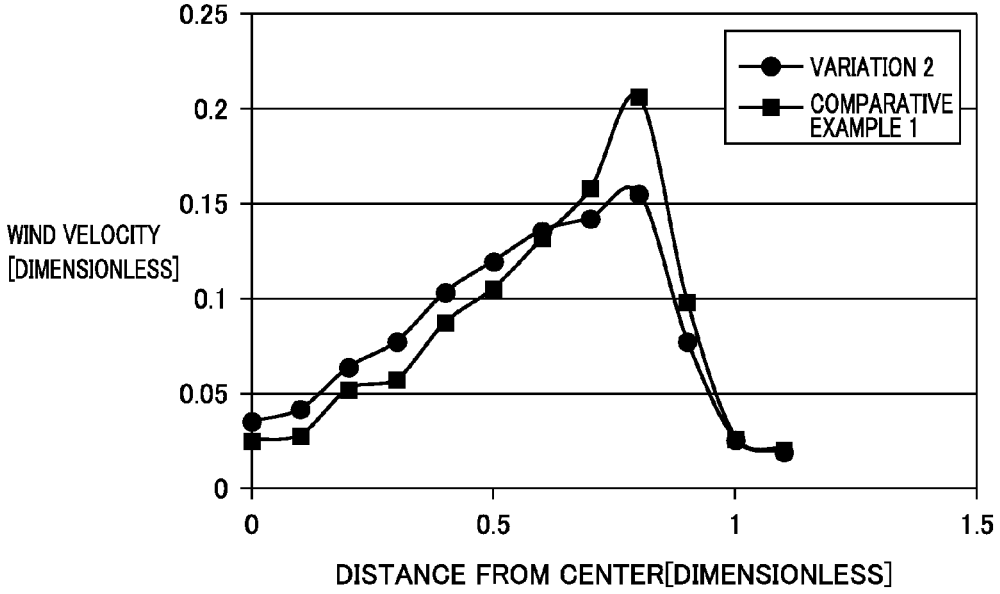

FIG. 125 is a graph showing relation between a distance from a center of rotation and a wind velocity in the propeller fan in Variation 2 in FIG. 118 and the propeller fan in Comparative Example 1 in FIG. 120.

Referring to FIG. 125, in propeller fan 3240 in Comparative Example 1, around a portion distant from central axis 3101 by 0.8R (R representing a maximum radius of blade 3021 in the plan view of the propeller fan), a wind velocity exhibited a high peak value. In propeller fan 3230 in Variation 2, a peak of a wind velocity could be suppressed to be low by suppressing capability to send wind on the outer circumferential side around central axis 3101.

Then, propeller fan 3210 in Embodiment C1 shown in FIG. 116 (x=0.1L in FIG. 116), propeller fan 3220 in Variation 1 shown in FIG. 117, and propeller fan 3250 in Comparative Example 2 shown in FIG. 121 which were identical in a diameter and height of blade 3021 as well as a diameter of boss hub portion 3041 were prepared. Then, relation between the number of rotations and a quantity of wind, relation between a quantity of wind and power consumption, relation between a quantity of wind and noise, and relation between a distance from the center of rotation and a wind velocity were found based on actual measurement in each propeller fan and results of measurement were compared.

As can be seen in FIGS. 116 and 117, propeller fan 3210 in Embodiment C1 and propeller fan 3220 in Variation 1 are basically the same in a shape of a blade. Propeller fan 3220 in Variation 1, however, is different from propeller fan 3210 in Embodiment C1 in that the outer circumferential side of rear edge portion 3024 is formed as being shifted in the direction of rotation in propeller fan 3210 in Embodiment C1 whereas rear edge portion 3024 extends smoothly between boss hub portion 3041 and outer edge portion 3023 in propeller fan 3220 in Variation 1. As can be seen in FIGS. 115 and 121, propeller fan 3210 in Embodiment C1 and propeller fan 3250 in Variation 2 are basically the same in a shape of a blade. Propeller fan 3250 in Variation 2, however, is different from propeller fan 3210 in Embodiment C1 in that a height of rear edge portion 3024 is great on the outer circumferential side in propeller fan 3210 in Embodiment C1 whereas a height of rear edge portion 3024 is constant in propeller fan 3250 in Comparative Example 2.

Figure 126:
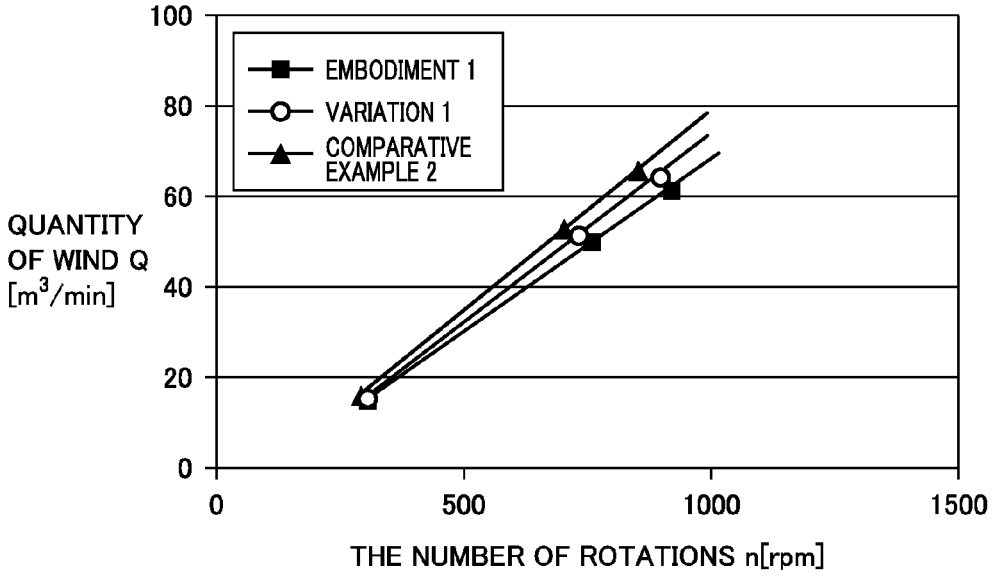
Figure 127:
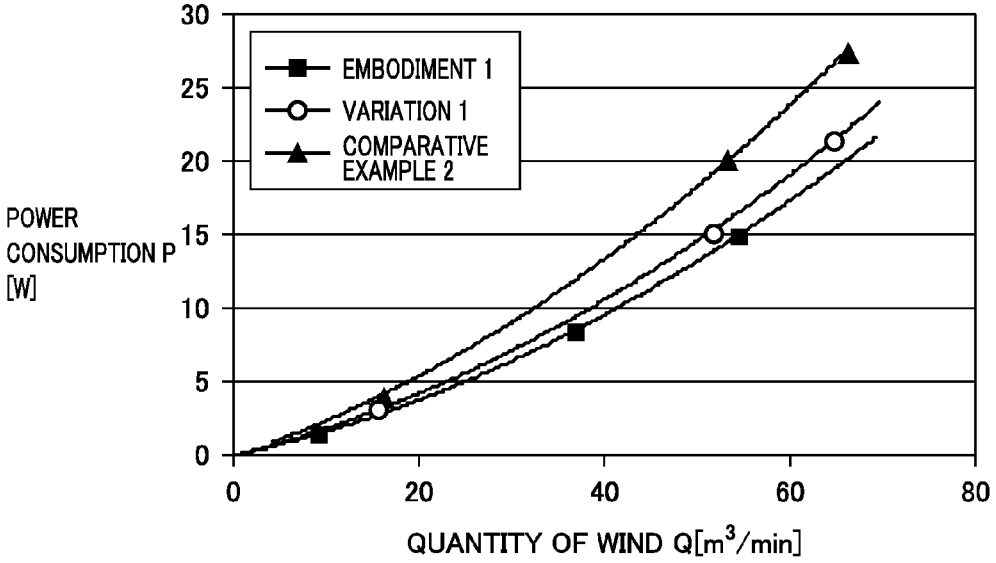
Figure 128:
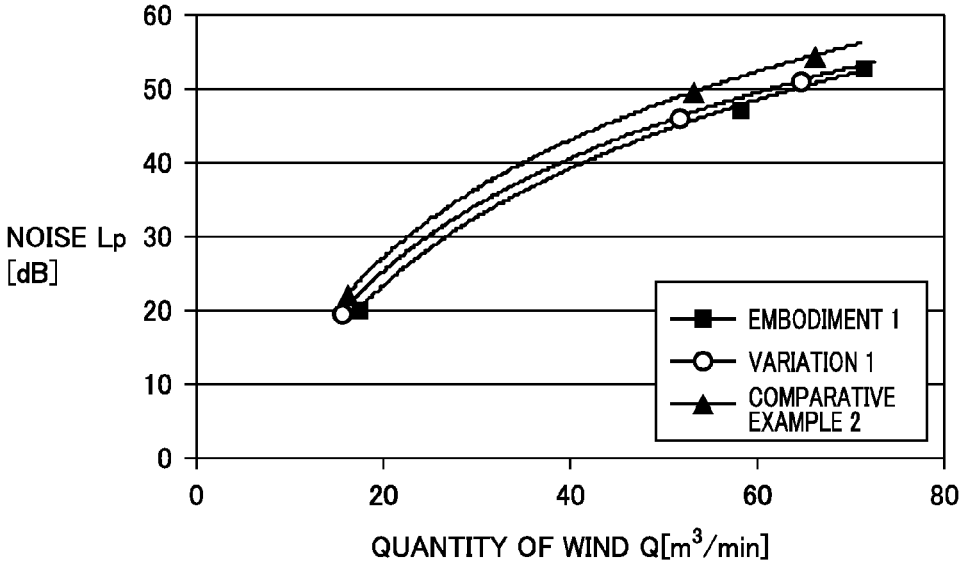

FIG. 126 is a graph showing relation between the number of rotations and a quantity of wind in the propeller fan in Embodiment C1 in FIG. 116, the propeller fan in Variation 1 in FIG. 117, and the propeller fan in Comparative Example 2 in FIG. 121. FIG. 127 is a graph showing relation between a quantity of wind and power consumption in the propeller fan in Embodiment C1 in FIG. 116, the propeller fan in Variation 1 in FIG. 117, and the propeller fan in Comparative Example 2 in FIG. 121. FIG. 128 is a graph showing relation between a quantity of wind and noise in the propeller fan in Embodiment C1 in FIG. 116, the propeller fan in Variation 1 in FIG. 117, and the propeller fan in Comparative Example 2 in FIG. 121.

Referring to FIGS. 126 to 128, since a height of blade 3021 is suppressed to be low on the outer circumferential side around central axis 3101 in propeller fans 3210 and 3220 in Embodiment C1 and Variation 1, a quantity of wind was slightly smaller than in propeller fan 3250 in Comparative Example 2. In propeller fan 3210 in Embodiment C1, an area of blade is decreased owing to shifting of the outer circumferential side of rear edge portion 3024 in the direction of rotation, and hence a quantity of wind was smaller than in propeller fan 3220 in Variation 1.

When power consumption and noise at the same quantity of wind were compared, propeller fans 3210 and 3220 in Embodiment C1 and Variation 1 were lower in power consumption and noise than propeller fan 3250 in Comparative Example 2. Since an area of blade is decreased owing to shifting of the outer circumferential side of rear edge portion 3024 in the direction of rotation in propeller fan 3210 in Embodiment C1, a horseshoe vortex generated over blade 3021 preceding in the direction of rotation is less likely to interfere with subsequent blade 3021. Therefore, in the present Example, a value for noise of propeller fan 3210 in Embodiment C1 was lowest.

Figure 129:
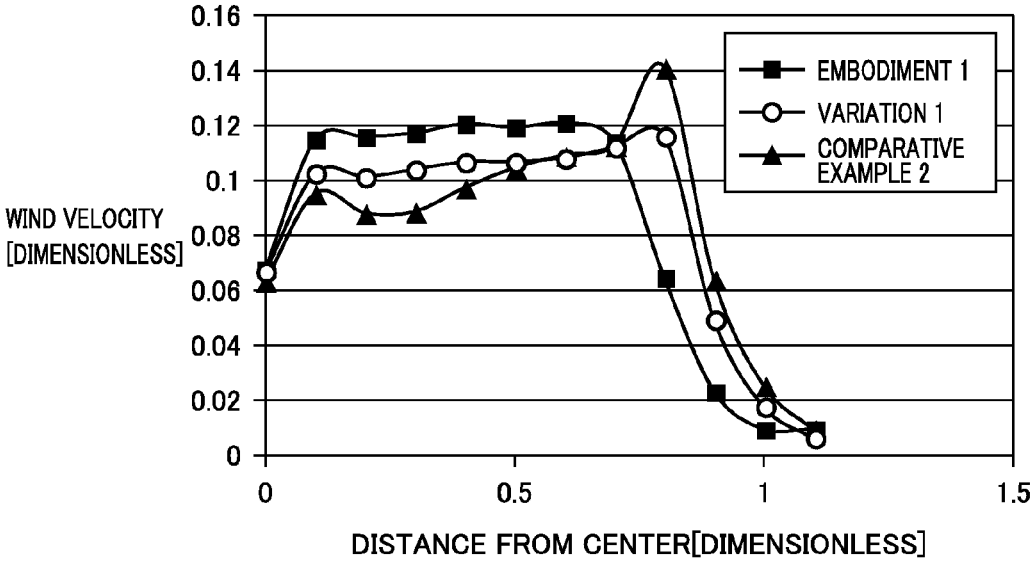

FIG. 129 is a graph showing relation between a distance from a center of rotation and a wind velocity in the propeller fan in Embodiment C1 in FIG. 116, the propeller fan in Variation 1 in FIG. 117, and the propeller fan in Comparative Example 2 in FIG. 121.

Referring to FIG. 129, in propeller fan 3250 in Comparative Example 2, around a portion distant from central axis 3101 by 0.8R (R representing a maximum radius of blade 3021 in the plan view of the propeller fan), a wind velocity exhibited a peak value. In propeller fan 3220 in Variation 1, a peak of the wind velocity was suppressed, and in propeller fan 3210 in Embodiment C1, a peak of the wind velocity could fully be eliminated.

Propeller fan 3230 in Variation 2 and propeller fan 3240 in Comparative Example 1 described in the previous example are different from propeller fan 3210 in Embodiment C1, propeller fan 3220 in Variation 1, and propeller fan 3250 in Comparative Example 2 described in the subsequent example, in a shape of front edge portion 3022. Owing to such a structure that front edge portion 3022 has a constant height on the inner circumferential side around central axis 3101, a quantity of wind was generally higher and wind velocity distribution was smoother in propeller fan 3210 in Embodiment C1, propeller fan 3220 in Variation 1, and propeller fan 3250 in Comparative Example 2 than in propeller fan 3230 in Variation 2 and propeller fan 3240 in Comparative Example 1.

Embodiment C2

Figure 130:
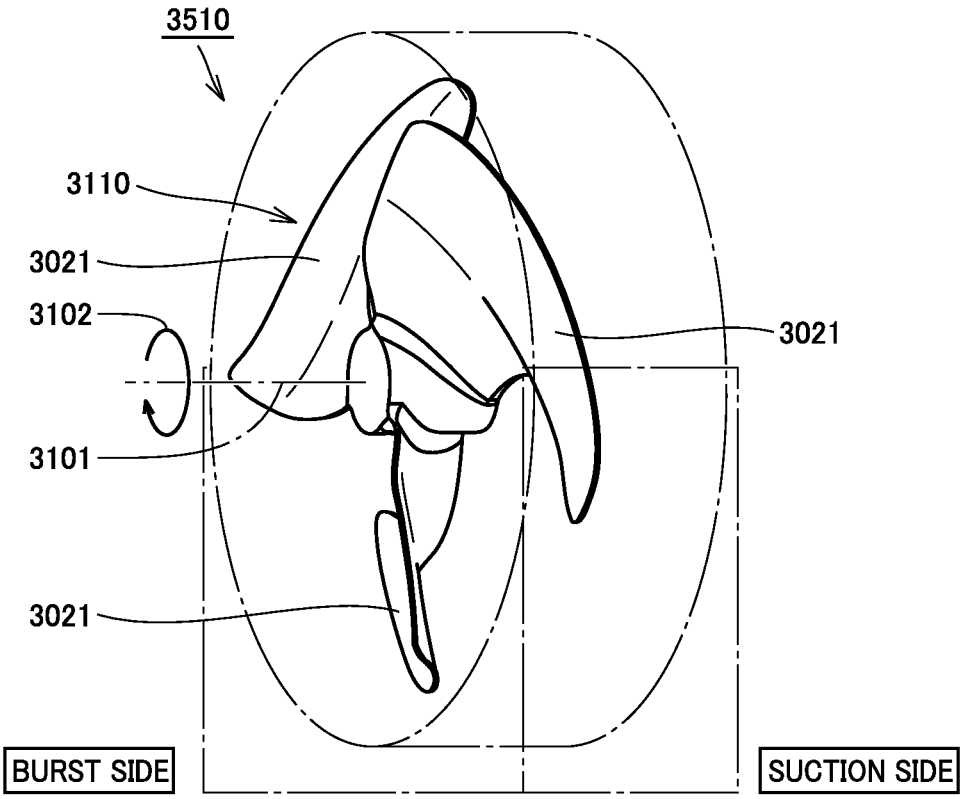

FIG. 130 is a perspective view showing a circulator including a propeller fan in an Embodiment C2 of this invention. FIG. 131 is a plan view of the propeller fan in Embodiment C2 of this invention viewed from the suction side. FIG. 132 is a plan view of the propeller fan in FIG. 131 viewed from the burst side. FIG. 133 is a side view showing the propeller fan in FIG. 131.

The propeller fan in the present embodiment is basically the same in structure as propeller fan 3210 in Embodiment C1. Description of a structure the same as in propeller fan 3210 will not be repeated below.

Referring to FIGS. 130 to 133, a propeller fan 3110 in the present embodiment has three blades, and has, as a plurality of blades, blade 3021A, blade 3021B, and blade 3021C (hereinafter referred to as blade 3021 unless particularly distinguished).

Propeller fan 3110 is mounted on a circulator 3510. Circulator 3510 is used, for example, for agitating cold air sent from an air-conditioner in a large room. Circulator 3510 has propeller fan 3110 and a not-shown drive motor to which boss hub portion 3041 of propeller fan 3110 is coupled, for rotating the plurality of blades 3021.

As shown in FIG. 133, in propeller fan 3110 in the present embodiment, rear edge portion 3024 has height h increasing toward outer edge portion 3023 on the outer circumferential side around central axis 3101. Front edge portion 3022 has a constant height in the axial direction of central axis 3101 between boss hub portion 3041 and a position distant outward from boss hub portion 3041 in the direction of radius of central axis 3101. In particular, in the present embodiment, front edge portion 3022 and outer edge portion 3023 have a constant height in the axial direction of central axis 3101 between boss hub portion 3041 and a maximum diameter end portion 3111 (a boundary position between a position where outer edge portion 3023 overlaps with circumscribed circle 3109 and a position where the outer edge portion is away from circumscribed circle 3109 shown in FIG. 131).

In succession, a fold structure in blade 3021 will be described with reference to propeller fan 3110. Though propeller fan 3210 in Embodiment C1 also has a fold structure similar to that of propeller fan 3110, description will be given referring representatively to propeller fan 3110 herein.

FIGS. 134 and 135 are plan views each partially showing the propeller fan in FIG. 131. FIGS. 134 and 135 show only one of three blades 3021 of propeller fan 3110. FIG. 136 is a cross-sectional view showing the propeller fan along the line A-A in FIG. 135. FIG. 137 is a cross-sectional view showing the propeller fan along the line B-B in FIG. 135. FIG. 138 is a cross-sectional view showing the propeller fan along the line C-C in FIG. 135. FIG. 139 is a cross-sectional view showing the propeller fan along the line D-D in FIG.

135. FIG. 140 is a cross-sectional view showing the propeller fan along the line E-E in FIG. 135. FIG. 141 is a cross-sectional view showing the propeller fan along the line F-F in FIG. 135.

Referring to FIGS. 134 to 141, blade 3021 has blade root portion 3034 and blade surface 3028 extending like a plate from blade root portion 3034. Blade root portion 3034 is arranged between blade 3021 and outer surface 3041S of boss hub portion 3041 (a boundary). On a periphery of blade surface 3028, front edge portion 3022, a blade tip end portion 3124, outer edge portion 3023, a blade rear end portion 3125, and rear edge portion 3024 are annularly arranged in this order from a portion in blade root portion 3034 on the side of the direction of rotation to a portion in blade root portion 3034 opposite in the direction of rotation.

In a plan view of blade 3021, blade 3021 has a shape pointed like a sickle, with blade tip end portion 3124 where front edge portion 3022 intersects with outer edge portion 3023 being defined as the tip end. Blade tip end portion 3124 is arranged in front edge portion 3022 on the outer side in the direction of radius when viewed from central axis 3101. Blade tip end portion 3124 is a portion where front edge portion 3022 and outer edge portion 3023 are connected to each other. Blade tip end portion 3124 in the present embodiment is located most on the side in the direction of rotation in blade 3021. Blade rear end portion 3125 is arranged in rear edge portion 3024 on the outer side in the direction of radius when viewed from central axis 3101. Blade rear end portion 3125 is a portion where rear edge portion 3024 and outer edge portion 3023 are connected to each other.

Front edge portion 3022, blade tip end portion 3124, outer edge portion 3023, blade rear end portion 3125, and rear edge portion 3024 constitute a peripheral portion forming a periphery of blade 3021 together with blade root portion 3034. This peripheral portion (front edge portion 3022, blade tip end portion 3124, outer edge portion 3023, blade rear end portion 3125, and rear edge portion 3024) is in a smooth shape not having a corner portion, as it is formed substantially in an arc shape. Blade surface 3028 is formed over the entire region inside a region surrounded by blade root portion 3034 and this peripheral portion (front edge portion 3022, blade tip end portion 3124, outer edge portion 3023, blade rear end portion 3125, and rear edge portion 3024).

[Description of Inner Region 3031, Outer Region 3032, and Coupling Portion 3033]

Blade surface 3028 of propeller fan 3110 has inner region 3031, outer region 3032, and coupling portion 3033. Inner region 3031, outer region 3032, and coupling portion 3033 are formed in both of positive pressure surface 3026 and negative pressure surface 3027.

Inner region 3031 includes blade root portion 3034 in a part thereof and it is located on the inner side in the direction of radius of central axis 3101 relative to outer region 3032. Outer region 3032 includes blade rear end portion 3125 in a part thereof and it is located on the outer side in the direction of radius of central axis 3101 relative to coupling portion 3033 and inner region 3031. Positive pressure surface 3026 in inner region 3031 and positive pressure surface 3026 in outer region 3032 are formed to be different in surface shape from each other. Negative pressure surface 3027 in inner region 3031 and negative pressure surface 3027 in outer region 3032 are formed to be different in surface shape from each other.

Coupling portion 3033 couples inner region 3031 and outer region 3032 to each other such that a side of positive pressure surface 3026 of blade surface 3028 is projecting and a side of negative pressure surface 3027 of blade surface 3028 is recessed. Coupling portion 3033 is provided to extend substantially along the direction of rotation, and extends from a front end portion 3033A located most upstream in the direction of rotation in coupling portion 3033 toward a rear end portion 3033B located most downstream in the direction of rotation in coupling portion 3033.

Coupling portion 3033 is formed such that blade surface 3028 is curved with slightly sharp variation in curvature from inner region 3031 toward outer region 3032, and couples in a curved manner, inner region 3031 and outer region 3032 different from each other in surface shape to each other at a boundary therebetween.

Coupling portion 3033 is provided such that a curvature in a cross-sectional view along the direction of radius of blade surface 3028 attains to relative maximum around the same, and appears as a projection projecting in a curved manner on positive pressure surface 3026 as extending like a streak from front end portion 3033A toward rear end portion 3033B, and appears as a groove portion recessed in a curved manner on negative pressure surface 3027 as extending like a streak from front end portion 3033A toward rear end portion 3033B.

Front end portion 3033A of coupling portion 3033 is located close to blade tip end portion 3124 and provided as being spaced apart from rear edge portion 3024. Front end portion 3033A of coupling portion 3033 in the present embodiment is provided at a position displaced slightly inward in blade surface 3028 from blade tip end portion 3124 toward the side opposite to the direction of rotation.

Front end portion 3033A of coupling portion 3033 may be provided close to front edge portion 3022 or close to outer edge portion 3023, so long as it is spaced apart from rear edge portion 3024. Front end portion 3033A of coupling portion 3033 is provided such that front edge portion 3022, blade tip end portion 3124, or outer edge portion 3023 is located on a line drawn by smoothly extending coupling portion 3033 in the direction of rotation.

Rear end portion 3033B of coupling portion 3033 is located close to rear edge portion 3024 and provided as being spaced apart from all of front edge portion 3022, blade tip end portion 3124, and outer edge portion 3023. Rear end portion 3033B of coupling portion 3033 in the present embodiment is provided at a position slightly displaced inward in blade surface 3028 from a substantially central position in rear edge portion 3024 in the direction of radius of central axis 3101 toward the direction of rotation. Rear end portion 3033B of coupling portion 3033 is provided such that rear edge portion 3024 is located on a line drawn by smoothly extending coupling portion 3033 toward the opposite side in the direction of rotation.

As shown in FIG. 134, when blade 3021 rotates in a direction shown with arrow 102 around central axis 3101, a blade tip end vortex 3340 is generated over blade surface 3028 around a portion around blade tip end portion 3124, which flows from each of front edge portion 3022, blade tip end portion 3124, and outer edge portion 3023 toward rear edge portion 3024. This blade tip end vortex 3340 is generated over each of positive pressure surface 3026 and negative pressure surface 3027. Preferably, coupling portion 3033 is provided to extend along a flow of this blade tip end vortex 3340.

As shown in FIGS. 135 and 136, coupling portion 3033 in the present embodiment is provided such that front end portion 3033A of coupling portion 3033 does not reach (does not overlap with) any of front edge portion 3022, blade tip end portion 3124, and outer edge portion 3023. A curve resulting from presence of coupling portion 3033 appears in none of front edge portion 3022, blade tip end portion 3124, and outer edge portion 3023, and blade surface 3028 located around front end portion 3033A of coupling portion 3033 (positive pressure surface 3026 and negative pressure surface 3027) is formed to be flat at 180° in a cross-sectional view along the direction of radius of central axis 3101, which passes through front end portion 3033A.

As shown in FIGS. 135 and 137, coupling portion 3033 is provided such that blade surface 3028 (positive pressure surface 3026 and negative pressure surface 3027) relatively sharply curves in the vicinity of front end portion 3033A in coupling portion 3033, on the side opposite to the direction of rotation. As shown in FIGS. 135, 138, and 139, coupling portion 3033 is provided such that interior angle θ virtually formed on the side of negative pressure surface 3027 of coupling portion 3033 is gradually smaller from front end portion 3033A toward a portion around the center of coupling portion 3033 in the direction of rotation. Preferably, this interior angle θ is formed to be smallest around the center of coupling portion 3033 in the direction of rotation.

As shown in FIGS. 135 and 140, coupling portion 3033 is provided such that interior angle θ virtually formed on the side of negative pressure surface 3027 of coupling portion 3033 is gradually greater from the portion around the center of coupling portion 3033 in the direction of rotation toward rear end portion 3033B. As shown in FIGS. 135 and 141, coupling portion 3033 in the present embodiment is provided such that rear end portion 3033B of coupling portion 3033 does not reach (does not overlap with) rear edge portion 3024. A curve resulting from presence of coupling portion 3033 does not appear in rear edge portion 3024, and blade surface 3028 located around rear end portion 3033B of coupling portion 3033 is formed to be flat at 180° in a cross-sectional view along the direction of radius of central axis 3101, which passes through rear end portion 3033B.

[Description of Stagger Angle θA, θB]

FIG. 142 is a cross-sectional view along the line CXLII-CXLII in FIG. 134. Referring to FIGS. 134 and 142, inner region 3031 in blade surface 3028 located on the inner side in the direction of radius relative to coupling portion 3033 has prescribed stagger angle θA. By connecting a point on front edge portion 3022 in inner region 3031 and a point on rear edge portion 3024 in inner region 3031 to each other, a virtual straight line 3031L is formed. Stagger angle θA refers to an angle formed by virtual straight line 3031L and central axis 3101 therebetween.

As shown in FIG. 142, inner region 3031 of blade 3021 in the present embodiment is curved such that a bulge portion of inner region 3031 is away from virtual straight line 3031L with front edge portion 3022 and rear edge portion 3024 being defined as opposing ends, and has a warped shape such that the side of positive pressure surface 3026 of blade surface 3028 (inner region 3031) is projecting and the side of negative pressure surface 3027 of blade surface 3028 (inner region 3031) is recessed. Blade 3021 in the present embodiment is formed such that stagger angle θA in a portion on the inner side in the direction of radius relative to coupling portion 3033 in blade 3021 is smaller toward boss hub portion 3041.

FIG. 143 is a cross-sectional view along the line CXLIII-CXLIII in FIG. 134. Referring to FIGS. 134 and 143, outer region 3032 in blade surface 3028 located on the outer side in the direction of radius relative to coupling portion 3033 has prescribed stagger angle θB. By connecting a point on front edge portion 3022 in outer region 3032 and a point on rear edge portion 3024 in outer region 3032 to each other, a virtual straight line 3033L is formed. Stagger angle θB refers to an angle formed by virtual straight line 3033L and central axis 3101 therebetween.

As shown in FIG. 143, outer region 3032 of blade 3021 in the present embodiment is curved such that a bulge portion of outer region 3032 is away from virtual straight line 3033L, with front edge portion 3022 and rear edge portion 3024 being defined as opposing ends, and has a warped shape such that the side of positive pressure surface 3026 of blade surface 3028 (outer region 3032) is recessed and the side of negative pressure surface 3027 of blade surface 3028 (outer region 3032) is projecting.

Referring to FIGS. 142 and 143, blade 3021 in the present embodiment is formed such that stagger angle θA is smaller than stagger angle θB. Blade 3021 is formed such that stagger angle θA in blade root portion 3034 is also smaller than stagger angle θB in outer edge portion 3023. Furthermore, blade 3021 has a warped shape on the inner side in the direction of radius relative to coupling portion 3033 such that the side of positive pressure surface 3026 is projecting and the side of negative pressure surface 3027 is recessed and has a warped shape on the outer side in the direction of radius relative to coupling portion 3033 such that the side of positive pressure surface 3026 is recessed and the side of negative pressure surface 3027 is projecting. Namely, in the present embodiment, blade 3021 is formed such that it is warped toward opposing sides with coupling portion 3033 being defined as a boundary.

[Description of Function and Effect]

A function and effect achieved by propeller fan 3110 in the present embodiment will be described with reference to FIGS. 144 to 146.

FIG. 144 is a plan view of a manner during rotation of a blade of a propeller fan viewed from the suction side. FIG. 145 is a plan view of a manner during rotation of a blade of a propeller fan viewed from the burst side. FIG. 146 is a cross-sectional view of a propeller fan virtually cut along a coupling portion, which is a diagram showing a manner during rotation of a blade of a propeller fan.

Referring to FIGS. 144 and 145, blade 3021 rotates in a direction shown with arrow 102 around central axis 3101. Over blade surface 3028 (both of positive pressure surface 3026 and negative pressure surface 3027) of blade 3021 in propeller fan 3110 in the present embodiment, blade tip end vortex 3340, a mainstream 3310, a secondary flow 3330, a horseshoe vortex 3320, and a horseshoe vortex 3350 are generated as flows of air.

Blade tip end vortex 3340 is formed as blade tip end portion 3124 mainly collides with air during rotation of propeller fan 3110. Blade tip end vortex 3340 originates mainly from blade tip end portion 3124, and flows from blade tip end portion 3124, a portion close to blade tip end portion 3124 of front edge portion 3022 located in the vicinity of blade tip end portion 3124, and a portion close to blade tip end portion 3124 of outer edge portion 3023 located in the vicinity of blade tip end portion 3124 over blade surface 3028 toward rear edge portion 3024.

Mainstream 3310 is formed on a further upper side of blade surface 3028 than blade tip end vortex 3340 during rotation of propeller fan 3110. In other words, mainstream 3310 is formed on an opposite side of blade surface 3028 with respect to a surface layer of blade surface 3028 over which blade tip end vortex 3340 is formed, with blade tip end vortex 3340 lying therebetween. Mainstream 3310 flows in from front edge portion 3022, blade tip end portion 3124, and outer edge portion 3023 to blade surface 3028, and flows toward rear edge portion 3024.

Horseshoe vortex 3320 is generated along outer edge portion 3023 so as to flow from positive pressure surface 3026 into negative pressure surface 3027, owing to a pressure difference between positive pressure surface 3026 and negative pressure surface 3027 caused by rotation of propeller fan 3110. Secondary flow 3330 is generated to flow from boss hub portion 3041 toward outer edge portion 3023, owing to centrifugal force caused by rotation of the propeller fan. Horseshoe vortex 3350 is generated as secondary flow 3330 flows across a portion where coupling portion 3033 is provided in blade surface 3028.

As described above, front end portion 3033A of coupling portion 3033 in the present embodiment is provided at a position slightly displaced inward in blade surface 3028, from blade tip end portion 3124 toward a side opposite to the direction of rotation, and rear end portion 3033B of coupling portion 3033 is provided at a position slightly displaced inward in blade surface 3028 from a substantially central position in rear edge portion 3024 in the direction of radius of central axis 3101 toward the direction of rotation. According to such a construction, coupling portion 3033 is formed to extend substantially along the direction of flow of mainstream 3310 and blade tip end vortex 3340.

Referring to FIG. 146, coupling portion 3033 coupling inner region 3031 and outer region 3032 to each other in a curved manner has horseshoe vortex 3350 and blade tip end vortex 3340 held in the vicinity of coupling portion 3033 at a surface layer of blade surface 3028, and suppresses separation of horseshoe vortex 3350 and blade tip end vortex 3340 from the surface layer of blade surface 3028. Coupling portion 3033 also suppresses development or fluctuation of horseshoe vortex 3350 which is generated in the vicinity of coupling portion 3033 and flows as being held by coupling portion 3033.

Blade tip end vortex 3340 which is generated in the vicinity of blade tip end portion 3124 and flows as being held by coupling portion 3033 and horseshoe vortex 3350 which is generated in the vicinity of coupling portion 3033 and flows as being held by coupling portion 3033 provide kinetic energy to mainstream 3310. Mainstream 3310 provided with kinetic energy is less likely to separate from blade surface 3028 on the downstream side over blade surface 3028. Consequently, separation region 3052 can be made smaller or eliminated. Propeller fan 3110 can achieve lowering in noise generated during rotation owing to suppression of separation, as well as increase in quantity of wind as compared with a case not provided with coupling portion 3033 and resulting higher efficiency.

FIG. 147 is a cross-sectional view of a propeller fan for comparison virtually cut along a portion corresponding to a coupling portion in the present embodiment, which is a diagram showing a manner during rotation of a blade of this propeller fan. A propeller fan for comparison is constructed substantially similarly to propeller fan 3110, except for not having coupling portion 3033.

Referring to FIG. 147, in such a propeller fan for comparison, mainstream 3310 and blade tip end vortex 3340 generated over positive pressure surface 3026 and negative pressure surface 3027 of blade surface 3028 flow along blade surface 3028 on the upstream side over blade surface 3028 close to front edge portion 3022, blade tip end portion 3124, and outer edge portion 3023, however, it is less likely to flow along blade surface 3028 on the downstream side over blade surface 3028 close to rear edge portion 3024. Since no kinetic energy is provided from blade tip end vortex 3340 to mainstream 3310 on the downstream side, separation region 3052 where mainstream 3310 separates from blade surface 3028 is likely to be created. In this propeller fan, it is difficult to lower noise generated during rotation. Such tendency is noticeable in particular over negative pressure surface 3027, of positive pressure surface 3026 and negative pressure surface 3027.

During rotation of propeller fan 3110 in the present embodiment, in the vicinity of a region where coupling portion 3033 is provided, mainstream 3310 flows from the outer side in the direction of radius toward the inner side in that direction. Therefore, by forming coupling portion 3033 substantially along a flow of mainstream 3310 and adopting a blade shape also for a region where coupling portion 3033 is provided, the blade shape can be realized for all flows of mainstream 3310 and hence wind can more efficiency be sent.

As coupling portion 3033 is provided such that blade surface 3028 is smoothly curved from inner region 3031 toward outer region 3032, a degree of freedom in terms of design of a shape of blade surface 3028 can be ensured. For example, in order to suppress generation of a horseshoe vortex, such a complicated shape of blade surface 3028 that a height of blade surface 3028 is increased around boss hub portion 3041 while a sickle shape decreasing in width of front edge portion 3022 and outer edge portion 3023 toward blade tip end portion 3124 is maintained can also be implemented.

In propeller fan 3110 in the present embodiment, blade surface 3028 (positive pressure surface 3026 and negative pressure surface 3027) located around front end portion 3033A of coupling portion 3033 is formed to be flat at 180° in a cross-sectional view along the direction of radius of central axis 3101, which passes through front end portion 3033A, and furthermore, blade surface 3028 (positive pressure surface 3026 and negative pressure surface 3027) located around rear end portion 3033B of coupling portion 3033 is formed to be flat at 180° in a cross-sectional view along the direction of radius of central axis 3101, which passes through rear end portion 3033B. According to such a construction, since wind which flows into blade surface 3028 and wind which flows out of blade surface 3028 are not disturbed, resistance against mainstream 3310 can be lessened. Such a feature is desirably provided as necessary.

Blade 3021 in the present embodiment has a warped shape such that the side of positive pressure surface 3026 is projecting and the side of negative pressure surface 3027 is recessed in blade root portion 3034 and inner region 3031, and has a warped shape such that the side of positive pressure surface 3026 is recessed and the side of negative pressure surface 3027 is projecting in outer region 3032 and outer edge portion 3023. Such a construction can be referred to as a reverse camber structure.

In a general propeller fan, owing to its structure, a peripheral velocity in a portion on the inner side in the direction of radius is low and a peripheral velocity in a portion on the outer side in the direction of radius is high. An inflow angle of air is different between the side of the blade root portion located on the inner side in the direction of radius and the side of the outer edge portion (a blade end side) located on the outer side in the direction of radius. Therefore, as an inflow angle (a camber angle) on the side of the outer edge portion (the blade end side) is designed such that inflow of air is appropriate on the side of the outer edge portion (the blade end side), good inflow of air is less likely on the side of the blade root portion, and separation may occur in a flow of air on the side of the blade root portion (vice versa).

Therefore, as in propeller fan 3110 in the present embodiment, a camber angle is varied appropriately on the side of blade root portion 3034 located on the inner side in the direction of radius and the side of outer edge portion 3023 (the blade end side) located on the outer side in the direction of radius and the reverse camber structure is provided in a region where an inflow angle of air on the side of blade root portion 3034 is large, so that air can flow in at an appropriate inflow angle with respect to blade surface 3028 over the entire region in the direction of radius, and in addition, separation of a flow of air can be prevented.

A construction of blade surface 3028 having a warped shape such that the side of positive pressure surface 3026 is projecting and the side of negative pressure surface 3027 is recessed in blade root portion 3034 and inner region 3031 and having a warped shape such that the side of positive pressure surface 3026 is recessed and the side of negative pressure surface 3027 is projecting in outer region 3032 and outer edge portion 3023 (the reverse camber structure) can be enabled independently of such a technical concept that coupling portion 3033 is provided in blade surface 3028.

Even when coupling portion 3033 is not provided in the propeller fan, according to blade surface 3028 having the reverse camber structure, air can flow in at an appropriate inflow angle with respect to blade surface 3028 over the entire region in the direction of radius, and in addition, the object to prevent separation of a flow of air can be achieved.

In propeller fan 3110 in the present embodiment, blade 3021 is formed such that stagger angle θA is smaller than stagger angle θB. Blade 3021 is formed such that stagger angle θA in blade root portion 3034 is also smaller than stagger angle θB in outer edge portion 3023. According to such a construction, inclination of blade surface 3028 is steeper on the inner circumferential side and gentler on the outer circumferential side, and hence a peak of a wind velocity on the outer side in the direction of radius causing uncomfortableness can be adjusted.

Blade 3021 in the present embodiment is formed such that stagger angle θA in a portion on the inner side in the direction of radius relative to coupling portion 3033 in blade 3021 is smaller toward boss hub portion 3041. According to such a construction, on the inner circumferential side around central axis 3101, capability to send wind is higher toward central axis 3101.

In a general propeller fan, there is a great difference in distribution of a wind velocity at the time of blowing off in the direction of radius. A wind velocity is high on the outer side in the direction of radius and highest around the tip end portion of the blade, and the wind velocity has an extreme peak point. A difference in wind velocity is excessive between a portion where blade 3021 does not function in the vicinity of central axis 3101 and a portion where blade 3021 functions most, and variation in wind velocity at the time of blowing off is caused, which is a major cause of uncomfortableness.

In contrast, according to propeller fan 3110 in the present embodiment, a difference in quantity of wind (wind velocity) between the inner circumferential side and the outer circumferential side can be lessened. Propeller fan 3110 can achieve more uniform blowing and uncomfortableness of a person who has received wind can be suppressed. With propeller fan 3110, a space which can be occupied by the fan can be utilized as much as possible and strong blowing can also be achieved. Such a feature is desirably provided as necessary.

From a point of view of more uniform blowing by propeller fan 3110, blade 3021 is desirably formed such that an area of a blade in a portion on the inner side (inner region 3031) in the direction of radius relative to coupling portion 3033 in blade 3021 is equal to or greater than an area of a blade in a portion on the outer side (outer region 3032) in the direction of radius relative to coupling portion 3033 in blade 3021.

With such a construction, capability to send wind in the portion on the inner side (inner region 3031) in the direction of radius relative to coupling portion 3033 in blade 3021 can be enhanced, and capability to send wind in the portion on the outer side (outer region 3032) in the direction of radius relative to coupling portion 3033 in blade 3021 can be lowered. A difference in quantity of wind (wind velocity) between the inner circumferential side and the outer circumferential side can be lessened, more uniform blowing by propeller fan 3110 can be achieved, and uncomfortableness of a person who has received wind can be suppressed. Such a feature is desirably provided as necessary.

[Description of Various Variations]

FIG. 148 is a cross-sectional view showing a Variation 1 of the propeller fan in FIG. 134. FIG. 148 corresponds to FIG. 138.

Coupling portion 3033 of propeller fan 3110 described above is formed such that blade surface 3028 is curved with slightly sharp variation in curvature from inner region 3031 toward outer region 3032 and couples in a curved manner, inner region 3031 and outer region 3032 different from each other in surface shape to each other at a boundary therebetween.

Referring to FIG. 148, coupling portion 3033 may be formed such that blade surface 3028 is curved with slightly sharp variation in curvature from inner region 3031 toward outer region 3032 and may couple in a bent manner, inner region 3031 and outer region 3032 different from each other in surface shape to each other at a boundary therebetween. According to such a construction as well, an effect the same as in propeller fan 3110 described above can be achieved.

If blade surface 3028 is bent too extremely in coupling portion 3033, that shape of coupling portion 3033 is likely to affect a secondary flow which is not a mainstream generated over blade surface 3028. In a case of maximum use of the same space as well, desirably, an appropriate degree of curving or bending is determined in consideration of a flow of air in coupling portion 3033.

FIG. 149 is a cross-sectional view showing a Variation 2 of the propeller fan in FIG. 134. Referring to FIG. 149, in the present Variation, when virtual concentric circle Z1 centered around central axis 3101 and passing through central position P1 of coupling portion 3033 in the direction of rotation is drawn, coupling portion 3033 is provided such that front end portion 3033A of coupling portion 3033 is located on the outer side in the direction of radius of concentric circle Z1 and rear end portion 3033B of coupling portion 3033 is located on the inner side in the direction of radius of concentric circle Z1. According to such a construction, a mainstream formed over blade surface 3028 is in a direction from the outer side to the inner side in the direction of radius, and hence coupling portion 3033 can be provided along such a flow of the mainstream.

Embodiment C3

In propeller fan 3210 described in Embodiment C1, outer edge portion 3023 of blade 3021 includes a front outer edge portion 3156 located on the side of front edge portion 3022, a rear outer edge portion 3157 located on the side of rear edge portion 3024, and a connection portion 3151 in a prescribed shape connecting front outer edge portion 3156 and rear outer edge portion 3157 to each other (see FIG. 113). With outer edge portion 3023 in such a shape, various effects which will be described later are exhibited. A specific shape of outer edge portion 3023 will be described in detail below with reference to FIGS. 111 to 115.

In outer edge portion 3023, connection portion 3151 recessed toward central axis 3101 is formed. Connection portion 3151 is formed at a position in midway between front edge side connection portion 3104 and rear edge side connection portion 3105.

As connection portion 3151 described above is formed in outer edge portion 3023, in outer edge portion 3023 of blade 3021, front outer edge portion 3156 (see FIG. 113) located on the side of front edge side connection portion 3104 and rear outer edge portion 3157 (see FIG. 113) located on the side of rear edge side connection portion 3105 are provided.

Connection portion 3151 may be in a smoothly curved shape or in a bent shape. In the present embodiment, since connection portion 3151 is formed as being relatively shallowly recessed, connection portion 3151 has a shape substantially at an obtuse angle.

A position where connection portion 3151 is formed is not particularly limited so long as it is a position on outer edge portion 3023. In the present embodiment, however, connection portion 3151 is formed at a position closer to rear edge side connection portion 3105 than to front edge side connection portion 3104. Therefore, in the present embodiment, a width of front outer edge portion 3156 along the direction of rotation is formed to be greater than a width of rear outer edge portion 3157 along the direction of rotation.

By forming such connection portion 3151 in blade 3021, an effect as follows is achieved.

Firstly, wind velocity distribution in a radial direction can be more uniform and variation in wind velocity can be suppressed. Thus, comfortably impinging wind can be obtained.

Namely, in a case of a blade shape not having recessed connection portion 3151 formed in outer edge portion 3023, since a wind velocity is greater radially outward substantially in proportion, there is a great difference in velocity between wind generated in a portion close to the radially inner side and wind generated in a portion close to the radially outer side. Thus, significant pressure fluctuation is caused in generated wind.

In contrast, in the present embodiment, recessed connection portion 3151 is formed in outer edge portion 3023. Therefore, as compared with a case that no recessed connection portion 3151 is formed in outer edge portion 3023, an area of a blade is decreased in the vicinity of outer edge portion 3023 (that is, a portion close to the radially outer side). Therefore, a wind velocity increasing radially outward substantially in proportion is lowered in a portion close to outer edge portion 3023. A velocity of wind generated in the portion close to the radially inner side and a velocity of wind generated in a portion close to outer edge portion 3023 are close to each other and wind velocity distribution in the radial direction is more uniform. Therefore, variation in wind velocity can be suppressed and comfortably impinging wind can be obtained.

Secondly, pressure fluctuation included in wind generated in a portion close to the radially outer side is less, and comfortably impinging wind can be generated.

Namely, in a case of a blade shape not having a recessed connection portion formed in outer edge portion 3023, air passes through a relatively large space between blades and great pressure fluctuation is caused in generated wind. This is particularly noticeable in a portion on the side of outer edge portion 3023 where wind higher in velocity is generated, and wind greater in pressure difference is generated as the number of blades is smaller.

In contrast, in the present embodiment, the blade shape is such that recessed connection portion 3151 is formed in outer edge portion 3023. Therefore, in each blade, a relatively small space (that is, a space where recessed connection portion 3151 is located) is formed between front outer edge portion 3156 and rear outer edge portion 3157 in one blade 3021, and the space is present as a space in blade 3021 where no wind is generated. Consequently, in a portion on the side of outer edge portion 3023 where wind high in velocity is generated, a pressure difference caused in generated wind is lessened as a result of decrease in area of the blade, and in addition, a pressure fluctuates in a more finely stepwise manner. Therefore, front outer edge portion 3156 and rear outer edge portion 3157 provided in one blade 3021 function as if two blades sent wind, and comfortably impinging wind less in pressure fluctuation as a whole can be generated.

Thirdly, during rotation at a low speed, comfortably impinging wind diffusing over a wide range can be obtained, and during rotation at a high speed, wind high in straightness and reaching farther can be obtained, which will be described in further detail with reference to FIGS. 150 to 153.

FIG. 150 is a conceptual diagram showing a flow of air obtained at the time when a propeller fan is rotated at a low speed. FIG. 151 is a diagram schematically showing a state of wind obtained at the time when a propeller fan is rotated at a low speed. FIG. 152 is a conceptual diagram showing a flow of wind obtained at the time when a propeller fan is rotated at a high speed. FIG. 153 is a diagram schematically showing a state of wind obtained at the time when a propeller fan is rotated at a high speed.

In FIGS. 150 and 152, as a track representative of a blade tip end vortex, a track of a blade tip end vortex generated around front edge side connection portion 3104 is schematically shown with a thin dashed line, a track representative of a horseshoe vortex is schematically shown with a thin line, and a track of wind generated at a position close to outer edge portion 3023 of blade 3021 is further shown schematically with a bold line.

As described above, in the present embodiment, recessed connection portion 3151 is formed in outer edge portion 3023 of blade 3021. The position on outer edge portion 3023 corresponds to a position on the downstream side of the blade tip end portion including front edge side connection portion 3104, along a streamline of the blade tip end vortex which flows over blade surface 3028.

Referring to FIGS. 150 and 151, when blade 3021 rotates at a low speed, kinetic energy of the blade tip end vortex and the horseshoe vortex generated as a result of rotation of blade 3021 is low, and hence separation of the blade tip end vortex and the horseshoe vortex is promoted in recessed connection portion 3151 without the vortexes being trapped therein. Thus, the blade tip end vortex and the horseshoe vortex are both dispelled radially outward by centrifugal force in a portion where recessed connection portion 3151 is formed. Therefore, as shown in FIG. 151, wind generated by blade 3021 is diffused in front of electric fan 3610, and comfortably impinging wind 3152 can be sent over a wide range. Therefore, in a case that electric fan 3610 is desirably operated during bedtime such as night without wind substantially being felt, a breezy operation satisfying such a desire can also be realized.

Referring to FIGS. 152 and 153, when blade 3021 rotates at a high speed, kinetic energy of the blade tip end vortex and the horseshoe vortex generated as a result of rotation of blade 3021 is great, and hence the blade tip end vortex and the horseshoe vortex are trapped and held in recessed connection portion 3151 and fluctuation or development of the blade tip end vortex and the horseshoe vortex is suppressed. In that case, the blade tip end vortex and the horseshoe vortex will move inward along recessed connection portion 3151, and hence, thereafter, the blade tip end vortex and the horseshoe vortex which are separated in rear edge side connection portion 3105 are dispelled in an axial direction by a large quantity of wind and a high static pressure resulting from rotation at a high speed. Therefore, as shown in FIG. 153, wind generated by blade 3021 converges in front of electric fan 3610, and wind 3153 high in straightness and reaching farther can be sent. Therefore, wind can efficiently be sent and generation of noise can also be suppressed owing to enhanced straightness of wind.

Thus, according to propeller fan 3110 and electric fan 3610 including the same in the present embodiment, generated wind can be less in pressure fluctuation and comfortable wind can be sent, and noise can be lowered.

A new propeller fan may be constructed by combining as appropriate various blade structures of the propeller fans in Embodiments C1 to C3 described above.

Embodiment C4

In the present embodiment, a structure of a molding die for molding various propeller fans in Embodiments C1 to C3 with a resin will be described.

FIG. 154 is a cross-sectional view showing a molding die used for manufacturing of a propeller fan. Referring to FIG. 154, a molding die 3061 has a fixed die 3062 and a movable die 3063. Fixed die 3062 and movable die 3063 define a cavity substantially the same in shape as the propeller fan, into which a fluid resin is injected.

Molding die 3061 may be provided with a not-shown heater for enhancing fluidity of the resin injected into the cavity. Such provision of a heater is particularly effective in using a synthetic resin having increased strength such as an AS resin filled with glass fibers.

With regard to molding die 3061 shown in FIG. 154, it is assumed that the surface on the side of the positive pressure surface in the propeller fan is formed with fixed die 3062 and the surface on the side of the negative pressure surface is formed with movable die 3063, however, the surface on the side of the negative pressure surface of the propeller fan may be formed with fixed die 3062 and the surface on the side of the positive pressure surface of the propeller fan may be formed with movable die 3063.

Some propeller fans are integrally formed with a metal as a material and through drawing by pressing. For such molding, a thin metal plate is generally employed, because a thick metal plate is difficult to draw and a mass thereof is also great. In this case, it is difficult to maintain strength (rigidity) in a large propeller fan. In contrast, some propeller fans include a part called a spider formed from a metal plate greater in thickness than a blade portion and have the blade portion fixed to a rotation shaft, however, the mass is great and fan balance is also is poor. Generally, since a metal plate which is thin and has a constant thickness is employed, a cross-sectional shape of a blade portion cannot be in a blade shape.

In contrast, by forming the propeller fan with a resin, such problems can collectively be solved.

Embodiment D1

FIG. 155 is a partially exploded side view of an electric fan in an Embodiment D1 of the present invention. An electric fan 4001 as a fluid feeder in the present embodiment will be described initially with reference to FIG. 155.

As shown in FIG. 155, electric fan 4001 mainly includes a front guard 4002, a rear guard 4003, a main body portion 4004, a stand 4005, and a propeller fan 4010A.

Main body portion 4004 is supported by stand 4005 and accommodates a not-shown drive motor. On a front surface of main body portion 4004, a rotation shaft 4004*a* of the drive motor is located as being exposed, and a boss hub portion 4011 (see FIG. 156 or the like) serving as a rotation shaft portion of propeller fan 4010A which will be described later is fixed to this rotation shaft 4004*a* with a screw cap 4006.

Front guard 4002 and rear guard 4003 are provided to surround propeller fan 4010A fixed to main body portion 4004. More specifically, rear guard 4003 is fixed to main body portion 4004 so as to cover a rear surface side of propeller fan 4010A, and front guard 4002 is fixed to rear guard 4003 so as to cover a front surface side of propeller fan 4010A. Front guard 4002 and rear guard 4003 are formed, for example, from a lattice-shaped or web-shaped metal member in order to enhance efficiency in suction and burst of air.

Stand 4005 is provided to place electric fan 4001 on a floor surface and supports main body portion 4004. At a prescribed position of stand 4005, a not-shown operation portion for turning on/off electric fan 4001 or switching between operation states thereof is provided.

Main body portion 4004 and stand 4005 are preferably coupled such that main body portion 4004 can swing in a horizontal plane and a vertical plane for an oscillation function of electric fan 4001.

Stand 4005 is preferably formed telescopically along a vertical direction such that electric fan 4001 has a height adjustment function.

FIGS. 156 and 157 are perspective views when the propeller fan in the present embodiment is viewed from the rear surface side and the front surface side, respectively, and FIGS. 158 to 160 are a rear view, a front view, and a side view of the propeller fan in the present embodiment, respectively. A basic structure of propeller fan 4010A in the present embodiment will now be described with reference to FIGS. 156 to 160.

As shown in FIGS. 156 to 160, propeller fan 4010A includes boss hub portion 4011 described above as the rotation shaft portion and a plurality of plate-shaped blades 4012A formed as being smoothly curved. Boss hub portion 4011 has a substantially cylindrical shape having a bottom, and each of the plurality of blades 4012A projects radially outward from an outer circumferential surface of boss hub portion 4011 for alignment along a circumferential direction of boss hub portion 4011.

Propeller fan 4010A in the present embodiment has seven blades, and formed from a resin molded product in which boss hub portion 4011 and seven blades 4012A are integrally molded with a synthetic resin such as an AS (acrylonitrile-styrene) resin.

With drive by the drive motor described above, boss hub portion 4011 rotates in a direction shown with an arrow a in the drawings, with a virtual central axis 4020 being defined as a center of rotation. Thus, entire propeller fan 4010A rotates in the direction shown with arrow a in the drawings with central axis 4020 described above being defined as the center of rotation, and the plurality of blades 4012A provided as being aligned along the circumferential direction of boss hub portion 4011 also rotate around central axis 4020 described above.

With rotation of the plurality of blades 4012A, air flows from the suction side which is the rear surface side of propeller fan 4010A toward the burst side which is the front surface side of propeller fan 4010A, and wind is sent forward of electric fan 4001.

Here, in the present embodiment, the plurality of blades 4012A are arranged at regular intervals as being spaced apart from one another along the direction of rotation, and the plurality of blades 4012A are identical in shape. Therefore, when any blade 4012A is rotated with central axis 4020 being defined as the center of rotation, that blade 4012A and another blade 4012A match in shape.

Blade 4012A includes a front edge portion 4013 located on a front side in the direction of rotation of propeller fan 4010A, a rear edge portion 4014 located on a rear side in the direction of rotation of propeller fan 4010A, an outer edge portion 4015 extending along the direction of rotation of propeller fan 4010A, a blade tip end projection portion 4016 connecting front edge portion 4013 and outer edge portion 4015 to each other, and a blade rear end projection portion 4017 connecting rear edge portion 4014 and outer edge portion 4015 to each other. Namely, in a plan view of propeller fan 4010A along central axis 4020, an outer shape of blade 4012A is defined by front edge portion 4013, rear edge portion 4014, outer edge portion 4015, blade tip end projection portion 4016, and blade rear end projection portion 4017, except for a portion connected to boss hub portion 4011.

Front edge portion 4013 and rear edge portion 4014 extend radially outward from boss hub portion 4011. In the plan view of propeller fan 4010A along central axis 4020, front edge portion 4013 and rear edge portion 4014 have a generally arc shape as a whole so as to be located gradually forward in the direction of rotation, from a generally radially inner side toward the outer side.

Here, when a plane orthogonal to central axis 4020 is assumed on the burst side of blade 4012A and a length in the axial direction of central axis 4020 from that plane is defined as a height, front edge portion 4013 includes a site having a constant height between an inner end thereof and a position distant radially outward from the inner end.

More specifically, when an end surface P1 (see FIG. 160) on the suction side in such a two-dimensional shape as including a site of blade 4012A located outermost on the suction side along a direction of extension of central axis 4020 and is orthogonal to central axis 4020 is assumed, a portion in front edge portion 4013 on the radially inner side which continues to boss hub portion 4011 extends to overlap with end surface P1 on the suction side. In other words, a portion in front edge portion 4013 close to the radially outer side does not overlap with end surface P1 on the suction side, but it is provided close to the burst side relative to end surface P1 on the suction side as a whole.

When a plane orthogonal to central axis 4020 is assumed on the burst side of blade 4012A and a length in the axial direction of central axis 4020 from that plane is defined as a height, a portion in rear edge portion 4014 on the radially outer side including an outer end is constructed to increase in height radially outward from the radially inner side.

In other words, when an end surface P2 (see FIG. 160) on the burst side in such a two-dimensional shape as including a site of blade 4012A located outermost on the burst side along the direction of extension of central axis 4020 and is orthogonal to central axis 4020 is assumed, rear edge portion 4014 is constructed to be away radially outward from end surface P2 on the burst side. Namely, the portion in rear edge portion 4014 close to the radially outer side does not overlap with end surface P2 on the burst side, but it is provided close to the suction side relative to end surface P2 on the burst side as a whole.

In a portion of front edge portion 4013 and rear edge portion 104 on the radially inner side, blade 4012A is constructed to be smaller in width along the direction of rotation, and in a portion of front edge portion 4013 and rear edge portion 4014 on the radially outer side, blade 4012A is constructed to be greater in width along the direction of rotation.

Outer edge portion 4015 extends along the direction of rotation as described above and has substantially an arc shape as a whole. Outer edge portion 4015 has a front outer edge portion 4015*b* (see FIGS. 158 and 159) located on the side of front edge portion 4013, a rear outer edge portion 4015*c* (see FIGS. 158 and 159) located on the side of rear edge portion 4014, and a connection portion 4015*a* in a prescribed shape connecting front outer edge portion 4015*b* and rear outer edge portion 4015*c* to each other. Connection portion 4015*a* is formed at a position in midway between a front end and a rear end of outer edge portion 4015.

Connection portion 4015*a* is formed by recessing a prescribed portion of outer edge portion 4015 toward central axis 4020, so that front outer edge portion 4015*b* described above and rear outer edge portion 4015*c* described above are provided in outer edge portion 4015 of blade 4012A. Though connection portion 4015*a* is preferably formed in a smoothly curved shape as illustrated, it does not necessarily have to be in a curved shape but it may be in a bent shape.

A position where connection portion 4015*a* is formed is not particularly limited so long as it is a position on outer edge portion 4015. In the present embodiment, however, connection portion 4015*a* is formed at a position close to the rear end of outer edge portion 4015. Therefore, in the present embodiment, a width of front outer edge portion 4015*b* along the direction of rotation is formed to be greater than a width of rear outer edge portion 4015*c* along the direction of rotation.

Outer edge portion 4015 is located such that its entirety is distant from end surface P1 on the suction side along the direction of extension of central axis 4020 and such that its entirety is distant from end surface P2 on the burst side along the direction of extension of central axis 4020. Namely, outer edge portion 4015 does not overlap with end surface P1 on the suction side and end surface P2 on the burst side at any position, but it is provided inward relative to end surface P1 on the suction side and end surface P2 on the burst side as a whole.

Blade tip end projection portion 4016 is located between front edge portion 4013 and outer edge portion 4015 and smoothly connects them to each other. Blade tip end projection portion 4016 has an arc shape greater in curvature than front edge portion 4013 and outer edge portion 4015. In a plan view of propeller fan 4010A along central axis 4020, a portion in blade 4012A in the vicinity of the portion where blade tip end projection portion 4016 is provided has a shape pointed like a sickle. This portion pointed like a sickle is arranged at a position most forward in blade 4012A in the direction of rotation. Since this portion pointed like a sickle is located forward in the direction of rotation, it corresponds to the blade tip end portion where a blade tip end vortex is generated.

Blade rear end projection portion 4017 is located between rear edge portion 4014 and outer edge portion 4015 and smoothly connects them to each other. Blade rear end projection portion 4017 has an arc shape greater in curvature than rear edge portion 4014 and outer edge portion 4015.

Blade tip end projection portion 4016 and blade rear end projection portion 4017 are both provided inward relative to end surface P1 on the suction side and end surface P2 on the burst side along the axial direction of central axis 4020.

In blade 4012A, a blade surface for sending wind (that is, sending air from the suction side to the burst side) with rotation of propeller fan 4010A is formed. The blade surface is constituted of a negative pressure surface 4012*a* corresponding to a rear surface of blade 4012A located on the suction side and a positive pressure surface 4012*b* corresponding to a front surface of blade 4012A located on the burst side, and these are both formed in a region surrounded by front edge portion 4013, rear edge portion 4014, outer edge portion 4015, blade tip end projection portion 4016, and blade rear end projection portion 4017 described above.

Negative pressure surface 4012*a* and positive pressure surface 4012*b* which are blade surfaces are both formed from a curved surface inclined from the burst side toward the suction side of propeller fan 4010A, from rear edge portion 4014 toward front edge portion 4013 along the direction of rotation of propeller fan 4010A. Thus, during rotation of propeller fan 4010A, as a flow of air is generated over the blade surface, such pressure distribution that a pressure is relatively high over positive pressure surface 4012*b* and a pressure is relatively low over negative pressure surface 4012*a* is generated.

Blade 4012A has a blade inner region 4019*a* and a blade outer region 4019*b* different from each other in a blade surface shape (see FIGS. 158 and 159). Blade inner region 4019*a* corresponds to a region of blade 4012A located on a side of boss hub portion 4011 and blade outer region 4019*b* corresponds to a region of blade 4012A located on a side of outer edge portion 4015. As blade inner region 4019*a* and blade outer region 4019*b* different from each other in a blade surface shape are provided in blade 4012A, blade 4012A is provided with a coupling portion 4018 coupling in a curved manner, these blade inner region 4019*a* and blade outer region 4019*b* to each other at a boundary therebetween, as illustrated.

Namely, blade 4012A has blade inner region 4019*a* located on the side of boss hub portion 4011, blade outer region 4019*b* located on the side of outer edge portion 4015, and coupling portion 4018 coupling in a curved or bent manner, blade inner region 4019*a* and blade outer region 4019*b* to each other at a boundary therebetween such that the side of negative pressure surface 4012*a* is recessed and the side of positive pressure surface 4012*b* is projecting.

Coupling portion 4018 has a curvature of a surface which attains to a relative maximum around the same, appears as a curved recessed groove portion in negative pressure surface 4012*a*, and appears as a curved protruding projection portion in positive pressure surface 4012*b*. Coupling portion 4018 is provided generally along the direction of rotation, and extends from a position in the vicinity of blade tip end projection portion 4016 toward a portion in the vicinity of a position in rear edge portion 4014 in midway in a radial direction.

Blade 4012A is formed in a shape of a blade having a thickness increasing from front edge portion 4013 and rear edge portion 4014 toward a portion around a center of the blade and having a largest thickness at a position close to front edge portion 4013 relative to the center of the blade when blade 4012A is viewed along the direction of rotation of propeller fan 4010A.

With propeller fan 4010A described above, an effect as below is obtained.

Firstly, with propeller fan 4010A in the present embodiment, as described above, a portion of front edge portion 4013 except for a portion close to the radially outer side is constructed to be located on end surface P1 on the suction side. Therefore, capability to send wind can be enhanced in a portion of blade 4012A close to the radially inner side. Wind generated in the portion close to the radially inner side can be higher in velocity, which can be close to a velocity of wind generated in a portion close to outer edge portion 4015, and wind velocity distribution in a radial direction can be more uniform. Therefore, variation in wind velocity can be suppressed and comfortably impinging wind can be obtained.

Secondly, with propeller fan 4010A in the present embodiment, as described above, rear edge portion 4014 is constructed to be distant radially outward from end surface P2 on the burst side. Therefore, wind velocity increasing radially outward substantially in proportion is lowered in the portion close to outer edge portion 4015. Then, a velocity of wind generated in the portion close to the radially inner side is close to a velocity of wind generated in the portion close to outer edge portion 4015, and hence wind velocity distribution in the radial direction is more uniform. Therefore, variation in wind velocity can be suppressed and comfortably impinging wind can be obtained.

Thirdly, with propeller fan 4010A in the present embodiment, as described above, at a boundary between blade inner region 4019*a* and blade outer region 4019*b*, coupling portion 4018 coupling them in a curved manner is provided. Therefore, a horseshoe vortex is generated over coupling portion 4018, and the horseshoe vortex suppresses separation of a mainstream which flows over the blade surface. Thus, noise is lowered and capability to send wind is enhanced. Additionally, as described above, since coupling portion 4018 is provided substantially along the direction of rotation in the present embodiment, in addition to the horseshoe vortex generated over coupling portion 4018, the blade tip end vortex is also held over coupling portion 4018 and separation of the mainstream can further be suppressed. Coupling portion 4018 does not have to be curved but may be, for example, bent.

Fourthly, with propeller fan 4010A in the present embodiment, as described above, since recessed connection portion 4015*a* is provided in outer edge portion 4015, distribution of a wind velocity in the radial direction can be more uniform, variation in wind velocity can be suppressed, and comfortably impinging wind can be obtained.

Namely, in a case of a blade shape not having a recessed connection portion formed in the outer edge portion, a wind velocity increases radially outward substantially in proportion, and there is a great difference in velocity between wind generated in a portion close to the radially inner side and wind generated in a portion close to the radially outer side. Thus, significant variation in wind velocity is caused in generated wind.

In contrast, in the present embodiment, recessed connection portion 4015*a* is formed on outer edge portion 4015. Therefore, as compared with a case that no recessed connection portion 4015*a* is formed on outer edge portion 4015, an area of a blade is decreased in the vicinity of outer edge portion 4015 (that is, a portion close to the radially outer side). Therefore, a wind velocity increasing radially outward substantially in proportion is lowered in a portion close to outer edge portion 4015. A velocity of wind generated in the portion close to the radially inner side and a velocity of wind generated in a portion close to outer edge portion 4015 are close to each other and wind velocity distribution in the radial direction is more uniform. Therefore, variation in wind velocity can be suppressed and comfortably impinging wind can be obtained.

With propeller fan 4010A in the present embodiment, as described above, since recessed connection portion 4015*a* is provided in outer edge portion 4015, pressure fluctuation included in wind generated in a portion close to the radially outer side is less and comfortably impinging wind is obtained.

Namely, in a case of a blade shape not having a recessed connection portion formed in the outer edge portion, air passes through a relatively large space between blades and great pressure fluctuation is caused in generated wind. This is particularly noticeable in a portion on the side of the outer edge portion where wind higher in velocity is generated, and wind greater in pressure difference is generated as the number of blades is smaller.

In contrast, in the present embodiment, the blade shape is such that recessed connection portion 4015*a* is formed in outer edge portion 4015. Therefore, a relatively small space (that is, a space where recessed connection portion 4015*a* is located) is formed between front outer edge portion 4015*b* and rear outer edge portion 4015*c* in one blade 4012A, and the space is present as a space in blade 4012A where no wind is generated.

Consequently, in a portion on the side of outer edge portion 4015 where wind high in velocity is generated, a pressure difference caused in generated wind is lessened as a result of decrease in area of the blade, and in addition, a pressure fluctuates in a more finely stepwise manner. Therefore, front outer edge portion 4015*b* and rear outer edge portion 4015*c* provided in one blade 4012A function as if two blades sent wind, and comfortably impinging wind less in pressure fluctuation as a whole can be generated.

With propeller fan 4010A in the present embodiment, as described above, recessed connection portion 4015*a* is provided in outer edge portion 4015. Therefore, during rotation at a low speed, comfortably impinging wind diffusing over a wide range can be obtained, and during rotation at a high speed, wind high in straightness and reaching farther can be obtained, which will be described in further detail with reference to FIGS. 161 to 164.

FIG. 161 is a conceptual view showing a flow of wind obtained at the time when the propeller fan is rotated at a low speed in the electric fan in the present embodiment. FIG. 162 is a diagram schematically showing a state of wind obtained at the time when the propeller fan is rotated at a low speed. FIG. 163 is a conceptual view showing a flow of wind obtained at the time when the propeller fan is rotated at a high speed in the electric fan in the present embodiment. FIG. 164 is a diagram schematically showing a state of wind obtained at the time when the propeller fan is rotated at a high speed. In FIGS. 161 and 163, as a track representative of a blade tip end vortex, a track of a blade tip end vortex generated around blade tip end projection portion 4016 is schematically shown with a thin dotted line, a track representative of a horseshoe vortex is schematically shown with a thin line, and a track of wind generated at a position close to outer edge portion 4015 of blade 4012A is further shown schematically with a bold line.

As described above, in the present embodiment, recessed connection portion 4015*a* is formed at a position on outer edge portion 4015 of blade 4012A. The position on outer edge portion 4015 corresponds to a position downstream of the blade tip end portion including blade tip end projection portion 4016, along a streamline of the blade tip end vortex which flows over the blade surface.

As shown in FIG. 161, when blade 4012A rotates at a low speed, kinetic energy of the blade tip end vortex and the horseshoe vortex generated as a result of rotation of blade 4012A is low, and hence separation of the blade tip end vortex and the horseshoe vortex is promoted in recessed connection portion 4015*a* without the vortexes being trapped therein. Thus, the blade tip end vortex and the horseshoe vortex are both dispelled radially outward by centrifugal force in a portion where recessed connection portion 4015*a* is formed. Therefore, as shown in FIG. 162, wind generated by blade 4012A is diffused in front of electric fan 4001, and comfortably impinging wind 4200 can be sent over a wide range. Therefore, in a case that the electric fan is desirably operated during bedtime such as night without wind substantially being felt, a breezy operation satisfying such a desire can also be realized.

On the other hand, as shown in FIG. 163, when blade 4012A rotates at a high speed, kinetic energy of the blade tip end vortex and the horseshoe vortex generated as a result of rotation of blade 4012A is great, and hence the blade tip end vortex and the horseshoe vortex are trapped and held in recessed connection portion 4015*a* and fluctuation or development of the blade tip end vortex and the horseshoe vortex is suppressed. In that case, the blade tip end vortex and the horseshoe vortex will also move inward along recessed connection portion 4015*a*, and hence, thereafter, the blade tip end vortex and the horseshoe vortex which are separated at blade rear end projection portion 4017 are dispelled in an axial direction by a large quantity of wind and a high static pressure resulting from rotation at a high speed. Therefore, as shown in FIG. 164, wind generated by blade 4012A converges in front of electric fan 4001, and wind 4300 high in straightness and reaching farther can be sent. Therefore, wind can efficiently be sent and generation of noise can also be suppressed owing to enhanced straightness of wind.

Thus, according to propeller fan 4010A and electric fan 4001 including the same in the present embodiment, generated wind can be less in pressure fluctuation and comfortably impinging wind can be sent, and reduction in noise can be achieved.

Additionally, in propeller fan 4010A in the present embodiment, occurrence of jamming of a finger can be suppressed and safety can be enhanced, which will be described in detail below.

FIGS. 165 and 166 are an enlarged rear view and an enlarged side view of a portion in the vicinity of the blade tip end projection portion of the propeller fan in the present embodiment, respectively. FIGS. 167 and 168 are an enlarged rear view and an enlarged side view of a portion in the vicinity of the blade rear end projection portion of the propeller fan in the present embodiment, respectively.

Initially, referring to FIGS. 165 to 168 in addition to FIGS. 158 to 160 described above, positions A1, A2, A3, B, C, D1, D2, E, and F, heights $h_{A1}$, $h_{A2}$, $h_{A3}$, $h_B$, $h_C$, $h_{D1}$, $h_{D2}$, $h_E$, and $h_F$, and radii $R_{A1}$, $R_{A2}$, $R_{A3}$, $R_B$, $R_C$, $R_{D1}$, $R_{D2}$, $R_E$, and $R_F$ shown in these figures will be described. The height means a length along the axial direction of central axis 4020 from the plane assumed to be orthogonal to central axis 4020 on the burst side of blade 4021A, and in the description below, end surface P2 on the burst side described above is defined as the reference of the plane. The radius means a distance from central axis 4020 in the plan view of blade 4012A along central axis 4020.

As shown in FIGS. 165 and 166, position A1 is a portion of connection between front edge portion 4013 and blade tip end projection portion 4016, which is a position where a curvature is varied, height $h_{A1}$ is a height at position A1, and radius $R_{A1}$ is a radius at position A1.

As shown in FIGS. 158 to 160, position A2 is a central position in front edge portion 4013, position $h_{A2}$ is a height at position A2, and radius $R_{A2}$ is a radius at position A2.

As shown in FIGS. 158 to 160, position A3 is a position lowest in height in front edge portion 4013, height $h_{A3}$ is a height at position A3, and radius $R_{A3}$ is a radius at position A3. In the present embodiment, a position lowest in height in front edge portion 4013 corresponds to a portion of connection between front edge portion 4013 and blade tip end projection portion 4016, which is a position where a curvature is varied, and hence position A3 matches with position A1 described above.

As shown in FIGS. 165 and 166, position B is a position of the front end in the direction of rotation of blade tip end projection portion 4016, height $h_B$ is a height at position B, and radius $R_B$ is a radius at position B.

As shown in FIGS. 165 and 166, position C is a portion of connection between outer edge portion 4015 and blade tip end projection portion 4016, which is a position where a curvature is varied, height $h_C$ is a height at position C, and radius $R_C$ is a radius at position C.

As shown in FIGS. 167 and 168, position D1 is a portion of connection between rear edge portion 4014 and blade rear end projection portion 4017, which is a position where a curvature is varied, height $h_{D1}$ is a height at position D1, and radius $R_{D1}$ is a radius at position D1.

As shown in FIGS. 158 to 160, position D2 is a central position in rear edge portion 4014, height $h_{D2}$ is a height at position D2, and radius $R_{D2}$ is a radius at position D2.

As shown in FIGS. 167 and 168, position E is a central position in blade rear end projection portion 4017, height $h_E$ is a position at position E, and radius $R_E$ is a radius at position E.

As shown in FIGS. 167 and 168, position F is a portion of connection between outer edge portion 4015 and blade rear end projection portion 4017, which is a position where a curvature is varied, height $h_F$ is a height at position F, and radius $R_F$ is a radius at position F.

In propeller fan 4010A in the present embodiment, as shown in FIGS. 158 to 160, 165, and 166, heights $h_{A1}$, $h_{A2}$, $h_{A3}$, $h_B$, and $h_C$ satisfy a condition of $h_{A2}>h_{A1}=h_{A3}>h_B>h_C$, and radii $R_{A1}$, $R_{A2}$, $R_{A3}$, $R_B$, and $R_C$ satisfy a condition of $R_{A2}<R_{A1}=R_{A3}<R_B<R_C$.

Here, as described above, blade 4012A has a shape like a smoothly curved plate. Therefore, by satisfying the conditions above, blade 4012A is constructed to be close to end surface P2 on the burst side, from the central position in front edge portion 4013 toward blade tip end projection portion 4016, and further, a portion in the vicinity of blade tip end projection portion 4016 of blade 4012A is constructed in a warped shape so as to be closer to end surface P2 on the burst side toward the tip end side.

In other words, blade 4012A is constructed to be distant from end surface P1 on the suction side from the central position in front edge portion 4013 toward blade tip end projection portion 4016, and in addition, a portion in the vicinity of blade tip end projection portion 4016 of blade 4012A is constructed in a warped shape to be further distant from end surface P1 on the suction side toward the tip end side.

In propeller fan 4010A in the present embodiment, as shown in FIGS. 158 to 160, 167, and 168, heights $h_{D1}$, $h_{D2}$, $h_E$, and $h_F$ satisfy a condition of $h_F>h_E>h_{D1}>h_{D2}$, and radii $R_{D1}$, $R_{D2}$, $R_E$, and $R_F$ satisfy a condition of $R_{D2}<R_{D1}<R_E<R_F$.

Here, as described above, blade 4012A has a shape like a smoothly curved plate. Therefore, by satisfying the conditions above, blade 4012A is constructed to be distant from end surface P2 on the burst side, from the central position in rear edge portion 4014 toward blade rear end projection portion 4017, and further, a portion in the vicinity of blade rear end projection portion 4017 of blade 4012A is constructed in a warped shape so as to be further distant from end surface P2 on the burst side toward the tip end.

FIG. 169 is a diagram showing a trace when the propeller fan in the present embodiment is rotated. FIG. 170 is a diagram showing positional relation between a non-passage region and a guard of the propeller fan when the propeller fan is rotated in the electric fan in the present embodiment.

As described above, in propeller fan 4010A in the present embodiment, blade 4012A is constructed to be distant from end surface P1 on the suction side from the central position in front edge portion 4013 toward blade tip end projection portion 4016, and in addition, the portion in the vicinity of blade tip end projection portion 4016 of blade 4012A is constructed in the warped shape so as to be further distant from end surface P1 on the suction side toward the tip end.

Therefore, as shown in FIG. 169, when a columnar space S having a maximum radius from central axis 4020 of outer edge portion 4015 of blade 4012A as a radius and having end surface P1 on the suction side and end surface P2 on the suction side as a pair of bottom surfaces (that is, a substantially columnar space encompassing propeller fan 4010A) is defined, a non-passage region S1 through which blade 4012A does not pass is formed in a portion in space S on the radially outer side and on a side where end surface P1 on the suction side is located. Here, non-passage region S1 has a region S1A inclined along the axial direction of central axis 4020 toward end surface P2 on the burst side, in a tip end portion on the radially outer side, which is a portion adjacent to a region through which the portion in the vicinity of blade tip end projection portion 4016 of blade 4012A passes.

As described above, in propeller fan 4010A in the present embodiment, blade 4012A is constructed to be distant from end surface P2 on the burst side from the central position in rear edge portion 4014 toward blade rear end projection portion 4017, and in addition, the portion in the vicinity of blade rear end projection portion 4017 of blade 4012A is constructed in the warped shape so as to be further distant from end surface P2 on the burst side toward the tip end.

Therefore, as shown in FIG. 169, a non-passage region S2 through which blade 4012A does not pass is formed in a portion in space S on the radially outer side and on a side where end surface P2 on the burst side is located. Here, non-passage region S2 has a region S2A inclined along the axial direction of central axis 4020 toward end surface P1 on the suction side, in the tip end portion on the radially outer side, which is a portion adjacent to a region through which the portion in the vicinity of blade rear end projection portion 4017 of blade 4012A passes.

Namely, by adopting the construction as described above, when propeller fan 4010A is rotated, a shape of the passage region through which propeller fan 4010A passes is in such a shape as obtained by cutting a circumferential angle portion of end surface P1 on the suction side from the substantially columnar space encompassing propeller fan 4010A and further cutting a circumferential angle portion of end surface P2 on the burst side.

Here, as shown in FIG. 169, in many cases, front guard 4002 and rear guard 4003 are constructed to have a curved shape small in thickness as a whole on the radially outer side based on reduction in size, design performance, or ease in molding. Therefore, by providing non-passage regions S1 and S2 as described above, as shown in FIG. 170, in electric fan 4001, a considerable space is formed between front guard 4002 and blade 4012A and between rear guard 4003 and blade 4012A in the entire region in the circumferential direction of the outer circumferential portion of the guard. Therefore, as illustrated, jamming of a finger can be suppressed and safety can be enhanced.

As described above, with propeller fan 4010A and electric fan 4001 including the same in the present embodiment, propeller fan 4010A and electric fan 4001 including the same not only achieving effects that pressure fluctuation in generated wind is less, comfortably impinging wind can be sent, and noise can be lowered, but also allowing reduction in size and contributing to improvement in safety can be provided.

FIG. 171 is a schematic cross-sectional view showing a molding die for the propeller fan in the present embodiment. A molding die 4100 for the propeller fan in the present embodiment will now be described with reference to FIG. 171.

As described above, propeller fan 4010A in the present embodiment is formed from a resin molded product. In molding propeller fan 4010A, for example, molding die 4100 for injection molding as shown in FIG. 171 is made use of.

As shown in FIG. 171, molding die 4100 has a fixed die 4101 and a movable die 4102. Fixed die 4101 and movable die 4102 define a cavity 4103 substantially the same in shape as propeller fan 4010A, into which a fluid resin is injected.

Molding die 4100 may be provided with a not-shown heater for enhancing fluidity of the resin injected into cavity 4103. Such provision of a heater is particularly effective in using a synthetic resin having increased strength such as an AS resin filled with glass fibers.

With regard to molding die 4100 shown in the figure, it is assumed that the surface on the side of positive pressure surface 4012*b* in propeller fan 4010A is molded with fixed die 4101 and the surface on the side of negative pressure surface 4012*a* is molded with movable die 4102, however, the surface on the side of negative pressure surface 4012*a* of propeller fan 4010A may be molded with fixed die 4101 and the surface on the side of positive pressure surface 4012*b* of propeller fan 4010A may be molded with movable die 4102.

Generally, a propeller fan is integrally formed with a metal as a material and through drawing by pressing. For such molding, a thin metal plate is generally employed, because a thick metal plate is difficult to draw and a mass thereof is also great. In this case, it is difficult to maintain strength (rigidity) in a large propeller fan. In contrast, some propeller fans include a part called a spider formed from a metal plate greater in thickness than a blade portion and have the blade portion fixed to a rotation shaft, however, the mass is great and fan balance is also is poor. Generally, since a metal plate which is thin and has a constant thickness is employed, a cross-sectional shape of a blade portion cannot be in a blade shape.

In contrast, by molding propeller fan 4010A with a resin as in the present embodiment, such problems can collectively be solved.

In a case that a DC motor is employed for the drive motor described above to which propeller fan 4010A is fixed, for further lowering in noise as measures against cocking noise specific to the DC motor, a cylindrical rubber boss may be insert molded in a shaft hole of boss hub portion 4011 provided for insertion of rotation shaft 4004*a*. In that case, a rubber boss as an insert part should only be provided prior to injection molding in a mold for molding the surface on the side of negative pressure surface 4012*a* of propeller fan 4010A.

In the present embodiment described above, a case that propeller fan 4010A satisfies the condition of $h_{A2}>h_{A1}=h_{A3}>h_B>h_C$, the condition of $R_{A2}<R_{A1}=R_{A3}<R_B<R_C$, the condition of $h_F>h_E>h_{D1}>h_{D2}$, and the condition of $R_{D2}<R_{D1}<R_E<R_F$ has been exemplified, however, all of these conditions do not necessarily have to be satisfied.

Namely, in order to achieve reduction in size and improve safety in particular at the tip end portion on the radially outer side which is a portion adjacent to a region where a portion in the vicinity of blade tip end projection portion 4016 of blade 4012A passes and where jamming of a finger is likely, the propeller fan is desirably constructed such that at least any of the condition of $h_{A1}>h_B$, the condition of $h_{A2}>h_B$, and the condition of $h_{A3}>h_B$ among the conditions described above is satisfied. In addition thereto, in order to achieve reduction in size and improve safety in particular at the tip end portion on the radially outer side which is a portion adjacent to a region where a portion in the vicinity of blade rear end projection portion 4017 of blade 4012A passes and where jamming of a finger is likely, the propeller fan is desirably constructed such that the condition of $h_E>h_{D1}$ is satisfied in addition to any of the conditions above.

Embodiment D2

FIG. 172 is a side view of a propeller fan in an Embodiment D2 of the present invention. A propeller fan 4010B in the present embodiment will be described below with reference to FIG. 172. Propeller fan 4010B in the present embodiment is used as being mounted on electric fan 4001, similarly to propeller fan 4010A shown in Embodiment D1 of the present invention described above.

As shown in FIG. 172, propeller fan 4010B in the present embodiment is different from propeller fan 4010A in Embodiment D1 described above in that rear edge portion 4014 is not constructed to be distant from end surface P2 on the burst side toward the radially outer side and the entire outer edge portion 4015 is not located as being distant from end surface P2 on the burst side along the direction of extension of central axis 4020, and otherwise they are common in construction to propeller fan 4010A in Embodiment D1 described above.

Namely, in propeller fan 4010B in the present embodiment, though a portion of outer edge portion 4015 close to blade tip end projection portion 4016 is located as being distant from end surface P1 on the suction side along the direction of extension of central axis 4020, a portion of outer edge portion 4015 close to blade rear end projection portion 4017 is located in the vicinity of end surface P2 on the burst side along the direction of extension of central axis 4020.

Though detailed description is not provided, propeller fan 4010B in the present embodiment also satisfies the condition of $h_{A2}>h_{A1}=h_{A3}>h_B>h_C$, the condition of $R_{A2}<R_{A1}=R_{A3}<R_B<R_C$, the condition of $h_F>h_E>h_{D1}>h_{D2}$, and the condition of $R_{D2}<R_{D1}<R_E<R_F$, likewise propeller fan 4010A in Embodiment D1 described above.

According to such a construction, as compared with Embodiment D1 described above, though a space formed between front guard 4002 and blade 4012B on the burst side (that is, on the side of front guard 4002 of electric fan 4001) is decreased, a considerable space is formed between rear guard 4003 and blade 4012B in the entire region in the circumferential direction of the outer circumferential portion of the guard. Therefore, jamming of a finger in that portion can be suppressed and reduction in size and improvement in safety can be achieved.

Embodiment D3

FIGS. 173 and 174 are a rear view and a side view of a propeller fan in an Embodiment D3 of the present invention, respectively. A propeller fan 4010C in the present embodiment will be described below with reference to FIGS. 173 and 174. Propeller fan 4010C in the present embodiment is used as being mounted on electric fan 4001, similarly to propeller fan 4010A shown in Embodiment D1 of the present invention described above.

As shown in FIGS. 173 and 174, unlike propeller fan 4010B in Embodiment D2 described above, in propeller fan 4010C in the present embodiment, blade 4012C is constructed such that the entire blade surface has a single blade surface shape, without blade 4012C being constructed such that the blade inner region and the blade outer region are different in a blade surface shape.

Propeller fan 4010C in the present embodiment is different from propeller fan 4010B in Embodiment D2 described above in a specific shape of blade tip end projection portion 4016 and blade rear end projection portion 4017, as well as in that front edge portion 4013 of blade 4012C is located on the end surface on the suction side in a portion close to the radially inner side and a portion close to the radially outer side, and a portion therebetween is provided as being curved to be located slightly close to the end surface on the burst side relative to the end surface on the suction side, and they are otherwise common in construction to propeller fan 4010B in Embodiment D2 described above.

As shown in FIGS. 173 and 174, in propeller fan 4010C in the present embodiment, heights $h_{A1}$, $h_B$, and $h_C$ satisfy a condition of $h_{A1}=h_B>h_C$, and radii $R_{A1}$, $R_B$, and $R_C$ satisfy a condition of $R_{A1}<R_B=0.93\times R_C$. Namely, as compared with propeller fan 4010B in Embodiment D2 described above, blade tip end projection portion 4016 is formed to enter the radially inner side and a portion of blade tip end projection portion 4016 close to front edge portion 4013 is in a flat shape.

According to such a construction as well, a portion in the vicinity of the portion close to outer edge portion 4015 in blade tip end projection portion 4016 of blade 4012C is constructed in a warped shape so as to be close to end surface P2 on the burst side, toward the radially outer side. In other words, the portion in the vicinity of the portion close to outer edge portion 4015 is constructed in the warped shape so as to be distant from end surface P1 on the suction side toward the radially outer side.

As shown in FIGS. 173 and 174, in propeller fan 4010C in the present embodiment, heights $h_{D1}$, $h_E$, and $h_F$ satisfy a condition of $h_F>h_E=h_{D1}$, and radii $R_{D1}$, $R_E$, and $R_F$ satisfy a condition of $R_{D1}<R_E<R_F$. Namely, as compared with propeller fan 4010B in Embodiment D2 described above, the portion of blade rear end projection portion 4017 close to rear edge portion 4014 is in a flat shape.

According to such a construction as well, a portion in the vicinity of the portion close to outer edge portion 4015 in blade rear end projection portion 4017 of blade 4012C is constructed in a warped shape to be distant from end surface P2 on the burst side toward the radially outer side.

In such a construction, as compared with propeller fan 4010B in Embodiment D2 described above, an effect obtained by providing coupling portion 4018 is lost, however, a considerable space is formed between the guard and blade 4012C in the entire region in the circumferential direction of the outer circumferential portion of the guard (in particular, a space formed between rear guard 4003 and blade 4012C is increased by a quantity corresponding to formation of blade tip end projection portion 4016 as entering the radially inner side). Therefore, jamming of a finger in that portion can be suppressed and reduction in size and improvement in safety can be achieved.

In the present embodiment described above, a case that propeller fan 4010C satisfies the condition of $h_{A1}=h_B>h_C$, the condition of $R_{A1}<R_B=0.93\times R_C$, the condition of $h_F>h_E=h_{D1}$, and the condition of $R_{D1}<R_E<R_F$ has been exemplified, however, all of these conditions do not necessarily have to be satisfied.

Namely, in order to achieve reduction in size and improve safety in particular at the tip end portion on the radially outer side which is a portion adjacent to a region where a portion in the vicinity of blade tip end projection portion 4016 of blade 4012C passes and where jamming of a finger is likely, the propeller fan is desirably constructed such that a condition of $h_{A1}\geq h_B>h_C$ and a condition of $0.8\times R_C\leq R_B\leq 0.93\times R_C$ are satisfied. Here, in the case of $R_B<0.8\times R_C$ among cases not satisfying the condition of $0.8\times R_C\leq R_B\leq 0.93\times R_C$, lowering in capability to send wind is concerned, and in the case of $R_B>0.93\times R_C$, failure in achieving reduction in size and improvement in safety in the tip end portion on the radially outer side which is a portion adjacent to a region where a portion in the vicinity of blade tip end projection portion 4016 of blade 4012C passes is concerned.

In addition to the above, in order to achieve reduction in size and improve safety in particular at the tip end portion on the radially outer side which is a portion adjacent to a region where a portion in the vicinity of blade rear end projection portion 4017 of blade 4012C passes and where jamming of a finger is likely, the propeller fan is desirably constructed such that a condition of $h_F>h_E\geq h_{D1}$ is satisfied a the condition of $R_E<R_F$ is satisfied in addition to any of the conditions above.

Embodiment D4

FIG. 175 is a side view of a propeller fan in an Embodiment D4 of the present invention. A propeller fan 4010D in the present embodiment will be described below with reference to FIG. 175. Propeller fan 4010D in the present embodiment is used as being mounted on electric fan 4001, similarly to propeller fan 4010A shown in Embodiment D1 of the present invention described above.

As shown in FIG. 175, propeller fan 4010D in the present embodiment is different from propeller fan 4010C in Embodiment D3 described above in that a portion close to the radially inner side which continues to boss hub portion 4011 in front edge portion 4013 of blade 4012D does not extend to overlap with end surface P1 on the suction side but is inclined gradually toward end surface P2 on the burst side, and it is otherwise common in construction thereto.

Namely, though detailed description is not provided, propeller fan 4010D in the present embodiment also satisfies the condition of $h_{A1}=h_B>h_C$, the condition of $R_{A1}<R_B=0.93\times R_C$, the condition of $h_F>h_E=h_{D1}$, and the condition of $R_{D1}<R_E<R_F$, likewise propeller fan 4010C in Embodiment D3 described above.

According to such a construction, as compared with propeller fan 4010C in Embodiment D3 described above, though high capability to send wind cannot be obtained in the portion on the radially inner side, jamming of a finger can be suppressed and reduction in size and improvement in safety can be achieved.

Embodiment D5

FIG. 176 is a side view of a propeller fan in an Embodiment D5 of the present invention. A propeller fan 4010E in the present embodiment will be described below with reference to FIG. 176. Propeller fan 4010E in the present embodiment is used as being mounted on electric fan 4001, similarly to propeller fan 4010A shown in Embodiment D1 of the present invention described above.

As shown in FIG. 176, propeller fan 4010E in the present embodiment is different from propeller fan 4010D in Embodiment D4 described above only in that a recessed connection portion is not formed in outer edge portion 4015 of blade 4012E, and it is otherwise common in construction thereto.

Namely, though detailed description is not provided, propeller fan 4010E in the present embodiment also satisfy the condition of $h_{A1}=h_B>h_C$, the condition of $R_{A1}<R_B=0.93\times R_C$, the condition of $h_F>h_E=h_{D1}$, and the condition of $R_{D1}<R_E<R_F$, likewise propeller fan 4010D in Embodiment D4 described above.

According to such a construction, as compared with propeller fan 4010D in Embodiment D4 described above, though the effect obtained by providing a recessed connection portion is lost, jamming of a finger can be suppressed and reduction in size and improvement in safety can be achieved.

Examples

In the following, results of a verification test in which propeller fan 4010C shown in Embodiment D3 described above was actually prototyped as an Example, a propeller fan different in shape therefrom is prototyped as a Comparative Example, various performances were measured by rotating the propeller fans according to Example and Comparative Example, and the obtained measurement results were compared will be described. In the verification test, influence in terms of performance in a case that blade tip end projection portion 4016 was formed to enter the radially inner side was verified.

FIGS. 177 and 178 are a rear view and a side view of the propeller fan according to Comparative Example, respectively. As shown in FIGS. 177 and 178, a propeller fan 4010X according to Comparative Example is common in construction to propeller fan 4010C in Embodiment D3 described above except that blade tip end projection portion 4016 was not formed to enter the radially inner side (that is, the condition of $R_B>0.93\times R_C$ was not satisfied).

FIG. 179 is a graph showing relation between the number of rotations and a quantity of wind of the propeller fans according to Example and Comparative Example. In FIG. 179, the abscissa represents the number of rotations (rpm) and the ordinate represents a quantity of wind ($m^3$/min.).

FIG. 180 is a graph showing relation between a quantity of wind and power consumption of the propeller fans according to Example and Comparative Example. In FIG. 180, the abscissa represents a quantity of wind ($m^3$/min.) and the ordinate represents power consumption (W) of a drive motor.

FIG. 181 is a graph showing relation between a quantity of wind and noise of the propeller fans according to Example and Comparative Example. In FIG. 181, the abscissa represents a quantity of wind ($m^3$/min.) and the ordinate represents noise (dB).

As shown in FIGS. 179 to 181, the propeller fans according to Example and Comparative Example were substantially comparable in performance to each other in terms of any of relation between the number of rotations and a quantity of wind, relation between a quantity of wind and power consumption, and relation between a quantity of wind and noise, and it is understood from the results that there is substantially no influence even when blade tip end projection portion 4016 is formed to enter the radially inner side.

FIG. 182 is a graph showing relation between a distance from a center of rotation and a wind velocity of the propeller fans according to Example and Comparative Example. In FIG. 182, the abscissa represents a distance from the center of rotation and the ordinate represents a wind velocity, The abscissa represents a distance from the center of rotation with a dimensionless value with a position corresponding to the center of rotation being defined as 0 and a position corresponding to the outer edge portion being defined as 1, and the ordinate represents a wind velocity with a dimensionless value obtained by matching a quantity of wind between Example and Comparative Example and dividing an actually measured value for a wind velocity by the quantity of wind.

As shown in FIG. 182, the propeller fan according to Comparative Example exhibits the tendency that a wind velocity is low on the radially inner side, the wind velocity gradually increases radially outward, the wind velocity exhibits a maximum value at a position 0.8 time as large as the maximum radius of the outer edge portion, and the wind velocity gradually decreases radially outward. In contrast, the propeller fan according to Example exhibits the tendency that a wind velocity is higher than in Comparative Example on the radially inner side, the wind velocity gradually increases radially outward, the wind velocity starts to decrease at a position 0.7 time as large as the maximum radius of the outer edge portion, and the wind velocity gradually decreases radially outward. Here, the maximum value of the wind velocity is lower in Example than in Comparative Example, and a manner of appearance of the peak thereof is gentler. Therefore, it can be understood from the results that, when blade tip end projection portion 4016 is formed to enter the radially inner side, there is no adverse influence in terms of capability to send wind, but on the contrary, variation in wind velocity in the radial direction is lessened and comfort is improved, which is more advantageous in use as an electric fan.

It was confirmed from the results above that, when the propeller fans according to Example and Comparative Example were compared with each other, substantially no difference was observed in terms of capability to send wind, and hence the propeller fan according to Example was more advantageous in order to achieve reduction in size and improvement in safety.

In the embodiments and the variations thereof according to the present invention described above, a propeller fan integrally molded with a synthetic resin has been exemplified as the propeller fan to which the present invention has been applied, however, applications of the present invention are not limited thereto. For example, the present invention may be applied to a propeller fan formed by twisting a sheet metal, or the present invention may be applied to a propeller fan formed from an integrated small-thickness material formed to have a curved surface. In such a case, a blade may be joined to a separately molded boss hub portion.

In the embodiments and the variations thereof according to the present invention described above, a case that the present invention has been applied to a propeller fan having seven blades has been exemplified, however, the present invention may be applied to a propeller fan having a plurality of blades other than seven, or the present invention may be applied to a propeller fan having a single blade. When the present invention is applied to the propeller fan having a single blade, a weight serving as a balancer is preferably provided on a side opposite to the blade with respect to the central axis.

In the embodiments and the variations thereof according to the present invention described above, an electric fan has been exemplified as a fluid feeder to which the present invention is applied and a propeller fan mounted on an electric fan has been exemplified as a propeller fan to which the present invention is applied. Other than the above, the present invention can naturally be applied also to various fluid feeders such as a circulator, an air-conditioner, an air cleaner, a humidifier, a dehumidifier, a fan heater, a cooling apparatus, or a ventilator as well as a propeller fan mounted thereon.

Thus, the embodiments disclosed herein are illustrative and non-restrictive in every respect. The technical scope of the present invention is delimited by the terms of the claims, and includes any modifications within the scope and meaning equivalent to the terms of the claims.

INDUSTRIAL APPLICABILITY

This invention is applied, for example, to such home electric appliances as an electric fan, a circulator, an air-conditioner, an air cleaner, a humidifier, a dehumidifier, a fan heater, a cooling apparatus, or a ventilator.

REFERENCE SIGNS LIST

1001 electric fan; 1002 front guard; 1003 rear guard; 1004 main body portion; 1004*a* rotation shaft; 1005 stand; 1006 screw cap; 1010A to 1010N propeller fan; 1011 boss hub portion; 1012A to 1012N blade; 1012*a* negative pressure surface; 1012*b* positive pressure surface; 1013 front edge portion; 1014 rear edge portion; 1015 outer edge portion; 1015*a* front end; 1015*b* rear end; 1016 coupling portion; 1017*a* connection portion; 1017*b* front outer edge portion; 1017*c* rear outer edge portion; 1018*a* blade inner region; 1018*b* blade outer region; 1020 central axis; 1030 bisector; 1100 molding die; 1101 fixed die; 1102 movable die; 1103 cavity; 1200, 1300 wind; 2102 arrow; 2110, 2120, 2125, 2130, 2140, 2160, 2210 propeller fan; 2021, 2021A, 2021B, 2021C, 2021D, 2021E, 2021F, 2021G blade; 2022 front edge portion; 2023 outer edge portion; 2024 rear edge portion; 2026 positive pressure surface; 2027 negative pressure surface; 2028 blade surface; 2031 inner region; 2031L, 2033L virtual straight line; 2032 outer region; 2033 coupling portion; 2033A front end portion; 2033B rear end portion; 2034 blade root portion; 2041 boss hub portion; 2041S outer surface; 2052 separation region; 2061 molding die; 2062 fixed die; 2063 movable die; 2101 central axis; 2104 front edge side connection portion; 2105 rear edge side connection portion; 2107 plane; 2109 circumscribed circle; 2111 maximum diameter end portion; 2112, 2116, 2118 chain double dotted line; 2114 occupied space; 2117, 2119 position; 2124 blade tip end portion; 2125 blade rear end portion; 2151 connection portion; 2152, 2153 wind; 2156 front outer edge portion; 2157 rear outer edge portion; 2310 mainstream; 2320, 2350 horseshoe vortex; 2330 secondary flow; 2340 blade tip end vortex; 2510 circulator; 2610 electric fan; 3021, 3021A, 3021B, 3021C, 3021D, 3021E, 3021F, 3021G blade; 3022 front edge portion; 3023 outer edge portion; 3024 rear edge portion; 3024*p* inner circumferential portion; 3024*q* outer circumferential portion; 3024*r* virtual line; 3026 positive pressure surface; 3027 negative pressure surface; 3028 blade surface; 3031 inner region; 3031L, 3033L virtual straight line; 3032 outer region; 3033 coupling portion; 3033A front end portion; 3033B rear end portion; 3034 blade root portion; 3041 boss hub portion; 3041S outer surface; 3052 separation region; 3061 molding die; 3062 fixed die; 3063 movable die; 3101 central axis; 3104 front edge side connection portion; 3105 rear edge side connection portion; 3107 plane; 3109 circumscribed circle; 3110, 3210, 3220, 3230, 3240, 3250, 3260 propeller fan; 3111 maximum diameter end portion; 3118 chain double dotted line; 3119 position; 3124 blade tip end portion; 3125 blade rear end portion; 3151 connection portion; 3152, 3153 wind; 3156 front outer edge portion; 3157 rear outer edge portion; 3310 mainstream; 3320, 3350 horseshoe vortex; 3330 secondary flow; 3340 blade tip end vortex; 3510 circulator; 3610 electric fan; 4001 electric fan; 4002 front guard; 4003 rear guard; 4004 main body portion; 4004*a* rotation shaft; 4005 stand; 4006 screw cap; 4010A to 4010E propeller fan; 4011 boss hub portion; 4012A to 4012E blade; 4012*a* negative pressure surface; 4012*b* positive pressure surface; 4013 front edge portion; 4014 rear edge portion; 4015 outer edge portion; 4015*a* connection portion; 4015*b* front outer edge portion; 4015*c* rear outer edge portion; 4016 blade tip end projection portion; 4017 blade rear end projection portion; 4018 coupling portion; 4019*a* blade inner region; 4019*b* blade outer region; 4020 central axis; 4100 molding die; 4101 fixed die; 4102 movable die; 4103 cavity; 4200, 4300 wind; P1 end surface on suction side; and P2 end surface on burst side.

The invention claimed is:

1. A propeller fan, comprising:

a rotation shaft portion rotatable around a virtual central axis; and a blade extending from said rotation shaft portion outward in a direction of radius of said central axis, wherein said blade includes:

a front edge portion arranged on a leading side in a direction of rotation when the propeller fan operates, a rear edge portion arranged on an opposite side in the direction of rotation, an outer edge portion extending in a circumferential direction around said central axis and connecting said front edge portion and said rear edge portion to each other, a blade root portion arranged between said blade and an outer surface of said rotation shaft portion, a blade tip end portion arranged on an outer side in the direction of radius of said central axis, in said front edge portion, a blade rear end portion arranged on the outer side in the direction of radius of said central axis, in said rear edge portion, and a blade surface formed in a region surrounded by said blade root portion, said front edge portion, said blade tip end portion, said outer edge portion, said blade rear end portion, and said rear edge portion, said outer edge portion connects said blade tip end portion and said blade rear end portion to each other, said blade surface includes:

an inner region including said blade root portion and located on an inner side in the direction of radius of said central axis, an outer region including said blade rear end portion and located on said outer side in the direction of radius of said central axis, and a coupling portion extending from a front end portion to a rear end portion and coupling said inner region and said outer region to each other such that a side of a positive pressure surface of said blade surface is projecting and a side of a negative pressure surface of said blade surface is recessed, said front end portion is located closer to said front edge portion, said blade tip end portion, or said outer edge portion than said rear edge portion, said rear end portion is located closer to said rear edge portion than said front edge portion, said blade surface is formed such that a stagger angle in a portion on the inner side in said direction of radius relative to said coupling portion in said blade surface is smaller than a stagger angle in a portion on the outer side in the direction of radius of said central axis relative to said coupling portion in said blade surface, and said front edge portion has a constant height in an axial direction of said central axis between said rotation shaft portion and a position distant from said rotation shaft portion outward in the direction of radius of said central axis.

2. The propeller fan according to claim 1, wherein said rear edge portion has a constant height in the axial direction of said central axis on an outer circumferential side around said central axis.

3. The propeller fan according to claim 1, wherein said coupling portion is formed along a flow of a blade tip end vortex generated over said blade surface with rotation of said blade.

4. The propeller fan according to claim 1, wherein said coupling portion is formed such that an interior angle formed on the side of said negative pressure surface of said coupling portion is smallest at a center of said coupling portion in a direction of rotation of said blade, and said blade surface located at each of said front end portion and said rear end portion is formed at 180° in a cross-sectional view along said direction of radius, which passes through each of said front end portion and said rear end portion.

5. The propeller fan according to claim 1, wherein when a virtual concentric circle passing through a central position in said coupling portion in a direction of rotation of said blade and centered around said central axis is drawn, said front end portion of said coupling portion is located on an outer side in a direction of radius of said concentric circle and said rear end portion of said coupling portion is located on an inner side in the direction of radius of said concentric circle.

6. The propeller fan according to claim 1, wherein said blade surface is formed such that, in the portion on the inner side in the direction of radius relative to said coupling portion in said blade surface, a first stagger angle defined by a virtual line of an inner region of said blade surface and said central axis is smaller than a second stagger angle defined by a virtual line of an outer region of said blade surface and said central axis.

7. The propeller fan according to claim 1, wherein said blade surface is formed such that an area of the blade in a portion on the inner side in the direction of radius relative to said coupling portion in said blade surface is equal to or greater than an area of the blade in a portion on the outer side in the direction of radius relative to said coupling portion in said blade surface.

8. The propeller fan according to claim 1, wherein a stagger angle in said blade root portion is smaller than a stagger angle in said outer edge portion, said blade root portion of said blade surface has a warped shape such that the side of the positive pressure surface of said blade surface is projecting and the side of the negative pressure surface of said blade surface is recessed, and said blade is formed such that a direction of warpage of said blade root portion and a direction of warpage of said outer edge portion are opposite to each other.

9. The propeller fan according to claim 1, wherein said coupling portion is provided as being curved from said inner region toward said outer region.

10. The propeller fan according to claim 1, wherein said coupling portion is provided as being bent from said inner region toward said outer region.

11. The propeller fan according to claim 1, wherein said outer edge portion includes a front outer edge portion located on a side of said front edge portion, a rear outer edge portion located on a side of said rear edge portion, and a connection portion connecting said front outer edge portion and said rear outer edge portion to each other.

12. The propeller fan according to claim 1, wherein said rear edge portion has a constant height in the axial direction of said central axis on an outer circumferential side around said central axis.

13. The propeller fan according to claim 12, wherein said coupling portion is formed along a flow of a blade tip end vortex generated over said blade surface with rotation of said blade.

14. The propeller fan according to claim 12, wherein said coupling portion is formed such that an interior angle formed on the side of said negative pressure surface of said coupling portion is smallest around a center of said coupling portion in a direction of rotation of said blade, and said blade surface located around each of said front end portion and said rear end portion is formed at 180° in a cross-sectional view along said direction of radius, which passes through each of said front end portion and said rear end portion.

15. The propeller fan according to claim 12, wherein when a virtual concentric circle passing through a central position in said coupling portion in a direction of rotation of said blade and centered around said central axis is drawn, said front end portion of said coupling portion is located on an outer side in a direction of radius of said concentric circle and said rear end portion of said coupling portion is located on an inner side in the direction of radius of said concentric circle.

16. The propeller fan according to claim 12, wherein said blade surface is formed such that, in the portion on the inner side in the direction of radius relative to said coupling portion in said blade surface, a first stagger angle defined by a virtual line of an inner region of said blade surface and said central axis is smaller than a second stagger angle defined by a virtual line of an outer region of said blade surface and said central axis.

17. The propeller fan according to claim 12, wherein said blade surface is formed such that an area of the blade in a portion on the inner side in the direction of radius relative to said coupling portion in said blade surface is equal to or greater than an area of the blade in a portion on the outer side in the direction of radius relative to said coupling portion in said blade surface.

18. The propeller fan according to claim 12, wherein a stagger angle in said blade root portion is smaller than a stagger angle in said outer edge portion, said blade root portion of said blade surface has a warped shape such that the side of the positive pressure surface of said blade surface is projecting and the side of the negative pressure surface of said blade surface is recessed, and said blade is formed such that a direction of warpage of said blade root portion and a direction of warpage of said outer edge portion are opposite to each other.

19. The propeller fan according to claim 12, wherein said coupling portion is provided as being curved from said inner region toward said outer region.

* * * * *